US005877443A

United States Patent [19]

Arends et al.

[11] Patent Number: 5,877,443

[45] Date of Patent: Mar. 2, 1999

[54] STROBE TUNER

[75] Inventors: Gregory E. Arends, Libertyville; Robert S. Dobrose, Mundelein, both of Ill.

[73] Assignee: Peterson Elecro-Musical Products, Inc., Worth, Ill.

[21] Appl. No.: 799,664

[22] Filed: Feb. 12, 1997

[51] Int. Cl.[6] ..... G10G 7/02

[52] U.S. Cl. ..... 84/454; 84/477 R; 84/DIG. 18

[58] Field of Search ..... 84/454, 477 R, 84/DIG. 18

[56] References Cited

U.S. PATENT DOCUMENTS

| | | | |
|---|---|---|---|
| 2,143,114 | 1/1939 | Severy . | |
| 2,221,523 | 11/1940 | Railsback | 84/454 |
| 2,286,030 | 6/1942 | Young et al. | 84/454 |
| 2,296,777 | 9/1942 | Elton . | |
| 2,542,540 | 2/1951 | Kunz . | |
| 2,761,994 | 9/1956 | Quitmeyer . | |
| 2,806,953 | 9/1957 | Krauss | 84/454 |
| 3,952,625 | 4/1976 | Peterson | 84/454 |
| 3,968,719 | 7/1976 | Sanderson . | |
| 3,982,184 | 9/1976 | Sanderson . | |
| 4,014,242 | 3/1977 | Sanderson . | |
| 4,038,899 | 8/1977 | MacMillan | 84/454 |
| 4,281,577 | 8/1981 | Middleton . | |
| 4,434,697 | 3/1984 | Roses | 84/454 |
| 4,457,203 | 7/1984 | Sanderson . | |
| 4,796,509 | 1/1989 | Mizuguchi et al. . | |
| 4,909,126 | 3/1990 | Skinn et al. | 84/454 |
| 5,016,515 | 5/1991 | Scott | 84/454 |
| 5,038,657 | 8/1991 | Busley | 84/455 |
| 5,285,711 | 2/1994 | Sanderson . | |

OTHER PUBLICATIONS

Brochure on Hale Sight Tuner, Tuners Supply Co., 2 pp., date unknown.

Brochure on Protune Automatic Full–Scale Chromatic Tuner, Protune Corp., 1 p., 1984.

Brochure on Timp–Tuner, Protune Corp., 1 p., date unknown.

Brochure on AccuTone Tuner, Widener Engineering, 4 pp., date unknown.

Brochure on Alphatone III Chomatic Note analyzer, Imaginearing Audio, 2. pp., 1980.

Brochure on Inventronics Programmable Tuner, Inventronics, Inc., 2 pp., Aug. 1984.

Brochure on How to Use the Conn Strobotuner in Piano Tuning, C. G. Conn., Ltd., 14 pp., Copyright 1979.

Brochure on The Secret of Tuning Fretted Instruments, C. G. Conn, Ltd., 13 pp., Copyright 1979.

Brochure on Visiontune, R. A. MacMillan, 7 pp., 1980.

*Primary Examiner*—William M. Shoop, Jr.
*Assistant Examiner*—Marlon T. Fletcher
*Attorney, Agent, or Firm*—Jones,Tullar & Cooper

[57] ABSTRACT

Single and multiple disc strobe tuners employ microprocessor controlled stepper motors for driving the disc(s) to facilitate the use of customized tuning schemes, such as unequal temperaments and stretch tuning. The tuning schemes are stored in a look up table and may be programmed by the user. The single disc embodiment preferably employs an auto note detector which determines the identity of a note being played by an instrument, and causes the microprocessor to adjust the speed of the stepper motor almost instantaneously to a speed assigned to that note in accordance with a selected tuning scheme. This enables a user to play through a series of notes rapidly to verify whether they are in tune with the selected tuning scheme. The multiple, preferably 12, disc embodiment employs a separate stepper motor and micro controller for each disc to accommodate individual tuning of each disc relative to one another. A main microprocessor is employed in this embodiment to control each of the micro controllers, and a master oscillator supplies clock pulses to all of the circuit elements to maintain synchronism with one another.

20 Claims, 3 Drawing Sheets

STROBE TUNER

BACKGROUND OF THE INVENTION

The present invention relates in general to a strobe tuner for indicating whether a musical instrument is tuned correctly.

Strobe tuners are employed to sense the pitch of a note being played by a musical instrument and indicate whether the note is in tune with a reference standard. A first type of strobe tuner employs a single strobe disc which is rotated by a synchronous motor at a precise speed determined by the reference standard and vernier pitch offset to which the musical instrument is to be tuned. An audio circuit is employed to detect the note being played by the instrument, and generate an oscillating electrical signal whose frequency is directly proportional to the note's frequency. This oscillating signal causes a light source positioned behind the strobe disc to flash at frequencies that are components of the sound generated by the musical instrument. If the instrument is in tune with the reference standard, the light source will flash in synchronism with a spinning pattern of black rectangles on the strobe disc, and thus produce a pattern that appears to be stationary. If the instrument's tone is flat relative to the reference standard, the strobe disc pattern will appear to be rotating counterclockwise at a speed proportional to the error in frequency. On the other hand, if the instrument's tone is sharp relative to the standard, the strobe disc pattern will appear to be rotating clockwise.

Single disc strobe tuners typically have some type of switching means or the like for selecting one note at a time to which the instrument is to be tuned so that the speed of the synchronous motor can be changed for each note as necessary. Another type of strobe tuner for tuning an instrument to multiple notes employs multiple strobe discs, one for each of the notes to which the instrument is to be tuned. For example, 12 wheel strobe tuners are known wherein strobe discs for each of the 12 natural and sharp notes in an octave are provided. These devices employ a single motor to drive all 12 strobe discs through a gear train. As a result, the speed relationships between the strobe discs are fixed by the gear ratios to an equal-tempered relationship. In particular, each note is related to an adjacent note by a factor of approximately the 12th root of 2.

A notable drawback to previous strobe tuners is that they cannot be readily adapted for use with complex tuning arrangements, such as unequal temperaments or stretch tuning. In unequal temperaments, the notes in each octave are not separated equally from one another. Stretch tuning is a technique employed for tuning string or bar percussion instruments, such as pianos, wherein notes played from keys one octave apart are tuned slightly farther apart than the exact ratio of 2:1. This is desired by many instrument tuners as a means to compensate for mechanical limitations and imperfect vibrational modes in these instruments. Obviously, neither unequal temperaments nor stretch tuning can be accommodated by the previous 12 disc strobe tuner since the gear ratios of the disc drive train prevent independent adjustment of the speed of one disc relative to the other discs. Even with previous single disc strobe tuners it is very difficult to accommodate unequal temperaments and stretch tuning since such schemes typically require adjustment in a very precise range of a fraction of a semitone. This would require some type of fine vernier adjustment for the strobe disc which would have to be manually adjusted for each note in the scale. A still further drawback to previous 12 disc strobe tuners is that their gear trains inherently tend to generate a lot of noise. This noise can interfere with the operation of the strobe tuner which ideally should be used in as quiet an environment as possible to isolate its sensitivity to the sounds played by the instrument to be tuned.

SUMMARY OF THE INVENTION

The present invention seeks to overcome the foregoing drawbacks by providing a microprocessor controlled strobe tuner which can be easily programmed for tuning an instrument using any desired tuning scheme, including an equal temperament, any desired unequal temperament or stretch tuning. To accomplish this, one or more digitally controlled stepper motors are employed to rotate one or more corresponding strobe tuning discs. In one embodiment of the invention, the microprocessor controls the speed of a single stepper motor in response to programmed tuning data entered by a user. More specifically, a user selects the type of tuning to be employed, such as equal temperament, unequal temperament or stretch tuning. Preferably, a number of known unequal temperaments are stored in the microprocessor's memory which can be selected by the user. In addition, the user can enter their own customized unequal temperament if desired. The selected tuning scheme is stored in a look up table in memory which is referenced by the microprocessor during the tuning operation. As each note in the scale is selected, the microprocessor retrieves that note's speed data from the look up table, and transfers it to a stepper motor control circuit which adjusts the stepper motor's speed accordingly. In this manner, the instrument can be easily tuned to each note in the temperament without any tedious manual speed adjustments by the user.

Preferably, this embodiment employs an auto note detector which automatically identifies the note being played, and causes the microprocessor to adjust the stepper motor's speed accordingly. The microprocessor provides extremely precise control of the stepper motor so that the motor's speed can be adjusted for each note virtually instantaneously. This enables a user to play through a scale rapidly, for example, and still be able to verify that each played note is in tune. Alternatively, note entry keys are preferably provided for permitting a user to select each note manually. In addition, foot operable switches may be employed for enabling a user to cycle the tuner through a user programmed series of notes.

In another preferred embodiment of the present invention, 12 strobe tuning discs are provided in the tuner, one for each note in an octave. This embodiment permits a user to check the tuning of simultaneously played multiple notes, such as a chord, for example. Unlike previous multiple disc strobe tuners, a separate motor is provided for each of the tuning discs. Each of the motors operates independently of all of the other motors to facilitate independent speed adjustment for accommodating unequal temperaments and stretch tuning. Not only does this arrangement facilitate independent speed adjustment of each tuning disc, it also eliminates the use of the inherently noisy gear train, thereby increasing the tuner's sensitivity to the instrument being tuned. In this embodiment of the invention, 12 separate micro controllers are provided for digitally controlling each of the disc motors. A main microprocessor is employed to provide speed instructions to each of the micro controllers. The sole purpose of each micro controller is to continuously provide the position control signals to its corresponding strobe disc motor that are necessary to maintain the desired disc speed. Although the speed of each motor can be adjusted independently of each other, a single master oscillator is employed as a clock signal generator for each of the micro controllers. This is necessary to insure that the speeds of each of the discs maintain the specific relationship dictated by the selected tuning scheme.

BRIEF DESCRIPTION OF THE DRAWINGS

The features and advantages of the present invention will become apparent from the following detailed description of a number of preferred embodiments thereof, taken in conjunction with the accompanying drawings, in which.

DETAILED DESCRIPTION OF THE PREFERRED EMBODIMENTS

Figure 1:
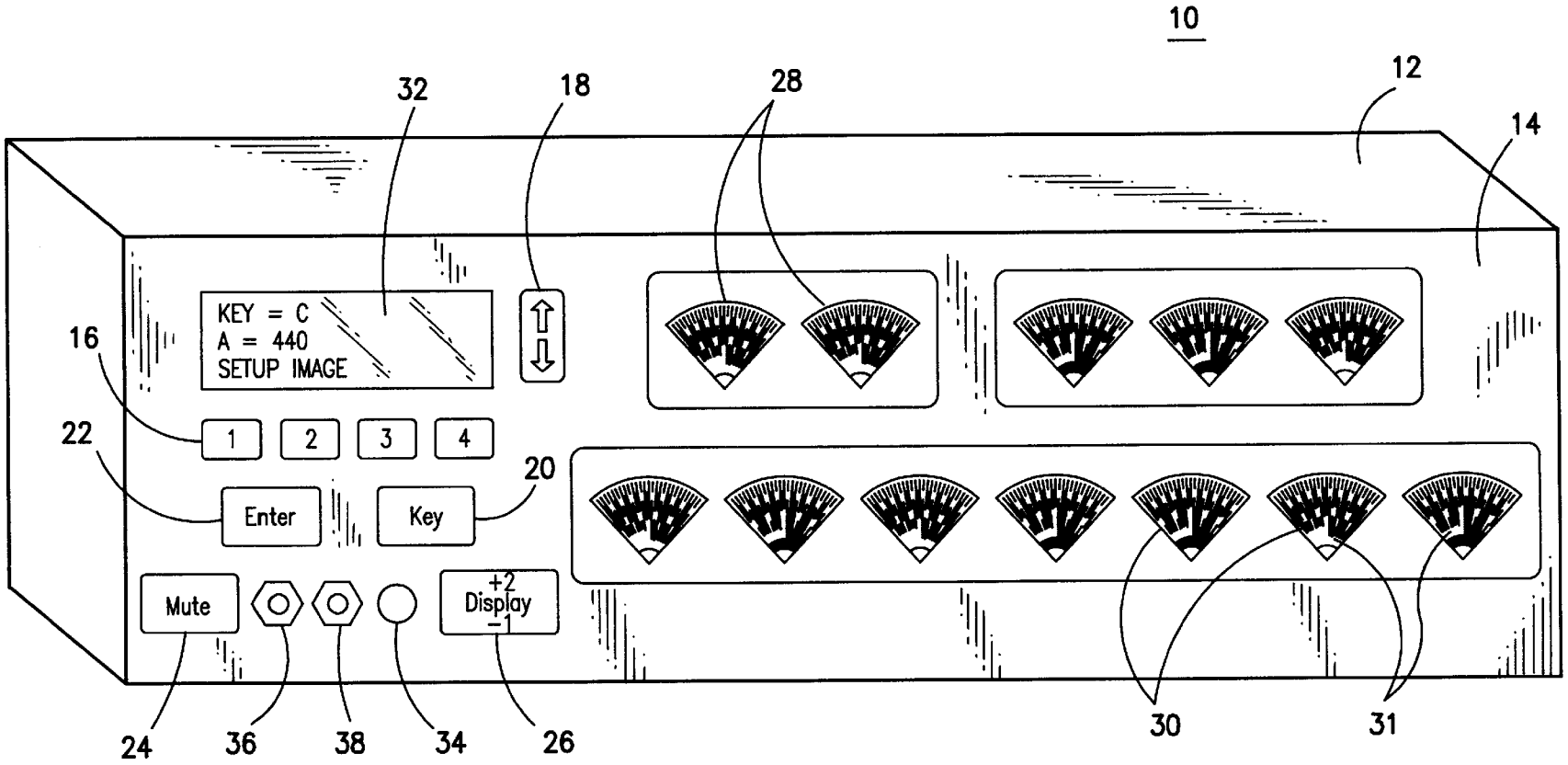
FIG. 1 is an illustration of the housing and control panel for a 12 disc strobe tuner which forms a first preferred embodiment of the present invention.
Figure 2:
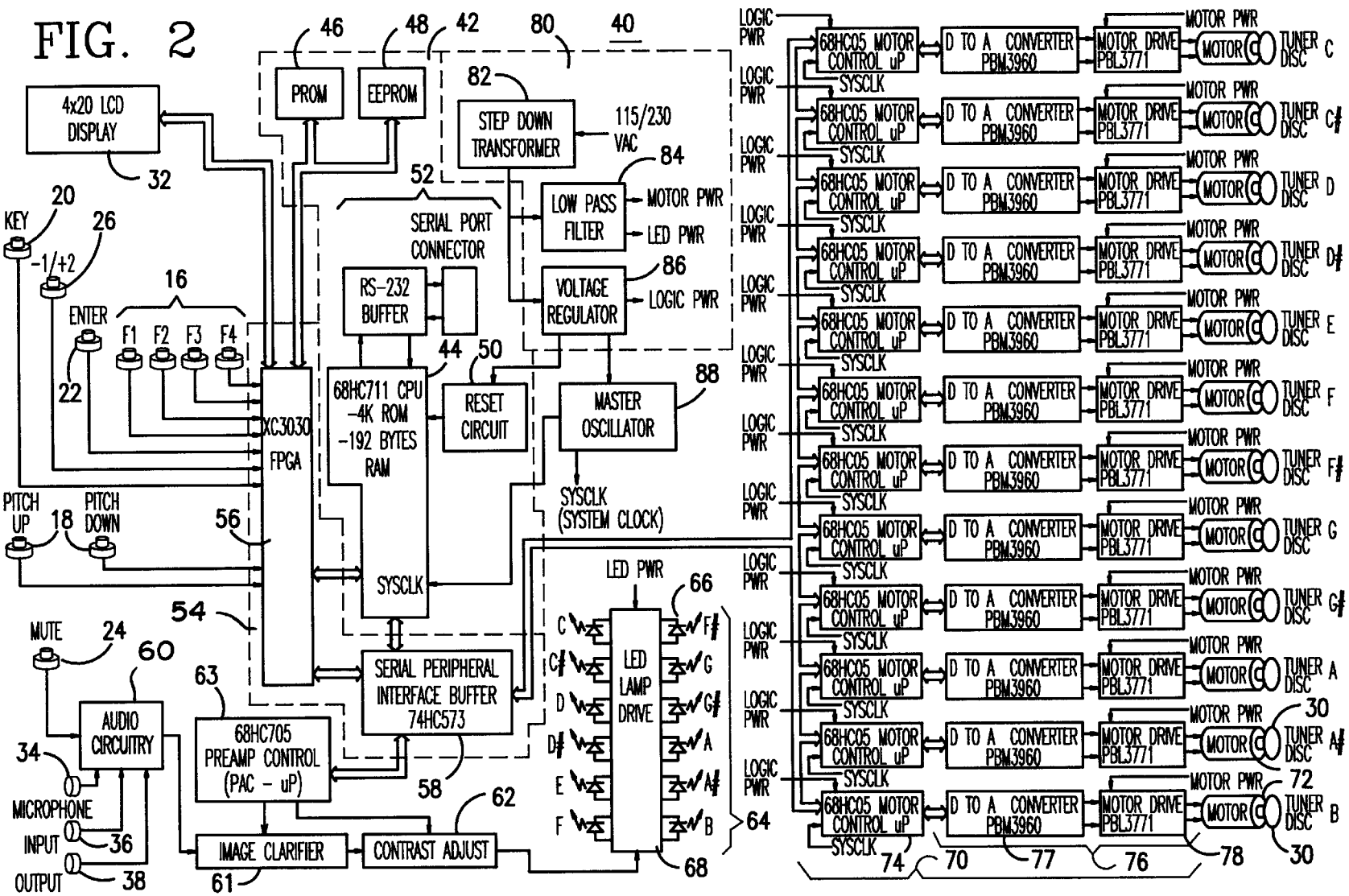
FIG. 2 is a schematic block diagram of the electrical circuitry for the 12 disc strobe tuner of FIG. 1.

Referring to FIG. 1, a 12 disc strobe tuner 10 is illustrated which comprises a first preferred embodiment of the present invention. The strobe tuner 10 includes a housing 12 which contains numerous electrical components as illustrated in FIG. 2 and discussed in greater detail below. Disposed in or on a front panel 14 of the housing 12 are a number of input and output devices. The input devices include a number of key switches including a group of four function keys 16, a pair of digital pitch vernier up/down keys 18, a musical key selection key 20, an enter key 22, a mute key 24 and a display +2/−1 selection key 26.

The output devices on the front panel 14 include a group of 12 strobe disc tuning windows 28, through each of which a corresponding one of 12 strobe discs 30 can be viewed. As is conventional, each of the strobe discs 30 has a pattern of seven or eight concentric rings of rectangular bars 31 formed thereon for generating the desired strobe patterns for each of seven or eight consecutive octaves of a musical instrument. As illustrated, each of the strobe discs 30 corresponds to one of 12 musical notes in an octave, these being C, C#, D, D#, E, F, F#, G, G#, A, A# and B for the default setting of the tuner 10.

The remaining devices disposed on the front panel 14 include an electro-luminescent LCD screen 32 for displaying programming and entered data information to a user, a microphone 34 for receiving sound generated by an instrument to be tuned, an audio input jack 36 for receiving external audio and an audio output jack 38 for pass through of an input audio signal.

Turning now to FIG. 2, a system circuit 40 of the strobe tuner 10 is illustrated, and is contained within the housing 12 of FIG. 1. The circuit 40 includes a microprocessor control module 42 (MCM) which directs the moment by moment functions of the strobe tuner's circuitry. The heart of the MCM 42 is a 68HC711 main system microprocessor 44 including a 4K ROM and a 192 byte RAM, as is conventional. A program run by the microprocessor 44 to operate the strobe tuner 10 is stored in a 27C010, or similar PROM 46. A 28C256 EEPROM 48, is also provided for nonvolatile storage of all user programmable options and note patterns, such as stretch and temperament data. Other, conventional circuitry in the MCM 42 includes a MAX707 reset circuit 50 and an RS-232 buffer and serial communication port 52 for allowing testing and configuration of the MCM 42. It will be understood that the scope of the invention is not limited to the specified circuit elements which could be replaced by other equivalent elements if desired.

An interface circuit 54 is provided for allowing the microprocessor 44 to communicate with the various other circuit elements in the system circuit 40. Preferably, the interface circuit 54 is implemented by a single XC3030/84PLCC field programmable gate array circuit 56 which is interfaced to a 74HC573 buffer 58. The gate array circuit 56 includes a parallel interface for facilitating communication with the LCD screen 32, the PROM 46 and the EEPROM 48, and a digital interface for facilitating entry of user data via the various keys 16, 18, 20, 22 and 26. The buffer 58 acts as a serial peripheral interface for facilitating communications with audio circuit elements and motor control circuit elements to be described in greater detail below.

The microphone 34, input jack 36 and output jack 38 are connected to an audio circuit 60 which converts the received audio signal to an oscillating electrical signal, and feeds it to a tunable low pass filter referred to as an image clarifier 61. From the image clarifier 61, the signal passes through a contrast adjust circuit 62 which selectively adjusts the duty cycle of the oscillating signal. A 68HC705 preamp control circuit (PAC) 63 controls operation of the image clarifier 61 and contrast adjust circuit 62 in response to information received from the MCM 42. The purpose of the image clarifier's filtering function is to eliminate extraneous noise, including higher order harmonics, from the converted audio signal, and preprocess it to a level appropriate for driving an array 64 of LEDs 66 through a lamp driver circuit 68. The contrast adjust circuit 62 enables the user to adjust the brightness of the LEDs 66. The electrical signal fed to the lamp driver circuit 68 oscillates at the same frequency as the audio frequency of the musical note or notes either detected by the microphone 34 or received through the audio input jack 36. As a result, each of the LEDs 66 is caused to flash at this frequency. Groups of the LEDs 66 are positioned behind each of the strobe discs 30 in the strobe tuner's housing 12 so that their flashing is readily visible through the strobe disc windows 28.

The mute key 24 is also interfaced to the audio circuit 60 for selectively connecting the input audio signal received through input jack 36 to the output jack 38 for pass through of the audio signal to an external device, such as an amplifier.

A group of 12 motor control circuits 70 is provided, each of which controls the speed and operation of a corresponding one of 12 stepper motors 72 for rotating a corresponding one of the 12 strobe discs 30. Each of the motor control circuits 70 is preferably comprised of a 68HC705 micro controller 74 which continually supplies digital motor control signals to a stepper motor drive circuit 76, such as a precision stepper motor driver manufactured by Ericsson which includes a PBM3960 dual D/A converter 77 and a PBL3771 microstep amplifier 78. It should be noted that it would not be possible for the main microprocessor 44 to control each of the motor drive circuits 76 because it would be far too time consuming. This is because approximately 1000 digital position signals are applied to the drive circuit 76 for every revolution of the strobe disc 30 to insure very precise speed control. As a result, a separate one of the micro controllers 74 is required for each drive circuit 76 whose sole purpose is to continually supply these digital position signals in response to speed signals received from the main microprocessor 44.

A power supply circuit 80 is also provided which supplies power to each of the elements in the strobe tuner 10. The power supply circuit 80 includes a step down transformer 82 for reducing the input voltage to a level appropriate for operating the circuit elements. This reduced voltage is fed through a low pass filter 84 which supplies power to the motor drive circuit 76 and the LED array 64, and a voltage regulator 86 for supplying power to the reset circuit 50, the micro controllers 74 and an 8 MHz master oscillator 88.

The master oscillator 88 is important because it generates clock pulses for a system clock (SYSCLK) which controls operation of the system microprocessor 44 and each of the motor micro controllers 74. It is important that a single clock be employed for these elements to insure that each of the micro controllers 74 operates in synchronism with the main microprocessor 44, as well as with each other. This is necessary to insure that the speed relationships between each pair of the motors 72 needed to implement the desired tuning scheme can be accurately maintained. Another advantage of using the 8 MHZ oscillator 88 to control system operation is that it results in extremely precise speed control of the stepper motors 72 which is essentially insensitive to varying operating parameters, such as temperature.

The operation of the strobe tuner 10 will now be described. The PROM 46 contains a number of programs which control operation of the strobe tuner 10 through the main microprocessor 44 and the 12 micro controllers 74. The source code listing for the preferred embodiment's programs is provided in the Appendix at the end of the specification. This listing includes the programs for the main microprocessor 44, PAC 63 and the micro controllers 74. First, at power-up, the MCM 42 configures itself for operation (BOOT stage), and then tests the other elements of the system for correct operation. The MCM 42 then responds to inputs which it receives from the interface circuit 54 by converting received information into the specific instructions and signals required by the motor control circuit 70 and the PAC 63. The MCM 42 will continue to monitor the activity of all system elements during operation, and will bring any faults or failures to the attention of the user through the display screen 32. The MCM 42 is also capable of being programmed to perform specific autonomous functions at the request of the user.

The user controls the actions of the strobe tuner 10 via the various keys which provide the following functions. The four function keys 16 labeled F1–F4 are software programmable function keys, the function of which is determined by the MCM 42 on a moment by moment basis. The selected function of each of these four keys at any given moment is displayed directly above the corresponding keys on the LCD screen 32. The vernier pitch up/down keys 18 are employed for very fine adjustment of the audible frequency assigned to each of the strobe discs 30. This permits the user to sharpen or flatten the pitch of a particular note to measure the correctness of their own intonation with an accuracy of 1/1000th of a semitone (1/10th of a cent, where 1 cent=1/100 semitone). The up/down keys 18 permit up and down adjustment over a range of ½ semitone (50 cents) each way, with selectable resolution of 1/10,½ or 1 cent increments. This feature can also be employed to determine how many cents sharp or flat the strobe tuner 10 has to be adjusted to match the note being played, thus providing an exact reading of the difference from correct intonation for each note observed.

The key selector key 20 allows the user to select any of a number of different musical keys in which the strobe tuner 10 is to operate. Once again, the selected key is displayed on the LCD screen 32. This allows the strobe tuner 10 to be easily employed for tuning instruments which are tuned in keys other than the key of C. In the preferred embodiment, the keys of C, B flat, F and E flat may be selected sequentially using the key selector key 20.

The strobe tuner 10 has a default pitch setting equal to the International Standard pitch of A=440 Hz. This can be raised or lowered to any tuning frequency desired within a broad range of from A=350 Hz to A=550 Hz. This modified standard pitch can be stored in the strobe tuner's memory so that the tuner powers-up calibrated for the selected pitch. The currently selected pitch for A is displayed by the LCD screen 32.

Three different techniques for changing the pitch of the reference note assigned to each of the strobe discs 30 are therefore provided. Coarse adjustment is provided through adjustment of the pitch for middle A and fine adjustment is provided through adjustment of the up/down keys 18. In addition, the identity of each note assigned to each of the strobe discs 30 can be changed by switching the musical key with the key selector key 20.

The enter key switch 22 is employed to select specific values of pitch up or pitch down deviations when editing customized temperament and/or stretch tuning files used in specialized tuning applications. It is also used for some of the user selections and programming menu of the strobe tuner 10.

The mute key 24 enables the strobe tuner 10 to be used on-stage during a performance with the external input patched through to the external output. The mute mode disconnects the internal patch through path to permit "silent" on-stage tuning of electrical instruments, such as electrical guitars. Actuation of the mute key switch 24 causes toggling between the two operational modes.

Improved pattern clarity is achieved for hard to see lower and upper octaves by actuating the display +2/−1 key 26. The +2 mode lifts the base notes up by two octaves into the middle the strobe discs 30 for easier readability. Similarly, the −1 mode drops the treble notes down one octave on the strobe discs 30. More particularly, with the tuner in the display +2 mode, the speed of all 12 strobe discs 30 is reduced by a factor of four. This causes the one of the strobe patterns 31 which appears to be stationary to be shifted upward exactly two registers on each disc 30 into the easier to read middle bands or registers of the strobe patterns 31. Similarly, for extremely high treble notes, the display −1 mode shifts all of the strobe patterns 31 down exactly one octave. The rotational speed of each of the strobe discs 30 is then doubled over the normal tuning speed. The stationary appearing one of the strobe patterns 31 is thus shifted downward by one band toward the middle region of the strobe discs 30.

The MCM 42 is programmed to allow the user to choose either an equal tempered scale or one from a list of preprogrammed non-equally tempered tunings. The user may program and save personal custom temperaments by entering the tempered values for each of the 12 notes in the chromatic scale in 1/10th of 1 cent increments. The current temperament in use is shown on the display screen 32 whenever it is different from the equal tempered scale. In an equal tempered scale, there are exactly 100 cents between each half-step note.

The MCM 42 also has several built-in stretch tables for tuning pianos or slightly inharmonic instruments. The user may also enter their own preferred stretch configuration and save it in memory. The chosen stretch configuration in use is once again displayed on the LCD screen 32 whenever the stretch mode is engaged.

At times when an instrument is being played in the softer dynamic range (piano or pianissimo) and/or the instrument is being played in lower or upper octaves, the strobe disc patterns 31 can be made more distinct with adjustments of the image clarifier 61 and the image contrast adjust circuit 62. Selective insertion of the low pass filter in the image clarifier 61 filters out higher order harmonics which are present in the detected note, and can give a false impression of the note's identity. Filtering out these higher order harmonics, thereby leaving only the lower order harmonics and the fundamental partial, insures that the LEDs 66 in the LED array 64 will be flashed at the correct frequency. The image contrast adjust circuit 62 effectively provides a plurality of illumination intensity levels for the LED array 64. These levels are selected by controlling the duty cycle of the drive signal applied to the LEDs 66 by the drive circuit 68.

During operation of the strobe tuner 10, the main microprocessor 44 sends motor speed control data to each of the micro controllers 74 in response to the tuning arrangements selected by the user. Each of the motors 72 is caused to rotate at the rpm necessary to cause the pattern 31 on its associated one of the strobe discs 30 to appear to be stopped by the flashing of the LED 66 when the musical note to which that particular strobe disc is tuned is detected by the audio circuit 60. Counterclockwise movement of the strobe disc pattern 31 indicates that the played note is flat relative to the standard, while clockwise movement indicates that the note is sharp. The strobe disc pattern appears to move more slowly as the note is brought closer into tune, and it appears to be stationary when the note is perfectly in tune.

As a user plays each note in an octave, one of the patterns 31 on the appropriate one of the strobe discs 30 will appear to stop if the instrument is correctly tuned to the selected tuning scheme or temperament. The strobe tuner 10 thus provides a very efficient means by which tuning of an instrument to any desired tuning scheme can be easily and quickly accomplished.

Figure 3:
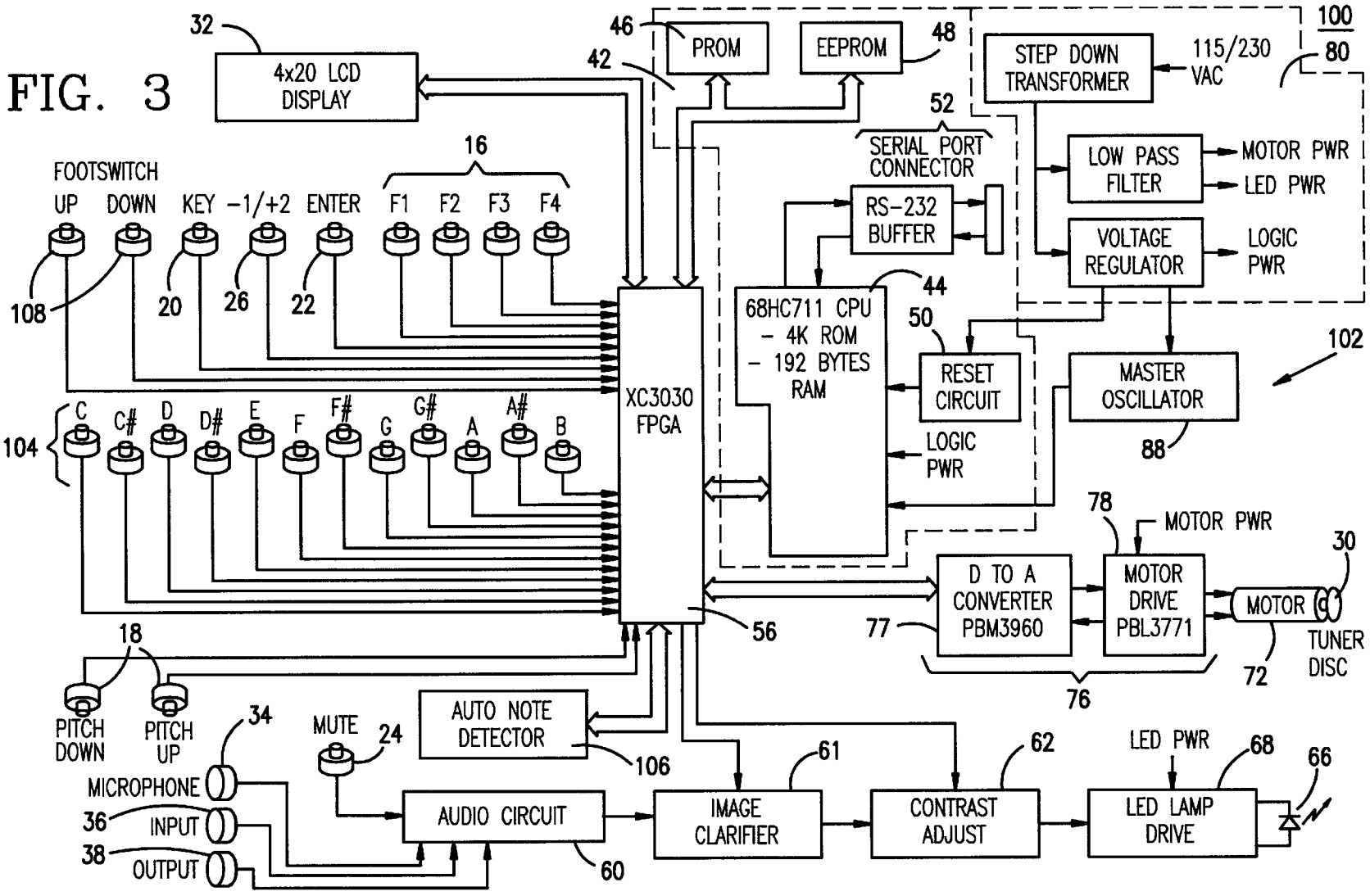
FIG. 3 is a schematic block diagram of the electrical circuitry of a single disc strobe tuner constructed in accordance with a second preferred embodiment of the present invention.

The second preferred embodiment of the present invention illustrated in FIG. 3 incorporates most of the advantages of the strobe tuner 10, and also provides the further advantage of reduced cost by eliminating all of the micro controllers 74, the PAC 63 and all but one of the strobe discs 30 and associated motor drive circuits 76. In particular, FIG. 3 illustrates a strobe tuner 100 which employs a system circuit 102 that includes many of the same elements of the system circuit 40 for the strobe tuner 10 of FIGS. 1 and 2. Like elements are illustrated in FIG. 3 by using the same reference numerals employed in FIG. 2, and reference can be made to the previous description for their identity and operation.

The notable differences between the system circuit 102 and the system circuit 40 include the following. As discussed previously, the system circuit 102 includes only one of the strobe discs 30 and associated motor drive circuits 76 and stepper motors 72. In addition, the micro controller 74 is not needed since the main microprocessor 44 has enough processing capacity to supply the digital position signals to the single drive circuit 76. In this case, the program for the micro controller is essentially incorporated into the main microprocessor's program. However, one of the micro controllers 74 could be used if desired to free up the main microprocessor 44 for performing other tasks.

A group of 12 additional data entry keys 104 is also provided, with each of the keys corresponding to one note in an octave as illustrated. An auto note detector circuit 106 is provided between the interface circuit 54 and the image clarifier 61 which senses the frequency of the note being played and thereby determines the identity of the note. Such auto note detector circuits are known in the art and typically include some means for converting the detected audio frequency to a corresponding electrical frequency, a frequency detector for identifying the frequency of the electrical signal, and a comparison circuit for comparing the detected frequency to a group of frequencies stored in a look up table which correspond to each possible musical note to be detected.

The detected note information is employed by the main microprocessor 44 to select the appropriate position control signals to be sent to the motor drive circuit 76 so that the strobe disc 30 is driven at the rpm corresponding to the reference standard for the detected note. By employing the stepper motor 72 in combination with the microprocessor 44, the speed of the strobe disc 30 can be adjusted in response to signals received from the auto note detector 104 within only a few milliseconds. This insures that the single disc strobe tuner 100 can be used to check the tuning of each note in an octave quickly, which is something that could not be accomplished if the motor driving the strobe disc 30 were a conventional DC motor. If desired, a user can disable the auto note function of the strobe tuner 100, and employ the note entry keys 104 to select the reference note to which the instrument is to be tuned.

A pair of foot operable switches 108 is also provided in this embodiment for permitting a user to cycle the tuner 100 through a user programmed series of notes. The user can cycle in either direction through the series by actuating either the up or down one of the switches 108 as necessary.

In summary, the present invention provides both single and multiple disc microprocessor controlled strobe tuners which are particularly advantageous in that they both permit a user to easily program the tuner with any desired tuning scheme, including those with customized temperaments or stretch tuning. The 12 disc embodiment also eliminates the noise and mechanical complexity of the gear trains employed in previous multiple disc tuners, while the single disc embodiment provides almost instantaneous speed response for rapid scale tuning. Although the invention has been disclosed in terms of a pair of preferred embodiments, and variations thereon, it will be understood that numerous additional modifications and variations could be made thereto without departing from the scope of the invention as defined in the following claims.

APPENDIX

```
0000                 1  $base 10T
0000                 2  $pagewidth 132
0000                 3  #SETNOT NOCOMP
                     4  *=====================================================*
                     5  *   Peterson Tuner Model 12W Source Code              *
                     6  *   Written by :: Robert S. Dobrose                   *
                     7  *   Saracon, Inc.                                     *
                     8  *     1135 Garfield Ave.                              *
                     9  *     Libertyville, IL  60048                         *
                    10  *=====================================================*
                    11  *   Release History                                   *
                    12  *   950214  x.0                                       *
                    13  *     Breadboard code - working file                  *
                    14  *=====================================================*
                    15
00A2                16  $list
                    17
                    18  *=====================================================
                    19  * MAIN Program (EEPROM)
                    20  * - - - - - - - - - - - - - - - - - - - - - - - - - - -
1000                21          ORG     ROMBASE
1000                22  START   EQU     *
                    23
                    24  * - - - - - - - - - - - - - - - - - - - - - - - - - - -
                    25  * INITIALIZATION *
                    26  * - - - - - - - - - - - - - - - - - - - - - - - - - - -
1000 [03] 8E00FF    27          LDS     #STACK          ;Initialize stack
1003 [06] 7F0041    28          CLR     MFLAGS
1006 [06] 7F0042    29          CLR     DFLAGS
1009 [06] 7F0040    30          CLR     MEM_ERR
100C [06] 7F0047    31          CLR     NOTE_OCT
100F [03] CE01B8    32          LDX     #!440
1012 [04] DF5A      33          STX     CAL_A
1014 [02] 860A      34          LDAA    #!10
1016 [03] 9759      35          STAA    N_SCAN
1018 [02] 8608      36          LDAA    #$08
101A [03] 9743      37          STAA    SFLAGS
101C [03] 9748      38          STAA    CONTRAST
                    39  ;#####
                    40  ;***    Look up System Header block (if any) and load stored values
                    41  ;***    stored values may include DFLAGS, SFLAGS & CAL_A value
101E [06] BD3391    42          JSR     GET_HEAD
                    43  ;***    Set IMAGE CLARIFIER (HI/LO) bit in OUTPUT buffer to stored
value
1021 [06] 12430803  44          BRSET   SFLAGS,$08,INI_SK1
1025 [02] 5F        45          CLRB
1026 [03] 2002      46          BRA     INI_SK2
                    47  INI_SK1:
1028 [03] D601      48          LDAB    $01
                    49  INI_SK2:
102A [04] F7E004    50          STAB    OUTPUTS
                    51
                    52  * - - - - - - - - - - - - - - - - - - - - - - - - - - -
                    53  * Initialize SCSI
                    54  * - - - - - - - - - - - - - - - - - - - - - - - - - - -
                    55  ;INITSCSI LDAA   #$30         ;Baud rate =9600
                    56  ;         STAA   BAUD
                    57
                    58  * - - - - - - - - - - - - - - - - - - - - - - - - - - -
                    59  * Initialize pointers for communication interface
                    60  * - - - - - - - - - - - - - - - - - - - - - - - - - - -
                    61  ;INIT_VAR LDY    #RM_BUFF     ;Initialize receive pointer
                    62  ;         STY    R_PTR
                    63  ;         LDX    #TM_BUFF     ;Initialize xmit pointer
```

```
                        ;          STX     T_PTR

                        * - - - - - - - - - - - - - - - - - - - - - - - - - - - - -
                        * Display Initialization
                        * - - - - - - - - - - - - - - - - - - - - - - - - - - - - -

102D [06] BD11A4        ;          JSR     DSP_INIT

                        * - - - - - - - - - - - - - - - - - - - - - - - - - - - - -
                        * SPI Initialization
                        * - - - - - - - - - - - - - - - - - - - - - - - - - - - - -
1030 [03] 9629          ;          LDAA    SPSR            ; Read SPI status
1032 [03] 962A          ;          LDAA    SPDR            ; Read Data Register (Clears SPIF
flag)
1034 [02] 8654          ;          LDAA    #$54            ; SPI initialization flags
1036 [03] 9728          ;          STAA    SPCR            ; Init SPI

                        *=========================================================
                        * Initial Message - This message should be included only
                        *   in pre-release development software.  It should be
                        *   removed for the production release version.
                        * The message strings for this screen should probably
                        *   stay in memory as identifiers of the development
                        *   participants.
                        * - - - - - - - - - - - - - - - - - - - - - - - - - - - - -
                        ;          LDX     #B_MSG1         ;Load boot message
                        ;          JSR     LINE1           ;display line 1
                        ;          LDX     #B_MSG2
                        ;          JSR     LINE2           ;display line 2
                        ;          LDX     #B_MSG3
                        ;          JSR     LINE3
                        ;          LDX     #B_MSG4
                        ;          JSR     LINE4

                        ;          LDX     #!200           ; Set for 2 seconds
                        ;          JSR     TIMER
                        * - - - - - - - - - - - - - - - - - - - - - - - - - - - - -
                        * End of Initial Message
                        *=========================================================

                        *=========================================================
                        * Opening Message - This message displays the opening
                        *   screen and the unit serial number (if any).
                        * - - - - - - - - - - - - - - - - - - - - - - - - - - - - -
1038 macro              ;          SCR     001,002,REV,003
1038 [03] CE603F        LDX #MSG%1
103B [06] BD12C1        JSR LINE1
103E [03] CE6054        LDX #MSG%2
1041 [06] BD12C7        JSR LINE2
1044 [03] CE6000        LDX #MSG%3
1047 [06] BD12CD        JSR LINE3
104A [03] CE6069        LDX #MSG%4
104D [06] BD12D3        JSR LINE4
1050 [06] BD33BD        ;          JSR     GET_SER
1053 [04] 8C0000        ;          CPX     #$0000
1056 [03] 270A          ;          BEQ     SER_SK1
                        ; Display serial number from header record
1058 [02] 8603          ;          LDAA    #!3             ; Line 3
105A [02] C609          ;          LDAB    #!9             ; Column 9
105C [06] BD1309        ;          JSR     DSP_CUR         ; Position Cursor
105F [06] BD12BD        ;          JSR     DSP_STR         ; and display string
                        SER_SK1:
1062 [03] CE012C        ;          LDX     #!300           ; Set for 3 seconds
1065 [06] BD1178        ;          JSR     TIMER
                        * - - - - - - - - - - - - - - - - - - - - - - - - - - - - -
                        * End of Opening Message
                        *=========================================================
```

```
                        131  ; ***   Set CONTRAST value to stored value
                        132          ;*** Update new value for contrast adjust
 1068 [03] D648         133          LDAB    CONTRAST        ; Get data
 106A [02] C40F         134          ANDB    #$0F            ; Mask off unused bits
 106C [02] 58           135          LSLB                    ; Shift data to high bits
 106D [02] 58           136          LSLB                    ;  **
 106E [02] 58           137          LSLB                    ;  **
 106F [02] 58           138          LSLB                    ;  **
 1070 [02] CB0B         139          ADDB    #$0B            ; Set CMD bits (low 4) to NEW CONTRAST
cmd
 1072 [02] 860D         140          LDAA    #13             ; Set for SPI unit #13
 1074 [06] BD35B8       141          JSR     SPI_DLY         ; Send data to PAC controller
                        142  ;       Set up Calibrated Multiplier values by multiplying CAL_A
                        143  ;       value by each of 12 note multiplier constants.
                        144  ;  Calculate multiplier table
 1077 [06] BD1776       145          JSR     CALC_MULT
                        146
                        147  * - - - - - - - - - - - - - - - - - - - - - - - - - - - -
                        148  * Enable interrupts
                        149  * - - - - - - - - - - - - - - - - - - - - - - - - - - - -
                        150  ;         BCLR   SCCR2,$FF    ;Reset interrupt enable reg
                        151  ;         BSET   SCCR2,RIE    ;Enable receive interrupt
                        152
                        153  ;         BSET   SCCR2,RE     ;Enable receiver
                        154  ;         BSET   SCCR2,TE     ;Enable transmitter
                        155
                        156
                        157  TEST_LP:
 107A [06] BD303F       158          JSR     MEM_TST         ; test memory
                        159  ;       TST     MEM_ERR         ; Check for errors
                        160  ;       BEQ     MEM_OK          ; No errors found, continue
                        161  ;       JSR     ERR_DFLT        ; Found errors!  Set defaults?
                        162  ; #####
                        163  ;       JSR     MENU            ; Set params manually?
                        164  ;       BRA     TEST_LP
 107D [04] B67C00       165          LDAA    V_INC1          ; set to Scale #1 (Default)
 1080 [03] 9746         166          STAA    V_SCL           ; Store new scale value
 1082 [06] 154201       167          BCLR    DFLAGS,$01      ; Clear fractional vernier display
flag
                        168  RESTART:
 1085 [03] CC0000       169          LDD     #$0
 1088 [04] DD44         170          STD     V_VAL
                        171  MEM_OK:
 108A [06] BD13E8       172          JSR     OP_SCR          ; Display Operational screen
 108D [06] BD1935       173          JSR     UPDATE          ; Update screen status
 1090 [06] BD1331       174          JSR     WAIT_NONE
 1093 [06] BD19EF       175          JSR     V_UPDATE        ; starting value, update system
                        176
                        177  * - - - - - - - - - - - - - - - - - - - - - - - - - - - -
                        178  * MAIN POLLING LOOP - - - - - - - - - - - - - - - - - - -
                        179  * - - - - - - - - - - - - - - - - - - - - - - - - - - - -
 1096                   180  MAIN:   EQU     *               ; Start of main loop
                        181          ; Check for PANEL key pressed & held
 1096 [04] B6E002       182          LDAA    PANEL           ; Check panel inputs
 1099 [02] 43           183          COMA                    ; Invert to adjust levels
 109A [03] 2706         184          BEQ     MAIN_BAD1       ; Skip if keys not active
                        185          ; If quick check of PANEL is TRUE, do longer check to be sure
 109C [06] BD1366       186          JSR     GET_KEY         ; Get PANEL inputs
 109F [02] 4D           187          TSTA
 10A0 [03] 2603         188          BNE     MAIN_OK1        ; Process if PANEL active
                        189  MAIN_BAD1:
 10A2 [03] 7E1120       190          JMP     MAIN_2          ; Skip next stuff if PANEL not active
                        191  MAIN_OK1:
                        192          ; PANEL is active, Determine key & perform function
 10A5 [02] 8101         193          CMPA    #$01            ; Check for SETUP (F1) key
 10A7 [03] 2605         194          BNE     MAIN_SK1        ; Skip next if not SETUP key
 10A9 [06] BD1B7F       195          JSR     MENU            ; SETUP hit, Jump to MENU
 10AC [03] 2067         196          BRA     MAIN_KDONE      ; Operation done, update stuff & cont.
```

```
                        MAIN_SK1:
10AE [02] 8102                  CMPA    #$02            ; Check for IMAG (F2) key
10B0 [03] 2609                  BNE     MAIN_SK2        ; Skip next if not IMAG key
10B2 [06] BD1F06                JSR     IC_CONT         ; Adjust Image Clarifier & CONTRAST
10B5 [06] BD1331                JSR     WAIT_NONE
10B8 [03] 7E108A                JMP     MEM_OK
                        MAIN_SK2:
10BB [02] 8104                  CMPA    #$04            ; Check for OCT DOWN (F3) key
10BD [03] 2606                  BNE     MAIN_SK3        ; Skip next if not OCT DOWN key
10BF [06] BD1EDA                JSR     OCT_DN          ; OCT DOWN hit, Jump to OCT DOWN
change
10C2 [03] 7E108A                JMP     MEM_OK          ; Re-start MAIN loop
                        MAIN_SK3:
10C5 [02] 8108                  CMPA    #$08            ; Check for OCT UP (F4) key
10C7 [03] 2606                  BNE     MAIN_SK4        ; Skip next if not OCT UP key
10C9 [06] BD1ECA                JSR     OCT_UP          ; OCT UP hit, Jump to OCT UP change
10CC [03] 7E108A                JMP     MEM_OK          ; Re-start MAIN loop
                        MAIN_SK4:
10CF [02] 8120                  CMPA    #$20            ; Check for '+' key
10D1 [03] 2611                  BNE     MAIN_SK6        ; Skip next if not '+' key
10D3 [04] DC44                  LDD     V_VAL           ; '+' hit, increment V_VAL by SCALE
10D5 [03] DB46                  ADDB    V_SCL
10D7 [02] 8900                  ADCA    #$0
10D9 [05] 1A8301F4              CPD     #!500
10DD [03] 2F03                  BLE     MAIN_SK61
10DF [03] CC01F4                LDD     #!500
                        MAIN_SK61:
10E2 [03] 2013                  BRA     MAIN_SK71
                        MAIN_SK6:
10E4 [02] 8140                  CMPA    #$40            ; Check for '-' key
10E6 [03] 261A                  BNE     MAIN_SK7        ; Skip next if not '-' key
10E8 [04] DC44                  LDD     V_VAL           ; '-' hit, decrement V_VAL by SCALE
10EA [03] D046                  SUBB    V_SCL
10EC [02] 8200                  SBCA    #$0
10EE [05] 1A83FE0C              CPD     #!-500
10F2 [03] 2C03                  BGE     MAIN_SK71
10F4 [03] CCFE0C                LDD     #!-500
                        MAIN_SK71:
10F7 [04] DD44                  STD     V_VAL
10F9 [06] BD19EF                JSR     V_UPDATE        ; new value, update system
10FC [03] CE000F                LDX     #!15
10FF [06] BD1178                JSR     TIMER
                        ;       BRA     MAIN_2
                        MAIN_SK7:
1102 [02] 8130                  CMPA    #$30            ; Check for ENTER & '+' key
1104 [03] 2704                  BEQ     MAIN_SK81       ; Change RES if ENTER & '+' key
1106 [02] 8150                  CMPA    #$50            ; Check for ENTER & '-' key
1108 [03] 2609                  BNE     MAIN_SK8        ; Skip next if not ENTER & '-' key
                        MAIN_SK81:
                                ; Change RES
110A [06] BD1867                JSR     CH_SCL          ; SCALE hit, Jump to SCALE change
110D [06] BD19EF                JSR     V_UPDATE        ; new vernier value, update system
1110 [06] BD1331                JSR     WAIT_NONE
                        MAIN_SK8:
1113 [03] 200B                  BRA     MAIN_2          ; no keys recognized, skip next stuff
                        MAIN_KDONE:
1115 [06] 7D0040                TST     MEM_ERR         ; Check for memory error during SETUP
1118 [03] 2703                  BEQ     MAIN_X1
111A [03] 7E107A                JMP     TEST_LP
                        MAIN_X1:
111D [03] 7E1085                JMP     RESTART         ; Re-start MAIN loop
                        MAIN_2:
                                ; Check for AUX key pressed & held
1120 [04] B6E003                LDAA    AUX_IRQ         ; Check AUX inputs
1123 [02] 43                    COMA                    ; Invert to adjust levels
1124 [03] 271A                  BEQ     MAIN_3          ; Skip if keys not active
                                ; If quick check of AUX is TRUE, do longer check to be sure
1126 [06] BD13C6                JSR     GET_AUX         ; Get AUX inputs
```

```
1129 [02] 4D          264          TSTA
112A [03] 2714        265          BEQ     MAIN_3          ; Skip if AUX not active
                      266          ; AUX is active, Determine key & perform function
112C [02] 8101        267          CMPA    #$01            ; Check for +2/-1 key
112E [03] 2606        268          BNE     MAIN2_SK1       ; Skip next if not +2/-1 key
1130 [06] BD1EEA      269          JSR     OCT_ADJ         ; +2/-1 hit, Jump to Octave Adjust
routine
1133 [03] 7E108A      270          JMP     MEM_OK          ; Re-start MAIN loop
                      271  MAIN2_SK1:
1136 [02] 8102        272          CMPA    #$02            ; Check for KEY key
1138 [03] 2606        273          BNE     MAIN_3          ; Skip next if not KEY key
113A [06] BD1EBB      274          JSR     CH_KEY          ; KEY hit, Jump to Change KEY routine
113D [03] 7E108A      275          JMP     MEM_OK          ; Re-start MAIN loop
                      276  MAIN_3:
                      277          ; Monitor for MUTE status
1140 [02] C60A        278          LDAB    #$0A            ; Set CMD bits for GET MUTE STATUS cmd
1142 [02] 860D        279          LDAA    #!13            ; Set for SPI unit #13
1144 [06] BD35B8      280          JSR     SPI_DLY         ; Send data to PAC controller
1147 [02] C410        281          ANDB    #$10            ; Mask off non-data bits
1149 [03] 2716        282          BEQ     MAIN_31         ; If data is clear, MUTE is ON
                      283          ; Mute is OFF, Clear MUTE STATUS Display
114B [06] 13434026    284          BRCLR   SFLAGS,$40,MAIN_32      ; Skip change if already set!
114F [06] 154340      285          BCLR    SFLAGS,$40
1152 [03] CE6DEE      286          LDX     #S_MUTEOF       ; Load MUTE OFF string
1155 [02] 8602        287          LDAA    #!2             ; Line 2
1157 [02] C603        288          LDAB    #!3             ; Column 3
1159 [06] BD1309      289          JSR     DSP_CUR         ; Position Cursor
115C [06] BD12BD      290          JSR     DSP_STR         ; and display string
115F [03] 2014        291          BRA     MAIN_32
                      292  MAIN_31:
                      293          ; Mute is ON, Display MUTE STATUS indicator
1161 [06] 12434010    294          BRSET   SFLAGS,$40,MAIN_32      ; Skip change if already set!
1165 [06] 144340      295          BSET    SFLAGS,$40
1168 [03] CE6DEC      296          LDX     #S_MUTEON       ; Load MUTE ON string
116B [02] 8602        297          LDAA    #!2             ; Line 2
116D [02] C603        298          LDAB    #!3             ; Column 3
116F [06] BD1309      299          JSR     DSP_CUR         ; Position Cursor
1172 [06] BD12BD      300          JSR     DSP_STR         ; and display string
                      301  MAIN_32:
                      302
1175 [03] 7E1096      303          JMP     MAIN
                      304
                      305  * - - - - - - - - - - - - - - - - - - - - - - - - - - - - -
                      306  * END OF MAIN
                      307  *=========================================================
                      308
                      309  *=========================================================
                      310  * Include Subroutine Files
                      311  * - - - - - - - - - - - - - - - - - - - - - - - - - - - - -
                      312
1178                  313  $INCLUDE 'TIMER.ASM'            ;Include Timer Subroutines
1178                  314  $base 10T
1178                  315  $pagewidth 132
                      316  *=========================================================*
                      317  *   Peterson Tuner: Timer Subroutines                     *
                      318  *   Rev. 1.0 - 02/10/95                                   *
                      319  *   Written by  Robert S. Dobrose                         *
                      320  *   Saracon, Inc.                                         *
                      321  *     1135 Garfield Ave.                                  *
                      322  *     Libertyville, IL  60048                             *
                      323  *=========================================================*
                      324  *   Release History                                       *
                      325  *   02/10/95  0.1 - Initial code revision                 *
                      326  *=========================================================*
                      327
                      328
                      329  *=========================================================
                      330  * Name:  TIMER
```

```
                    331  * Subroutine: Timed Delay Subroutine
                    332  * Written by: Robert S. Dobrose
                    333  * Purpose: This subroutine delays a regulated amount of
                    334  *          time given in 0.01 second time ticks.
                    335  *   Input: Reg-X contains the number of time ticks
                    336  *            to be performed.
                    337  *  Output: NONE
                    338  *   Notes: Value in X-Reg is destroyed
                    339  *          Calling this routine with X = 0 causes a
                    340  *            VERY long delay! ~11 minutes!
                    341  * - - - - - - - - - - - - - - - - - - - - - - - - - - - - -
                    342
                    343  TIMER:
1178                344       EQU     *
1178 [05] 183C      345       PSHY
                    346  TIME_X1:
117A [04] 18CE0B27  347       LDY     #$0B27
                    348  TIME_X2:
117E [04] 1809      349       DEY
1180 [03] 26FC      350       BNE     TIME_X2
1182 [02] 01        351       NOP
1183 [02] 01        352       NOP
1184 [03] 09        353       DEX
1185 [03] 26F3      354       BNE     TIME_X1
1187 [06] 1838      355       PULY
1189 [05] 39        356       RTS
                    357
                    358  *=========================================================
                    359  * Subroutine: T1_DLY
                    360  * Purpose: Delay routine 1
                    361  *   Input: none
                    362  *  Output: none
                    363  *   Notes: short delay, re-entrant
                    364  * - - - - - - - - - - - - - - - - - - - - - - - - - - - - -
                    365
118A [05] 183C      366  T1_DLY     PSHY
118C [04] 18CE00FF  367            LDY     #$00FF
1190 [04] 1809      368  T1D-LP     DEY
1192 [03] 26FC      369            BNE     T1D-LP
1194 [06] 1838      370            PULY
1196 [05] 39        371            RTS
                    372
                    373  *=========================================================
                    374  * Subroutine: T2_DLY
                    375  * Purpose: Delay routine 2
                    376  *   Input: none
                    377  *  Output: none
                    378  *   Notes: longer delay, re-entrant
                    379  * - - - - - - - - - - - - - - - - - - - - - - - - - - - - -
                    380
1197 [05] 183C      381  T2_DLY     PSHY
1199 [04] 18CEFFFF  382            LDY     #$FFFF
119D [04] 1809      383  T2D-LP     DEY
119F [03] 26FC      384            BNE     T2D-LP
11A1 [06] 1838      385            PULY
11A3 [05] 39        386            RTS
                    387
                    388  * - - - - - - - - - - - - - - - - - - - - - - - - - - - - -
                    389  * End of TIMER Subroutines
                    390  *=========================================================
                    391
11A4                392  $INCLUDE 'DISPLAY.ASM'          ;Include Display Subroutines
                    393  *=========================================================*
                    394  *   Peterson Tuner Display Subroutines                    *
                    395  *   Rev. 1.0 - 01/19/95                                   *
                    396  *   Written by  Robert S. Dobrose                         *
                    397  *   Saracon, Inc.                                         *
                    398  *     1135 Garfield Ave.                                  *
```

```
                    399  *     Libertyville, IL  60048                          *
                    400  *=================================================*
                    401  *   Modifications by  Robert S. Dobrose                *
                    402  *   Saracon, Inc.                                      *
                    403  *     1135 Garfield Ave.                               *
                    404  *     Libertyville, IL  60048                          *
                    405  *=================================================*
                    406  *   Release History                                    *
                    407  *   02/13/95  0.1 - Initial code revision              *
                    408  *=================================================*
                    409
                    410
                    411  *=================================================
                    412  * NAME:  DSP_INIT
                    413  * Subroutine: Display Initialization
                    414  * Written by: Robert S. Dobrose
                    415  * From Original In-Line Code by: John Pischl
                    416  * Purpose: This subroutine Initializes the LCD
                    417  *          display to the operational settings.
                    418  *   Input: NONE
                    419  *  Output: NONE
                    420  *   Notes: Modifies Accum-A
                    421  * - - - - - - - - - - - - - - - - - - - - - - - - - - -
                    422  DSP_INIT:
 11A4               423       EQU     *
                    424                                ;HARDWARE -----------
 11A4 [02] 8638     425       LDAA    #$38             ;Function set - 8 bits
                    426                                ;  2 lines
                    427                                ;  5x7
 11A6 [06] BD12E9   428       JSR     DSP_CMD
                    429
                    430  ; The following turns on the display with no cursor and blinking
cursor off
 11A9 [02] 860C     431       LDAA    #$0C             ;Turn display on
 11AB [06] BD12E9   432       JSR     DSP_CMD
                    433
                    434  ; The following sets the display to increment the cursor position each
time
                    435  ;   it receives a character but not scroll the display at the end
points!
 11AE [02] 8606     436       LDAA    #$06             ;Set entry mode - increment
                    437                                ;  accompanies display shift
 11B0 [06] BD12E9   438       JSR     DSP_CMD
 11B3 [05] 39       439       RTS
                    440
                    441  *=================================================
                    442  * NAME:  VERN_STR
                    443  * Subroutine: Create Vernier value string for display
                    444  * Written by: Robert S. Dobrose
                    445  * Purpose: This subroutine converts a 16 bit number to
                    446  *          a 3 digit (2 + 1 decimal place) ASCII string.
                    447  *   Input: rD contains the number
                    448  *  Output: rX = pointer to ASCII string in variable D_STR
                    449  *   Notes:
                    450  * - - - - - - - - - - - - - - - - - - - - - - - - - - -
                    451  VERN_STR:
 11B4               452       EQU     *
 11B4 [05] 183C     453       PSHY                     ;save rY
 11B6 [03] 37       454       PSHB                     ;save rB
 11B7 [03] 36       455       PSHA                     ;save rA
 11B8 [04] DD9E     456       STD     V_TEMP           ; Save value
 11BA [04] 18CE0082 457       LDY     #D_STR           ;Move string addr to Y
 11BE [05] 1A830000 458       CPD     #$0000
 11C2 [03] 2B0A     459       BMI     VS_NEG
 11C4 [03] 2704     460       BEQ     VS_ZERO
 11C6 [02] 862B     461       LDAA    #$2B             ; Load '+'
 11C8 [03] 200C     462       BRA     VS_SK1
                    463  VS_ZERO:
```

```
11CA [02] 8620        464      LDAA    #$20            ; Load ' ' (SPACE)
11CC [03] 2008        465      BRA     VS_SK1
                      466  VS_NEG:
11CE [02] 4F          467      CLRA
11CF [02] 5F          468      CLRB
11D0 [05] 939E        469      SUBD    V_TEMP          ; Negate value
11D2 [04] DD9E        470      STD     V_TEMP          ; and re-save
11D4 [02] 862D        471      LDAA    #$2D            ; Load '-'
                      472  VS_SK1:
11D6 [05] 18A700      473      STAA    0,Y             ; Store sign in string
11D9 [02] C605        474      LDAB    #!5             ; Get string length
11DB [04] 183A        475      ABY                     ; and add to Y
11DD [07] 186F00      476      CLR     0,Y             ;Terminate string with 0
11E0 [04] DE9E        477      LDX     V_TEMP          ; Load value into X
                      478
11E2 [04] 1809        479      DEY                     ; Point to next digit slot
11E4 [03] 8F          480      XGDX                    ;Transfer X to D
11E5 [03] CE000A      481      LDX     #!10            ; Set to divide by 10
11E8 [41] 02          482      IDIV
                      483      ; After divide, remainder in D (B) is 0 - 9
11E9 [02] CB30        484      ADDB    #$30            ; Convert to ASCII
11EB [06] 12420102    485      BRSET   DFLAGS,$01,VS_SK2       ; Check for vernier fraction
11EF [02] C620        486      LDAB    #$20            ; Load 'SPACE'
                      487  VS_SK2:
11F1 [05] 18E700      488      STAB    0,Y             ; Store ASCII digit in current slot
                      489
11F4 [04] 1809        490      DEY                     ; Point to next digit slot
11F6 [02] C62E        491      LDAB    #$2E            ; Load '.' (decimal point)
11F8 [06] 12420102    492      BRSET   DFLAGS,$01,VS_SK3       ; Check for vernier fraction
11FC [02] C620        493      LDAB    #$20            ; Load 'SPACE'
                      494  VS_SK3:
11FE [05] 18E700      495      STAB    0,Y             ; Store decimal point in current slot
                      496
1201 [04] 1809        497      DEY                     ; Point to next digit slot
1203 [03] 8F          498      XGDX                    ;Transfer X to D
1204 [03] CE000A      499      LDX     #!10            ; Set to divide by 10
1207 [41] 02          500      IDIV
                      501      ; After divide, remainder in D (B) is 0 - 9
1208 [02] CB30        502      ADDB    #$30            ; Convert to ASCII
120A [05] 18E700      503      STAB    0,Y             ; Store ASCII digit in current slot
                      504
120D [04] 1809        505      DEY                     ; Point to next digit slot
120F [03] 8F          506      XGDX                    ;Transfer X to D
1210 [03] CE000A      507      LDX     #!10            ; Set to divide by 10
1213 [41] 02          508      IDIV
                      509      ; After divide, remainder in D (B) is 0 - 9
1214 [02] CB30        510      ADDB    #$30            ; Convert to ASCII
1216 [05] 18E700      511      STAB    0,Y             ; Store ASCII digit in current slot
                      512
1219 [03] CE0082      513      LDX     #D_STR          ; Return pointer in Reg-X
121C [04] 32          514      PULA                    ;recover rA
121D [04] 33          515      PULB                    ;recover rB
121E [06] 1838        516      PULY                    ;recover rY
1220 [05] 39          517      RTS
                      518
                      519  *=========================================================
                      520  * NAME:  DEC_DSP
                      521  * Subroutine: Create decimal number string for display
                      522  * Written by: Robert S. Dobrose
                      523  * Purpose: This subroutine converts a 16 bit number to
                      524  *          a decimal ASCII string.
                      525  *   Input: rX contains the number
                      526  *          rA contains the pad char (usually '0' or SPACE)
                      527  *          rB contains the number of digits to display
                      528  *  Output: rX = pointer to ASCII string in variable D_STR
                      529  *   Notes:
                      530  * - - - - - - - - - - - - - - - - - - - - - - - - - - - - -
1221                  531  DEC_DSP      EQU     *
```

```
1221 [05] 183C        532        PSHY              ;save rY
1223 [03] 37          533        PSHB              ;save rB
1224 [03] 36          534        PSHA              ;save rA
1225 [03] 97A1        535        STAA    D_PAD     ;Save Pad char
1227 [04] 18CE0082    536        LDY     #D_STR    ;Move string addr to Y
122B [04] 183A        537        ABY               ;Set Y to end of string
122D [07] 186F00      538        CLR     0,Y       ;Terminate string with 0
                      539   DD_LP1:
1230 [04] 1809        540        DEY               ; Point to next digit slot
1232 [03] 8F          541        XGDX              ;Transfer X to D
1233 [03] CE000A      542        LDX     #!10      ; Set to divide by 10
1236 [41] 02          543        IDIV
                      544        ; After divide, remainder in D (B) is 0 - 9
1237 [02] CB30        545        ADDB    #$30      ; Convert to ASCII
1239 [05] 18E700      546        STAB    0,Y       ; Store ASCII digit in current slot
123C [05] 188C0082    547        CPY     #D_STR    ; Check if string full
1240 [03] 2712        548        BEQ     DD_DONE   ; If full, then DONE
1242 [04] 8C0000      549        CPX     #$0       ; Check if number = 0 (Done with digits)
1245 [03] 2EE9        550        BGT     DD_LP1
                      551        ; Done with digits, so just pad rest of string with pad char
1247 [03] D6A1        552        LDAB    D_PAD
                      553   DD_LP2:
1249 [04] 1809        554        DEY               ; Point to next digit slot
124B [05] 18E700      555        STAB    0,Y       ; Store pad char in current slot
124E [05] 188C0082    556        CPY     #D_STR    ; Check if string full
1252 [03] 26F5        557        BNE     DD_LP2    ; If not full, then loop
                      558
                      559   DD_DONE:
1254 [04] 32          560        PULA              ;recover rA
1255 [04] 33          561        PULB              ;recover rB
1256 [06] 1838        562        PULY              ;recover rY
1258 [03] CE0082      563        LDX     #D_STR    ; Return pointer in Reg-X
125B [05] 39          564        RTS
                      565
                      566   *=====================================================
                      567   * Subroutine: HEX_DSP
                      568   * Purpose: Hex display.  This subroutine converts a
                      569   *          16 bit binary number to it's ASCII value.
                      570   *   Input: rD contains the binary number (returned)
                      571   *  Output: ASCII string in variable D_STR
                      572   *   Notes:
                      573   * - - - - - - - - - - - - - - - - - - - - - - - - - - -
125C                  574   HEX_DSP   EQU     *
125C [05] 183C        575             PSHY                    ;save rY
125E [03] 36          576             PSHA                    ;save rA
125F [03] 37          577             PSHB                    ;save rB
1260 [04] 18CE0082    578             LDY     #D_STR          ;rY contains adrs of string
1264 [03] 36          579             PSHA
1265 [02] 84F0        580             ANDA    #$F0            ;Select MSBy
1267 [02] 44          581             LSRA                    ;Shift into lower 4 bits
1268 [02] 44          582             LSRA
1269 [02] 44          583             LSRA
126A [02] 44          584             LSRA
126B [02] 8109        585             CMPA    #$09
126D [03] 2E05        586             BGT     DSP_A1
126F [02] 8B30        587             ADDA    #$30            ;ASCII adjust
1271 [03] 7E1276      588             JMP     DSP_MSB
1274 [02] 8B37        589   DSP_A1    ADDA    #$37            ;rA > 9 ASCII adjust
1276 [05] 18A700      590   DSP_MSB   STAA    0,Y
                      591
1279 [04] 32          592             PULA
127A [02] 840F        593             ANDA    #$0F
127C [02] 8109        594             CMPA    #$09
127E [03] 2E05        595             BGT     DSP_A2
1280 [02] 8B30        596             ADDA    #$30            ;ASCII adjust
1282 [03] 7E1287      597             JMP     DSP_2SB
1285 [02] 8B37        598   DSP_A2    ADDA    #$37            ;rA > 9 ASCII adjust
1287 [05] 18A701      599   DSP_2SB   STAA    1,Y
```

```
                        600
128A [03] 37            601            PSHB
128B [02] C4F0          602            ANDB   #$F0          ;Select 3SBy
128D [02] 54            603            LSRB                  ;Shift into lower 4 bits
128E [02] 54            604            LSRB
128F [02] 54            605            LSRB
1290 [02] 54            606            LSRB
1291 [02] C109          607            CMPB   #$09
1293 [03] 2E05          608            BGT    DSP_A3
1295 [02] CB30          609            ADDB   #$30          ;ASCII adjust
1297 [03] 7E129C        610            JMP    DSP_3SB
129A [02] CB37          611  DSP_A3    ADDB   #$37          ;rA > 9 ASCII adjust
129C [05] 18E702        612  DSP_3SB   STAB   2,Y
                        613
129F [04] 33            614            PULB
12A0 [02] C40F          615            ANDB   #$0F
12A2 [02] C109          616            CMPB   #$09
12A4 [03] 2E05          617            BGT    DSP_A4
12A6 [02] CB30          618            ADDB   #$30          ;ASCII adjust
12A8 [03] 7E12AD        619            JMP    DSP_4SB
12AB [02] CB37          620  DSP_A4    ADDB   #$37          ;rA > 9 ASCII adjust
12AD [05] 18E703        621  DSP_4SB   STAB   3,Y
                        622
12B0 [02] C600          623            LDAB   #$00          ;terminate string
12B2 [05] 18E704        624            STAB   4,Y
                        625
12B5 [04] 33            626            PULB                 ;recover rB
12B6 [04] 32            627            PULA                 ;recover rA
12B7 [06] 1838          628            PULY                 ;recover rY
12B9 [03] CE0082        629       LDX     #D_STR  ; Return pointer in Reg-X
12BC [05] 39            630            RTS
                        631
                        632  *=========================================================
                        633  * NAME:  DSP_STR
                        634  *        LINE1
                        635  *        LINE2
                        636  *        LINE3
                        637  *        LINE4
                        638  * Subroutine: Display Output Subroutines
                        639  * Written by: John Pischl
                        640  * Modified by: Robert S. Dobrose
                        641  * Purpose: These subroutines are used to write data
                        642  *          on the LCD display.
                        643  *   Input: rX contains the message address
                        644  *  Output: none
                        645  *   Notes: Entry into the subroutine determines the
                        646  *          display line written to.  All message must
                        647  *          be 20 characters long, to overwrite any
                        648  *          existing data.  Message strings must be
                        649  *          terminated with a null character.
                        650  * - - - - - - - - - - - - - - - - - - - - - - - - - - - -
                        651
                        652                                  ;DISPLAY TESTS
12BD                    653  DSP_STR   EQU    *             ;Current cursor position entry
12BD [03] 36            654            PSHA
12BE [03] 7E12DA        655            JMP    DSP_CONT
                        656
12C1                    657  LINE1     EQU    *             ;line 1 entry
12C1 [03] 36            658            PSHA                 ;save rA - use rA to data
12C2 [02] 8680          659            LDAA   #$80
12C4 [03] 7E12D6        660            JMP    SET_LN
                        661
12C7                    662  LINE2     EQU    *             ;line 2 entry
12C7 [03] 36            663            PSHA
12C8 [02] 86C0          664            LDAA   #$C0
12CA [03] 7E12D6        665            JMP    SET_LN
                        666
12CD                    667  LINE3     EQU    *             ;line 3 entry
```

```
12CD [03] 36          668            PSHA
12CE [02] 8694        669            LDAA   #$94
12D0 [03] 7E12D6      670            JMP    SET_LN
                      671
12D3                  672  LINE4     EQU    *              ;line 4 entry
12D3 [03] 36          673            PSHA
12D4 [02] 86D4        674            LDAA   #$D4
                      675
12D6 [06] BD12E9      676  SET_LN       JSR     DSP_CMD          ;position cursor
12D9 [02] 01          677       NOP
                      678
12DA [04] A600        679  DSP_CONT  LDAA   0,X            ;load data
12DC [02] 8100        680            CMPA   #$00           ;test for end of string
12DE [03] 2707        681            BEQ    DSP_DONE
                      682
12E0 [03] 08          683            INX
12E1 [06] BD12EE      684            JSR    DSP_CHR
12E4 [03] 7E12DA      685            JMP    DSP_CONT
                      686
12E7 [04] 32          687  DSP_DONE  PULA
12E8 [05] 39          688            RTS
                      689
                      690  * - - - - - - - - - - - - - - - - - - - - - - - - - - - - - -
                      691
                      692  *=========================================================
                      693  * NAME:  DSP_DLY
                      694  * Subroutine: Display Delay Subroutine
                      695  * Purpose:
                      696  * Written by: John Pischl
                      697  *   Input: none
                      698  *  Output: none
                      699  *   Notes:
                      700  * - - - - - - - - - - - - - - - - - - - - - - - - - - - - - -
                      701
                      702  DSP_CMD:
12E9 [04] B7E006      703       STAA    LCD_C            ; send command to display
12EC [03] 2003        704       BRA     DSP_DLY
                      705  DSP_CHR:
12EE [04] B7E007      706       STAA    LCD_D            ; send char to display
                      707  DSP_DLY:
12F1 [03] 36          708       PSHA
12F2 [02] 8640        709       LDAA    #$40
12F4 [02] 4A          710  DD_X1:       DECA
12F5 [03] 26FD        711       BNE     DD_X1
                      712
12F7 [04] 32          713       PULA
12F8 [05] 39          714       RTS
                      715
                      716  * - - - - - - - - - - - - - - - - - - - - - - - - - - - - - -
                      717  *=========================================================
                      718  * NAME:  DSP_CLR
                      719  * Subroutine: Display Clear Subroutine
                      720  * Written by: Robert S. Dobrose
                      721  * Purpose: Clear the LCD display
                      722  *   Input: none
                      723  *  Output: none
                      724  *   Notes:
                      725  * - - - - - - - - - - - - - - - - - - - - - - - - - - - - - -
                      726
                      727  DSP_CLR:
12F9                  728       EQU     *
12F9 [03] 36          729       PSHA
                      730
12FA [02] 8601        731       LDAA    #$01             ; CLEAR DISPLAY command
12FC [06] BD12E9      732       JSR     DSP_CMD
                      733
12FF [02] 8620        734       LDAA    #$20             ; Set up to wait a long time (~5msec)
1301 [06] BD12F1      735  DC_X1:       JSR     DSP_DLY
```

```
1304 [02] 4A          736        DECA
1305 [03] 26FA        737        BNE      DC_X1
                      738
1307 [04] 32          739        PULA
1308 [05] 39          740        RTS
                      741
                      742  * - - - - - - - - - - - - - - - - - - - - - - - - - - - - - -
                      743  *=====================================================
                      744  * NAME:  DSP_CUR
                      745  * Subroutine: Set Display Cursor Position Subroutine
                      746  * Written by: Robert S. Dobrose
                      747  * Purpose: Set the cursor position on the LCD Display
                      748  *   Input: Accum-A = Line #,  Accum-B = Column #
                      749  *            Line = 0 - 3        Column = 0 - 19
                      750  *  Output: none
                      751  *   Notes:
                      752  * - - - - - - - - - - - - - - - - - - - - - - - - - - - - - -
                      753
                      754  DSP_CUR:
1309                  755        EQU      *
1309 [03] 36          756        PSHA
130A [03] 37          757        PSHB
130B [02] 16          758        TAB
130C [02] 8680        759        LDAA     #$80            ; Start of line 0 or 2 is $80
130E [02] C501        760        BITB     #$01            ; Test for line 1 or 3
1310 [03] 2702        761        BEQ      SC_X1
1312 [02] 86C0        762        LDAA     #$C0            ; Start of line 1 or 3 is $C0
                      763  SC_X1:
1314 [02] C502        764        BITB     #$02            ; Test for line 2 or 3
1316 [03] 2702        765        BEQ      SC_X2
1318 [02] 8B14        766        ADDA     #$14            ; Start of line 2 or 3 is 20 chars offset
                      767  SC_X2:
131A [04] 33          768        PULB                     ; Restore original Accum-B
131B [02] 1B          769        ABA                      ; Add Column offset (Accum-B) to Accum-A
131C [06] BD12E9      770        JSR      DSP_CMD
                      771
131F [04] 32          772        PULA                     ; Restore original Accum-A
1320 [05] 39          773        RTS
                      774
                      775  * - - - - - - - - - - - - - - - - - - - - - - - - - - - - - -
                      776  *=====================================================
                      777  * NAME:  CUR_ON
                      778  * Subroutine: Turn Display Cursor ON
                      779  * Written by: Robert S. Dobrose
                      780  * Purpose: Turn the display cursor ON
                      781  *   Input: none
                      782  *  Output: none
                      783  *   Notes:
                      784  * - - - - - - - - - - - - - - - - - - - - - - - - - - - - - -
                      785  CUR_ON:
1321                  786        EQU      *
1321 [03] 36          787        PSHA
1322 [02] 860E        788        LDAA     #$0E            ; Set display and cursor ON
1324 [06] BD12E9      789        JSR      DSP_CMD
1327 [04] 32          790        PULA                     ; Restore original Accum-A
1328 [05] 39          791        RTS
                      792  * - - - - - - - - - - - - - - - - - - - - - - - - - - - - - -
                      793  *=====================================================
                      794  * NAME:  CUR_OFF
                      795  * Subroutine: Turn Display Cursor OFF
                      796  * Written by: Robert S. Dobrose
                      797  * Purpose: Turn the display cursor OFF
                      798  *   Input: none
                      799  *  Output: none
                      800  *   Notes:
                      801  * - - - - - - - - - - - - - - - - - - - - - - - - - - - - - -
                      802  CUR_OFF:
1329                  803        EQU      *
```

```
1329 [03] 36          804        PSHA
132A [02] 860C        805        LDAA    #$0C            ; Display ON and cursor OFF
132C [06] BD12E9      806        JSR     DSP_CMD
132F [04] 32          807        PULA                    ; Restore original Accum-A
1330 [05] 39          808        RTS
                      809  * - - - - - - - - - - - - - - - - - - - - - - - - - - - -
                      810
                      811
1331                  812  $INCLUDE 'SUBR.ASM'             ;Include General Purpose Subroutines
                      813  *=====================================================*
                      814  *   Peterson Tuner I/O and Select Subroutines          *
                      815  *   Written by: Robert S. Dobrose                      *
                      816  *   Saracon, Inc.                                      *
                      817  *     1135 Garfield Ave.                               *
                      818  *     Libertyville, IL  60048                          *
                      819  *=====================================================*
                      820  *   Release History                                    *
                      821  *   02/14/95  1.0  - Initial Code                      *
                      822  *=====================================================*
                      823
                      824
                      825  *=====================================================
                      826  * Name:  WAIT_NONE
                      827  * Subroutine: Wait for no keys pressed
                      828  * Written by: Robert S. Dobrose
                      829  * Purpose: Waits for all function keys (& JOG & MODE)
                      830  *            to be released.  Inputs are debounced to
                      831  *            three samples each 0.01 seconds apart.
                      832  *   Input: none
                      833  *  Output: none
                      834  *   Notes: This subroutine has a LONG delay in it
                      835  *            (>20 milliseconds).
                      836  * - - - - - - - - - - - - - - - - - - - - - - - - - - - -
                      837
                      838  WAIT_NONE:
1331                  839       EQU     *
1331 [03] 36          840       PSHA
1332 [04] 3C          841       PSHX
                      842  WAIT_X1:
1333 [04] B6E002      843       LDAA    PANEL           ; ** First Sample
1336 [02] 43          844       COMA                    ; Invert Input data
1337 [03] 26FA        845       BNE     WAIT_X1         ; Branch while any keys hit
1339 [04] B6E003      846       LDAA    AUX_IRQ         ; ** First Sample
133C [02] 43          847       COMA                    ; Invert Input data
133D [03] 26F4        848       BNE     WAIT_X1         ; Branch while any keys hit
133F [03] CE0001      849       LDX     #$1             ; Set for 1 tick wait
1342 [06] BD1178      850       JSR     TIMER
                      851
1345 [04] B6E002      852       LDAA    PANEL           ; ** Second Sample
1348 [02] 43          853       COMA                    ; Invert Input data
1349 [03] 26E8        854       BNE     WAIT_X1         ; Branch while any keys hit
134B [04] B6E003      855       LDAA    AUX_IRQ         ; ** First Sample
134E [02] 43          856       COMA                    ; Invert Input data
134F [03] 26E2        857       BNE     WAIT_X1         ; Branch while any keys hit
1351 [03] CE0001      858       LDX     #$1             ; Set for 1 tick wait
1354 [06] BD1178      859       JSR     TIMER
                      860
1357 [04] B6E002      861       LDAA    PANEL           ; ** Third Sample
135A [02] 43          862       COMA                    ; Invert Input data
135B [03] 26D6        863       BNE     WAIT_X1         ; Branch while any keys hit
135D [04] B6E003      864       LDAA    AUX_IRQ         ; ** First Sample
1360 [02] 43          865       COMA                    ; Invert Input data
1361 [03] 26D0        866       BNE     WAIT_X1         ; Branch while any keys hit
                      867
1363 [05] 38          868       PULX
1364 [04] 32          869       PULA
1365 [05] 39          870       RTS
                      871
```

```
                    872  *=====================================================
                    873  * Name:  GET_KEY
                    874  * Subroutine: Get PANEL Key input data
                    875  * Written by: Robert S. Dobrose
                    876  * Purpose: Waits for all function keys (& JOG & MODE)
                    877  *            to be stable (identical data) for
                    878  *            three samples each 0.01 seconds apart.
                    879  *   Input: none
                    880  *  Output: Accum-A returns stable PANEL register data
                    881  *   Notes: This subroutine has a LONG delay in it
                    882  *            (>20 milliseconds).
                    883  *          This routine returns as soon as inputs are
                    884  *            stable (even if they are all = 0)
                    885  *       ** Accum-A is modified!
                    886  * - - - - - - - - - - - - - - - - - - - - - - - - - - -
                    887
                    888  GET_KEY:
1366                889       EQU     *
1366 [03] 37        890       PSHB
1367 [04] 3C        891       PSHX
1368 [04] B6E002    892       LDAA    PANEL           ; ** First Sample
                    893  GETK_X1:
136B [02] 16        894       TAB                     ; Save latest unique sample
136C [03] CE0001    895       LDX     #$1             ; Set for 1 tick wait
136F [06] BD1178    896       JSR     TIMER
                    897
1372 [04] B6E002    898       LDAA    PANEL           ; ** Second Sample
1375 [02] 11        899       CBA                     ; Compare Samples
1376 [03] 26F3      900       BNE     GETK_X1         ; Branch while not identical
1378 [03] CE0001    901       LDX     #$1             ; Set for 1 tick wait
137B [06] BD1178    902       JSR     TIMER
                    903
137E [04] B6E002    904       LDAA    PANEL           ; ** Third Sample
1381 [02] 11        905       CBA                     ; Compare Samples
1382 [03] 26E7      906       BNE     GETK_X1         ; Branch while not identical
                    907
1384 [02] 43        908       COMA                    ; Invert Input data
1385 [05] 38        909       PULX
1386 [04] 33        910       PULB
1387 [05] 39        911       RTS
                    912
                    913  *=====================================================
                    914  * Name:  WAIT_KEY
                    915  * Subroutine: Wait a time period for PANEL Key input data
                    916  * Written by: Robert S. Dobrose
                    917  * Purpose: Waits a given time while monitoring the PANEL
                    918  *            register for a stable active input.  Allowed
                    919  *            inputs are designated with a mask value.
                    920  *   Input: Accum-A is allowed input mask.
                    921  *          Register-Y is timeout (maximum) delay time
                    922  *  Output: Accum-A returns stable PANEL register data
                    923  *            or 0 if timeout expired.
                    924  *   Notes: The timing of this routine is approximate
                    925  *            and will actually be slightly longer than
                    926  *            specified due to instructions between 0.01
                    927  *            second time slices.
                    928  *       ** Accum-A is modified!
                    929  * - - - - - - - - - - - - - - - - - - - - - - - - - - -
                    930
                    931  WAIT_KEY:
1388                932       EQU     *
1388 [03] 37        933       PSHB
1389 [05] 183C      934       PSHY
138B [04] 3C        935       PSHX
138C [03] 97A0      936       STAA    D1TEMP          ; Store mask in temp location
                    937  WK_X0:
138E [04] B6E002    938       LDAA    PANEL           ; ** First Sample
1391 [02] 43        939       COMA                    ; Invert Input data
```

```
1392 [03] 94A0      940        ANDA    D1TEMP          ; Mask off unused inputs
                    941  WK_X1:
1394 [02] 16        942        TAB                     ; Save latest unique sample
1395 [03] CE0001    943        LDX     #$1             ; Set for 1 tick wait
1398 [06] BD1178    944        JSR     TIMER
139B [04] 1809      945        DEY
139D [03] 2721      946        BEQ     WK_OUT          ; Time out!
139F [02] 5D        947        TSTB
13A0 [03] 27EC      948        BEQ     WK_X0           ; Sample while no active inputs
                    949
13A2 [04] B6E002    950        LDAA    PANEL           ; ** Second Sample
13A5 [02] 43        951        COMA                    ; Invert Input data
13A6 [03] 94A0      952        ANDA    D1TEMP          ; Mask off unused inputs
13A8 [02] 11        953        CBA                     ; Compare Samples
13A9 [03] 26E9      954        BNE     WK_X1           ; Branch while not identical
13AB [03] CE0001    955        LDX     #$1             ; Set for 1 tick wait
13AE [06] BD1178    956        JSR     TIMER
13B1 [04] 1809      957        DEY
13B3 [03] 270B      958        BEQ     WK_OUT          ; Time out!
                    959
13B5 [04] B6E002    960        LDAA    PANEL           ; ** Third Sample
13B8 [02] 43        961        COMA                    ; Invert Input data
13B9 [03] 94A0      962        ANDA    D1TEMP          ; Mask off unused inputs
13BB [02] 11        963        CBA                     ; Compare Samples
13BC [03] 26D6      964        BNE     WK_X1           ; Branch while not identical
                    965
13BE [03] 2001      966        BRA     WK_DONE         ; Stable data in Accum-A
                    967  WK_OUT:
13C0 [02] 4F        968        CLRA                    ; Timed out!  Return 0!
                    969  WK_DONE:
13C1 [05] 38        970        PULX
13C2 [06] 1838      971        PULY
13C4 [04] 33        972        PULB
13C5 [05] 39        973        RTS
                    974
                    975  *=====================================================
                    976  * Name:  GET_AUX
                    977  * Subroutine: Get AUX_IRQ input data
                    978  * Written by: Robert S. Dobrose
                    979  * Purpose: Waits for all auxilliary inputs
                    980  *            to be stable (identical data) for
                    981  *            three samples each 0.01 seconds apart.
                    982  *   Input: none
                    983  *  Output: Accum-A returns stable AUX_IRQ register data
                    984  *   Notes: This subroutine has a LONG delay in it
                    985  *            (>20 milliseconds).
                    986  *          This routine returns as soon as inputs are
                    987  *            stable (even if they are all = 0)
                    988  *       ** Accum-A is modified!
                    989  * - - - - - - - - - - - - - - - - - - - - - - - - - - -
                    990
                    991  GET_AUX:
13C6                992        EQU     *
13C6 [03] 37        993        PSHB
13C7 [04] 3C        994        PSHX
13C8 [04] B6E003    995        LDAA    AUX_IRQ         ; ** First Sample
                    996  GETA_X1:
13CB [02] 16        997        TAB                     ; Save latest unique sample
13CC [03] CE0001    998        LDX     #$1             ; Set for 1 tick wait
13CF [06] BD1178    999        JSR     TIMER
                   1000
13D2 [04] B6E003   1001        LDAA    AUX_IRQ         ; ** Second Sample
13D5 [02] 11       1002        CBA                     ; Compare Samples
13D6 [03] 26F3     1003        BNE     GETA_X1         ; Branch while not identical
13D8 [03] CE0001   1004        LDX     #$1             ; Set for 1 tick wait
13DB [06] BD1178   1005        JSR     TIMER
                   1006
13DE [04] B6E003   1007        LDAA    AUX_IRQ         ; ** Third Sample
```

```
13E1 [02] 11        1008        CBA                     ; Compare Samples
13E2 [03] 26E7      1009        BNE     GETA_X1         ; Branch while not identical
                    1010
13E4 [02] 43        1011        COMA                    ; Invert Input data
13E5 [05] 38        1012        PULX
13E6 [04] 33        1013        PULB
13E7 [05] 39        1014        RTS
                    1015
                    1016  *=====================================================
                    1017  * Name:  OP_SCR
                    1018  * Subroutine: Display OPERATIONAL screen
                    1019  * Written by: Robert S. Dobrose
                    1020  * Purpose: Displays the RUN MODE screen
                    1021  *   Input: none
                    1022  *  Output: none
                    1023  *   Notes:
                    1024  * - - - - - - - - - - - - - - - - - - - - - - - - - -
                    1025
                    1026  OP_SCR:
13E8                1027        EQU     *
13E8 [04] 3C        1028        PSHX
13E9 [03] CE60D2    1029        LDX     #MSG011         ;Load Operational message
13EC [06] BD12C1    1030        JSR     LINE1
13EF [03] CE60E7    1031        LDX     #MSG012
13F2 [06] BD12C7    1032        JSR     LINE2
13F5 [03] CE60FC    1033        LDX     #MSG013
13F8 [06] BD12CD    1034        JSR     LINE3
13FB [03] CE6111    1035        LDX     #MSG014
13FE [06] BD12D3    1036        JSR     LINE4
1401 [05] 38        1037        PULX
1402 [05] 39        1038        RTS
                    1039
                    1040  *=====================================================
                    1041  * Name:  TRY_AGAIN
                    1042  * Subroutine: "TRY AGAIN?" user choice screen
                    1043  * Written by: Robert S. Dobrose
                    1044  * Purpose: Displays the "STORAGE ERROR, TRY AGAIN?" screen
                    1045  *            and waits for user to select F1 for YES or
                    1046  *            F4 for NO.
                    1047  *   Input: none
                    1048  *  Output: Accum-B contains 0 for NO, non-0 for YES
                    1049  *   Notes:
                    1050  * - - - - - - - - - - - - - - - - - - - - - - - - - -
                    1051  TRY_AGAIN:
1403                1052        EQU     *
1403 [03] 36        1053        PSHA
1404 [06] BD1331    1054        JSR     WAIT_NONE       ; Wait for no keys pressed
                    1055        ; display TRY AGAIN? screen
1407 [03] CE7CC4    1056        LDX     #E_MSG1
140A [06] BD12C1    1057        JSR     LINE1
140D [03] CE7CD9    1058        LDX     #E_MSG2
1410 [06] BD12C7    1059        JSR     LINE2
1413 [03] CE7CEE    1060        LDX     #E_MSG3
1416 [06] BD12CD    1061        JSR     LINE3
1419 [03] CE607E    1062        LDX     #MSG004
141C [06] BD12D3    1063        JSR     LINE4
141F [02] 5F        1064        CLRB                    ; Default to NO
                    1065  TA_LP0:
1420 [06] BD1366    1066        JSR     GET_KEY         ; Get PANEL Inputs
1423 [02] 8409      1067        ANDA    #$09            ; Mask off all but F1 & F4 keys
1425 [03] 27F9      1068        BEQ     TA_LP0          ; Branch while no keys hit
                    1069
1427 [02] 8101      1070        CMPA    #$01            ; Test for F1 key (YES)
1429 [03] 2604      1071        BNE     TA_SK1          ; If not F1, continue
142B [02] C601      1072        LDAB    #$1             ; Set result to YES
142D [03] 2009      1073        BRA     TA_OUT          ; and return
                    1074  TA_SK1:
142F [02] 8108      1075        CMPA    #$08            ; Test for F4 key (NO)
```

```
1431 [03] 2603      1076        BNE     TA_SK2          ; If not F4, continue loop
1433 [02] 5F        1077        CLRB                    ; Set result to NO
1434 [03] 2002      1078        BRA     TA_OUT          ; and return
                    1079  TA_SK2:
1436 [03] 20E8      1080        BRA     TA_LP0          ; Loop until Function key is hit
                    1081
                    1082  TA_OUT:
1438 [04] 32        1083        PULA
1439 [05] 39        1084        RTS
                    1085
                    1086  *=====================================================
                    1087  * Name:  SLCT_ON_OFF
                    1088  * Subroutine: "ON/OFF" user choice screen
                    1089  * Written by: Robert S. Dobrose
                    1090  * Purpose: Displays the current (default) value in Reg-B
                    1091  *            and waits for user to select F4 for ON or
                    1092  *            F3 for OFF.  F1 will accept & return.
                    1093  *            F2 will accept with different return code.
                    1094  *   Input: Accum-B contains default value for choice.
                    1095  *  Output: Accum-B contains 0 for OFF, non-0 for ON
                    1096  *          Accum-A contains keyhit code
                    1097  *   Notes:
                    1098  * - - - - - - - - - - - - - - - - - - - - - - - - - - - -
                    1099  SLCT_ON_OFF:
143A                1100        EQU     *
143A [04] 3C        1101        PSHX
                    1102  SOF_LP0:
                    1103        ; Display current value text
143B [03] 37        1104        PSHB
143C [02] 8601      1105        LDAA    #!1             ; Line 1
143E [02] C60F      1106        LDAB    #!15            ; Column 15
1440 [06] BD1309    1107        JSR     DSP_CUR         ; Position Cursor
1443 [04] 33        1108        PULB
1444 [02] 5D        1109        TSTB
1445 [03] 2705      1110        BEQ     SOF_DSK1
1447 [03] CE6256    1111        LDX     #MSG034         ; Set up ON message
144A [03] 2003      1112        BRA     SOF_DSK2
                    1113  SOF_DSK1:
144C [03] CE625A    1114        LDX     #MSG035         ; Set up OFF message
                    1115  SOF_DSK2:
144F [06] BD12BD    1116        JSR     DSP_STR         ; and display it
1452 [06] BD1331    1117        JSR     WAIT_NONE       ; Wait for no keys pressed
                    1118  SOF_LP1:
1455 [06] BD1366    1119        JSR     GET_KEY         ; Get PANEL Inputs
1458 [02] 840F      1120        ANDA    #$0F            ; Mask off all but Function keys
145A [03] 27F9      1121        BEQ     SOF_LP1         ; Branch while no keys hit
                    1122
145C [02] 8101      1123        CMPA    #$01            ; Test for F1 key (CONT)
145E [03] 2602      1124        BNE     SOF_SK1         ; If not F1, continue
1460 [03] 2013      1125        BRA     SOF_OUT         ; CONT (F1) selected so return
                    1126  SOF_SK1:
1462 [02] 8102      1127        CMPA    #$02            ; Test for F2 key (RUN)
1464 [03] 2602      1128        BNE     SOF_SK2         ; If not F2, continue
1466 [03] 200D      1129        BRA     SOF_OUT         ; CONT (F2) selected so return
                    1130  SOF_SK2:
1468 [02] 8104      1131        CMPA    #$04            ; Test for F3 key (OFF)
146A [03] 2601      1132        BNE     SOF_SK3         ; If not F3, continue
146C [02] 5F        1133        CLRB                    ; Set result to OFF
                    1134  SOF_SK3:
146D [02] 8108      1135        CMPA    #$08            ; Test for F4 key (ON)
146F [03] 2602      1136        BNE     SOF_SK4         ; If not F4, continue loop
1471 [02] C601      1137        LDAB    #$1             ; Set result to ON
                    1138  SOF_SK4:
1473 [03] 20C6      1139        BRA     SOF_LP0         ; Loop until Function key is hit
                    1140  SOF_OUT:
1475 [05] 38        1141        PULX
1476 [05] 39        1142        RTS
                    1143
```

```
                    *=====================================================
                    * Name:  SLCT_HI_LOW
                    * Subroutine: "HI/LOW" user choice screen
                    * Written by: Robert S. Dobrose
                    * Purpose: Displays the current (default) value in Reg-B
                    *            and waits for user to select F4 for HI or
                    *            F3 for LOW.  F1 will accept & return.
                    *            F2 will accept with different return code.
                    *   Input: Accum-B contains default value for choice.
                    *  Output: Accum-B contains 0 for LOW, non-0 for HI
                    *          Accum-A contains keyhit code
                    *   Notes:
                    * - - - - - - - - - - - - - - - - - - - - - - - - - - - -
                    SLCT_HI_LOW:
1477                     EQU     *
1477 [04] 3C             PSHX
                    SHL_LP0:
                         ; Display current value text
1478 [03] 37             PSHB
1479 [02] 8601           LDAA    #!1             ; Line 1
147B [02] C60F           LDAB    #!15            ; Column 15
147D [06] BD1309         JSR     DSP_CUR         ; Position Cursor
1480 [04] 33             PULB
1481 [02] 5D             TSTB
1482 [03] 2705           BEQ     SHL_DSK1
1484 [03] CE630A         LDX     #MSG049         ; Set up HI message
1487 [03] 2003           BRA     SHL_DSK2
                    SHL_DSK1:
1489 [03] CE6306         LDX     #MSG048         ; Set up LOW message
                    SHL_DSK2:
148C [06] BD12BD         JSR     DSP_STR         ; and display it
148F [06] BD1331         JSR     WAIT_NONE       ; Wait for no keys pressed
                    SHL_LP1:
1492 [06] BD1366         JSR     GET_KEY         ; Get PANEL Inputs
1495 [02] 840F           ANDA    #$0F            ; Mask off all but Function keys
1497 [03] 27F9           BEQ     SHL_LP1         ; Branch while no keys hit
                    
1499 [02] 8101           CMPA    #$01            ; Test for F1 key (CONT)
149B [03] 2602           BNE     SHL_SK1         ; If not F1, continue
149D [03] 2019           BRA     SHL_OUT         ; CONT (F1) selected so return
                    SHL_SK1:
149F [02] 8102           CMPA    #$02            ; Test for F2 key (RUN)
14A1 [03] 2602           BNE     SHL_SK2         ; If not F2, continue
14A3 [03] 2013           BRA     SHL_OUT         ; CONT (F2) selected so return
                    SHL_SK2:
14A5 [02] 8104           CMPA    #$04            ; Test for F3 key (LOW)
14A7 [03] 2604           BNE     SHL_SK3         ; If not F3, continue
14A9 [02] 5F             CLRB                    ; Set result to LOW
14AA [04] F7E004         STAB    OUTPUTS
                    SHL_SK3:
14AD [02] 8108           CMPA    #$08            ; Test for F4 key (HI)
14AF [03] 2605           BNE     SHL_SK4         ; If not F4, continue loop
14B1 [02] C601           LDAB    #$1             ; Set result to HI
14B3 [04] F7E004         STAB    OUTPUTS
                    SHL_SK4:
14B6 [03] 20C0           BRA     SHL_LP0         ; Loop until Function key is hit
                    SHL_OUT:
14B8 [05] 38             PULX
14B9 [05] 39             RTS
                    
                    *=====================================================
                    * Name:  SLCT_FST_SLO
                    * Subroutine: "FAST/SLOW" user change screen
                    * Written by: Robert S. Dobrose
                    * Purpose: Displays the current (default) value in Reg-B
                    *            and waits for user to select F4 to decrement
                    *            (FASTER) or F3 to increment (SLOWER).
                    *            F1 will accept & return.
```

```
                    1212  *            F2 will accept with different return code.
                    1213  *   Input: Accum-B contains default value for choice.
                    1214  *  Output: Accum-B contains Result of changes.
                    1215  *          Accum-A contains keyhit code
                    1216  *   Notes:  This routine will limit the value of the
                    1217  *             change value between 1 and 99.
                    1218  * - - - - - - - - - - - - - - - - - - - - - - - - - - - -
                    1219  SLCT_FST_SLO:
14BA                1220       EQU     *
14BA [04] 3C        1221       PSHX
                    1222  SFS_LP0:
                    1223       ; Limit value of Accum-B to between 1 and 99
14BB [02] 5D        1224       TSTB
14BC [03] 2E02      1225       BGT     SFS_LSK1
14BE [02] C601      1226       LDAB    #!1             ; Limit lower to 1
                    1227  SFS_LSK1:
14C0 [02] C163      1228       CMPB    #!99
14C2 [03] 2F02      1229       BLE     SFS_LSK2
14C4 [02] C663      1230       LDAB    #!99            ; Limit upper to 99
                    1231  SFS_LSK2:
                    1232       ; Display current value text
14C6 [03] 37        1233       PSHB
14C7 [02] 8601      1234       LDAA    #!1             ; Line 1
14C9 [02] C60E      1235       LDAB    #!14            ; Column 14
14CB [06] BD1309    1236       JSR     DSP_CUR         ; Position Cursor
14CE [04] 33        1237       PULB
14CF [03] 37        1238       PSHB
                    1239       ; Convert number in Accum-B to numeric string
14D0 [03] CE0000    1240       LDX     #$0
14D3 [03] 3A        1241       ABX
                    1242       ; Convert value in Reg-X as decimal value
14D4 [02] 8620      1243       LDAA    #$20            ; Pad with SPACE
14D6 [02] C602      1244       LDAB    #$2             ; Do 2 digits
14D8 [06] BD1221    1245       JSR     DEC_DSP         ; Convert to decimal ASCII string
14DB [06] BD12BD    1246       JSR     DSP_STR         ; and display it
14DE [04] 33        1247       PULB
14DF [06] BD1331    1248       JSR     WAIT_NONE       ; Wait for no keys pressed
                    1249  SFS_LP1:
14E2 [06] BD1366    1250       JSR     GET_KEY         ; Get PANEL Inputs
14E5 [02] 840F      1251       ANDA    #$0F            ; Mask off all but Function keys
14E7 [03] 27F9      1252       BEQ     SFS_LP1         ; Branch while no keys hit
                    1253
14E9 [02] 8101      1254       CMPA    #$01            ; Test for F1 key (CONT)
14EB [03] 2602      1255       BNE     SFS_SK1         ; If not F1, continue
14ED [03] 2012      1256       BRA     SFS_OUT         ; CONT (F1) selected so return
                    1257  SFS_SK1:
14EF [02] 8102      1258       CMPA    #$02            ; Test for F2 key (RUN)
14F1 [03] 2602      1259       BNE     SFS_SK2         ; If not F2, continue
14F3 [03] 200C      1260       BRA     SFS_OUT         ; CONT (F2) selected so return
                    1261  SFS_SK2:
14F5 [02] 8104      1262       CMPA    #$04            ; Test for F3 key (SLOW)
14F7 [03] 2601      1263       BNE     SFS_SK3         ; If not F3, continue
14F9 [02] 5C        1264       INCB                    ; Increment value
                    1265  SFS_SK3:
14FA [02] 8108      1266       CMPA    #$08            ; Test for F4 key (FAST)
14FC [03] 2601      1267       BNE     SFS_SK4         ; If not F4, continue loop
14FE [02] 5A        1268       DECB                    ; Decrement value
                    1269  SFS_SK4:
14FF [03] 20BA      1270       BRA     SFS_LP0         ; Loop until Function key is hit
                    1271  SFS_OUT:
1501 [05] 38        1272       PULX
1502 [05] 39        1273       RTS
                    1274
                    1275  *=========================================================
                    1276  * Name:  SLCT_UP_DOWN
                    1277  * Subroutine: "UP/DOWN" user change screen
                    1278  * Written by: Robert S. Dobrose
                    1279  * Purpose: Displays the current (default) value in Reg-X
```

```
                    *            and waits for user to select F4 to increment
                    *            or F3 to decrement.
                    *            F1 will accept & return.
                    *            F2 will accept with different return code.
                    *   Input: Reg-X contains default value for choice.
                    *  Output: Reg-X contains Result of changes.
                    *          Accum-A contains keyhit code
                    *   Notes:  This routine will limit the value of the
                    *             change value between 100 and 999.
                    * - - - - - - - - - - - - - - - - - - - - - - - - - - - - - -
                    SLCT_UP_DOWN:
1503                     EQU     *
1503 [03] 37             PSHB
                    SUD_LP0:
                         ; Limit value of Reg-X to between 350 and 550
1504 [04] 8C015E         CPX     #!350
1507 [03] 2C03           BGE     SUD_LSK1
1509 [03] CE015E         LDX     #!350           ; Limit lower to 350
                    SUD_LSK1:
150C [04] 8C0226         CPX     #!550
150F [03] 2F03           BLE     SUD_LSK2
1511 [03] CE0226         LDX     #!550           ; Limit upper to 550
                    SUD_LSK2:
                         ; Display current value text
1514 [02] 8601           LDAA    #!1             ; Line 1
1516 [02] C60C           LDAB    #!12            ; Column 12
1518 [06] BD1309         JSR     DSP_CUR         ; Position Cursor
151B [04] 3C             PSHX                    ; Save current value
                         ; Convert value in Reg-X to decimal string
151C [02] 8620           LDAA    #$20            ; Pad with SPACE
151E [02] C603           LDAB    #$3             ; Do 3 digits
1520 [06] BD1221         JSR     DEC_DSP         ; Convert to decimal ASCII string
1523 [06] BD12BD         JSR     DSP_STR         ; and display it
                         ; delay a time for slow scroll through chars
1526 [03] CE001E         LDX     #!30            ; wait for 300 milliseconds
1529 [06] BD1178         JSR     TIMER
152C [05] 38             PULX                    ; Restore current value
                    SUD_LP1:
152D [06] BD1366         JSR     GET_KEY         ; Get PANEL Inputs
1530 [02] 840F           ANDA    #$0F            ; Mask off all but Function keys
1532 [03] 27F9           BEQ     SUD_LP1         ; Branch while no keys hit

1534 [02] 8101           CMPA    #$01            ; Test for F1 key (CONT)
1536 [03] 2602           BNE     SUD_SK1         ; If not F1, continue
1538 [03] 2014           BRA     SUD_OUT         ; CONT (F1) selected so return
                    SUD_SK1:
153A [02] 8102           CMPA    #$02            ; Test for F2 key (RUN)
153C [03] 2602           BNE     SUD_SK2         ; If not F2, continue
153E [03] 200E           BRA     SUD_OUT         ; CONT (F2) selected so return
                    SUD_SK2:
1540 [02] 8104           CMPA    #$04            ; Test for F3 key (DOWN)
1542 [03] 2603           BNE     SUD_SK3         ; If not F3, continue
1544 [03] 09             DEX                     ; Decrement value
1545 [03] 2005           BRA     SUD_SK4         ; and skip to end of loop
                    SUD_SK3:
1547 [02] 8108           CMPA    #$08            ; Test for F4 key (UP)
1549 [03] 2601           BNE     SUD_SK4         ; If not F4, continue loop
154B [03] 08             INX                     ; Increment value
                    SUD_SK4:
154C [03] 20B6           BRA     SUD_LP0         ; Loop until Function key is hit
                    SUD_OUT:
154E [06] BD1331         JSR     WAIT_NONE       ; Wait for no keys pressed
1551 [04] 33             PULB
1552 [05] 39             RTS

                    *=========================================================
                    * Name:  SLCT_CONTRAST
                    * Subroutine: "CONTRAST" user change screen
```

```
                    1348  * Written by: Robert S. Dobrose
                    1349  * Purpose: Displays the current (default) value in Reg-X
                    1350  *           and waits for user to select F4 to increment
                    1351  *           or F3 to decrement.
                    1352  *           F1 will accept & return.
                    1353  *           F2 will accept with different return code.
                    1354  *   Input: Reg-X contains default value for choice.
                    1355  *  Output: Reg-X contains Result of changes.
                    1356  *         Accum-A contains keyhit code
                    1357  *   Notes:  This routine will limit the value of the
                    1358  *             change value between 0 and 15.
                    1359  * - - - - - - - - - - - - - - - - - - - - - - - - - - - - - -
                    1360  SLCT_CONTRAST:
1553                1361       EQU     *
1553 [03] 37        1362       PSHB
                    1363  SCN_LP0:
                    1364       ; Limit value of Reg-X to between 0 and 15
1554 [04] 8C0000    1365       CPX     #!0
1557 [03] 2C03      1366       BGE     SCN_LSK1
1559 [03] CE0000    1367       LDX     #!0             ; Limit lower to 0
                    1368  SCN_LSK1:
155C [04] 8C000F    1369       CPX     #!15
155F [03] 2F03      1370       BLE     SCN_LSK2
1561 [03] CE000F    1371       LDX     #!15            ; Limit upper to 15
                    1372  SCN_LSK2:
                    1373       ;*** Update new value for contrast adjust
1564 [04] 3C        1374       PSHX                    ; Save numeric data
1565 [03] 8F        1375       XGDX                    ; Transfer numeric data to Reg-D
1566 [02] C40F      1376       ANDB    #$0F            ; Mask off unused bits
1568 [02] 58        1377       LSLB                    ; Shift data to high bits
1569 [02] 58        1378       LSLB                    ;  **
156A [02] 58        1379       LSLB                    ;  **
156B [02] 58        1380       LSLB                    ;  **
156C [02] CB0B      1381       ADDB    #$0B            ; Set CMD bits (low 4) to NEW CONTRAST
cmd
156E [02] 860D      1382       LDAA    #!13            ; Set for SPI unit #13
1570 [06] BD35B8    1383       JSR     SPI_DLY         ; Send data to PAC controller
1573 [05] 38        1384       PULX                    ; Restore numeric data
                    1385       ; Display current value text
1574 [02] 8601      1386       LDAA    #!1             ; Line 1
1576 [02] C60E      1387       LDAB    #!14            ; Column 14
1578 [06] BD1309    1388       JSR     DSP_CUR         ; Position Cursor
157B [04] 3C        1389       PSHX                    ; Save current value
157C [03] 08        1390       INX                     ; Bump displayed range to 1-16
                    1391       ; Convert value in Reg-X to decimal string
157D [02] 8620      1392       LDAA    #$20            ; Pad with SPACE
157F [02] C602      1393       LDAB    #$2             ; Do 2 digits
1581 [06] BD1221    1394       JSR     DEC_DSP         ; Convert to decimal ASCII string
1584 [06] BD12BD    1395       JSR     DSP_STR         ; and display it
                    1396       ; delay a time for slow scroll through values
1587 [03] CE001E    1397       LDX     #!30            ; wait for 300 milliseconds
158A [06] BD1178    1398       JSR     TIMER
158D [05] 38        1399       PULX                    ; Restore current value
                    1400  SCN_LP1:
158E [06] BD1366    1401       JSR     GET_KEY         ; Get PANEL Inputs
1591 [02] 840F      1402       ANDA    #$0F            ; Mask off all but Function keys
1593 [03] 27F9      1403       BEQ     SCN_LP1         ; Branch while no keys hit
                    1404
1595 [02] 8101      1405       CMPA    #$01            ; Test for F1 key (CONT)
1597 [03] 2602      1406       BNE     SCN_SK1         ; If not F1, continue
1599 [03] 2014      1407       BRA     SCN_OUT         ; CONT (F1) selected so return
                    1408  SCN_SK1:
159B [02] 8102      1409       CMPA    #$02            ; Test for F2 key (RUN)
159D [03] 2602      1410       BNE     SCN_SK2         ; If not F2, continue
159F [03] 200E      1411       BRA     SCN_OUT         ; RUN (F2) selected so return
                    1412  SCN_SK2:
15A1 [02] 8104      1413       CMPA    #$04            ; Test for F3 key (DOWN)
15A3 [03] 2603      1414       BNE     SCN_SK3         ; If not F3, continue
```

```
15A5 [03] 09        1415        DEX                     ; Decrement value
15A6 [03] 2005      1416        BRA     SCN_SK4
                    1417  SCN_SK3:
15A8 [02] 8108      1418        CMPA    #$08            ; Test for F4 key (UP)
15AA [03] 2601      1419        BNE     SCN_SK4         ; If not F4, continue loop
15AC [03] 08        1420        INX                     ; Increment value
                    1421  SCN_SK4:
15AD [03] 20A5      1422        BRA     SCN_LP0         ; Loop until Function key is hit
                    1423  SCN_OUT:
15AF [06] BD1331    1424        JSR     WAIT_NONE       ; Wait for no keys pressed
15B2 [04] 33        1425        PULB
15B3 [05] 39        1426        RTS
                    1427
                    1428  *=====================================================
                    1429  * Name:  PICK_NAME
                    1430  * Subroutine: User "PICK NAME" select screen
                    1431  * Written by: Robert S. Dobrose
                    1432  * Purpose: Displays the PICK NAME screen and allows the
                    1433  *            user to select characters for a given name.
                    1434  *            F1 will move cursor to next alphanum char.
                    1435  *            F2 will move cursor to prev alphanum char.
                    1436  *            F3 will delete the last selected char.
                    1437  *            F4 will select the current char.
                    1438  *            MODE/ENTER will accept the name.
                    1439  *   Input: Reg-X contains a pointer to the string buffer
                    1440  *          Reg-Y contains a pointer to the type text
                    1441  *            (This will be displayed on the third line
                    1442  *             in front of the name blank.)
                    1443  *  Output: Reg-X contains a pointer to the string buffer
                    1444  *   Notes:
                    1445  * - - - - - - - - - - - - - - - - - - - - - - - - - - - -
                    1446  PICK_NAME:
15B4                1447        EQU     *
15B4 [03] 36        1448        PSHA
15B5 [03] 37        1449        PSHB
15B6 [04] 3C        1450        PSHX
15B7 [05] 183C      1451        PSHY
                    1452  ;     TSTA
                    1453  ;     BEQ     PN_SK01
                    1454  ;     SCR     093,094,095,096
                    1455  ;     BRA     PN_SK02
                    1456  ;PN_SK01:
15B9 macro          1457        SCR     093,094,095,096
15B9 [03] CE65AE    1458   LDX #MSG%1
15BC [06] BD12C1    1459   JSR LINE1
15BF [03] CE65C3    1460   LDX #MSG%2
15C2 [06] BD12C7    1461   JSR LINE2
15C5 [03] CE65D8    1462   LDX #MSG%3
15C8 [06] BD12CD    1463   JSR LINE3
15CB [03] CE65ED    1464   LDX #MSG%4
15CE [06] BD12D3    1465   JSR LINE4
                    1466  ;PN_SK02:
15D1 [06] 7F0080    1467        CLR     IDX1            ; Start at 'A' in Alpha-Num
15D4 [06] 7F0081    1468        CLR     IDX2            ; Start with first char in name buffer
                    1469        ; Position cursor for type text
15D7 [02] 8602      1470        LDAA    #!2             ; Line 2
15D9 [02] C60A      1471        LDAB    #!10            ; Column 10
15DB [06] BD1309    1472        JSR     DSP_CUR         ; Position Cursor
15DE [05] 38        1473        PULX                    ; Transfer old Y to X
15DF [06] BD12BD    1474        JSR     DSP_STR         ; Display string in X
15E2 [05] 38        1475        PULX                    ; Restore previous X
15E3 [04] 3C        1476        PSHX                    ; & Re-save it
15E4 [06] 6F00      1477        CLR     0,X             ; Name is blank to start
15E6 [06] BD1321    1478        JSR     CUR_ON          ; Turn display cursor ON
15E9 [06] BD1331    1479        JSR     WAIT_NONE       ; Wait for no keys pressed
                    1480  PN_LP1:
                    1481        ; Position Cursor on current character
15EC [03] D680      1482        LDAB    IDX1            ; Get char number
```

```
15EE [02] 4F        1483        CLRA                    ; Start at line 0
15EF [02] CB0C      1484        ADDB    #!12            ; First char is in column 12
15F1 [02] C114      1485        CMPB    #!20            ; Check for 2nd line
15F3 [03] 2D0A      1486        BLT     PN_SK1          ; If in 1st line then skip next stuff
15F5 [02] 4C        1487        INCA                    ; Increment to 2nd line (Line 1)
15F6 [02] C014      1488        SUBB    #!20            ; and subtract 20 for column
15F8 [02] C114      1489        CMPB    #!20            ; Check for 3rd line
15FA [03] 2D03      1490        BLT     PN_SK1          ; If in 2nd line then skip next stuff
15FC [02] 4C        1491        INCA                    ; Increment to 3rd line (Line 2)
15FD [02] C014      1492        SUBB    #!20            ; and subtract 20 for column
                    1493  PN_SK1:
15FF [06] BD1309    1494        JSR     DSP_CUR         ; Position cursor on character
                    1495        ; delay a time for slow scroll through chars
1602 [04] 3C        1496        PSHX
1603 [03] CE0014    1497        LDX     #!20            ; wait for 200 milliseconds
1606 [06] BD1178    1498        JSR     TIMER
1609 [05] 38        1499        PULX
                    1500        ; Get a key hit
                    1501  PN_LP2:
160A [06] BD1366    1502        JSR     GET_KEY         ; Get PANEL Inputs
160D [02] 841F      1503        ANDA    #$1F            ; Mask off all but Function & ENTER keys
160F [03] 27F9      1504        BEQ     PN_LP2          ; Branch while no keys hit
                    1505        ; F1 - shift cursor to prev char
1611 [02] 8101      1506        CMPA    #$01            ; Test for F1 key (PREV)
1613 [03] 260B      1507        BNE     PN_KSK1         ; If not F1, continue
1615 [03] 9680      1508        LDAA    IDX1
1617 [02] 4A        1509        DECA                    ; PREV (F1) selected so decrement index
1618 [03] 2C02      1510        BGE     PN_KSK11
161A [02] 8624      1511        LDAA    #!36            ; Loop to last if decr from first
                    1512  PN_KSK11:
161C [03] 9780      1513        STAA    IDX1            ; save new index
161E [03] 20CC      1514        BRA     PN_LP1          ; And start loop again
                    1515  PN_KSK1:
                    1516        ; F2 - shift cursor to next char
1620 [02] 8102      1517        CMPA    #$02            ; Test for F2 key (NEXT)
1622 [03] 260D      1518        BNE     PN_KSK2         ; If not F2, continue
1624 [03] 9680      1519        LDAA    IDX1
1626 [02] 4C        1520        INCA                    ; NEXT (F2) selected so increment index
1627 [02] 8124      1521        CMPA    #!36
1629 [03] 2F02      1522        BLE     PN_KSK21
162B [02] 8600      1523        LDAA    #!0             ; Loop to first if decr from last
                    1524  PN_KSK21:
162D [03] 9780      1525        STAA    IDX1            ; save new index
162F [03] 20BB      1526        BRA     PN_LP1          ; And start loop again
                    1527  PN_KSK2:
                    1528        ; F3 - BACKSPACE: delete last buffer char selected
                    1529        ;      no action if buffer char is position #0
1631 [02] 8104      1530        CMPA    #$04            ; Test for F3 key (BKSP)
1633 [03] 261E      1531        BNE     PN_KSK3         ; If not F3, continue
1635 [03] D681      1532        LDAB    IDX2            ; Get buffer position
1637 [03] 271A      1533        BEQ     PN_KSK3         ; Skip delete if nothing in buffer
1639 [06] 7A0081    1534        DEC     IDX2            ; backspace onto last char
163C [03] D681      1535        LDAB    IDX2            ; Re-load char buffer position
163E [02] CB10      1536        ADDB    #!16            ; Name starts in column 16
1640 [02] 8602      1537        LDAA    #!2             ; Name is on line #2
1642 [06] BD1309    1538        JSR     DSP_CUR         ; Position cursor on char
1645 [03] 09        1539        DEX                     ; Backspace buffer
1646 [02] 4F        1540        CLRA                    ; Load NULL char (End of String)
1647 [04] A700      1541        STAA    0,X             ; Store NULL in string
1649 [02] 865F      1542        LDAA    #$5F            ; Load an UNDERLINE char
164B [06] BD12EE    1543        JSR     DSP_CHR         ; Display char
164E [06] BD1331    1544        JSR     WAIT_NONE       ; Wait for no keys pressed
1651 [03] 2099      1545        BRA     PN_LP1          ; And start loop again
                    1546  PN_KSK3:
                    1547        ; F4 - cancel name selection.
                    1548        ;      if 4 chars selected, finish & return
1653 [02] 8108      1549        CMPA    #$08            ; Test for F4 key (CNCL)
1655 [03] 2608      1550        BNE     PN_KSK4         ; If not F4, continue loop
```

```
1657 [05] 38        1551        PULX                    ; Get old Reg-X address
1658 [03] CE0000    1552        LDX     #$0             ; Clear address
165B [04] 3C        1553        PSHX                    ; And push NULL Address on stack!
165C [03] 7E1697    1554        JMP     PN_OUT1         ; Then jump to exit
                    1555  PN_KSK4:
                    1556        ; ENTER - select char cursor is on & place in buffer
                    1557        ;       if 4 chars selected, finish & return
165F [02] 8110      1558        CMPA    #$10            ; Test for ENTER key
1661 [03] 2631      1559        BNE     PN_KSK5         ; If not ENTER, continue loop
                    1560        ; position cursor at current name position
1663 [03] D681      1561        LDAB    IDX2            ; Load char buffer position
1665 [02] CB10      1562        ADDB    #!16            ; Name starts in column 16
1667 [02] 8602      1563        LDAA    #!2             ; Name is on line #2
1669 [06] BD1309    1564        JSR     DSP_CUR         ; Position cursor on char
                    1565        ; Display char and store in buffer
166C [03] 9680      1566        LDAA    IDX1            ; Get char index
                    1567        ; convert index to ASCII char
166E [02] 8124      1568        CMPA    #!36            ; Is this a SPACE char?
1670 [03] 2708      1569        BEQ     PN_KSK50        ; Go to SPACE select
1672 [02] 811A      1570        CMPA    #!26            ; Is this a number char?
1674 [03] 2D08      1571        BLT     PN_KSK51        ; Go to ALPHA convert
1676 [02] 8B16      1572        ADDA    #!22            ; Add numeric offset
1678 [03] 2006      1573        BRA     PN_KSK52        ; and continue
                    1574  PN_KSK50:
167A [02] 8620      1575        LDAA    #$20            ; Load a SPACE char
167C [03] 2002      1576        BRA     PN_KSK52        ; and continue
                    1577  PN_KSK51:
167E [02] 8B41      1578        ADDA    #$41            ; Add Alpha offset
                    1579  PN_KSK52:
1680 [04] A700      1580        STAA    0,X             ; Store char in buffer
1682 [06] BD12EE    1581        JSR     DSP_CHR         ; Display char
1685 [03] 08        1582        INX                     ; increment buffer pointer
1686 [06] 6F00      1583        CLR     0,X             ; and re-terminate string
1688 [06] BD1331    1584        JSR     WAIT_NONE       ; Wait for no keys pressed
168B [06] 7C0081    1585        INC     IDX2            ; Increment name buffer count
168E [03] 9681      1586        LDAA    IDX2
1690 [02] 8104      1587        CMPA    #!4             ; Test new count for name size = 4
1692 [03] 2703      1588        BEQ     PN_OUT1         ; Name buffer is full so we're done
                    1589  PN_KSK5:
1694 [03] 7E15EC    1590        JMP     PN_LP1          ; Loop until Function key is hit
                    1591  PN_OUT1:
                    1592
1697 [06] BD1329    1593        JSR     CUR_OFF         ; Turn display cursor OFF
169A [05] 38        1594        PULX
169B [04] 33        1595        PULB
169C [04] 32        1596        PULA
169D [05] 39        1597        RTS
                    1598
                    1599  *=====================================================
                    1600  * Name:  SER_NUM
                    1601  * Subroutine: User "SERIAL NUMBER" select screen
                    1602  * Written by: Robert S. Dobrose
                    1603  * Purpose: Displays the SERIAL NUMBER screen and allows the
                    1604  *            user to select characters for a given name.
                    1605  *            F1 will move cursor to next alphanum char.
                    1606  *            F2 will move cursor to prev alphanum char.
                    1607  *            F3 will delete the last selected char.
                    1608  *            F4 will select the current char.
                    1609  *            MODE/ENTER will accept the name.
                    1610  *   Input: Reg-X contains a pointer to the string buffer
                    1611  *  Output: Reg-X contains a pointer to the string buffer
                    1612  *   Notes:
                    1613  * - - - - - - - - - - - - - - - - - - - - - - - - - - - -
                    1614  SER_NUM:
169E                1615        EQU     *
169E [03] 36        1616        PSHA
169F [03] 37        1617        PSHB
16A0 [05] 183C      1618        PSHY
```

```
16A2 [04] 3C        1619        PSHX
16A3 macro          1620        SCR     820,821,822,096
16A3 [03] CE6CCE    1621    LDX #MSG%1
16A6 [06] BD12C1    1622    JSR LINE1
16A9 [03] CE6CE3    1623    LDX #MSG%2
16AC [06] BD12C7    1624    JSR LINE2
16AF [03] CE6CF8    1625    LDX #MSG%3
16B2 [06] BD12CD    1626    JSR LINE3
16B5 [03] CE65ED    1627    LDX #MSG%4
16B8 [06] BD12D3    1628    JSR LINE4
16BB [05] 38        1629        PULX
16BC [04] 3C        1630        PSHX
16BD [06] 7F0080    1631        CLR     IDX1            ; Start at 'A' in Alpha-Num
16C0 [06] 7F0081    1632        CLR     IDX2            ; Start with first char in name buffer
16C3 [06] 6F00      1633        CLR     0,X             ; Name is blank to start
16C5 [06] BD1321    1634        JSR     CUR_ON          ; Turn display cursor ON
16C8 [06] BD1331    1635        JSR     WAIT_NONE       ; Wait for no keys pressed
                    1636    SN_LP1:
                    1637        ; Position Cursor on current character
16CB [03] D680      1638        LDAB    IDX1            ; Get char number
16CD [02] 4F        1639        CLRA                    ; Start at line 0
16CE [02] C114      1640        CMPB    #!20            ; Check for 2nd line
16D0 [03] 2D03      1641        BLT     SN_SK1          ; If in 1st line then skip next stuff
16D2 [02] 4C        1642        INCA                    ; Increment to 2nd line (Line 1)
16D3 [02] C014      1643        SUBB    #!20            ; and subtract 20 for column
                    1644    SN_SK1:
16D5 [06] BD1309    1645        JSR     DSP_CUR         ; Position cursor on character
                    1646        ; delay a time for slow scroll through chars
16D8 [04] 3C        1647        PSHX
16D9 [03] CE0014    1648        LDX     #!20            ; wait for 200 milliseconds
16DC [06] BD1178    1649        JSR     TIMER
16DF [05] 38        1650        PULX
                    1651        ; Get a key hit
                    1652    SN_LP2:
16E0 [06] BD1366    1653        JSR     GET_KEY         ; Get PANEL Inputs
16E3 [02] 841F      1654        ANDA    #$1F            ; Mask off all but Function & ENTER keys
16E5 [03] 27F9      1655        BEQ     SN_LP2          ; Branch while no keys hit
                    1656        ; F1 - shift cursor to prev char
16E7 [02] 8101      1657        CMPA    #$01            ; Test for F1 key (PREV)
16E9 [03] 260B      1658        BNE     SN_KSK1         ; If not F1, continue
16EB [03] 9680      1659        LDAA    IDX1
16ED [02] 4A        1660        DECA                    ; PREV (F1) selected so decrement index
16EE [03] 2C02      1661        BGE     SN_KSK11
16F0 [02] 8624      1662        LDAA    #!36            ; Loop to last if decr from first
                    1663    SN_KSK11:
16F2 [03] 9780      1664        STAA    IDX1            ; save new index
16F4 [03] 20D5      1665        BRA     SN_LP1          ; And start loop again
                    1666    SN_KSK1:
                    1667        ; F2 - shift cursor to next char
16F6 [02] 8102      1668        CMPA    #$02            ; Test for F2 key (NEXT)
16F8 [03] 260D      1669        BNE     SN_KSK2         ; If not F2, continue
16FA [03] 9680      1670        LDAA    IDX1
16FC [02] 4C        1671        INCA                    ; NEXT (F2) selected so increment index
16FD [02] 8124      1672        CMPA    #!36
16FF [03] 2F02      1673        BLE     SN_KSK21
1701 [02] 8600      1674        LDAA    #!0             ; Loop to first if decr from last
                    1675    SN_KSK21:
1703 [03] 9780      1676        STAA    IDX1            ; save new index
1705 [03] 20C4      1677        BRA     SN_LP1          ; And start loop again
                    1678    SN_KSK2:
                    1679        ; F3 - delete last buffer char selected
                    1680        ;      no action if buffer char is position #0
1707 [02] 8104      1681        CMPA    #$04            ; Test for F3 key (DEL)
1709 [03] 261E      1682        BNE     SN_KSK3         ; If not F3, continue
170B [03] D681      1683        LDAB    IDX2            ; Get buffer position
170D [03] 271A      1684        BEQ     SN_KSK3         ; Skip delete if nothing in buffer
170F [06] 7A0081    1685        DEC     IDX2            ; backspace onto last char
1712 [03] D681      1686        LDAB    IDX2            ; Re-load char buffer position
```

```
1714 [02] CB08      1687        ADDB    #!8             ; Name starts in column 8
1716 [02] 8602      1688        LDAA    #!2             ; Name is on line #2
1718 [06] BD1309    1689        JSR     DSP_CUR         ; Position cursor on char
171B [03] 09        1690        DEX                     ; Backspace buffer
171C [02] 4F        1691        CLRA                    ; Load NULL char (End of String)
171D [04] A700      1692        STAA    0,X             ; Store NULL in string
171F [02] 865F      1693        LDAA    #$5F            ; Load an UNDERLINE char
1721 [06] BD12EE    1694        JSR     DSP_CHR         ; Display char
1724 [06] BD1331    1695        JSR     WAIT_NONE       ; Wait for no keys pressed
1727 [03] 20A2      1696        BRA     SN_LP1          ; And start loop again
                    1697    SN_KSK3:
                    1698        ; F4 - cancel name selection.
                    1699        ;       if 4 chars selected, finish & return
1729 [02] 8108      1700        CMPA    #$08            ; Test for F4 key (CNCL)
172B [03] 2608      1701        BNE     SN_KSK4         ; If not F4, continue loop
172D [05] 38        1702        PULX                    ; Get old Reg-X address
172E [03] CE0000    1703        LDX     #$0             ; Clear address
1731 [04] 3C        1704        PSHX                    ; And push NULL Address on stack!
1732 [03] 7E176D    1705        JMP     SN_OUT1         ; Then jump to exit
                    1706    SN_KSK4:
                    1707        ; ENTER - select char cursor is on & place in buffer
                    1708        ;       if 11 chars selected, finish & return
1735 [02] 8110      1709        CMPA    #$10            ; Test for ENTER key
1737 [03] 2631      1710        BNE     SN_KSK5         ; If not ENTER, continue loop
                    1711        ; position cursor at current name position
1739 [03] D681      1712        LDAB    IDX2            ; Load char buffer position
173B [02] CB08      1713        ADDB    #!8             ; Name starts in column 8
173D [02] 8602      1714        LDAA    #!2             ; Name is on line #2
173F [06] BD1309    1715        JSR     DSP_CUR         ; Position cursor on char
                    1716        ; Display char and store in buffer
1742 [03] 9680      1717        LDAA    IDX1            ; Get char index
                    1718        ; convert index to ASCII char
1744 [02] 8124      1719        CMPA    #!36            ; Is this a SPACE char?
1746 [03] 2708      1720        BEQ     SN_KSK50        ; Go to SPACE select
1748 [02] 811A      1721        CMPA    #!26            ; Is this a number char?
174A [03] 2D08      1722        BLT     SN_KSK51        ; Go to ALPHA convert
174C [02] 8B16      1723        ADDA    #!22            ; Add numeric offset
174E [03] 2006      1724        BRA     SN_KSK52        ; and continue
                    1725    SN_KSK50:
1750 [02] 8620      1726        LDAA    #$20            ; Load SPACE char
1752 [03] 2002      1727        BRA     SN_KSK52        ; and continue
                    1728    SN_KSK51:
1754 [02] 8B41      1729        ADDA    #$41            ; Add Alpha offset
                    1730    SN_KSK52:
1756 [04] A700      1731        STAA    0,X             ; Store char in buffer
1758 [06] BD12EE    1732        JSR     DSP_CHR         ; Display char
175B [03] 08        1733        INX                     ; increment buffer pointer
175C [06] 6F00      1734        CLR     0,X             ; and re-terminate string
175E [06] BD1331    1735        JSR     WAIT_NONE       ; Wait for no keys pressed
1761 [06] 7C0081    1736        INC     IDX2            ; Increment name buffer count
1764 [03] 9681      1737        LDAA    IDX2
1766 [02] 810B      1738        CMPA    #!11            ; Test new count for name size = 11
1768 [03] 2703      1739        BEQ     SN_OUT1         ; Name buffer is full so we're done
                    1740    SN_KSK5:
176A [03] 7E16CB    1741        JMP     SN_LP1          ; Loop until Function key is hit
                    1742    SN_OUT1:
176D [06] BD1329    1743        JSR     CUR_OFF         ; Turn display cursor OFF
1770 [05] 38        1744        PULX
1771 [06] 1838      1745        PULY
1773 [04] 33        1746        PULB
1774 [04] 32        1747        PULA
1775 [05] 39        1748        RTS
                    1749
                    1750    *=================================================
                    1751    * Name:  CALC_MULT
                    1752    * Subroutine: Calculate Multiplier Table
                    1753    * Written by: Robert S. Dobrose
                    1754    * Purpose: Calculates the Multiplier Table for a given
```

```
                    1755  *            CAL_A value for all 12 notes.
                    1756  *   Input: None
                    1757  *  Output: None
                    1758  *   Notes:
                    1759  * - - - - - - - - - - - - - - - - - - - - - - - - - - - - - -
                    1760  CALC_MULT:
1776                1761       EQU     *
                    1762       ;  Start index at Note 0 & offset for KEY
1776 [03] CE7C03    1763       LDX     #KEY_OFF
1779 [03] D643      1764       LDAB    SFLAGS
177B [02] C403      1765       ANDB    #$03            ; Mask off non-KEY data
177D [03] 3A        1766       ABX                     ; adjust addr for KEY offset data
177E [04] E600      1767       LDAB    0,X             ; Get offset data for desired KEY
1780 [03] D780      1768       STAB    IDX1            ; and save it as index start
1782 [06] 7F0081    1769       CLR     IDX2            ; Clear counter
1785 [04] 18CE005C  1770       LDY     #NOTE_CAL
                    1771       ;  Get CAL_A value
1789 [06] 7F0094    1772       CLR     MULT2+2
178C [04] DC5A      1773       LDD     CAL_A
178E [04] DD92      1774       STD     MULT2
                    1775       ;  Start of loop
                    1776  CM_LP1:
                    1777       ;  Get Multiplier for current Note
1790 [03] CE9F60    1778       LDX     #NOTE           ; Get base addr of note table
1793 [03] D680      1779       LDAB    IDX1            ; Get note data
1795 [02] 58        1780       LSLB                    ; Multiply by record size (= 4 bytes)
1796 [02] 58        1781       LSLB                    ; **
1797 [03] 3A        1782       ABX                     ; Add offset to base
1798 [05] EC00      1783       LDD     $0,X            ; Get MSW of multiplier value
179A [04] DD8E      1784       STD     MULT1           ; Store in temp var
179C [04] A602      1785       LDAA    $2,X            ; Get LSB of multiplier
179E [03] 9790      1786       STAA    MULT1+2         ; Store in temp var
                    1787       ;  Perform Multiply
17A0 [06] BD1B03    1788       JSR     MULTMCS
17A3 [03] D69A      1789       LDAB    DBUFFER+4       ; Check if LSB rounding is needed
17A5 [03] 2A0F      1790       BPL     CM_SK1          ; Not needed, Skip next stuff
17A7 [04] DC98      1791       LDD     DBUFFER+2       ; Round resulting value up to next int.
17A9 [04] C30001    1792       ADDD    #$1
17AC [04] DD98      1793       STD     DBUFFER+2       ; and store it
17AE [04] DC96      1794       LDD     DBUFFER
17B0 [02] C900      1795       ADCB    #$0
17B2 [02] 8900      1796       ADCA    #$0
17B4 [04] DD96      1797       STD     DBUFFER
                    1798  CM_SK1:
17B6 [06] 7F009A    1799       CLR     DBUFFER+4       ; Clear unused LSB
                    1800  ;    LDAA    #!0             ;** Line 0
                    1801  ;    LDAB    #!0             ;** Column 0
                    1802  ;    JSR     DSP_CUR         ; Position Cursor
                    1803  ;    LDAB    IDX1
                    1804  ;    CLRA
                    1805  ;    JSR     HEX_DSP
                    1806  ;    JSR     DSP_STR         ; and display string
                    1807  ;    LDAA    #!0             ;** Line 0
                    1808  ;    LDAB    #!6             ;** Column 6
                    1809  ;    JSR     DSP_CUR         ; Position Cursor
                    1810  ;    LDAB    IDX2
                    1811  ;    CLRA
                    1812  ;    JSR     HEX_DSP
                    1813  ;    JSR     DSP_STR         ; and display string
                    1814  ;    LDAA    #!0             ;** Line 0
                    1815  ;    LDAB    #!12            ;** Column 12
                    1816  ;    JSR     DSP_CUR         ; Position Cursor
                    1817  ;    PSHY
                    1818  ;    XGDY
                    1819  ;    PULY
                    1820  ;    JSR     HEX_DSP
                    1821  ;    JSR     DSP_STR         ; and display string
                    1822  ;    LDAA    #!1             ;** Line 1
```

```
                    ;    LDAB    #!0            ;** Column 0
                    ;    JSR     DSP_CUR        ; Position Cursor
                    ;    CLRA
                    ;    LDAB    MULT1
                    ;    JSR     HEX_DSP
                    ;    JSR     DSP_STR        ; and display string
                    ;    LDD     MULT1+1
                    ;    JSR     HEX_DSP
                    ;    JSR     DSP_STR        ; and display string
                    ;    LDAA    #!1            ;** Line 1
                    ;    LDAB    #!10           ;** Column 10
                    ;    JSR     DSP_CUR        ; Position Cursor
                    ;    CLRA
                    ;    LDAB    MULT2
                    ;    JSR     HEX_DSP
                    ;    JSR     DSP_STR        ; and display string
                    ;    LDD     MULT2+1
                    ;    JSR     HEX_DSP
                    ;    JSR     DSP_STR        ; and display string
                    ;    LDAA    #!2            ;** Line 2
                    ;    LDAB    #!0            ;** Column 0
                    ;    JSR     DSP_CUR        ; Position Cursor
                    ;    LDD     DBUFFER
                    ;    JSR     HEX_DSP
                    ;    JSR     DSP_STR        ; and display string
                    ;    LDD     DBUFFER+2
                    ;    JSR     HEX_DSP
                    ;    JSR     DSP_STR        ; and display string
                    ;    LDD     DBUFFER+4
                    ;    JSR     HEX_DSP
                    ;    JSR     DSP_STR        ; and display string
                    ;    PSHY
                    ;    LDY     #!1000         ; Wait up to 10 sec.
                    ;    LDAA    #$10           ; Wait for MODE key
                    ;    JSR     WAIT_KEY
                    ;    JSR     WAIT_NONE
                    ;    PULY
                         ;  Store Result for current Note
17B9 [04] DC98           LDD     DBUFFER+2
17BB [06] 18ED01         STD     $1,Y
17BE [03] 9697           LDAA    DBUFFER+1
17C0 [05] 18A700         STAA    $0,Y
                         ;  Increment Indices
17C3 [04] 1808           INY
17C5 [04] 1808           INY
17C7 [04] 1808           INY
17C9 [06] 7C0080         INC     IDX1
17CC [06] 7C0081         INC     IDX2
                         ;  Compare to 12
17CF [03] 9681           LDAA    IDX2
17D1 [02] 810C           CMPA    #!12
                         ;  If less, loop until done
17D3 [03] 2C03           BGE     CM_SK2
17D5 [03] 7E1790         JMP     CM_LP1
                    CM_SK2:
17D8 [05] 39             RTS


                    *=========================================================
                    * Name:  VERNIER
                    * Subroutine: User "VERNIER ADJUST" screen
                    * Written by: Robert S. Dobrose
                    * Purpose: Displays the VERNIER screen and allows the
                    *           user to change the value of a given number
                    *           using the digital vernier knob (quadrature
                    *           encoder wheel)
                    *           MODE/ENTER will accept the value & return.
                    *   Input: Reg-X contains the default (starting) value.
```

```
                    1891  *  Output: Reg-X contains the final value returned.
                    1892  *   Notes:
                    1893  * - - - - - - - - - - - - - - - - - - - - - - - - - - - -
                    1894  VERNIER:
17D9                1895       EQU     *
17D9 [03] 36        1896       PSHA
17DA [03] 37        1897       PSHB
17DB [04] 8C01F4    1898       CPX     #!500
17DE [03] 2F03      1899       BLE     VRN_SK1
17E0 [03] CE01F4    1900       LDX     #!500
                    1901  VRN_SK1:
17E3 [04] 8CFE0C    1902       CPX     #!-500
17E6 [03] 2C03      1903       BGE     VRN_SK2
17E8 [03] CEFE0C    1904       LDX     #!-500
                    1905  VRN_SK2:
17EB [04] DF44      1906       STX     V_VAL
17ED macro          1907       SCR     140,141,142,143
17ED [03] CE68F3    1908   LDX #MSG%1
17F0 [06] BD12C1    1909   JSR LINE1
17F3 [03] CE6908    1910   LDX #MSG%2
17F6 [06] BD12C7    1911   JSR LINE2
17F9 [03] CE691D    1912   LDX #MSG%3
17FC [06] BD12CD    1913   JSR LINE3
17FF [03] CE6932    1914   LDX #MSG%4
1802 [06] BD12D3    1915   JSR LINE4
1805 [04] B67C00    1916       LDAA    V_INC1          ; set to Scale #1 (Default)
1808 [06] 154201    1917       BCLR    DFLAGS,$01      ; Clear fractional vernier display flag
180B [03] 9746      1918       STAA    V_SCL           ; Store new scale value
180D [03] CC0000    1919       LDD     #$0
                    1920  VRN_LP1:
1810 [04] DE44      1921       LDX     V_VAL
1812 [02] 8601      1922       LDAA    #!1             ; Line 1
1814 [02] C60C      1923       LDAB    #!12            ; Column 12
1816 [06] BD18B7    1924       JSR     V_DISP          ; Display current value
1819 [03] CE000A    1925       LDX     #!10
181C [06] BD1178    1926       JSR     TIMER
                    1927  VRN_LP2:
181F [06] BD1366    1928       JSR     GET_KEY
1822 [03] 27FB      1929       BEQ     VRN_LP2
                    1930  ; Test for +/- key hit
                    1931  ; Bump V_VAL up by V_SCL on '+' & down on '-'
1824 [02] 8120      1932       CMPA    #$20            ; Check for '+' key
1826 [03] 2613      1933       BNE     VRN_SK3
1828 [04] DC44      1934       LDD     V_VAL
182A [03] DB46      1935       ADDB    V_SCL
182C [02] 8900      1936       ADCA    #$0
182E [05] 1A8301F4  1937       CPD     #!500
1832 [03] 2F03      1938       BLE     VRN_SK31
1834 [03] CC01F4    1939       LDD     #!500
                    1940  VRN_SK31:
1837 [04] DD44      1941       STD     V_VAL
1839 [03] 2025      1942       BRA     VRN_SK6
                    1943  VRN_SK3:
183B [02] 8140      1944       CMPA    #$40            ; Check for '-' key
183D [03] 2613      1945       BNE     VRN_SK4
183F [04] DC44      1946       LDD     V_VAL
1841 [03] D046      1947       SUBB    V_SCL
1843 [02] 8200      1948       SBCA    #$0
1845 [05] 1A83FE0C  1949       CPD     #!-500
1849 [03] 2C03      1950       BGE     VRN_SK41
184B [03] CCFE0C    1951       LDD     #!-500
                    1952  VRN_SK41:
184E [04] DD44      1953       STD     V_VAL
1850 [03] 200E      1954       BRA     VRN_SK6
                    1955  VRN_SK4:
1852 [02] 8110      1956       CMPA    #$10            ; Check for MODE key
1854 [03] 270C      1957       BEQ     VRN_OUT         ; if MODE hit, then return
1856 [02] 8102      1958       CMPA    #$02            ; Check for F2 (SCALE CHANGE) key
```

```
1858 [03] 2606      1959        BNE     VRN_SK6          ; Skip changes if not Encoder Push
185A [06] BD1867    1960        JSR     CH_SCL           ; Change Scale!
185D [06] BD1331    1961        JSR     WAIT_NONE        ; Wait for no keys pressed
                    1962  VRN_SK6:
1860 [03] 20AE      1963        BRA     VRN_LP1          ; Loop to check again
                    1964  VRN_OUT:
1862 [04] 33        1965        PULB
1863 [04] 32        1966        PULA
1864 [04] DE44      1967        LDX     V_VAL
1866 [05] 39        1968        RTS
                    1969
                    1970  *=====================================================
                    1971  * Name:  CH_SCL
                    1972  * Subroutine: Change scale factor multiplier
                    1973  * Written by: Robert S. Dobrose
                    1974  * Purpose: Updates the scale factor multiplier used by
                    1975  *            the vernier routines in the RUN MODE screen
                    1976  *            (and the VERNIER routine??)
                    1977  *   Input: none
                    1978  *  Output: none
                    1979  *   Notes:
                    1980  * - - - - - - - - - - - - - - - - - - - - - - - - - - - -
                    1981  CH_SCL:
1867                1982        EQU     *
1867 [03] 9646      1983        LDAA    V_SCL            ; Load last scale value
1869 [04] B17C00    1984        CMPA    V_INC1           ; Is it scale #1
186C [03] 2608      1985        BNE     CHS_SK13         ; No!  Skip to next check
186E [04] B67C01    1986        LDAA    V_INC2           ; Yes!  Set to Scale #2
1871 [06] 144201    1987        BSET    DFLAGS,$01       ; Set fractional vernier display flag
1874 [03] 2013      1988        BRA     CHS_SK1X         ; we're done, skip to end
                    1989  CHS_SK13:
1876 [04] B17C01    1990        CMPA    V_INC2           ; Is it scale #2
1879 [03] 2608      1991        BNE     CHS_SK14         ; No!  Skip to next check
187B [04] B67C02    1992        LDAA    V_INC3           ; Yes!  Set to Scale #3
187E [06] 144201    1993        BSET    DFLAGS,$01       ; Set fractional vernier display flag
1881 [03] 2006      1994        BRA     CHS_SK1X         ; we're done, skip to end
                    1995  CHS_SK14:
1883 [04] B67C00    1996        LDAA    V_INC1           ; Else set to Scale #1 (Default)
1886 [06] 154201    1997        BCLR    DFLAGS,$01       ; Clear fractional vernier display flag
                    1998  CHS_SK1X:
1889 [03] 9746      1999        STAA    V_SCL            ; Store new scale value
188B [03] 9792      2000        STAA    MULT2            ; Set up scale rounding multiplier
188D [02] 4F        2001        CLRA
188E [03] D646      2002        LDAB    V_SCL            ; Load last scale value
1890 [03] 8F        2003        XGDX
1891 [04] DC44      2004        LDD     V_VAL            ; Load last value
1893 [03] 2A05      2005        BPL     CHS_SK15         ; Check for negative
1895 [03] CC0000    2006        LDD     #$0
1898 [05] 9344      2007        SUBD    V_VAL            ; If negative, grab Absolute (negated)
value
                    2008  CHS_SK15:
189A [41] 02        2009        IDIV                     ; Divide value by scale (round to scale)
189B [03] 05        2010        LSLD                     ; set remainder for round up
189C [03] D146      2011        CMPB    V_SCL            ; compare to scale
189E [03] 2D01      2012        BLT     CHS_SK16         ; Skip round up if not needed
18A0 [03] 08        2013        INX                      ; Increment result (round up)
                    2014  CHS_SK16:
18A1 [04] DF8E      2015        STX     MULT1            ; Save divide result
18A3 [06] BD1AED    2016        JSR     MULTSCL          ; Scale value up again
18A6 [06] 7D0044    2017        TST     V_VAL            ; test last value
18A9 [03] 2A07      2018        BPL     CHS_SK17         ; Check for negative
18AB [03] CC0000    2019        LDD     #$0
18AE [05] 9396      2020        SUBD    DBUFFER          ; If negative, negate result value
18B0 [03] 2002      2021        BRA     CHS_SK18
                    2022  CHS_SK17:
18B2 [04] DC96      2023        LDD     DBUFFER
                    2024  CHS_SK18:
18B4 [04] DD44      2025        STD     V_VAL            ; Save new value
```

```
18B6 [05] 39          2026        RTS
                      2027
                      2028  *=====================================================
                      2029  * Name:  V_DISP
                      2030  * Subroutine: Display the RUN MODE Vernier Value
                      2031  * Written by: Robert S. Dobrose
                      2032  * Purpose: Displays the Vernier value on the
                      2033  *            RUN MODE screen.
                      2034  *   Input: Reg-A contains the screen line number
                      2035  *          Reg-B contains the screen column number
                      2036  *          Reg-X contains the latest Vernier value
                      2037  *  Output: none
                      2038  *   Notes:
                      2039  * - - - - - - - - - - - - - - - - - - - - - - - - - - -
                      2040  V_DISP:
18B7                  2041        EQU     *
18B7 [03] 36          2042        PSHA
18B8 [03] 37          2043        PSHB
18B9 [04] 3C          2044        PSHX
18BA [06] BD1309      2045        JSR     DSP_CUR         ; Position cursor for value
18BD [03] 8F          2046        XGDX
18BE [06] BD11B4      2047        JSR     VERN_STR        ; Convert value to string
18C1 [06] BD12BD      2048        JSR     DSP_STR         ; and display it
18C4 [05] 38          2049        PULX
18C5 [04] 33          2050        PULB
18C6 [04] 32          2051        PULA
18C7 [05] 39          2052        RTS
                      2053
                      2054  *=====================================================
                      2055  * Name:  V_CALC
                      2056  * Subroutine: Calculate & send a new speed value
                      2057  * Written by: Robert S. Dobrose
                      2058  * Purpose: Calculates a new speed value & sends it to
                      2059  *            an MCS module.
                      2060  *   Input: Reg-D contains the starting CENTS offset
                      2061  *            (for TMPR or STRCH in RUN MODE)
                      2062  *          V_VAL contains the current CENTS offset
                      2063  *            (for +/- adjust in RUN MODE)
                      2064  *          NOTE_OCT contains the current NOTE & OCTAVE data
                      2065  *  Output: none
                      2066  *   Notes:
                      2067  * - - - - - - - - - - - - - - - - - - - - - - - - - - -
                      2068  V_CALC:
18C8                  2069        EQU     *
                      2070        ; | Lookup offset multiplier value
18C8 [05] D344        2071        ADDD    V_VAL
18CA [04] C303E8      2072        ADDD    #!1000          ; Shift to positive values
18CD [03] 05          2073        LSLD                    ; Multiply by record size (= 4 bytes)
18CE [03] 05          2074        LSLD                    ; **
18CF [04] C38000      2075        ADDD    #CENTS          ; Add in base addr of cents table
18D2 [03] 8F          2076        XGDX                    ; Move value to X-Reg
18D3 [05] EC00        2077        LDD     $0,X            ; Get MSW of multiplier value
18D5 [04] DD92        2078        STD     MULT2           ; Store in temp var
18D7 [04] A602        2079        LDAA    $2,X            ; Get LSB of multiplier
18D9 [03] 9794        2080        STAA    MULT2+2         ; Store in temp var
                      2081        ; | Lookup NOTE base frequency
18DB [03] CE005C      2082        LDX     #NOTE_CAL       ; Get base addr of note table (in RAM)
18DE [03] D647        2083        LDAB    NOTE_OCT        ; Get note data
18E0 [02] C40F        2084        ANDB    #$0F            ; Mask off non-note info
18E2 [02] 17          2085        TBA                     ; Copy Note number (in B) to A
18E3 [02] 48          2086        LSLA                    ; Multiply Note by 2
18E4 [02] 1B          2087        ABA                     ; Add *1 to *2 value (= *3)
18E5 [02] 16          2088        TAB                     ; Transfer result back to B
18E6 [03] 3A          2089        ABX                     ; Add offset to base
18E7 [05] EC00        2090        LDD     $0,X            ; Get MSW of multiplier value
18E9 [04] DD8E        2091        STD     MULT1           ; Store in temp var
18EB [04] A602        2092        LDAA    $2,X            ; Get LSB of multiplier
18ED [03] 9790        2093        STAA    MULT1+2         ; Store in temp var
```

```
                    2094        ; | Multiply base * multiplier = MCS velocity
 18EF [06] BD1B03   2095        JSR     MULTMCS
 18F2 [03] D699     2096        LDAB    DBUFFER+3       ; Check if LSB rounding is needed
 18F4 [03] 2A0D     2097        BPL     VC_SK1          ; Not needed, Skip next stuff
 18F6 [04] DC97     2098        LDD     DBUFFER+1       ; Round resulting value up to next int.
 18F8 [04] C30001   2099        ADDD    #$1
 18FB [04] DD97     2100        STD     DBUFFER+1       ; and store it
 18FD [03] 9696     2101        LDAA    DBUFFER
 18FF [02] 8900     2102        ADCA    #$0
 1901 [03] 9796     2103        STAA    DBUFFER
                    2104  VC_SK1:
 1903 [06] 7F0099   2105        CLR     DBUFFER+3       ; Clear unused LSB
 1906 [06] 13424012 2106        BRCLR   DFLAGS,$40,VC_SK2
                    2107        ; +2 flag is set, Divide speed by 4 (to shift response down 2
rings)
 190A [06] 740096   2108        LSR     DBUFFER
 190D [06] 760097   2109        ROR     DBUFFER+1
 1910 [06] 760098   2110        ROR     DBUFFER+2
 1913 [06] 740096   2111        LSR     DBUFFER
 1916 [06] 760097   2112        ROR     DBUFFER+1
 1919 [06] 760098   2113        ROR     DBUFFER+2
                    2114  VC_SK2:
 191C [06] 13422009 2115        BRCLR   DFLAGS,$20,VC_SK3
                    2116        ; -1 flag is set, Multiply speed by 2 (to shift response up 1
ring)
 1920 [06] 780098   2117        LSL     DBUFFER+2
 1923 [06] 790097   2118        ROL     DBUFFER+1
 1926 [06] 790096   2119        ROL     DBUFFER
                    2120  VC_SK3:
                    2121        ; | Transmit new velocity to MCS
 1929 [03] 9647     2122        LDAA    NOTE_OCT
 192B [02] 840F     2123        ANDA    #$0F            ; Look only at Note data
 192D [02] 4C       2124        INCA
 192E [03] CE0096   2125        LDX     #DBUFFER        ; Point to data to be xmitted
 1931 [06] BD3570   2126        JSR     SPI_SEND        ; and send data
 1934 [05] 39       2127        RTS
                    2128
                    2129  *=========================================================
                    2130  * Name:  UPDATE
                    2131  * Subroutine: Update the RUN MODE screen
                    2132  * Written by: Robert S. Dobrose
                    2133  * Purpose: Updates the static data displayed on the
                    2134  *          RUN MODE screen.
                    2135  *   Input: none
                    2136  *  Output: none
                    2137  *   Notes:
                    2138  * - - - - - - - - - - - - - - - - - - - - - - - - - - - -
                    2139  UPDATE:
 1935               2140        EQU     *
 1935 [03] 36       2141        PSHA
 1936 [03] 37       2142        PSHB
 1937 [04] 3C       2143        PSHX
                    2144        ; Display fixed screen data (Data that will always be present)
 1938 [03] CE6DF3   2145        LDX     #S_KEY0         ; Get KEY strings base addr
 193B [03] D643     2146        LDAB    SFLAGS          ; Get system flags
 193D [02] C403     2147        ANDB    #$03            ; mask off all but KEY bits
 193F [02] 58       2148        LSLB                    ; Mult KEY offset by 4
 1940 [02] 58       2149        LSLB                    ; **
 1941 [03] 3A       2150        ABX                     ; add offset to base addr (KEY string)
 1942 [02] 8600     2151        LDAA    #!0             ; Line 0
 1944 [02] C605     2152        LDAB    #!5             ; Column 5
 1946 [06] BD1309   2153        JSR     DSP_CUR         ; Position Cursor
 1949 [06] BD12BD   2154        JSR     DSP_STR         ; and display string
                    2155
                    2156  ;     LDX     #NOTE01         ; Get NOTE strings base addr
                    2157  ;     LDAB    NOTE_OCT        ; Get Note info
                    2158  ;     ANDB    #$0F            ; Mask off non-Note info
                    2159  ;     LSLB                    ; Mult NOTE offset by 4
```

```
                    ;     LSLB                    ; **
                    ;     ABX                     ; add offset to base addr (NOTE string)
                    ;     LDAA    #!1             ; Line 1
                    ;     LDAB    #!11            ; Column 11
                    ;     JSR     DSP_CUR         ; Position Cursor
                    ;     JSR     DSP_STR         ; and display string

194C [02] 8602            LDAA    #!2             ; Line 2
194E [02] C607            LDAB    #!7             ; Column 7
1950 [06] BD1309          JSR     DSP_CUR         ; Position Cursor
1953 [04] DE5A            LDX     CAL_A           ; Load 'A3' value
1955 [02] 8620            LDAA    #$20            ; Pad with SPACE
1957 [02] C603            LDAB    #$3             ; Print 3 digits
1959 [06] BD1221          JSR     DEC_DSP         ; Create string
195C [06] BD12BD          JSR     DSP_STR         ; and display string

195F [02] 8601            LDAA    #!1
1961 [02] C60E            LDAB    #!14
1963 [04] DE44            LDX     V_VAL
1965 [06] BD18B7          JSR     V_DISP          ; Display current vernier value

                          ; Display optional (conditional) data
1968 [06] 1342022C        BRCLR   DFLAGS,$02,UD_SK1
                          ; STRCH selected, display Octave Info
196C [02] 8603            LDAA    #!3             ; Line 3
196E [02] C60B            LDAB    #!11            ; Column 11
1970 [06] BD1309          JSR     DSP_CUR         ; Position Cursor
1973 [03] CE6126          LDX     #MSG015         ; Point to 'OCT+/-' string
1976 [06] BD12BD          JSR     DSP_STR         ; and display string
1979 [02] 8602            LDAA    #!2             ; Line 2
197B [02] C60B            LDAB    #!11            ; Column 11
197D [06] BD1309          JSR     DSP_CUR         ; Position Cursor
1980 [03] CE6DE0          LDX     #S_OCT          ; Point to 'OCT=' string
1983 [06] BD12BD          JSR     DSP_STR         ; and display string
1986 [03] 9647            LDAA    NOTE_OCT        ; Get Octave info
1988 [02] 44              LSRA                    ; Shift Octave data down to low bits
1989 [02] 44              LSRA                    ; **
198A [02] 44              LSRA                    ; **
198B [02] 44              LSRA                    ; **
198C [02] 8407            ANDA    #$07            ; Mask off non-Octave info
198E [02] 8B30            ADDA    #$30            ; Convert to ASCII digit
1990 [06] BD12EE          JSR     DSP_CHR         ; Display char
                          ; STRCH selected, display title & name
1993 [03] CE6DD8          LDX     #S_STRCH        ; Load "STRCH" string
1996 [03] 2007            BRA     UD_SK11
                    UD_SK1:
1998 [06] 13420413        BRCLR   DFLAGS,$04,UD_SK2
                          ; TMPR selected, display title & name
199C [03] CE6DD0          LDX     #S_TMPR         ; Load "TMPR" string
                    UD_SK11:
199F [02] 8600            LDAA    #!0             ; Line 0
19A1 [02] C609            LDAB    #!9             ; Column 9
19A3 [06] BD1309          JSR     DSP_CUR         ; Position Cursor
19A6 [06] BD12BD          JSR     DSP_STR         ; and display string
19A9 [03] CE0049          LDX     #TS_NAME        ; Point to name string
19AC [06] BD12BD          JSR     DSP_STR         ; and display string
                    UD_SK2:
                    ;     BRCLR   DFLAGS,$08,UD_SK3
                    ;     ; SEQ selected, display title & name
                    ;     LDX     #S_SEQ          ; Load "SEQ" string
                    ;     LDAA    #!1             ; Line 1
                    ;     LDAB    #!0             ; Column 0
                    ;     JSR     DSP_CUR         ; Position Cursor
                    ;     JSR     DSP_STR         ; and display string
                    ;     LDX     #SQ_NAME        ; Point to name string
                    ;     JSR     DSP_STR         ; and display string
                    UD_SK3:
19AF [06] 1342100D        BRCLR   DFLAGS,$10,UD_SK4
```

```
                    2228        ; AUTO-NOTE selected, display indicator
19B3 [03] CE6DF0    2229        LDX     #S_AN           ; Load "Auto-Note" string
19B6 [02] 8602      2230        LDAA    #!2             ; Line 2
19B8 [02] C600      2231        LDAB    #!0             ; Column 0
19BA [06] BD1309    2232        JSR     DSP_CUR         ; Position Cursor
19BD [06] BD12BD    2233        JSR     DSP_STR         ; and display string
                    2234  UD_SK4:
19C0 [06] 13424005  2235        BRCLR   DFLAGS,$40,UD_SK5
                    2236        ; '+2' selected, display name
19C4 [03] CE6DE6    2237        LDX     #S_OOF2         ; Load "+2" string
19C7 [03] 2007      2238        BRA     UD_SK51
                    2239  UD_SK5:
19C9 [06] 1342200D  2240        BRCLR   DFLAGS,$20,UD_SK6
                    2241        ; '-1' selected, display name
19CD [03] CE6DE9    2242        LDX     #S_OOF1         ; Load "-1" string
                    2243  UD_SK51:
19D0 [02] 8602      2244        LDAA    #!2             ; Line 2
19D2 [02] C612      2245        LDAB    #!18            ; Column 18
19D4 [06] BD1309    2246        JSR     DSP_CUR         ; Position Cursor
19D7 [06] BD12BD    2247        JSR     DSP_STR         ; and display string
                    2248  UD_SK6:
19DA [06] 1343400D  2249        BRCLR   SFLAGS,$40,UD_SK7
                    2250        ; MUTE selected, display name
19DE [03] CE6DEC    2251        LDX     #S_MUTEON       ; Load MUTE ON string
19E1 [02] 8602      2252        LDAA    #!2             ; Line 2
19E3 [02] C603      2253        LDAB    #!3             ; Column 3
19E5 [06] BD1309    2254        JSR     DSP_CUR         ; Position Cursor
19E8 [06] BD12BD    2255        JSR     DSP_STR         ; and display string
                    2256  UD_SK7:
19EB [05] 38        2257        PULX
19EC [04] 33        2258        PULB
19ED [04] 32        2259        PULA
19EE [05] 39        2260        RTS
                    2261
                    2262  *=====================================================

                    2263  * Name:  V_UPDATE
                    2264  * Subroutine: Update the RUN MODE Vernier Value
                    2265  * Written by: Robert S. Dobrose
                    2266  * Purpose: Updates the Vernier value displayed on the
                    2267  *            RUN MODE screen.
                    2268  *          Creates new MCS velocity value and sends
                    2269  *            the new data to the MCS via the SPI.
                    2270  *   Input: Reg-D contains the latest Encoder value
                    2271  *  Output: none
                    2272  *   Notes:
                    2273  * - - - - - - - - - - - - - - - - - - - - - - - - - - - -
                    2274  V_UPDATE:
19EF                2275        EQU     *
                    2276        ; Display new value
19EF [02] 8601      2277        LDAA    #!1
19F1 [02] C60E      2278        LDAB    #!14
19F3 [04] DE44      2279        LDX     V_VAL
19F5 [06] BD18B7    2280        JSR     V_DISP
                    2281        ; Set NOTE index (if 12-wheel version) [start of loop]
19F8 [06] 15470F    2282        BCLR    NOTE_OCT,$0F    ; clear Note bits (Start at Note #0)
                    2283  VU_LP1:
19FB [03] CC0000    2284        LDD     #$0
19FE [06] 13420603  2285        BRCLR   DFLAGS,$06,VU_SK5
                    2286  ; #####  Change LOOK_TS to adjust for a selected TMPR Key.
1A02 [06] BD3285    2287        JSR     LOOK_TS
                    2288  ; #####  Add in TMPR Key offset in cents (adjusted for 'A') here.
                    2289  VU_SK5:
                    2290        ; | Calculate & perform new speed
1A05 [06] BD18C8    2291        JSR     V_CALC
                    2292        ; = Increment NOTE index (if 12-wheel version) and repeat loop
1A08 [06] 7C0047    2293        INC     NOTE_OCT        ; Increment to next Note
1A0B [03] 9647      2294        LDAA    NOTE_OCT
```

```
1A0D [02] 840F      2295      ANDA    #$0F            ; Look only at Note data
1A0F [02] 810C      2296      CMPA    #!12            ; Are 12 Notes done?
1A11 [03] 2DE8      2297      BLT     VU_LP1          ; Loop until 12 Notes done!
1A13 [06] 15470F    2298      BCLR    NOTE_OCT,$0F    ; Clear Note bits (return to Note #0)
1A16 [05] 39        2299      RTS
                    2300
                    2301  *=====================================================
                    2302  * Name:  MEM_FULL
                    2303  * Subroutine:
                    2304  * Written by: Robert S. Dobrose
                    2305  * Purpose:
                    2306  *   Input:
                    2307  *  Output: none
                    2308  *   Notes:
                    2309  * - - - - - - - - - - - - - - - - - - - - - - - - - -
                    2310  MEM_FULL:
1A17                2311      EQU     *
1A17 [03] 36        2312      PSHA
1A18 [04] 3C        2313      PSHX
                    2314      ; Display memory full message screen
1A19 macro          2315      SCR     005,0,125,126
1A19 [03] CE6093    2316   LDX #MSG%1
1A1C [06] BD12C1    2317   JSR LINE1
1A1F [03] CE6015    2318   LDX #MSG%2
1A22 [06] BD12C7    2319   JSR LINE2
1A25 [03] CE67B8    2320   LDX #MSG%3
1A28 [06] BD12CD    2321   JSR LINE3
1A2B [03] CE67CD    2322   LDX #MSG%4
1A2E [06] BD12D3    2323   JSR LINE4
                    2324      ; wait for a key hit
                    2325  MF_LP1:
1A31 [06] BD1366    2326      JSR     GET_KEY
1A34 [02] 4D        2327      TSTA
1A35 [03] 27FA      2328      BEQ     MF_LP1
1A37 [05] 38        2329      PULX
1A38 [04] 32        2330      PULA
1A39 [05] 39        2331      RTS
                    2332
                    2333  *=====================================================
                    2334  * Name:  ERR_BLOCK
                    2335  * Subroutine:
                    2336  * Written by: Robert S. Dobrose
                    2337  * Purpose:
                    2338  *   Input:
                    2339  *  Output: none
                    2340  *   Notes:
                    2341  * - - - - - - - - - - - - - - - - - - - - - - - - - -
                    2342  ERR_BLOCK:
1A3A                2343      EQU     *
1A3A [03] 36        2344      PSHA
1A3B [04] 3C        2345      PSHX
                    2346      ; Display BLOCK ERROR message screen
1A3C macro          2347      SCR     800,801,802,803
1A3C [03] CE6C3B    2348   LDX #MSG%1
1A3F [06] BD12C1    2349   JSR LINE1
1A42 [03] CE6C50    2350   LDX #MSG%2
1A45 [06] BD12C7    2351   JSR LINE2
1A48 [03] CE6C65    2352   LDX #MSG%3
1A4B [06] BD12CD    2353   JSR LINE3
1A4E [03] CE6C7A    2354   LDX #MSG%4
1A51 [06] BD12D3    2355   JSR LINE4
                    2356      ; wait for a key hit
                    2357  ERB_LP1:
1A54 [06] BD1366    2358      JSR     GET_KEY
1A57 [02] 4D        2359      TSTA
1A58 [03] 27FA      2360      BEQ     ERB_LP1
1A5A [05] 38        2361      PULX
1A5B [04] 32        2362      PULA
```

```
1A5C [05] 39          2363        RTS
                      2364
                      2365  *=====================================================
                      2366  * Name:  ERR_CS
                      2367  * Subroutine: Display CHECKSUM ERROR data screen
                      2368  * Written by: Robert S. Dobrose
                      2369  * Purpose:
                      2370  *   Input:
                      2371  *  Output: none
                      2372  *   Notes:
                      2373  * - - - - - - - - - - - - - - - - - - - - - - - - - - -
                      2374  ERR_CS:
1A5D                  2375        EQU     *
1A5D [03] 36          2376        PSHA
1A5E [03] 37          2377        PSHB
1A5F [04] 3C          2378        PSHX
                      2379        ; Display BLOCK ERROR message screen
1A60 macro            2380        SCR     810,811,812,803
1A60 [03] CE6C8F      2381   LDX #MSG%1
1A63 [06] BD12C1      2382   JSR LINE1
1A66 [03] CE6CA4      2383   LDX #MSG%2
1A69 [06] BD12C7      2384   JSR LINE2
1A6C [03] CE6CB9      2385   LDX #MSG%3
1A6F [06] BD12CD      2386   JSR LINE3
1A72 [03] CE6C7A      2387   LDX #MSG%4
1A75 [06] BD12D3      2388   JSR LINE4
                      2389        ; Display record type
1A78 [02] 8601        2390        LDAA    #!1             ; Line 1
1A7A [02] C601        2391        LDAB    #!1             ; Column 1
1A7C [06] BD1309      2392        JSR     DSP_CUR         ; Position Cursor
1A7F [03] 9681        2393        LDAA    IDX2
1A81 [02] 8108        2394        CMPA    #TYP_S0
1A83 [03] 2605        2395        BNE     ERC_SK10
                      2396        ; Record is a STRCH
1A85 [03] CE675E      2397        LDX     #MSG117
1A88 [03] 200C        2398        BRA     ERC_SK14
                      2399  ERC_SK10:
1A8A [02] 8107        2400        CMPA    #TYP_T0
1A8C [03] 2605        2401        BNE     ERC_SK11
                      2402        ; Record is a TMPR
1A8E [03] CE6758      2403        LDX     #MSG116
1A91 [03] 2003        2404        BRA     ERC_SK14
                      2405  ERC_SK11:
                      2406  ;     CMPA    #TYP_Q0
                      2407  ;     BNE     ERC_SK13
                      2408        ; Record is a SEQ
1A93 [03] CE6752      2409        LDX     #MSG115
                      2410  ;     BRA     ERC_SK14
                      2411  ERC_SK14:
1A96 [06] BD12BD      2412        JSR     DSP_STR         ; and display string
                      2413        ; Display record name
1A99 [02] 8601        2414        LDAA    #!1             ; Line 1
1A9B [02] C60F        2415        LDAB    #!15            ; Column 15
1A9D [06] BD1309      2416        JSR     DSP_CUR         ; Position Cursor
1AA0 [04] DE55        2417        LDX     PTR3
1AA2 [04] A61A        2418        LDAA    TS_NOFF,X
1AA4 [06] BD12EE      2419        JSR     DSP_CHR
1AA7 [04] A61B        2420        LDAA    TS_NOFF+1,X
1AA9 [06] BD12EE      2421        JSR     DSP_CHR
1AAC [04] A61C        2422        LDAA    TS_NOFF+2,X
1AAE [06] BD12EE      2423        JSR     DSP_CHR
1AB1 [04] A61D        2424        LDAA    TS_NOFF+3,X
1AB3 [06] BD12EE      2425        JSR     DSP_CHR
                      2426        ; wait for a key hit
                      2427  ERC_LP1:
1AB6 [06] BD1366      2428        JSR     GET_KEY
1AB9 [02] 4D          2429        TSTA
1ABA [03] 27FA        2430        BEQ     ERC_LP1
```

```
1ABC [05] 38        2431        PULX
1ABD [04] 33        2432        PULB
1ABE [04] 32        2433        PULA
1ABF [05] 39        2434        RTS
                    2435
                    2436
                    2437  * - - - - - - - - - - - - - - - - - - - - - - - - - - - - - -
                    2438  * End of I/O and Select Subroutines
                    2439  *=========================================================
                    2440
1AC0                2441  $INCLUDE 'MATH.ASM'              ;Include MATH Subroutines
1AC0                2442  $base 10T
1AC0                2443  $pagewidth 132
                    2444  *=========================================================*
                    2445  *   Peterson Tuner: Math Subroutines                      *
                    2446  *   Written by  Robert S. Dobrose                         *
                    2447  *   Saracon, Inc.                                         *
                    2448  *     1135 Garfield Ave.                                  *
                    2449  *     Libertyville, IL  60048                             *
                    2450  *=========================================================*
                    2451  *   Release History                                       *
                    2452  *   03/02/95  0.1 - Initial code revision                 *
                    2453  *=========================================================*
                    2454
                    2455
                    2456  *=========================================================
                    2457  * Subroutine: MULTI
                    2458  *    Purpose: Unsigned binary multiply
                    2459  *             This subroutine multiplies a 16 bit number
                    2460  *             by a 16 bit number.  The result is a
                    2461  *             32 bit number, stored in memory.
                    2462  *      Input: MULT1  multiplicand
                    2463  *             MULT2  multiplier
                    2464  *     Output: None
                    2465  *      Notes: Data in the X and D registers is
                    2466  *             destroyed.
                    2467  *             Global variables -
                    2468  *                MULT1     FDB    $0000  multiplier
                    2469  *                MULT2     FDB    $0000  multiplicand
                    2470  *                DBUFFER   RMB    $04    product
                    2471  * - - - - - - - - - - - - - - - - - - - - - - - - - - - - - -
1AC0                2472  MULTI:       EQU     *
                    2473  ;        STX MULT2            ;save multiplicand in MULT2
                    2474  ;        STD MULT1            ;save multiplier in MULT1
1AC0 [03] CE0000    2475        LDX     #$0000          ;use rX to index the result
1AC3 [04] DF96      2476        STX     DBUFFER         ;clear result MSW
1AC5 [04] DF98      2477        STX     DBUFFER+2       ;clear result LSW
1AC7 [03] 968F      2478        LDAA    MULT1+1         ;multiplier LSB -> rA
1AC9 [03] D693      2479        LDAB    MULT2+1         ;multiplicand LSB -> rB
1ACB [10] 3D        2480        MUL
1ACC [04] DD98      2481        STD     DBUFFER+2       ;rD -> result (low 16)
1ACE [03] 968F      2482        LDAA    MULT1+1         ;multiplier LSB -> rA
1AD0 [03] D692      2483        LDAB    MULT2           ;multiplicand MSB -> rB
1AD2 [10] 3D        2484        MUL
1AD3 [05] D397      2485        ADDD    DBUFFER+1       ;add rD to result
1AD5 [04] DD97      2486        STD     DBUFFER+1       ;save in result
                    2487  ;     BCC     MUL_SK1
                    2488  ;     INC     DBUFFER         ;increment next byte if carry
                    2489  ;MUL_SK1:
1AD7 [03] 968E      2490        LDAA    MULT1           ;multiplier MSB -> rA
1AD9 [03] D693      2491        LDAB    MULT2+1         ;multiplicand LSB -> rB
1ADB [10] 3D        2492        MUL
1ADC [05] D397      2493        ADDD    DBUFFER+1       ;add rD to result
1ADE [04] DD97      2494        STD     DBUFFER+1       ;save rD in result
                    2495  ;     BCC     MUL_SK2
                    2496  ;     INC     DBUFFER         ;increment next byte if carry
                    2497  ;MUL_SK2:
1AE0 [06] 790096    2498        ROL     DBUFFER         ;adjust for carry
```

```
1AE3 [03] 968E      2499      LDAA    MULT1          ;load MSB of mulitplier
1AE5 [03] D692      2500      LDAB    MULT2          ;load MSB of multiplicand
1AE7 [10] 3D        2501      MUL
1AE8 [05] D396      2502      ADDD    DBUFFER
1AEA [04] DD96      2503      STD     DBUFFER
1AEC [05] 39        2504      RTS
                    2505
                    2506  * - - - - - - - - - - - - - - - - - - - - - - - - - - - -
                    2507  * End of binary multiply
                    2508  *=====================================================
                    2509
                    2510  *=====================================================
                    2511  * Subroutine: MULTSCL
                    2512  *    Purpose: Special Scale factor multiply
                    2513  *             This subroutine multiplies a 16 bit number
                    2514  *             by an 8 bit number.  The result is a
                    2515  *             16 bit number, stored in memory.
                    2516  *      Input: MULT1  multiplicand
                    2517  *             MULT2  multiplier
                    2518  *     Output: None
                    2519  *      Notes: Data in the X and D registers is
                    2520  *             destroyed.
                    2521  *             Global variables -
                    2522  *                MULT1     FDB    $0000  multiplier
                    2523  *                MULT2     FCB    $00    multiplicand
                    2524  *                DBUFFER   RMB    $02    product
                    2525  * - - - - - - - - - - - - - - - - - - - - - - - - - - - -
                    2526  MULTSCL:
1AED                2527      EQU     *
1AED [03] CE0000    2528      LDX     #$0000         ;use rX to index the result
1AF0 [04] DF96      2529      STX     DBUFFER        ;clear result MSW
1AF2 [03] 968E      2530      LDAA    MULT1          ;multiplier MSB -> rA
1AF4 [03] D692      2531      LDAB    MULT2          ;multiplicand -> rB
1AF6 [10] 3D        2532      MUL
1AF7 [03] D796      2533      STAB    DBUFFER        ;save LSB of result rB in buffer
1AF9 [03] 968F      2534      LDAA    MULT1+1        ;multiplier LSB -> rA
1AFB [03] D692      2535      LDAB    MULT2          ;multiplicand -> rB
1AFD [10] 3D        2536      MUL
1AFE [05] D396      2537      ADDD    DBUFFER        ;add buffer to result
1B00 [04] DD96      2538      STD     DBUFFER        ;save in buffer
1B02 [05] 39        2539      RTS
                    2540
                    2541  * - - - - - - - - - - - - - - - - - - - - - - - - - - - -
                    2542  * End of Scale multiply
                    2543  *=====================================================
                    2544
                    2545  *=====================================================
                    2546  * Subroutine: MULTMCS
                    2547  *    Purpose: Unsigned special MCS multiply
                    2548  *             This subroutine multiplies a 24 bit number
                    2549  *             by a 24 bit number.  The result is a
                    2550  *             48 bit number, stored in memory.
                    2551  *      Input: MULT1  multiplicand (24-bit)
                    2552  *              (scaled as 8.16 bits [8 int, 16 frac])
                    2553  *             MULT2  multiplier (24-bit)
                    2554  *              (scaled as 24-bit fractional value)
                    2555  *     Output: None
                    2556  *      Notes: Data in the X and D registers is
                    2557  *             destroyed.
                    2558  *             The starting values must be small enough
                    2559  *             that the result does not overflow a 32 bit
                    2560  *             value!!!
                    2561  *             For MCS, Max value in MSB (24 bit) is integer,
                    2562  *             multiplier is always fractional (24 bit).
                    2563  *             Throw away the least significant bytes of
                    2564  *             result!  (probably don't even have to mult.
                    2565  *             them!)   (This will save time!)
                    2566  * - - - - - - - - - - - - - - - - - - - - - - - - - - - -
```

```
                    MULTMCS:
1B03                EQU     *
1B03 [03] CE0000    LDX     #$0000          ;use rX to index the result
1B06 [04] DF96      STX     DBUFFER         ;clear result MSW
1B08 [04] DF98      STX     DBUFFER+2       ;clear result LSW
1B0A [04] DF9A      STX     DBUFFER+4       ;clear result LSW
1B0C [03] 9690      LDAA    MULT1+2         ;multiplier LSBy -> rA
1B0E [03] D694      LDAB    MULT2+2         ;multiplicand LSBy -> rB
1B10 [10] 3D        MUL
1B11 [04] DD9A      STD     DBUFFER+4       ;rD -> result (low 16)
1B13 [03] 9690      LDAA    MULT1+2         ;multiplier LSBy -> rA
1B15 [03] D693      LDAB    MULT2+1         ;multiplicand 2SBy -> rB
1B17 [10] 3D        MUL
1B18 [05] D399      ADDD    DBUFFER+3       ;add rD to result
1B1A [04] DD99      STD     DBUFFER+3       ;save in result
1B1C [03] 2403      BCC     MM_SK1
1B1E [06] 7C0098    INC     DBUFFER+2       ;increment next byte if carry
                    MM_SK1:
1B21 [03] 968F      LDAA    MULT1+1         ;multiplier 2SBy -> rA
1B23 [03] D694      LDAB    MULT2+2         ;multiplicand LSBy -> rB
1B25 [10] 3D        MUL
1B26 [05] D399      ADDD    DBUFFER+3       ;add rD to result
1B28 [04] DD99      STD     DBUFFER+3       ;save in result
1B2A [03] 2403      BCC     MM_SK2
1B2C [06] 7C0098    INC     DBUFFER+2       ;increment next byte if carry
                    MM_SK2:
1B2F [03] 9690      LDAA    MULT1+2         ;multiplier LSBy -> rA
1B31 [03] D692      LDAB    MULT2           ;multiplicand MSBy -> rB
1B33 [10] 3D        MUL
1B34 [05] D398      ADDD    DBUFFER+2       ;add rD to result
1B36 [04] DD98      STD     DBUFFER+2       ;save in result
1B38 [03] 2403      BCC     MM_SK3
1B3A [06] 7C0097    INC     DBUFFER+1       ;increment next byte if carry
                    MM_SK3:
1B3D [03] 968F      LDAA    MULT1+1         ;multiplier 2SBy -> rA
1B3F [03] D693      LDAB    MULT2+1         ;multiplicand 2SBy -> rB
1B41 [10] 3D        MUL
1B42 [05] D398      ADDD    DBUFFER+2       ;add rD to result
1B44 [04] DD98      STD     DBUFFER+2       ;save in result
1B46 [03] 2403      BCC     MM_SK4
1B48 [06] 7C0097    INC     DBUFFER+1       ;increment next byte if carry
                    MM_SK4:
1B4B [03] 968E      LDAA    MULT1           ;multiplier MSBy -> rA
1B4D [03] D694      LDAB    MULT2+2         ;multiplicand LSBy -> rB
1B4F [10] 3D        MUL
1B50 [05] D398      ADDD    DBUFFER+2       ;add rD to result
1B52 [04] DD98      STD     DBUFFER+2       ;save rD in result
1B54 [03] 2403      BCC     MM_SK5
1B56 [06] 7C0097    INC     DBUFFER+1       ;increment next byte if carry
                    MM_SK5:
                    ;       LDAB    DBUFFER+3       ; Check if LSB rounding is needed
                    ;       BPL     MM_SK21         ; Not needed, Skip next stuff
                    ;       LDX     DBUFFER+1       ; Round resulting value up to next int.
                    ;       INX
                    ;       STX     DBUFFER+1       ; and store it
                    ;MM_SK21:
                    ;       CLR     DBUFFER+3       ; Clear unused LSB
1B59 [03] 968E      LDAA    MULT1           ;multiplier MSBy -> rA
1B5B [03] D693      LDAB    MULT2+1         ;multiplicand 2SBy -> rB
1B5D [10] 3D        MUL
1B5E [05] D397      ADDD    DBUFFER+1       ;add rD to result
1B60 [04] DD97      STD     DBUFFER+1       ;save rD in result
1B62 [03] 2403      BCC     MM_SK6
1B64 [06] 7C0096    INC     DBUFFER         ;increment next byte if carry
                    MM_SK6:
1B67 [03] 968F      LDAA    MULT1+1         ;multiplier 2SBy -> rA
1B69 [03] D692      LDAB    MULT2           ;multiplicand LSBy -> rB
1B6B [10] 3D        MUL
```

```
1B6C [05] D397      2635      ADDD    DBUFFER+1        ;add rD to result
1B6E [04] DD97      2636      STD     DBUFFER+1        ;save rD in result
1B70 [03] 2403      2637      BCC     MM_SK7
1B72 [06] 7C0096    2638      INC     DBUFFER          ;increment next byte if carry
                    2639  MM_SK7:
1B75 [03] 968E      2640      LDAA    MULT1            ;load MSBy of mulitplier
1B77 [03] D692      2641      LDAB    MULT2            ;load MSBy of multiplicand
1B79 [10] 3D        2642      MUL
1B7A [05] D396      2643      ADDD    DBUFFER
1B7C [04] DD96      2644      STD     DBUFFER
1B7E [05] 39        2645      RTS
                    2646
                    2647  * - - - - - - - - - - - - - - - - - - - - - - - - - - - - - -
                    2648  * End of MCS multiply
                    2649  *=========================================================
                    2650
                    2651
1B7F                2652  $INCLUDE 'MENU.ASM'              ;Include MENU Subroutines
                    2653  *=========================================================*
                    2654  *   Peterson Tuner Menu Subroutines                       *
                    2655  *   Written by: Robert S. Dobrose                         *
                    2656  *   Saracon, Inc.                                         *
                    2657  *     1135 Garfield Ave.                                  *
                    2658  *     Libertyville, IL  60048                             *
                    2659  *=========================================================*
                    2660  *   Release History                                       *
                    2661  *   02/15/95  1.0  - Initial Code                         *
                    2662  *=========================================================*
                    2663
                    2664
                    2665  *=========================================================
                    2666  * Name:  MENU
                    2667  * Subroutine: Main Menu Routine
                    2668  * Written by: Robert S. Dobrose
                    2669  * Purpose: Displays the "Main Menu" screen and waits for
                    2670  *            Function key input.  Then jumps to the
                    2671  *            selected sub-menu routine.
                    2672  *   Input: none
                    2673  *  Output: none
                    2674  *   Notes:  This routine is called as a subroutine
                    2675  *             but jumps to other routines.  The other
                    2676  *             menu routines should jump to the start
                    2677  *             of this routine on a "Return To MAIN"
                    2678  *             function and should perform an RTS on a
                    2679  *             "RUN" function to return to the main
                    2680  *             operational loop.
                    2681  *        ** Register X and Accum-A are modified
                    2682  * - - - - - - - - - - - - - - - - - - - - - - - - - - - - - -
                    2683
                    2684  MENU:
1B7F                2685      EQU     *
                    2686
                    2687  ;     MNU     020,021,0,022,SETUP,DIAG,MENU_RUN,DIAG2,MNU0
                    2688  ;     MNU     020,021,0,022,SETUP,DIAG,MENU_RUN,CH_NOTE,MNU0
                    2689  ;     MNU     020,021,0,022,SETUP,DIAG,MENU_RUN,MNU0,MNU0
1B7F macro          2690      MNU     020,021,0,022,SETUP,ED_REC,MENU_RUN,DIAG,MNU0
1B7F [03] CE6130    2691   LDX #MSG%1
1B82 [06] BD12C1    2692   JSR LINE1
1B85 [03] CE6145    2693   LDX #MSG%2
1B88 [06] BD12C7    2694   JSR LINE2
1B8B [03] CE6015    2695   LDX #MSG%3
1B8E [06] BD12CD    2696   JSR LINE3
1B91 [03] CE615A    2697   LDX #MSG%4
1B94 [06] BD12D3    2698   JSR LINE4
1B97 [06] BD1331    2699   JSR WAIT_NONE
                    2700  MNU0:
1B9A [02] 861F      2701   LDAA #$1F
1B9C [04] 18CE2EE0  2702   LDY #!12000
```

```
1BA0 [06] BD1388    2703   JSR WAIT_KEY
1BA3 [02] 4D        2704   TSTA
1BA4 [03] 2601      2705   BNE MNU0A
1BA6 [05] 39        2706   RTS
                    2707  MNU0A:
1BA7 [02] 8101      2708   CMPA #$01
1BA9 [03] 2603      2709   BNE MNU1
1BAB [03] 7E1BD0    2710   JMP %5
                    2711  MNU1:
1BAE [02] 8102      2712   CMPA #$02
1BB0 [03] 2603      2713   BNE MNU2
1BB2 [03] 7E1E64    2714   JMP %6
                    2715  MNU2:
1BB5 [02] 8104      2716   CMPA #$04
1BB7 [03] 2603      2717   BNE MNU3
1BB9 [03] 7E1BCC    2718   JMP %7
                    2719  MNU3:
1BBC [02] 8108      2720   CMPA #$08
1BBE [03] 2603      2721   BNE MNU4
1BC0 [03] 7E1CC2    2722   JMP %8
                    2723  MNU4:
1BC3 [02] 8110      2724   CMPA #$10
1BC5 [03] 2603      2725   BNE MNU5
1BC7 [03] 7E1B9A    2726   JMP %9
                    2727  MNU5:
1BCA [03] 20CE      2728   BRA MNU0
                    2729
                    2730  MENU_RUN:
1BCC [06] BD1331    2731       JSR     WAIT_NONE       ; Wait for no keys pressed
1BCF [05] 39        2732       RTS
                    2733
                    2734  ;CH_NOTE:
                    2735  ;    INC     NOTE_OCT
                    2736  ;    LDAA    NOTE_OCT
                    2737  ;    ANDA    #$0F
                    2738  ;    CMPA    #!12
                    2739  ;    BLT     CN_X1
                    2740  ;    LDAA    NOTE_OCT
                    2741  ;    ANDA    #$F0
                    2742  ;    STAA    NOTE_OCT
                    2743  ;CN_X1:
                    2744  ;    JSR     WAIT_NONE       ; Wait for no keys pressed
                    2745  ;    RTS
                    2746
                    2747  SETUP:
1BD0 [06] BD1331    2748       JSR     WAIT_NONE       ; Wait for no keys pressed
                    2749       ; Display "RECAL TUNER" screen
1BD3 macro          2750       SCR     050,051,0,052
1BD3 [03] CE630E    2751   LDX #MSG%1
1BD6 [06] BD12C1    2752   JSR LINE1
1BD9 [03] CE6323    2753   LDX #MSG%2
1BDC [06] BD12C7    2754   JSR LINE2
1BDF [03] CE6015    2755   LDX #MSG%3
1BE2 [06] BD12CD    2756   JSR LINE3
1BE5 [03] CE6338    2757   LDX #MSG%4
1BE8 [06] BD12D3    2758   JSR LINE4
1BEB [04] DE5A      2759       LDX     CAL_A
1BED [06] BD1503    2760       JSR     SLCT_UP_DOWN
1BF0 [04] DF5A      2761       STX     CAL_A
1BF2 [03] 36        2762       PSHA
1BF3 [06] BD1776    2763       JSR     CALC_MULT
1BF6 [04] 32        2764       PULA
1BF7 [02] 8102      2765       CMPA    #$2             ; Check for RUN return
1BF9 [03] 2604      2766       BNE     STUP_SK03
1BFB [06] BD1331    2767       JSR     WAIT_NONE       ; Wait for no keys pressed
1BFE [05] 39        2768       RTS                     ; RUN hit, return to RUN MODE
                    2769  STUP_SK03:
                    2770
```

```
1BFF [06] BD1331    2771      JSR     WAIT_NONE       ; Wait for no keys pressed
                    2772      ; Display "CONTRAST ADJUST" screen
1C02 macro          2773      SCR     053,054,0,058
1C02 [03] CE634D    2774   LDX #MSG%1
1C05 [06] BD12C1    2775   JSR LINE1
1C08 [03] CE6362    2776   LDX #MSG%2
1C0B [06] BD12C7    2777   JSR LINE2
1C0E [03] CE6015    2778   LDX #MSG%3
1C11 [06] BD12CD    2779   JSR LINE3
1C14 [03] CE63B6    2780   LDX #MSG%4
1C17 [06] BD12D3    2781   JSR LINE4
1C1A [03] D648      2782      LDAB    CONTRAST        ; Get CONTRAST value
1C1C [02] 4F        2783      CLRA                    ; Clear high bits
1C1D [03] 8F        2784      XGDX                    ; Transfer data to Reg-X (for Edit)
1C1E [06] BD1553    2785      JSR     SLCT_CONTRAST   ; Set new CONTRAST value
1C21 [03] 8F        2786      XGDX                    ; Swap data back to Reg-D (Key return to
X)
1C22 [02] C40F      2787      ANDB    #$0F            ; Mask off unused bits
1C24 [03] D748      2788      STAB    CONTRAST        ; Save new value for Contrast
1C26 [03] 8F        2789      XGDX                    ; Swap Key return back to Reg-A (From
Reg-X)
1C27 [02] 8102      2790      CMPA    #$2             ; Check for RUN return
1C29 [03] 2604      2791      BNE     STUP_SK13
1C2B [06] BD1331    2792      JSR     WAIT_NONE       ; Wait for no keys pressed
1C2E [05] 39        2793      RTS                     ; RUN hit, return to RUN MODE
                    2794  STUP_SK13:
                    2795  ;   JSR     WAIT_NONE       ; Wait for no keys pressed
                    2796  ;   ; Display "AUTO SEQ" screen
                    2797  ;   SCR     030,031,0,032
                    2798  ;   LDAB    SFLAGS
                    2799  ;   ANDB    #$04
                    2800  ;   JSR     SLCT_ON_OFF
                    2801  ;   TSTB
                    2802  ;   BNE     STUP_SK21
                    2803  ;   BCLR    SFLAGS,$04
                    2804  ;   BRA     STUP_SK22
                    2805  ;STUP_SK21:
                    2806  ;   BSET    SFLAGS,$04
                    2807  ;STUP_SK22:
                    2808  ;   CMPA    #$2             ; Check for RUN return
                    2809  ;   BNE     STUP_SK23
                    2810  ;   JSR     WAIT_NONE       ; Wait for no keys pressed
                    2811  ;   RTS                     ; RUN hit, return to RUN MODE
                    2812  ;STUP_SK23:
                    2813  ;   JSR     WAIT_NONE       ; Wait for no keys pressed
                    2814  ;   ; Display "NOTE SCAN" screen
                    2815  ;   SCR     040,041,0,042
                    2816  ;   LDAB    N_SCAN
                    2817  ;   JSR     SLCT_FST_SLO
                    2818  ;   STAB    N_SCAN
                    2819  ;   CMPA    #$2             ; Check for RUN return
                    2820  ;   BNE     STUP_SK3
                    2821  ;   JSR     WAIT_NONE       ; Wait for no keys pressed
                    2822  ;   RTS                     ; RUN hit, return to RUN MODE
                    2823  ;STUP_SK3:
1C2F [06] BD1331    2824      JSR     WAIT_NONE       ; Wait for no keys pressed
                    2825      ; Display "IMG CLAR" screen
1C32 macro          2826      SCR     045,046,0,047
1C32 [03] CE62C7    2827   LDX #MSG%1
1C35 [06] BD12C1    2828   JSR LINE1
1C38 [03] CE62DC    2829   LDX #MSG%2
1C3B [06] BD12C7    2830   JSR LINE2
1C3E [03] CE6015    2831   LDX #MSG%3
1C41 [06] BD12CD    2832   JSR LINE3
1C44 [03] CE62F1    2833   LDX #MSG%4
1C47 [06] BD12D3    2834   JSR LINE4
1C4A [03] D643      2835      LDAB    SFLAGS
1C4C [02] C408      2836      ANDB    #$08
```

```
1C4E [06] BD1477    2837        JSR     SLCT_HI_LOW
1C51 [02] 5D        2838        TSTB
1C52 [03] 2606      2839        BNE     STUP_SK41
1C54 [06] 154308    2840        BCLR    SFLAGS,$08
1C57 [02] 5F        2841        CLRB
1C58 [03] 2005      2842        BRA     STUP_SK42
                    2843   STUP_SK41:
1C5A [06] 144308    2844        BSET    SFLAGS,$08
1C5D [03] D601      2845        LDAB    $01
                    2846   STUP_SK42:
1C5F [04] F7E004    2847        STAB    OUTPUTS
1C62 [02] 8102      2848        CMPA    #$2             ; Check for RUN return
1C64 [03] 2604      2849        BNE     STUP_SK43
1C66 [06] BD1331    2850        JSR     WAIT_NONE       ; Wait for no keys pressed
1C69 [05] 39        2851        RTS                     ; RUN hit, return to RUN MODE
                    2852   STUP_SK43:
                    2853
                    2854   ;    JSR     WAIT_NONE       ; Wait for no keys pressed
                    2855        ; Display "AUTO NOTE" screen
                    2856   ;    SCR     037,031,0,032
                    2857   ;    LDAB    DFLAGS
                    2858   ;    ANDB    #$10
                    2859   ;    JSR     SLCT_ON_OFF
                    2860   ;    TSTB
                    2861   ;    BNE     STUP_SK51
                    2862   ;    BCLR    DFLAGS,$10
                    2863   ;    BRA     STUP_SK52
                    2864   ;STUP_SK51:
                    2865   ;    BSET    DFLAGS,$10
                    2866   ;STUP_SK52:
                    2867
                    2868   ;    JSR     WAIT_NONE       ; Wait for no keys pressed
                    2869        ; Display "BATTERY OPTION" screen
                    2870   ;    SCR     038,031,0,032
                    2871   ;    LDAB    SFLAGS
                    2872   ;    ANDB    #$10
                    2873   ;    JSR     SLCT_ON_OFF
                    2874   ;    TSTB
                    2875   ;    BNE     STUP_SK61
                    2876   ;    BCLR    SFLAGS,$10
                    2877   ;    BRA     STUP_SK62
                    2878   ;STUP_SK61:
                    2879   ;    BSET    SFLAGS,$10
                    2880   ;STUP_SK62:
                    2881
1C6A [03] 9640      2882        LDAA    MEM_ERR
1C6C [03] 2706      2883        BEQ     STUP_SK71
1C6E [06] BD1A3A    2884        JSR     ERR_BLOCK
1C71 [03] 7E1B7F    2885        JMP     MENU
                    2886   STUP_SK71:
1C74 macro          2887        SCR     055,056,0,057
1C74 [03] CE6377    2888   LDX #MSG%1
1C77 [06] BD12C1    2889   JSR LINE1
1C7A [03] CE638C    2890   LDX #MSG%2
1C7D [06] BD12C7    2891   JSR LINE2
1C80 [03] CE6015    2892   LDX #MSG%3
1C83 [06] BD12CD    2893   JSR LINE3
1C86 [03] CE63A1    2894   LDX #MSG%4
1C89 [06] BD12D3    2895   JSR LINE4
1C8C [06] BD1331    2896        JSR     WAIT_NONE       ; Wait for no keys pressed
1C8F macro          2897        CHOOSE  STUP_SK75,STUP_SK74,STUP_SK76,MNU0,MNU0
                    2898   MNU0:
1C8F [06] BD1366    2899   JSR GET_KEY
1C92 [02] 841F      2900   ANDA #$1F
1C94 [03] 27F9      2901   BEQ MNU0
1C96 [02] 8101      2902   CMPA #$01
1C98 [03] 2603      2903   BNE MNU1
1C9A [03] 7E1CBE    2904   JMP %1
```

```
                    2905  MNU1:
1C9D [02] 8102      2906   CMPA #$02
1C9F [03] 2603      2907   BNE MNU2
1CA1 [03] 7E1CBB    2908   JMP %2
                    2909  MNU2:
1CA4 [02] 8104      2910   CMPA #$04
1CA6 [03] 2603      2911   BNE MNU3
1CA8 [03] 7E1CC1    2912   JMP %3
                    2913  MNU3:
1CAB [02] 8108      2914   CMPA #$08
1CAD [03] 2603      2915   BNE MNU4
1CAF [03] 7E1C8F    2916   JMP %4
                    2917  MNU4:
1CB2 [02] 8110      2918   CMPA #$10
1CB4 [03] 2603      2919   BNE MNU5
1CB6 [03] 7E1C8F    2920   JMP %5
                    2921  MNU5:
1CB9 [03] 20D4      2922   BRA MNU0
                    2923       ; Add Memory Save option here
                    2924  STUP_SK74:
1CBB [06] BD3346    2925       JSR     SAVE_HEAD
                    2926  STUP_SK75:
1CBE [03] 7E1B7F    2927       JMP     MENU
                    2928  STUP_SK76:
1CC1 [05] 39        2929       RTS
                    2930
                    2931  DIAG:
                    2932  ;    JSR     NO_IMP
                    2933  ;    JSR     WAIT_NONE       ; Wait for no keys pressed
1CC2 macro          2934       SCR     060,021,061,062
1CC2 [03] CE63CB    2935   LDX #MSG%1
1CC5 [06] BD12C1    2936   JSR LINE1
1CC8 [03] CE6145    2937   LDX #MSG%2
1CCB [06] BD12C7    2938   JSR LINE2
1CCE [03] CE63E0    2939   LDX #MSG%3
1CD1 [06] BD12CD    2940   JSR LINE3
1CD4 [03] CE63F5    2941   LDX #MSG%4
1CD7 [06] BD12D3    2942   JSR LINE4
1CDA macro          2943       MNUX    DG_1,DG_2,DG_3,MENU,DG_4,DG_7,DG_5,DG_6
1CDA [06] BD1331    2944   JSR WAIT_NONE
                    2945  MNU0:
1CDD [02] 861F      2946   LDAA #$1F
1CDF [04] 18CE2EE0  2947   LDY #!12000
1CE3 [06] BD1388    2948   JSR WAIT_KEY
1CE6 [02] 4D        2949   TSTA
1CE7 [03] 2601      2950   BNE MNUX0A
1CE9 [05] 39        2951   RTS
                    2952  MNUX0A:
1CEA [02] 8101      2953   CMPA #$01
1CEC [03] 2603      2954   BNE MNUX1
1CEE [03] 7E1D27    2955   JMP %1
                    2956  MNUX1:
1CF1 [02] 8102      2957   CMPA #$02
1CF3 [03] 2603      2958   BNE MNUX2
1CF5 [03] 7E1D58    2959   JMP %2
                    2960  MNUX2:
1CF8 [02] 8104      2961   CMPA #$04
1CFA [03] 2603      2962   BNE MNUX3
1CFC [03] 7E1D79    2963   JMP %3
                    2964  MNUX3:
1CFF [02] 8108      2965   CMPA #$08
1D01 [03] 2603      2966   BNE MNUX4
1D03 [03] 7E1B7F    2967   JMP %4
                    2968  MNUX4:
1D06 [02] 8111      2969   CMPA #$11
1D08 [03] 2603      2970   BNE MNUX11
1D0A [03] 7E1D7A    2971   JMP %5
                    2972  MNUX11:
```

```
1D0D [02] 8112      2973   CMPA #$12
1D0F [03] 2603      2974   BNE MNUX12
1D11 [03] 7E1E55    2975   JMP %6
                    2976  MNUX12:
1D14 [02] 8114      2977   CMPA #$14
1D16 [03] 2603      2978   BNE MNUX13
1D18 [03] 7E1DDA    2979   JMP %7
                    2980  MNUX13:
1D1B [02] 8118      2981   CMPA #$18
1D1D [03] 2603      2982   BNE MNUX14
1D1F [03] 7E1DE3    2983   JMP %8
                    2984  MNUX14:
1D22 [03] 20B9      2985   BRA MNU0
1D24 [03] 7E1B7F    2986       JMP     MENU
                    2987
                    2988  DG_1:
                    2989       ; *** SELF TEST ***
1D27 [06] BD1331    2990       JSR     WAIT_NONE
1D2A [06] BD303F    2991       JSR     MEM_TST
1D2D [03] 9640      2992       LDAA    MEM_ERR
1D2F [03] 2706      2993       BEQ     DG1_SK1
1D31 [06] BD33DD    2994       JSR     ERR_DFLT
1D34 [03] 7E1CC2    2995       JMP     DIAG
                    2996  DG1_SK1:
1D37 macro          2997       SCR     0,063,0,0
1D37 [03] CE6015    2998   LDX #MSG%1
1D3A [06] BD12C1    2999   JSR LINE1
1D3D [03] CE640A    3000   LDX #MSG%2
1D40 [06] BD12C7    3001   JSR LINE2
1D43 [03] CE6015    3002   LDX #MSG%3
1D46 [06] BD12CD    3003   JSR LINE3
1D49 [03] CE6015    3004   LDX #MSG%4
1D4C [06] BD12D3    3005   JSR LINE4
1D4F [03] CE012C    3006       LDX     #!300
1D52 [06] BD1178    3007       JSR     TIMER
1D55 [03] 7E1CC2    3008       JMP     DIAG
                    3009
                    3010  DG_2:
                    3011       ; *** OSC TEST ***
                    3012  ;    JSR     NO_IMP
                    3013  ;    JSR     WAIT_NONE
1D58 macro          3014       SCR     0,063,0,0
1D58 [03] CE6015    3015   LDX #MSG%1
1D5B [06] BD12C1    3016   JSR LINE1
1D5E [03] CE640A    3017   LDX #MSG%2
1D61 [06] BD12C7    3018   JSR LINE2
1D64 [03] CE6015    3019   LDX #MSG%3
1D67 [06] BD12CD    3020   JSR LINE3
1D6A [03] CE6015    3021   LDX #MSG%4
1D6D [06] BD12D3    3022   JSR LINE4
1D70 [03] CE012C    3023       LDX     #!300
1D73 [06] BD1178    3024       JSR     TIMER
1D76 [03] 7E1CC2    3025       JMP     DIAG
                    3026
                    3027  DG_3:
1D79 [05] 39        3028       RTS             ; Return to RUN MODE
                    3029
                    3030  DG_4:
                    3031       ; *** SERIAL NUMBER ENTRY ***
1D7A [06] BD1331    3032       JSR     WAIT_NONE
1D7D [03] CE0082    3033       LDX     #D_STR
1D80 [06] BD169E    3034       JSR     SER_NUM
                    3035       ; Check returned pointer
1D83 [04] 8C0000    3036       CPX     #$0000
1D86 [03] 2603      3037       BNE     DG4_SK11        ; Not NULL, continue.
1D88 [03] 7E1CC2    3038       JMP     DIAG            ; NULL Pointer.  Cancel change!
                    3039  DG4_SK11:
                    3040       ; Store new SERIAL NUMBER in EEPROM Header Record
```

```
1D8B [03] CE0082     3041        LDX     #D_STR
1D8E [04] 18CEA000   3042        LDY     #EEPROM
1D92 [02] C60B       3043        LDAB    #!11
1D94 [04] A600       3044        LDAA    0,X
                     3045   DG4_LP1:
1D96 [05] 18A712     3046        STAA    H_SNUM,Y
1D99 [03] 08         3047        INX
1D9A [04] 1808       3048        INY
1D9C [02] 5A         3049        DECB
1D9D [03] 2707       3050        BEQ     DG4_OUT
1D9F [02] 4D         3051        TSTA
1DA0 [03] 27F4       3052        BEQ     DG4_LP1
1DA2 [04] A600       3053        LDAA    0,X
1DA4 [03] 20F0       3054        BRA     DG4_LP1
                     3055   DG4_OUT:
1DA6 [02] 4F         3056        CLRA                    ; Terminate HEADER Serial Number with
NULL
1DA7 [05] 18A712     3057        STAA    H_SNUM,Y
                     3058        ; Wait for EEPROM to store data
1DAA [03] CE0002     3059        LDX     #$2
1DAD [06] BD1178     3060        JSR     TIMER
1DB0 [05] 18A112     3061        CMPA    H_SNUM,Y
1DB3 [03] 2706       3062        BEQ     DG4_SK21
1DB5 [06] BD1403     3063        JSR     TRY_AGAIN
1DB8 [02] 5D         3064        TSTB
1DB9 [03] 26D0       3065        BNE     DG4_SK11
                     3066   DG4_SK21:
                     3067        ; Re-calc checksum for header record
1DBB [03] CEA000     3068        LDX     #EEPROM
1DBE [02] C61F       3069        LDAB    #!31
1DC0 [06] BD313E     3070        JSR     CSUM
                     3071   DG4_SK31:
1DC3 [04] A700       3072        STAA    0,X             ; Store new checksum
                     3073        ; Wait for EEPROM to store data
1DC5 [04] 3C         3074        PSHX
1DC6 [03] CE0002     3075        LDX     #$2
1DC9 [06] BD1178     3076        JSR     TIMER
1DCC [05] 38         3077        PULX
1DCD [04] A100       3078        CMPA    0,X
1DCF [03] 2706       3079        BEQ     DG4_SK32
1DD1 [06] BD1403     3080        JSR     TRY_AGAIN
1DD4 [02] 5D         3081        TSTB
1DD5 [03] 26EC       3082        BNE     DG4_SK31
                     3083   DG4_SK32:
1DD7 [03] 7E1CC2     3084        JMP     DIAG
                     3085
                     3086   DG_5:
                     3087        ; *** SYSTEM MEMORY FORMAT ***
1DDA [06] BD1331     3088        JSR     WAIT_NONE
1DDD [06] BD33FB     3089        JSR     SET_DFLT
1DE0 [03] 7E1CC2     3090        JMP     DIAG
                     3091
                     3092   DG_6:
                     3093        ; *** USER MEMORY ERASE ***
1DE3 macro           3094        SCR     029,0,0,0
1DE3 [03] CE61ED     3095    LDX #MSG%1
1DE6 [06] BD12C1     3096    JSR LINE1
1DE9 [03] CE6015     3097    LDX #MSG%2
1DEC [06] BD12C7     3098    JSR LINE2
1DEF [03] CE6015     3099    LDX #MSG%3
1DF2 [06] BD12CD     3100    JSR LINE3
1DF5 [03] CE6015     3101    LDX #MSG%4
1DF8 [06] BD12D3     3102    JSR LINE4
1DFB [06] BD1331     3103        JSR     WAIT_NONE
1DFE macro           3104        SCR     029,0,105,006
1DFE [03] CE61ED     3105    LDX #MSG%1
1E01 [06] BD12C1     3106    JSR LINE1
1E04 [03] CE6015     3107    LDX #MSG%2
```

```
1E07 [06] BD12C7     3108   JSR LINE2
1E0A [03] CE66AA     3109   LDX #MSG%3
1E0D [06] BD12CD     3110   JSR LINE3
1E10 [03] CE60A8     3111   LDX #MSG%4
1E13 [06] BD12D3     3112   JSR LINE4
                     3113  DG6_LP1:
1E16 [06] BD1366     3114       JSR     GET_KEY          ; Get PANEL Inputs
1E19 [02] 840F       3115       ANDA    #$0F             ; Mask off all but FUNCTION keys
1E1B [03] 27F9       3116       BEQ     DG6_LP1          ; Branch while no keys hit
                     3117
1E1D [02] 8502       3118       BITA    #$02             ; Test for F2 key (YES)
1E1F [03] 2607       3119       BNE     DG6_OUT1         ; If F2, branch to continue
                     3120
1E21 [02] 8504       3121       BITA    #$04             ; Test for F3 key (NO)
1E23 [03] 2701       3122       BEQ     DG6_SK11         ; If not F3, continue loop
1E25 [05] 39         3123       RTS                      ;   else, Return
                     3124  DG6_SK11:
1E26 [03] 20EE       3125       BRA     DG6_LP1          ; Loop until Function key is hit
                     3126  DG6_OUT1:
1E28 [03] CE6015     3127       LDX     #MSG0
1E2B [06] BD12CD     3128       JSR     LINE3
1E2E [06] BD1331     3129       JSR     WAIT_NONE
1E31 [03] CE61AE     3130       LDX     #MSG026
1E34 [06] BD12D3     3131       JSR     LINE4
1E37 [06] BD32CA     3132       JSR     ERASE_USER
1E3A macro           3133       SCR     029,0,0,028
1E3A [03] CE61ED     3134   LDX #MSG%1
1E3D [06] BD12C1     3135   JSR LINE1
1E40 [03] CE6015     3136   LDX #MSG%2
1E43 [06] BD12C7     3137   JSR LINE2
1E46 [03] CE6015     3138   LDX #MSG%3
1E49 [06] BD12CD     3139   JSR LINE3
1E4C [03] CE61D8     3140   LDX #MSG%4
1E4F [06] BD12D3     3141   JSR LINE4
1E52 [03] 7E1CC2     3142       JMP     DIAG
                     3143
                     3144  DG_7:
1E55 [06] BD3503     3145       JSR     TEST_SHOW
1E58 [03] 7E1CC2     3146       JMP     DIAG
                     3147
                     3148  DIAG2:
1E5B [06] BD34E0     3149       JSR     NO_IMP
1E5E [06] BD1331     3150       JSR     WAIT_NONE        ; Wait for no keys pressed
1E61 [03] 7E1B7F     3151       JMP     MENU
                     3152
                     3153  ED_REC:
1E64 [03] 9640       3154       LDAA    MEM_ERR
1E66 [03] 2706       3155       BEQ     ER_SK1
1E68 [06] BD1A3A     3156       JSR     ERR_BLOCK
1E6B [03] 7E1B7F     3157       JMP     MENU
                     3158  ER_SK1:
1E6E macro           3159       MNU     082,021,0,080,TMPR,STRCH,MNU0,MENU,MNU0
1E6E [03] CE655A     3160   LDX #MSG%1
1E71 [06] BD12C1     3161   JSR LINE1
1E74 [03] CE6145     3162   LDX #MSG%2
1E77 [06] BD12C7     3163   JSR LINE2
1E7A [03] CE6015     3164   LDX #MSG%3
1E7D [06] BD12CD     3165   JSR LINE3
1E80 [03] CE6530     3166   LDX #MSG%4
1E83 [06] BD12D3     3167   JSR LINE4
1E86 [06] BD1331     3168   JSR WAIT_NONE
                     3169  MNU0:
1E89 [02] 861F       3170   LDAA #$1F
1E8B [04] 18CE2EE0   3171   LDY #!12000
1E8F [06] BD1388     3172   JSR WAIT_KEY
1E92 [02] 4D         3173   TSTA
1E93 [03] 2601       3174   BNE MNU0A
1E95 [05] 39         3175   RTS
```

```
                        MNU0A:
1E96 [02] 8101          CMPA #$01
1E98 [03] 2603          BNE MNU1
1E9A [03] 7E26F1        JMP %5
                        MNU1:
1E9D [02] 8102          CMPA #$02
1E9F [03] 2603          BNE MNU2
1EA1 [03] 7E2B9B        JMP %6
                        MNU2:
1EA4 [02] 8104          CMPA #$04
1EA6 [03] 2603          BNE MNU3
1EA8 [03] 7E1E89        JMP %7
                        MNU3:
1EAB [02] 8108          CMPA #$08
1EAD [03] 2603          BNE MNU4
1EAF [03] 7E1B7F        JMP %8
                        MNU4:
1EB2 [02] 8110          CMPA #$10
1EB4 [03] 2603          BNE MNU5
1EB6 [03] 7E1E89        JMP %9
                        MNU5:
1EB9 [03] 20CE          BRA MNU0

                        CH_KEY:
1EBB [03] 9643          LDAA    SFLAGS
1EBD [02] 16            TAB
1EBE [02] 84FC          ANDA    #$FC
1EC0 [02] 5C            INCB
1EC1 [02] C403          ANDB    #$03
1EC3 [02] 1B            ABA
1EC4 [03] 9743          STAA    SFLAGS
1EC6 [06] BD1776        JSR     CALC_MULT
1EC9 [05] 39            RTS

                        OCT_UP:
1ECA [06] 13420208      BRCLR   DFLAGS,$02,OU_SK1
1ECE [03] 9647          LDAA    NOTE_OCT
1ED0 [02] 8B10          ADDA    #$10
1ED2 [02] 847F          ANDA    #$7F
1ED4 [03] 9747          STAA    NOTE_OCT
                        OU_SK1:
1ED6 [06] BD1331        JSR     WAIT_NONE       ; Wait for no keys pressed
1ED9 [05] 39            RTS

                        OCT_DN:
1EDA [06] 13420208      BRCLR   DFLAGS,$02,OD_SK1
1EDE [03] 9647          LDAA    NOTE_OCT
1EE0 [02] 8010          SUBA    #$10
1EE2 [02] 847F          ANDA    #$7F
1EE4 [03] 9747          STAA    NOTE_OCT
                        OD_SK1:
1EE6 [06] BD1331        JSR     WAIT_NONE       ; Wait for no keys pressed
1EE9 [05] 39            RTS

                        OCT_ADJ:
                        ; "+2/-1" Key was hit.  Set octave adjust flags.
                        ;       JSR     NO_IMP
                        ;       JSR     WAIT_NONE       ; Wait for no keys pressed
                        ;       JMP     MENU
1EEA [06] 13424008      BRCLR   DFLAGS,$40,OA_SK1
                        ; +2 is set, set -1 & turn off +2
1EEE [06] 154240        BCLR    DFLAGS,$40
1EF1 [06] 144220        BSET    DFLAGS,$20
1EF4 [03] 200C          BRA     OA_SK4
                        OA_SK1:
1EF6 [06] 13422005      BRCLR   DFLAGS,$20,OA_SK2
                        ; -1 is set, turn off -1
1EFA [06] 154260        BCLR    DFLAGS,$60
```

```
1EFD [03] 2003        3244        BRA     OA_SK4
                      3245  OA_SK2:
                      3246        ; nothing set, Turn on +2
1EFF [06] 144240      3247        BSET    DFLAGS,$40
                      3248  OA_SK4:
1F02 [06] BD1331      3249        JSR     WAIT_NONE       ; Wait for no keys pressed
1F05 [05] 39          3250        RTS
                      3251
                      3252  IC_CONT:
1F06 macro            3253        SCR     200,201,202,203
1F06 [03] CE6BE7      3254   LDX #MSG%1
1F09 [06] BD12C1      3255   JSR LINE1
1F0C [03] CE6BFC      3256   LDX #MSG%2
1F0F [06] BD12C7      3257   JSR LINE2
1F12 [03] CE6C11      3258   LDX #MSG%3
1F15 [06] BD12CD      3259   JSR LINE3
1F18 [03] CE6C26      3260   LDX #MSG%4
1F1B [06] BD12D3      3261   JSR LINE4
1F1E [06] BD1331      3262        JSR     WAIT_NONE       ; Wait for no keys pressed
                      3263  ICC_DISP:
                      3264        ; Update the display values
1F21 [02] 8602        3265        LDAA    #!2             ; Line 2
1F23 [02] C605        3266        LDAB    #!5             ; Column 5
1F25 [06] BD1309      3267        JSR     DSP_CUR         ; Position Cursor
                      3268        ; Branch on current IC value
1F28 [06] 13430805    3269        BRCLR   SFLAGS,$08,ICC_SK11
1F2C [03] CE630A      3270        LDX     #MSG049         ; Set up HI message
1F2F [03] 2003        3271        BRA     ICC_SK12
                      3272  ICC_SK11:
1F31 [03] CE6306      3273        LDX     #MSG048         ; Set up LOW message
                      3274  ICC_SK12:
1F34 [06] BD12BD      3275        JSR     DSP_STR         ; and display it
1F37 [02] 8602        3276        LDAA    #!2             ; Line 2
1F39 [02] C610        3277        LDAB    #!16            ; Column 16
1F3B [06] BD1309      3278        JSR     DSP_CUR         ; Position Cursor
                      3279        ; Get current CONTRAST value
1F3E [03] D648        3280        LDAB    CONTRAST
1F40 [02] 5C          3281        INCB
1F41 [02] 4F          3282        CLRA
1F42 [03] 8F          3283        XGDX
                      3284        ; Convert value in Reg-X to decimal string
1F43 [02] 8620        3285        LDAA    #$20            ; Pad with SPACE
1F45 [02] C602        3286        LDAB    #$2             ; Do 2 digits
1F47 [06] BD1221      3287        JSR     DEC_DSP         ; Convert to decimal ASCII string
1F4A [06] BD12BD      3288        JSR     DSP_STR         ; and display it
                      3289        ; delay a time for slow scroll through values
1F4D [03] CE001E      3290        LDX     #!30            ; wait for 300 milliseconds
1F50 [06] BD1178      3291        JSR     TIMER
                      3292        ; Choose key option with timeout
1F53 macro            3293        TCHS    ICC_LOW,ICC_HI,ICC_DN,ICC_UP,ICC_DONE
                      3294  MNU0:
1F53 [02] 861F        3295   LDAA #$1F
1F55 [04] 18CE05DC    3296   LDY #!1500
1F59 [06] BD1388      3297   JSR WAIT_KEY
1F5C [02] 4D          3298   TSTA
1F5D [03] 2601        3299   BNE MNU0A
1F5F [05] 39          3300   RTS
                      3301  MNU0A:
1F60 [02] 8101        3302   CMPA #$01
1F62 [03] 2603        3303   BNE MNU1
1F64 [03] 7E1F85      3304   JMP %1
                      3305  MNU1:
1F67 [02] 8102        3306   CMPA #$02
1F69 [03] 2603        3307   BNE MNU2
1F6B [03] 7E1F8F      3308   JMP %2
                      3309  MNU2:
1F6E [02] 8104        3310   CMPA #$04
1F70 [03] 2603        3311   BNE MNU3
```

```
1F72 [03] 7E1F9A    3312   JMP %3
                    3313  MNU3:
1F75 [02] 8108      3314   CMPA #$08
1F77 [03] 2603      3315   BNE MNU4
1F79 [03] 7E1FA5    3316   JMP %4
                    3317  MNU4:
1F7C [02] 8110      3318   CMPA #$10
1F7E [03] 2603      3319   BNE MNU5
1F80 [03] 7E1FC2    3320   JMP %5
                    3321  MNU5:
1F83 [03] 20CE      3322   BRA MNU0
                    3323  ICC_LOW:
                    3324       ; Set IC to LOW
1F85 [06] 154308    3325       BCLR    SFLAGS,$08
1F88 [02] 5F        3326       CLRB                    ; Set result to LOW
1F89 [04] F7E004    3327       STAB    OUTPUTS
1F8C [03] 7E1F21    3328       JMP     ICC_DISP
                    3329  ICC_HI:
                    3330       ; Set IC to HI
1F8F [06] 144308    3331       BSET    SFLAGS,$08
1F92 [02] C601      3332       LDAB    #$1             ; Set result to HI
1F94 [04] F7E004    3333       STAB    OUTPUTS
1F97 [03] 7E1F21    3334       JMP     ICC_DISP
                    3335  ICC_DN:
                    3336       ; Decrement CONTRAST by one
1F9A [03] D648      3337       LDAB    CONTRAST
1F9C [02] 5A        3338       DECB
                    3339       ; Limit value of Reg-X to between 0 and 15
1F9D [02] C100      3340       CMPB    #!0
1F9F [03] 2C02      3341       BGE     ICC_DN2
1FA1 [02] C600      3342       LDAB    #!0             ; Limit lower to 0
                    3343  ICC_DN2:
1FA3 [03] 200B      3344       BRA     ICC_CUPD
                    3345  ICC_UP:
1FA5 [03] D648      3346       LDAB    CONTRAST
1FA7 [02] 5C        3347       INCB
1FA8 [02] C10F      3348       CMPB    #!15
1FAA [03] 2F02      3349       BLE     ICC_UP2
1FAC [02] C60F      3350       LDAB    #!15            ; Limit upper to 15
                    3351  ICC_UP2:
1FAE [03] 2000      3352       BRA     ICC_CUPD
                    3353  ICC_CUPD:
                    3354       ;*** Update new value for contrast adjust
1FB0 [03] D748      3355       STAB    CONTRAST
1FB2 [02] C40F      3356       ANDB    #$0F            ; Mask off unused bits
1FB4 [02] 58        3357       LSLB                    ; Shift data to high bits
1FB5 [02] 58        3358       LSLB                    ;  **
1FB6 [02] 58        3359       LSLB                    ;  **
1FB7 [02] 58        3360       LSLB                    ;  **
1FB8 [02] CB0B      3361       ADDB    #$0B            ; Set CMD bits (low 4) to NEW CONTRAST
cmd
1FBA [02] 860D      3362       LDAA    #!13            ; Set for SPI unit #13
1FBC [06] BD35B8    3363       JSR     SPI_DLY         ; Send data to PAC controller
1FBF [03] 7E1F21    3364       JMP     ICC_DISP
                    3365  ICC_DONE:
1FC2 [05] 39        3366       RTS
                    3367
                    3368  * - - - - - - - - - - - - - - - - - - - - - - - - - - - - -
                    3369  * End of MENU Subroutines
                    3370  *=====================================================
                    3371
1FC3                3372  $INCLUDE 'EDIT.ASM'             ;Include EDIT Subroutines
                    3373  *=====================================================*
                    3374  *   Peterson Tuner TMPR/STRCH Edit Subroutines        *
                    3375  *   Written by: Robert S. Dobrose                     *
                    3376  *   Saracon, Inc.                                     *
                    3377  *     1135 Garfield Ave.                              *
                    3378  *     Libertyville, IL  60048                         *
```

```
                        3379  *=====================================================*
                        3380  *   Release History                                   *
                        3381  *   05/22/95  1.0  - Initial Code                     *
                        3382  *=====================================================*
                        3383
                        3384  *=====================================================
                        3385  * Name:  EDIT_TS
                        3386  * Subroutine: Edit a TMPR or STRCH record
                        3387  * Written by: Robert S. Dobrose
                        3388  * Purpose: Edit each note slot in a TMPR or STRCH record
                        3389  *            (12 notes/block) (8 blocks for STRCH)
                        3390  *   Input: Reg-X : Address of record to be edited
                        3391  *  Output: none
                        3392  *   Notes: TMPRs are always edited in the key of 'C' (0 offset)
                        3393  * - - - - - - - - - - - - - - - - - - - - - - - - - - - -
                        3394  EDIT_TS:
 1FC3                   3395       EQU     *
 1FC3 [03] 36           3396       PSHA
 1FC4 [03] 37           3397       PSHB
 1FC5 [04] 3C           3398       PSHX
                        3399  ;    STX     PTR1
 1FC6 [03] 2603         3400       BNE     ETS_SK11
 1FC8 [03] 7E223C       3401       JMP     ETS_DONE
                        3402  ETS_SK11:
 1FCB [06] 1242800D     3403       BRSET   DFLAGS,$80,ETS_SK13
 1FCF [04] 8CA000       3404       CPX     #EEPROM
 1FD2 [03] 2D08         3405       BLT     ETS_SK13
 1FD4 [04] 8CDFFF       3406       CPX     #EEPEND
 1FD7 [03] 2F26         3407       BLE     ETS_SK15
 1FD9 [06] 144280       3408       BSET    DFLAGS,$80
                        3409  ETS_SK13:
                        3410       ; Record ADDR is in ROM!  Not Editable!!
                        3411  ; Display "Unable to Edit" screen & wait for any key hit
 1FDC macro             3412       SCR     830,831,832,803
 1FDC [03] CE6D0D       3413   LDX #MSG%1
 1FDF [06] BD12C1       3414   JSR LINE1
 1FE2 [03] CE6D22       3415   LDX #MSG%2
 1FE5 [06] BD12C7       3416   JSR LINE2
 1FE8 [03] CE6D37       3417   LDX #MSG%3
 1FEB [06] BD12CD       3418   JSR LINE3
 1FEE [03] CE6C7A       3419   LDX #MSG%4
 1FF1 [06] BD12D3       3420   JSR LINE4
                        3421       ; | Wait for a key hit
 1FF4 [06] BD1331       3422       JSR     WAIT_NONE
                        3423  ETS_LP0:
 1FF7 [06] BD1366       3424       JSR     GET_KEY          ; Get PANEL Inputs
 1FFA [03] 27FB         3425       BEQ     ETS_LP0          ; Branch while no keys hit
 1FFC [03] 7E223C       3426       JMP     ETS_DONE
                        3427  ETS_SK15:
 1FFF [02] 8640         3428       LDAA    #$40             ; Start at note 'C' in octave 4 (Middle
C)
 2001 [03] 9747         3429       STAA    NOTE_OCT         ; (octave used only for STRCH edit!)
                        3430  ; Set KEY to 'C'
 2003 [06] 154303       3431       BCLR    SFLAGS,$03
                        3432  ;**; Get current KEY value
                        3433  ;**  LDAA    SFLAGS
                        3434  ;**  ANDA    #$FC
                        3435  ;**  ORAA    TS_FOFF,X        ; Get KEY data for current record
                        3436  ;**  STAA    SFLAGS
                        3437  ;**; Display KEY select screen & current KEY value
                        3438  ;**  SCR     135,136,0,096
                        3439  ;**  JSR     CUR_ON
                        3440  ;**ETS_LP1:
                        3441  ;**  ; | Get current KEY value & hilight (with cursor) on screen
                        3442  ;**  JSR     WAIT_NONE
                        3443  ;**  LDAB    SFLAGS
                        3444  ;**  ANDB    #$03             ; Get only KEY data
                        3445  ;**  TBA                      ; Move value to Reg-A
```

```
                    3446  ;**  LSLB                    ; Mult KEY value by 2
                    3447  ;**  ABA                     ; Add to Reg-A (= KEY * 3 now)
                    3448  ;**  ADDA    #$8             ; Add offset for display area
                    3449  ;**  TAB                     ; And move to Reg-B for Cur Position
                    3450  ;**  LDAA    #!1             ; Line 1
                    3451  ;**  JSR     DSP_CUR         ; Position Cursor
                    3452  ;**  ; | Wait for a key hit
                    3453  ;**ETS_LP2:
                    3454  ;**  JSR     GET_KEY         ; Get PANEL Inputs
                    3455  ;**  ANDA    #$0F            ; Mask off all but Fx keys
                    3456  ;**  BEQ     ETS_LP2         ; Branch while no keys hit
                    3457
                    3458  ;**  CMPA    #$01            ; Test for F1 key
                    3459  ;**  BNE     ETS_SK21        ; If not F1, continue
                    3460  ;**  ; | If F1 then decr KEY value
                    3461  ;**  LDAA    SFLAGS
                    3462  ;**  TAB
                    3463  ;**  ANDA    #$FC
                    3464  ;**  DECB
                    3465  ;**  ANDB    #$03
                    3466  ;**  ABA
                    3467  ;**  STAA    SFLAGS
                    3468  ;**  BRA     ETS_LP1
                    3469  ;**ETS_SK21:
                    3470  ;**  CMPA    #$02            ; Test for F2 key
                    3471  ;**  BNE     ETS_SK22        ; If not F2, continue
                    3472  ;**  ; | If F2 then incr KEY value
                    3473  ;**  LDAA    SFLAGS
                    3474  ;**  TAB
                    3475  ;**  ANDA    #$FC
                    3476  ;**  INCB
                    3477  ;**  ANDB    #$03
                    3478  ;**  ABA
                    3479  ;**  STAA    SFLAGS
                    3480  ;**  BRA     ETS_LP1
                    3481  ;**ETS_SK22:
                    3482  ;**  ; | If F3 or F4, save new KEY data & exit loop
                    3483  ;**  CMPA    #$04            ; Test for F3 key
                    3484  ;**  BEQ     ETS_OUT2        ; and return
                    3485  ;**  CMPA    #$08            ; Test for F4 key
                    3486  ;**  BEQ     ETS_OUT2        ; and return
                    3487  ;**  BRA     ETS_LP2         ; Loop until Function key is hit
                    3488  ETS_OUT2:
                    3489  ; Perform CALC_MULT for new KEY value
2006 [06] BD1776    3490      JSR     CALC_MULT
                    3491  ; Display edit screen data
                    3492  ;     SCR     140,141,142,143
                    3493  ; Display static data (TMPR/STRCH text & name & KEY data)
2009 [06] 1342022E  3494      BRCLR   DFLAGS,$02,ETS_SK31
                    3495      ; STRCH selected, display Octave Info
200D macro          3496      SCR     158,141,159,160
200D [03] CE6A6D    3497   LDX #MSG%1
2010 [06] BD12C1    3498   JSR LINE1
2013 [03] CE6908    3499   LDX #MSG%2
2016 [06] BD12C7    3500   JSR LINE2
2019 [03] CE6A82    3501   LDX #MSG%3
201C [06] BD12CD    3502   JSR LINE3
201F [03] CE6A97    3503   LDX #MSG%4
2022 [06] BD12D3    3504   JSR LINE4
2025 [02] 8602      3505      LDAA    #!2             ; Line 2
2027 [02] C60C      3506      LDAB    #!12            ; Column 12
2029 [06] BD1309    3507      JSR     DSP_CUR         ; Position Cursor
202C [03] 9647      3508      LDAA    NOTE_OCT        ; Get Octave info
202E [02] 44        3509      LSRA                    ; Shift Octave data down to low bits
202F [02] 44        3510      LSRA                    ; **
2030 [02] 44        3511      LSRA                    ; **
2031 [02] 44        3512      LSRA                    ; **
2032 [02] 8407      3513      ANDA    #$07            ; Mask off non-Octave info
```

```
2034 [02] 8B30        3514        ADDA    #$30            ; Convert to ASCII digit
2036 [06] BD12EE      3515        JSR     DSP_CHR         ; Display char
                      3516        ; STRCH selected, display title & name
                      3517  ;     LDX     #S_STRCH        ; Load "STRCH" string
2039 [03] 201F        3518        BRA     ETS_SK32
                      3519  ETS_SK31:
203B [06] 12420403    3520        BRSET   DFLAGS,$04,ETS_SK33
203F [03] 7E223C      3521        JMP     ETS_DONE        ; Neither TMPR nor STRCH selected!
QUIT!!
                      3522  ETS_SK33:
                      3523        ; TMPR selected, display title & name
2042 macro            3524        SCR     140,141,0,160
2042 [03] CE68F3      3525   LDX #MSG%1
2045 [06] BD12C1      3526   JSR LINE1
2048 [03] CE6908      3527   LDX #MSG%2
204B [06] BD12C7      3528   JSR LINE2
204E [03] CE6015      3529   LDX #MSG%3
2051 [06] BD12CD      3530   JSR LINE3
2054 [03] CE6A97      3531   LDX #MSG%4
2057 [06] BD12D3      3532   JSR LINE4
                      3533  ;     LDX     #S_TMPR         ; Load "TMPR" string
                      3534  ETS_SK32:
205A [06] BD1331      3535        JSR     WAIT_NONE
205D [02] 8600        3536        LDAA    #!0             ; Line 0
205F [02] C607        3537        LDAB    #!7             ; Column 7
2061 [06] BD1309      3538        JSR     DSP_CUR         ; Position Cursor
                      3539  ;     JSR     DSP_STR         ; and display string
2064 [03] CE0049      3540        LDX     #TS_NAME        ; Point to name string
2067 [06] BD12BD      3541        JSR     DSP_STR         ; and display string
206A [03] CE6DF3      3542        LDX     #S_KEY0         ; Get KEY strings base addr
206D [03] D643        3543        LDAB    SFLAGS          ; Get system flags
206F [02] C403        3544        ANDB    #$03            ; mask off all but KEY bits
2071 [02] 58          3545        LSLB                    ; Mult KEY offset by 4
2072 [02] 58          3546        LSLB                    ; **
2073 [03] 3A          3547        ABX                     ; add offset to base addr (KEY string)
2074 [02] 8600        3548        LDAA    #!0             ; Line 0
2076 [02] C612        3549        LDAB    #!18            ; Column 18
2078 [06] BD1309      3550        JSR     DSP_CUR         ; Position Cursor
207B [06] BD12BD      3551        JSR     DSP_STR         ; and display string
                      3552  ETS_LP4:
                      3553  ; | Display current note (and octave?) data
207E [03] CE6E03      3554        LDX     #NOTE01         ; Get NOTE strings base addr
2081 [03] D647        3555        LDAB    NOTE_OCT        ; Get Note info
2083 [02] C40F        3556        ANDB    #$0F            ; Mask off non-Note info
2085 [02] 58          3557        LSLB                    ; Mult NOTE offset by 4
2086 [02] 58          3558        LSLB                    ; **
2087 [03] 3A          3559        ABX                     ; add offset to base addr (NOTE string)
2088 [02] 8601        3560        LDAA    #!1             ; Line 1
208A [02] C609        3561        LDAB    #!9             ; Column 9
208C [06] BD1309      3562        JSR     DSP_CUR         ; Position Cursor
208F [06] BD12BD      3563        JSR     DSP_STR         ; and display string
                      3564  ; Display Octave if editing STRCH
2092 [06] 13420214    3565        BRCLR   DFLAGS,$02,ETS_SK34
2096 [02] 8602        3566        LDAA    #!2             ; Line 2
2098 [02] C60C        3567        LDAB    #!12            ; Column 12
209A [06] BD1309      3568        JSR     DSP_CUR         ; Position Cursor
209D [03] 9647        3569        LDAA    NOTE_OCT        ; Get Octave info
209F [02] 44          3570        LSRA                    ; Shift Octave data down to low bits
20A0 [02] 44          3571        LSRA                    ; **
20A1 [02] 44          3572        LSRA                    ; **
20A2 [02] 44          3573        LSRA                    ; **
20A3 [02] 8407        3574        ANDA    #$07            ; Mask off non-Octave info
20A5 [02] 8B30        3575        ADDA    #$30            ; Convert to ASCII digit
20A7 [06] BD12EE      3576        JSR     DSP_CHR         ; Display char
                      3577  ETS_SK34:
                      3578  ; | Get stored offset value of current note (and octave?) entry
20AA [06] 13420602    3579        BRCLR   DFLAGS,$06,ETS_SK37
20AE [03] 2003        3580        BRA     ETS_SK38
```

```
                    3581  ETS_SK37:
20B0 [03] 7E223C    3582        JMP     ETS_DONE
                    3583  ETS_SK38:
20B3 [06] BD3285    3584        JSR     LOOK_TS
20B6 [04] DD44      3585        STD     V_VAL
                    3586  ; | Determine SCALE of value & set edit scale accordingly
20B8 [02] 4F        3587        CLRA
                    3588  ;     LDAB    V_INC1
                    3589  ;     STAB    V_SCL
                    3590  ;     XGDX
                    3591  ;     LDD     V_VAL
                    3592  ;     BCLR    DFLAGS,$01      ; Clear Vernier fraction flag
                    3593  ;     IDIV
                    3594  ;     CPD     #$0
                    3595  ;     BEQ     ETS_LP41
20B9 [06] 144201    3596        BSET    DFLAGS,$01      ; Set Vernier fraction flag

                    3597  ;     CMPB    V_INC2
                    3598  ;     BEQ     ETS_SK40
20BC [02] 4F        3599        CLRA
20BD [04] F67C02    3600        LDAB    V_INC3
                    3601  ;ETS_SK40:
20C0 [03] D746      3602        STAB    V_SCL
                    3603  ; | Display offset value
                    3604  ETS_LP41:
20C2 [02] 8601      3605        LDAA    #!1             ; Line 1
20C4 [02] C60C      3606        LDAB    #!12            ; Column 12
20C6 [04] DE44      3607        LDX     V_VAL
20C8 [06] BD18B7    3608        JSR     V_DISP
                    3609  ; Do this speed now!
20CB [03] CC0000    3610        LDD     #$0
20CE [06] BD18C8    3611        JSR     V_CALC
                    3612  ; #####  Add time delay call here?? (.2 or .3 seconds??)
20D1 [03] CE0014    3613        LDX     #!20
20D4 [06] BD1178    3614        JSR     TIMER
                    3615  ; | | Wait for key hit.  If F4 (or MODE??) then end this loop.
                    3616  ETS_LP42:
20D7 [06] BD1366    3617        JSR     GET_KEY         ; Get PANEL Inputs
20DA [03] 27FB      3618        BEQ     ETS_LP42        ; Branch while no keys hit
                    3619  ; | | If Edit+/- key, then increment/decrement value & re-display
20DC [02] 8120      3620        CMPA    #$20            ; Test for '+' key
20DE [03] 2613      3621        BNE     ETS_SK42        ; If not '+', continue
                    3622        ; | If '+' then incr V_VAL by SCALE value
20E0 [04] DC44      3623        LDD     V_VAL
20E2 [03] DB46      3624        ADDB    V_SCL
20E4 [02] 8900      3625        ADCA    #$0
20E6 [05] 1A8301F4  3626        CPD     #!500
20EA [03] 2F03      3627        BLE     ETS_SK41
20EC [03] CC01F4    3628        LDD     #!500
                    3629  ETS_SK41:
20EF [04] DD44      3630        STD     V_VAL
20F1 [03] 20CF      3631        BRA     ETS_LP41
                    3632  ETS_SK42:
20F3 [02] 8140      3633        CMPA    #$40            ; Test for '-' key
20F5 [03] 2613      3634        BNE     ETS_SK44        ; If not '-', continue
                    3635        ; | If '-' then decr V_VAL by SCALE value
20F7 [04] DC44      3636        LDD     V_VAL
20F9 [03] D046      3637        SUBB    V_SCL
20FB [02] 8200      3638        SBCA    #$0
20FD [05] 1A83FE0C  3639        CPD     #!-500
2101 [03] 2C03      3640        BGE     ETS_SK43
2103 [03] CCFE0C    3641        LDD     #!-500
                    3642  ETS_SK43:
2106 [04] DD44      3643        STD     V_VAL
2108 [03] 20B8      3644        BRA     ETS_LP41
                    3645  ETS_SK44:
                    3646  ;     CMPA    #$02            ; Test for F2 (RES) key
                    3647  ;     BNE     ETS_SK45
```

```
                    ;    JSR     CH_SCL
                    ;    BRA     ETS_LP41
                    ETS_SK45:
210A [02] 8104           CMPA    #$04            ; Test for F3 (RUN) key
210C [03] 2603           BNE     ETS_SK46
210E [03] 7E21ED         JMP     ETS_RUN
                    ETS_SK46:
                         ; | If ENTER, save new KEY data & exit loop
2111 [02] 8110           CMPA    #$10            ; Test for ENTER key
2113 [03] 2706           BEQ     ETS_OUT4        ; Proceed to next NOTE
2115 [02] 8108           CMPA    #$08            ; Test for F4 key
2117 [03] 2702           BEQ     ETS_OUT4        ; Proceed to next NOTE
                         ; No Recognized Keyhit!  Loop until key is hit.
2119 [03] 20BC           BRA     ETS_LP42        ; Loop until Function key is hit
                    ; | | Loop (inner loop)
                    ETS_OUT4:
                    ; | End of inner loop.  Store current value & change NOTE_OCT index.
211B [04] DE53           LDX     PTR2
211D [04] DC44           LDD     V_VAL
211F [05] ED00           STD     0,X
2121 [03] CE0002         LDX     #$2
2124 [06] BD1178         JSR     TIMER
2127 [04] DE53           LDX     PTR2
2129 [07] 1AA300         CPD     0,X
212C [03] 2706           BEQ     ETS_SK47
212E [06] BD1403         JSR     TRY_AGAIN
2131 [02] 5D             TSTB
2132 [03] 26E7           BNE     ETS_OUT4
                    ETS_SK47:
                    ; | Change NOTE_OCT index.  (up & down from Middle C)
2134 [03] 9647           LDAA    NOTE_OCT
2136 [02] 8140           CMPA    #$40
2138 [03] 2D5D           BLT     ETS_SK62
                         ; Octave is > Middle C, count up to 11 then adjust octave down
213A [02] 840F           ANDA    #$0F            ; Mask off non-note data
213C [02] 810B           CMPA    #!11            ; Are we on the last note of the octave?
213E [03] 2D4E           BLT     ETS_SK59        ; If not, incr note in same octave.
                    ; | If block is full, Store KEY data.  Calc new checksum & store it.
                         ; save octave block data (KEY data)
2140 [04] DC53           LDD     PTR2
2142 [02] C4E0           ANDB    #$E0            ; Adjust ptr to beginning of block
2144 [03] 8F             XGDX                    ; and move result to Reg-X
2145 [03] 9643           LDAA    SFLAGS
2147 [02] 8403           ANDA    #$03
                    ETS_SK51:
2149 [04] A71E           STAA    TS_FOFF,X       ; Save KEY data
214B [04] 3C             PSHX
214C [03] CE0002         LDX     #$2
214F [06] BD1178         JSR     TIMER
2152 [05] 38             PULX
2153 [04] A11E           CMPA    TS_FOFF,X
2155 [03] 2706           BEQ     ETS_SK52
2157 [06] BD1403         JSR     TRY_AGAIN
215A [02] 5D             TSTB
215B [03] 26EC           BNE     ETS_SK51
                    ETS_SK52:
                         ; save new checksum
215D [02] C61F           LDAB    #!31
215F [06] BD313E         JSR     CSUM
                    ETS_SK53:
2162 [04] A700           STAA    0,X             ; Store calculated checksum
2164 [04] 3C             PSHX
2165 [03] CE0002         LDX     #$2
2168 [06] BD1178         JSR     TIMER
216B [05] 38             PULX
216C [04] A100           CMPA    0,X
216E [03] 2706           BEQ     ETS_SK54
2170 [06] BD1403         JSR     TRY_AGAIN
```

```
2173 [02] 5D          3716        TSTB
2174 [03] 26EC        3717        BNE      ETS_SK53
                      3718   ETS_SK54:
                      3719        ; change octave & loop if editing STRCH, exit loop if editing
TMPR
2176 [06] 12420203    3720        BRSET    DFLAGS,$02,ETS_SK55      ; If editing STRCH, change OCTAVE
217A [03] 7E223C      3721        JMP      ETS_DONE          ; done with TMPR.  Exit!
                      3722   ETS_SK55:
217D [03] D647        3723        LDAB     NOTE_OCT
217F [02] C470        3724        ANDB     #$70
2181 [02] 8670        3725        LDAA     #$70
2183 [02] 10          3726        SBA                        ; New octave = 7 - old octave
2184 [02] 8A0B        3727        ORAA     #!11              ; Start at note 11 (= 12th note = B)
2186 [03] 9747        3728        STAA     NOTE_OCT
2188 [06] BD1331      3729        JSR      WAIT_NONE
218B [03] 7E207E      3730        JMP      ETS_LP4
                      3731   ETS_SK59:
                      3732   ; | If record is not full, then loop (outer loop)
                      3733        ; Incr note in this octave
218E [06] 7C0047      3734        INC      NOTE_OCT
                      3735        ; loop.
2191 [06] BD1331      3736        JSR      WAIT_NONE
2194 [03] 7E207E      3737        JMP      ETS_LP4
                      3738   ETS_SK62:
                      3739        ; Octave is < Middle C, count down to 0 then adjust octave up
2197 [02] 840F        3740        ANDA     #$0F              ; Mask off non-note data
2199 [02] 8100        3741        CMPA     #!0               ; Are we on the last note of the octave?
219B [03] 2E47        3742        BGT      ETS_SK67          ; If not, incr note in same octave.
                      3743   ; | If block is full, Store KEY data.  Calc new checksum & store it.
                      3744        ; save octave block data (KEY data)
219D [04] DC53        3745        LDD      PTR2
219F [02] C4E0        3746        ANDB     #$E0              ; Adjust ptr to beginning of block
21A1 [03] 8F          3747        XGDX                       ; and move result to Reg-X
21A2 [03] 9643        3748        LDAA     SFLAGS
21A4 [02] 8403        3749        ANDA     #$03
                      3750   ETS_SK63:
21A6 [04] A71E        3751        STAA     TS_FOFF,X         ; Save KEY data
21A8 [04] 3C          3752        PSHX
21A9 [03] CE0002      3753        LDX      #$2
21AC [06] BD1178      3754        JSR      TIMER
21AF [05] 38          3755        PULX
21B0 [04] A11E        3756        CMPA     TS_FOFF,X
21B2 [03] 2706        3757        BEQ      ETS_SK64
21B4 [06] BD1403      3758        JSR      TRY_AGAIN
21B7 [02] 5D          3759        TSTB
21B8 [03] 26EC        3760        BNE      ETS_SK63
                      3761   ETS_SK64:
                      3762        ; save new checksum
21BA [02] C61F        3763        LDAB     #!31
21BC [06] BD313E      3764        JSR      CSUM
                      3765   ETS_SK65:
21BF [04] A700        3766        STAA     0,X               ; Store calculated checksum
21C1 [04] 3C          3767        PSHX
21C2 [03] CE0002      3768        LDX      #$2
21C5 [06] BD1178      3769        JSR      TIMER
21C8 [05] 38          3770        PULX
21C9 [04] A100        3771        CMPA     0,X
21CB [03] 2706        3772        BEQ      ETS_SK66
21CD [06] BD1403      3773        JSR      TRY_AGAIN
21D0 [02] 5D          3774        TSTB
21D1 [03] 26EC        3775        BNE      ETS_SK65
                      3776   ETS_SK66:
                      3777        ; change octave & loop (we can only get here if editing STRCH)
21D3 [03] D647        3778        LDAB     NOTE_OCT
21D5 [02] C470        3779        ANDB     #$70
                      3780        ; Check for end of STRCH (octave = 0) & quit if done
21D7 [03] 2763        3781        BEQ      ETS_DONE          ; Quit if octave = 0 (last in STRCH)
21D9 [02] 8680        3782        LDAA     #$80
```

```
21DB [02] 10        3783        SBA                     ; New octave = 8 - old octave
21DC [03] 9747      3784        STAA    NOTE_OCT        ; start at note 0 in new octave
21DE [06] BD1331    3785        JSR     WAIT_NONE
21E1 [03] 7E207E    3786        JMP     ETS_LP4
                    3787  ETS_SK67:
                    3788  ; | If record is not full, then loop (outer loop)
                    3789        ; Decr note in this octave
21E4 [06] 7A0047    3790        DEC     NOTE_OCT
                    3791        ; loop.
21E7 [06] BD1331    3792        JSR     WAIT_NONE
21EA [03] 7E207E    3793        JMP     ETS_LP4
                    3794  ETS_RUN:
                    3795  ; EXIT ROUTINE.  Save value & return to run mode!
21ED [04] DE53      3796        LDX     PTR2
21EF [04] DC44      3797        LDD     V_VAL
21F1 [05] ED00      3798        STD     0,X
21F3 [03] CE0002    3799        LDX     #$2
21F6 [06] BD1178    3800        JSR     TIMER
21F9 [04] DE53      3801        LDX     PTR2
21FB [07] 1AA300    3802        CPD     0,X
21FE [03] 2706      3803        BEQ     ETS_SK71
2200 [06] BD1403    3804        JSR     TRY_AGAIN
2203 [02] 5D        3805        TSTB
2204 [03] 26E7      3806        BNE     ETS_RUN
                    3807  ETS_SK71:
                    3808        ; save octave block data (KEY data)
2206 [04] DC53      3809        LDD     PTR2
2208 [02] C4E0      3810        ANDB    #$E0            ; Adjust ptr to beginning of block
220A [03] 8F        3811        XGDX                    ; and move result to Reg-X
220B [03] 9643      3812        LDAA    SFLAGS
220D [02] 8403      3813        ANDA    #$03
                    3814  ETS_SK72:
220F [04] A71E      3815        STAA    TS_FOFF,X       ; Save KEY data
2211 [04] 3C        3816        PSHX
2212 [03] CE0002    3817        LDX     #$2
2215 [06] BD1178    3818        JSR     TIMER
2218 [05] 38        3819        PULX
2219 [04] A11E      3820        CMPA    TS_FOFF,X
221B [03] 2706      3821        BEQ     ETS_SK73
221D [06] BD1403    3822        JSR     TRY_AGAIN
2220 [02] 5D        3823        TSTB
2221 [03] 26EC      3824        BNE     ETS_SK72
                    3825  ETS_SK73:
                    3826        ; save new checksum
2223 [02] C61F      3827        LDAB    #!31
2225 [06] BD313E    3828        JSR     CSUM
                    3829  ETS_SK74:
2228 [04] A700      3830        STAA    0,X             ; Store calculated checksum
222A [04] 3C        3831        PSHX
222B [03] CE0002    3832        LDX     #$2
222E [06] BD1178    3833        JSR     TIMER
2231 [05] 38        3834        PULX
2232 [04] A100      3835        CMPA    0,X
2234 [03] 2706      3836        BEQ     ETS_SK75
2236 [06] BD1403    3837        JSR     TRY_AGAIN
2239 [02] 5D        3838        TSTB
223A [03] 26EC      3839        BNE     ETS_SK74
                    3840  ETS_SK75:
                    3841  ; END OF ROUTINE.  Restore saved values & return!
                    3842  ETS_DONE:
223C [05] 38        3843        PULX
223D [04] 33        3844        PULB
223E [04] 32        3845        PULA
223F [05] 39        3846        RTS
                    3847
                    3848  *=====================================================
                    3849  * Name:  CLEAR_TS
                    3850  * Subroutine: Clear a block (32 bytes) of EEPROM memory
```

```
                    3851  *                for TMPR/STRCH record use
                    3852  * Written by: Robert S. Dobrose
                    3853  * Purpose: Clears a given block of EEPROM memory for use
                    3854  *            in a TMPR/STRCH record.  This is done by
                    3855  *            filling the data bytes with $0, storing the
                    3856  *            current TS_NAME in the record name area and
                    3857  *            setting the block type to the pattern in
                    3858  *            Reg-B then creating & storing a checksum value.
                    3859  *   Input: Reg-X : Address of block to be cleared
                    3860  *          Reg-D : Next block pointer and block type pattern.
                    3861  *          TS_NAME : current TMPR/STRCH record name.
                    3862  *          SFLAGS : low 2 bits contains KEY data
                    3863  *  Output: none
                    3864  *   Notes: This routine assumes the block pointer (Reg-X)
                    3865  *            is legitimate!
                    3866  *          This routine assumes blank (= 0) values for
                    3867  *            all bytes except the block type pattern.
                    3868  *            This means that the checksum will be the
                    3869  *            same as this block type value.
                    3870  * - - - - - - - - - - - - - - - - - - - - - - - - - - - - - -
                    3871  CLEAR_TS:
2240                3872       EQU     *
2240 [05] 183C      3873       PSHY
2242 [04] 3C        3874       PSHX
2243 [03] 36        3875       PSHA
2244 [03] 37        3876       PSHB
2245 [04] 18CE0049  3877       LDY     #TS_NAME          ; Set Reg-Y as name string pointer
2249 [05] ED00      3878       STD     0,X
224B [03] 08        3879       INX                       ; bump address pointer 2 bytes
224C [03] 08        3880       INX                       ; **
224D [02] 1B        3881       ABA                       ; Starting checksum is block type + ptr
224E [02] C618      3882       LDAB    #!24              ; Set up to do 24 more blank bytes
                    3883  CTS_LP1:
2250 [06] 6F00      3884       CLR     0,X
2252 [03] 08        3885       INX
2253 [02] 5A        3886       DECB
2254 [03] 26FA      3887       BNE     CTS_LP1
2256 [05] 18E600    3888       LDAB    0,Y
2259 [04] E700      3889       STAB    0,X
225B [02] 1B        3890       ABA
225C [03] 08        3891       INX
225D [05] 18E601    3892       LDAB    1,Y
2260 [04] E700      3893       STAB    0,X
2262 [02] 1B        3894       ABA
2263 [03] 08        3895       INX
2264 [05] 18E602    3896       LDAB    2,Y
2267 [04] E700      3897       STAB    0,X
2269 [02] 1B        3898       ABA
226A [03] 08        3899       INX
226B [05] 18E603    3900       LDAB    3,Y
226E [04] E700      3901       STAB    0,X
2270 [02] 1B        3902       ABA
2271 [03] 08        3903       INX
2272 [03] D643      3904       LDAB    SFLAGS
2274 [02] C403      3905       ANDB    #$03              ; Mask off non-KEY data
2276 [04] E700      3906       STAB    0,X
2278 [02] 1B        3907       ABA
2279 [03] 08        3908       INX
227A [04] A700      3909       STAA    0,X               ; and save checksum at end of block
                    3910       ; Wait for EEPROM to store data
227C [03] CE0002    3911       LDX     #$2
227F [06] BD1178    3912       JSR     TIMER
2282 [04] 33        3913       PULB
2283 [04] 32        3914       PULA
2284 [05] 38        3915       PULX
2285 [06] 1838      3916       PULY
2287 [05] 39        3917       RTS
                    3918
```

```
                    3919  *=========================================================
                    3920  * Name:  NEW_TMPR
                    3921  * Subroutine: Create a new TMPR record in EEPROM memory
                    3922  * Written by: Robert S. Dobrose
                    3923  * Purpose: Creates a new TMPR record in EEPROM memory
                    3924  *   Input: TS_NAME : current TMPR/STRCH record name.
                    3925  *  Output: Reg-X = address of the new TMPR block
                    3926  *   Notes:
                    3927  * - - - - - - - - - - - - - - - - - - - - - - - - - - - -
                    3928  NEW_TMPR:
2288                3929       EQU     *
                    3930       ; Create new TMPR record.
                    3931       ; Find a free block for new TMPR record
2288 [06] BD318E    3932       JSR     FIND_FREE
228B [04] 8C0000    3933       CPX     #$0000
228E [03] 2608      3934       BNE     NWT_SK31        ; No free blocks!  Error message!
                    3935       ; No free blocks!  (Do error processing!)
2290 [06] BD1A17    3936       JSR     MEM_FULL
2293 [03] CE0000    3937       LDX     #$0000
2296 [03] 2006      3938       BRA     NWT_OUT
                    3939  NWT_SK31:
                    3940       ; Clear block for new TMPR record
2298 [02] 4F        3941       CLRA
2299 [02] C607      3942       LDAB    #TYP_T0
229B [06] BD2240    3943       JSR     CLEAR_TS
                    3944  NWT_OUT:
229E [05] 39        3945       RTS
                    3946
                    3947  *=========================================================
                    3948  * Name:  NEW_STRCH
                    3949  * Subroutine: Create a new STRCH record in EEPROM memory
                    3950  * Written by: Robert S. Dobrose
                    3951  * Purpose: Creates a new STRCH record in EEPROM memory
                    3952  *   Input: TS_NAME : current TMPR/STRCH record name.
                    3953  *  Output: Reg-X = address of the 1st block of the new
                    3954  *            STRCH record chain
                    3955  *   Notes: A STRCH record is 8 blocks long with each
                    3956  *            record chained to the next in line with
                    3957  *            an address pointer value in the first 2
                    3958  *            bytes of each block.  The low 5 bits of
                    3959  *            this ptr value is the block type value!
                    3960  *          This routine returns the address (pointer)
                    3961  *            of the first block of the record
                    3962  *            (start of the chain).
                    3963  * - - - - - - - - - - - - - - - - - - - - - - - - - - - -
                    3964  NEW_STRCH:
229F                3965       EQU     *
                    3966       ; Create new STRCH record.
229F [03] CE0000    3967       LDX     #$0
22A2 [04] DF57      3968       STX     PTR4
22A4 [02] C60F      3969       LDAB    #TYP_S7
22A6 [03] D780      3970       STAB    IDX1            ; Save block type as index value
                    3971  NWS_LP3:
                    3972       ; Find a free block for new STRCH record header
22A8 [06] BD318E    3973       JSR     FIND_FREE
22AB [04] 8C0000    3974       CPX     #$0000
22AE [03] 2619      3975       BNE     NWS_SK31        ; If free block O.K., Continue.
                    3976       ; No free blocks!  (Do error processing!)
                    3977       ;Must Erase all chained blocks already allocated!
22B0 [04] DE57      3978       LDX     PTR4            ; Get ptr to start of partial chain
22B2 [03] 270D      3979       BEQ     NWS_SK41        ; If no blocks chained, then quit now
                    3980  NWS_LP4:
22B4 [05] EC00      3981       LDD     EE_PTR,X        ; Get next block ptr data
22B6 [06] BD3146    3982       JSR     ERASE_BLK       ; Erase the current block
22B9 [02] C4E0      3983       ANDB    #$E0            ; Mask off non-ptr data of NEXT PTR
22BB [03] 8F        3984       XGDX                    ; Move new ptr to Reg-X
22BC [04] 8C0000    3985       CPX     #$0             ; Is this the END-OF-CHAIN (NULL ptr)
22BF [03] 26F3      3986       BNE     NWS_LP4         ; No!  Loop to erase this block.
```

```
                        NWS_SK41:
22C1 [06] BD1A17            JSR     MEM_FULL        ; Done erasing chain.  Report memory
full!
22C4 [03] CE0000            LDX     #$0000
22C7 [03] 2012              BRA     NWS_OUT
                        NWS_SK31:
                            ; Clear block for new STRCH record
22C9 [04] DC57              LDD     PTR4            ; Get previous block address
22CB [03] DB80              ADDB    IDX1            ; Add block TYPE value
22CD [04] DF57              STX     PTR4            ; Save new block addr for next link
22CF [06] BD2240            JSR     CLEAR_TS
22D2 [03] D680              LDAB    IDX1
22D4 [02] 5A                DECB
22D5 [03] D780              STAB    IDX1
22D7 [02] C108              CMPB    #TYP_S0
22D9 [03] 2CCD              BGE     NWS_LP3         ; Loop until all 8 STRCH blocks are done
                        NWS_OUT:
22DB [05] 39                RTS

                        *=====================================================
                        * Name:  COPY_TS
                        * Subroutine: Copy TMPR or STRCH data from one file to another
                        * Written by: Robert S. Dobrose
                        * Purpose: Copies data from a given TMPR/STRCH record
                        *           into another record of the same type.
                        *           This is done by copying each block of data
                        *           from the source record into the destination
                        *           record.
                        *   Input: PTR1 : Header Addr of source TMPR/STRCH record
                        *          PTR3 : Header Addr of destination TMPR/STRCH record
                        *  Output: none
                        *   Notes: Uses temporary RAM memory area!
                        * - - - - - - - - - - - - - - - - - - - - - - - - - - - -
                        COPY_TS:
22DC                        EQU     *
22DC [05] 183C              PSHY
22DE [04] 3C                PSHX
22DF [03] 36                PSHA
22E0 [03] 37                PSHB
22E1 [04] DE51              LDX     PTR1
22E3 [05] 18DE55            LDY     PTR3
                        CPTS_LP1:
22E6 [04] 3C                PSHX                    ; Save latest Source block ptr
22E7 [05] 183C              PSHY                    ; Save latest Dest block ptr
22E9 [04] 18CE0082          LDY     #D_STR          ; Point to temporary storage area
22ED [02] C618              LDAB    #!24            ; Set to transfer 24 bytes
                        CPTS_LP2:
22EF [04] A602              LDAA    TS_DOFF,X       ; Get a byte from Source block
22F1 [05] 18A700            STAA    0,Y             ; and save it in temporary area
22F4 [03] 08                INX                     ; Point to next byte to transfer
22F5 [04] 1808              INY                     ; **
22F7 [02] 5A                DECB                    ; Count this byte
22F8 [03] 26F5              BNE     CPTS_LP2        ; and loop until done
22FA [06] 1838              PULY                    ; Restore current Dest block ptr
22FC [05] 183C              PSHY                    ; and re-save it
22FE [03] CE0082            LDX     #D_STR          ; Point to temporary storage area
2301 [02] 4F                CLRA                    ; Clear out CHECKSUM register
2302 [02] C618              LDAB    #!24            ; Set to transfer 24 bytes
2304 [03] D780              STAB    IDX1            ; (count in IDX1)
2306 [05] 18E600            LDAB    EE_PTR,Y        ; Get 1st byte of block PTR data
2309 [02] 1B                ABA                     ; Add 1st byte of PTR to checksum
230A [05] 18E601            LDAB    EE_PTR+1,Y      ; Get 2nd byte of block PTR data
230D [02] 1B                ABA                     ; Add 2nd byte of PTR to checksum
230E [05] 18E61A            LDAB    TS_NOFF,Y       ; Get each byte of new file name
2311 [02] 1B                ABA                     ; and add it to checksum
2312 [05] 18E61B            LDAB    TS_NOFF+1,Y     ; **
2315 [02] 1B                ABA                     ; **
2316 [05] 18E61C            LDAB    TS_NOFF+2,Y     ; **
```

```
2319 [02] 1B          4054        ABA                         ; **
231A [05] 18E61D      4055        LDAB    TS_NOFF+3,Y         ; **
231D [02] 1B          4056        ABA                         ; **
231E [05] 18E61E      4057        LDAB    TS_FOFF,Y           ; Get flag byte from new file
2321 [02] 1B          4058        ABA                         ; and add it to checksum
                      4059  CPTS_LP3:
2322 [04] E600        4060        LDAB    0,X                 ; Get next byte of stored data
2324 [02] 1B          4061        ABA                         ; Add data to checksum
2325 [05] 18E702      4062        STAB    TS_DOFF,Y           ; Store data in new record
2328 [03] 08          4063        INX                         ; Point to next byte of transfer
2329 [04] 1808        4064        INY                         ; **
232B [06] 7A0080      4065        DEC     IDX1                ; Count this byte
232E [03] 26F2        4066        BNE     CPTS_LP3            ; and loop until done
2330 [06] 1838        4067        PULY                        ; Restore last Dest block ptr
2332 [05] 183C        4068        PSHY                        ; and re-save it
2334 [05] 18A71F      4069        STAA    EE_COFF,Y           ; Store checksum byte
                      4070        ; Wait for EEPROM to store data
2337 [03] CE0002      4071        LDX     #$2
233A [06] BD1178      4072        JSR     TIMER
233D [06] 1838        4073        PULY                        ; Restore last DEST block ptr
233F [05] 38          4074        PULX                        ; Restore last SOURCE block ptr
2340 [05] EC00        4075        LDD     EE_PTR,X            ; Get NEXT-BLOCK ptr for SOURCE file
2342 [02] C4E0        4076        ANDB    #$E0                ; Mask off non-ptr data of NEXT PTR
2344 [03] 8F          4077        XGDX                        ; Move new ptr to Reg-X
2345 [04] 8C0000      4078        CPX     #$0                 ; Is this the END-OF-CHAIN (NULL ptr)
2348 [03] 270D        4079        BEQ     CPTS_DONE           ; Yes!  Jump to exit.
234A [06] 18EC00      4080        LDD     EE_PTR,Y            ; Get NEXT-BLOCK ptr for DEST file
234D [02] C4E0        4081        ANDB    #$E0                ; Mask off non-ptr data of NEXT PTR
234F [04] 188F        4082        XGDY                        ; Move new ptr to Reg-Y
2351 [05] 188C0000    4083        CPY     #$0                 ; Is this the END-OF-CHAIN (NULL ptr)
2355 [03] 268F        4084        BNE     CPTS_LP1            ; No!  Loop to do another block.
                      4085  CPTS_DONE:
2357 [04] 33          4086        PULB
2358 [04] 32          4087        PULA
2359 [05] 38          4088        PULX
235A [06] 1838        4089        PULY
235C [05] 39          4090        RTS
                      4091
                      4092  *=====================================================
                      4093  * Name:  DEL_TS
                      4094  * Subroutine: Delete a TMPR or STRCH record block/chain
                      4095  * Written by: Robert S. Dobrose
                      4096  * Purpose: Deletes a given block/chain of EEPROM memory
                      4097  *            for a TMPR/STRCH record.  This is done by
                      4098  *            filling the data bytes with $FF for the
                      4099  *            TMPR block or each block of a STRCH chain.
                      4100  *   Input: Reg-X : Address of block to be cleared
                      4101  *          PTR1 : Header Addr of TMPR/STRCH to be deleted
                      4102  *          TS_NAME : current TMPR/STRCH record name.
                      4103  *          DFLAGS : T or S bits indicate TMPR or STRCH
                      4104  *  Output: none
                      4105  *   Notes:
                      4106  * - - - - - - - - - - - - - - - - - - - - - - - - - - - -
                      4107  DEL_TS:
235D                  4108        EQU     *
235D [03] 37          4109        PSHB
235E [04] 3C          4110        PSHX
235F [05] 183C        4111        PSHY
2361 [06] 1242800D    4112        BRSET   DFLAGS,$80,DTS_SK03
2365 [04] 8CA000      4113        CPX     #EEPROM
2368 [03] 2D08        4114        BLT     DTS_SK03
236A [04] 8CDFFF      4115        CPX     #EEPEND
236D [03] 2F23        4116        BLE     DTS_SK05
236F [06] 144280      4117        BSET    DFLAGS,$80
                      4118  DTS_SK03:
                      4119        ; Record ADDR is in ROM!  Not Deletable!!
                      4120  ; Display "Unable to Delete" screen & wait for any key hit
2372 macro            4121        SCR     833,831,832,803
```

```
2372 [03] CE6D4C     4122   LDX #MSG%1
2375 [06] BD12C1     4123   JSR LINE1
2378 [03] CE6D22     4124   LDX #MSG%2
237B [06] BD12C7     4125   JSR LINE2
237E [03] CE6D37     4126   LDX #MSG%3
2381 [06] BD12CD     4127   JSR LINE3
2384 [03] CE6C7A     4128   LDX #MSG%4
2387 [06] BD12D3     4129   JSR LINE4
                     4130       ; | Wait for a key hit
                     4131  DTS_LP0:
238A [06] BD1366     4132       JSR     GET_KEY          ; Get PANEL Inputs
238D [03] 27FB       4133       BEQ     DTS_LP0          ; Branch while no keys hit
238F [03] 7E2428     4134       JMP     DTS_DONE
                     4135  DTS_SK05:
2392 [06] 1242021A   4136       BRSET   DFLAGS,$02,DTS_SK11
2396 macro           4137       SCR     134,105,0,106
2396 [03] CE6875     4138   LDX #MSG%1
2399 [06] BD12C1     4139   JSR LINE1
239C [03] CE66AA     4140   LDX #MSG%2
239F [06] BD12C7     4141   JSR LINE2
23A2 [03] CE6015     4142   LDX #MSG%3
23A5 [06] BD12CD     4143   JSR LINE3
23A8 [03] CE66BF     4144   LDX #MSG%4
23AB [06] BD12D3     4145   JSR LINE4
23AE [03] 2018       4146       BRA     DTS_SK12
                     4147  DTS_SK11:
23B0 macro           4148       SCR     156,105,0,106
23B0 [03] CE6A43     4149   LDX #MSG%1
23B3 [06] BD12C1     4150   JSR LINE1
23B6 [03] CE66AA     4151   LDX #MSG%2
23B9 [06] BD12C7     4152   JSR LINE2
23BC [03] CE6015     4153   LDX #MSG%3
23BF [06] BD12CD     4154   JSR LINE3
23C2 [03] CE66BF     4155   LDX #MSG%4
23C5 [06] BD12D3     4156   JSR LINE4
                     4157  DTS_SK12:
                     4158       ; Must display TS_NAME here!!
23C8 [02] 8600       4159       LDAA    #!0              ; Line 0
23CA [02] C60F       4160       LDAB    #!15             ; Column 15
23CC [06] BD1309     4161       JSR     DSP_CUR          ; Position Cursor
23CF [05] 38         4162       PULX                     ; Get old Reg-Y into Reg-X
23D0 [04] 3C         4163       PSHX                     ; and re-save it
23D1 [06] BD12BD     4164       JSR     DSP_STR          ; and display string
23D4 [06] BD1331     4165       JSR     WAIT_NONE
23D7 [02] 8602       4166       LDAA    #$02
23D9 macro           4167       CHOOSE  DTS_SK21,DTS_DONE,MNU0,MNU0,MNU0
                     4168  MNU0:
23D9 [06] BD1366     4169   JSR GET_KEY
23DC [02] 841F       4170   ANDA #$1F
23DE [03] 27F9       4171   BEQ MNU0
23E0 [02] 8101       4172   CMPA #$01
23E2 [03] 2603       4173   BNE MNU1
23E4 [03] 7E2405     4174   JMP %1
                     4175  MNU1:
23E7 [02] 8102       4176   CMPA #$02
23E9 [03] 2603       4177   BNE MNU2
23EB [03] 7E2428     4178   JMP %2
                     4179  MNU2:
23EE [02] 8104       4180   CMPA #$04
23F0 [03] 2603       4181   BNE MNU3
23F2 [03] 7E23D9     4182   JMP %3
                     4183  MNU3:
23F5 [02] 8108       4184   CMPA #$08
23F7 [03] 2603       4185   BNE MNU4
23F9 [03] 7E23D9     4186   JMP %4
                     4187  MNU4:
23FC [02] 8110       4188   CMPA #$10
23FE [03] 2603       4189   BNE MNU5
```

```
2400 [03] 7E23D9    4190   JMP %5
                    4191  MNU5:
2403 [03] 20D4      4192   BRA MNU0
                    4193  DTS_SK21:
                    4194       ; Delete the TMPR/STRCH selected
2405 [04] DE51      4195       LDX     PTR1
                    4196  DTS_LP1:
2407 [04] 8C0000    4197       CPX     #$0000
                    4198       ; if block ptr is NULL, end of chain so exit!
240A [03] 270D      4199       BEQ     DTS_EXIT
                    4200       ; grab & save NEXT BLOCK value (type/ptr data)
240C [05] EC00      4201       LDD     EE_PTR,X
240E [02] C4E0      4202       ANDB    #$E0            ; mask off non-ptr data
2410 [04] DD57      4203       STD     PTR4
                    4204       ; delete this block
2412 [06] BD3146    4205       JSR     ERASE_BLK
                    4206       ; process next block
2415 [04] DE57      4207       LDX     PTR4
2417 [03] 20EE      4208       BRA     DTS_LP1
                    4209  DTS_EXIT:
                    4210       ; on exit, clear PTR1, PTR2, DFLAGS (T & S bits) and SFLAGS (KEY
bits)
2419 [03] CE0000    4211       LDX     #$0000
241C [04] DF51      4212       STX     PTR1
241E [04] DF53      4213       STX     PTR2
2420 [06] 154206    4214       BCLR    DFLAGS,$06
2423 [06] 154303    4215       BCLR    SFLAGS,$03
2426 [02] 8601      4216       LDAA    #$01
                    4217  DTS_DONE:
2428 [06] 1838      4218       PULY
242A [05] 38        4219       PULX
242B [04] 33        4220       PULB
242C [05] 39        4221       RTS
                    4222
                    4223  *=========================================================
                    4224  * Name:  SEL_TS
                    4225  * Subroutine: Select a TMPR or STRCH record block/chain
                    4226  * Written by: Robert S. Dobrose
                    4227  * Purpose: Selects a given TMPR/STRCH record from a
                    4228  *            directory block chain in EEPROM.
                    4229  *   Input: Reg-X : Address of 1st line text string
                    4230  *          Reg-A : 0 = normal select, 1 = alternate
                    4231  *          DFLAGS : T or S bits indicate TMPR or STRCH
                    4232  *          SFLAGS : RS bit allows search of ROM'd records
                    4233  *  Output: PTR1 = addr of TMPR/STRCH header block
                    4234  *          Reg-A = Panel Key hit for exit.
                    4235  *          TS_NAME = current TMPR/STRCH record name.
                    4236  *          DFLAGS : R bit indicates Rom'd Standard TMPR/STRCH
                    4237  *          SFLAGS : KEY bits set to TMPR/STRCH KEY data
                    4238  *   Notes:
                    4239  * - - - - - - - - - - - - - - - - - - - - - - - - - - - -
                    4240  SEL_TS:
242D                4241       EQU     *
242D [03] 37        4242       PSHB
242E [05] 183C      4243       PSHY
2430 [04] 3C        4244       PSHX
2431 [03] 97A0      4245       STAA    D1TEMP
2433 [03] 261A      4246       BNE     STS_SK01
2435 macro          4247       SCR     0,0,0,127
2435 [03] CE6015    4248   LDX #MSG%1
2438 [06] BD12C1    4249   JSR LINE1
243B [03] CE6015    4250   LDX #MSG%2
243E [06] BD12C7    4251   JSR LINE2
2441 [03] CE6015    4252   LDX #MSG%3
2444 [06] BD12CD    4253   JSR LINE3
2447 [03] CE67E2    4254   LDX #MSG%4
244A [06] BD12D3    4255   JSR LINE4
244D [03] 2018      4256       BRA     STS_SK02
```

```
                    4257  STS_SK01:
 244F macro         4258        SCR      0,0,0,128
 244F [03] CE6015   4259   LDX #MSG%1
 2452 [06] BD12C1   4260   JSR LINE1
 2455 [03] CE6015   4261   LDX #MSG%2
 2458 [06] BD12C7   4262   JSR LINE2
 245B [03] CE6015   4263   LDX #MSG%3
 245E [06] BD12CD   4264   JSR LINE3
 2461 [03] CE67F7   4265   LDX #MSG%4
 2464 [06] BD12D3   4266   JSR LINE4
                    4267  STS_SK02:
 2467 [06] BD1331   4268        JSR      WAIT_NONE        ; Wait for no keys pressed
 246A [06] BD1321   4269        JSR      CUR_ON
 246D [05] 38       4270        PULX
 246E [06] BD12C1   4271        JSR      LINE1
 2471 [06] 12432008 4272        BRSET    SFLAGS,$20,STS_SK11
 2475 [03] CEA000   4273        LDX      #EEPROM
 2478 [06] 154280   4274        BCLR     DFLAGS,$80
 247B [03] 2006     4275        BRA      STS_SK12
                    4276  STS_SK11:
 247D [03] CE7000   4277        LDX      #ROM_TS
 2480 [06] 144280   4278        BSET     DFLAGS,$80
                    4279  STS_SK12:
 2483 [06] 7F0080   4280        CLR      IDX1             ; Start at first entry on screen
 2486 [04] DF53     4281        STX      PTR2
 2488 [06] BD31B0   4282        JSR      NEXT_TS
 248B [04] 8C0000   4283        CPX      #$0000
 248E [03] 2615     4284        BNE      STS_SK15         ; Found a record.  Continue.
                    4285        ; No record found in initial search memory.
 2490 [06] 1342800E 4286        BRCLR    DFLAGS,$80,STS_SK13      ; If in EEPROM then done (no
entries)
 2494 [03] CEA000   4287        LDX      #EEPROM          ; Else in ROM so search EEPROM
 2497 [06] 154280   4288        BCLR     DFLAGS,$80
 249A [06] BD31B0   4289        JSR      NEXT_TS
                    4290  ; Compare Reg-X (Result of search) If == 0 ==> No USER files!
 249D [04] 8C0000   4291        CPX      #$0000           ; Did we find a file?
 24A0 [03] 2603     4292        BNE      STS_SK15         ; YES!  Continue.
                    4293  STS_SK13:
 24A2 [03] 7E26B4   4294        JMP      STS_NONE         ; No file found in any memory
                    4295  STS_SK15:
 24A5 [04] DF57     4296        STX      PTR4             ; Save Starting Block address
                    4297  STS_LP2:
 24A7 [06] 7F0081   4298        CLR      IDX2
 24AA [03] CE6015   4299        LDX      #MSG0            ; Clear line #1 (2nd line)
 24AD [06] BD12C7   4300        JSR      LINE2
 24B0 [03] CE6015   4301        LDX      #MSG0            ; Clear line #2 (3rd line)
 24B3 [06] BD12CD   4302        JSR      LINE3
 24B6 [02] 8601     4303        LDAA     #!1              ; Line 1
 24B8 [02] C600     4304        LDAB     #!0              ; Column 0
 24BA [06] BD1309   4305        JSR      DSP_CUR          ; Position Cursor
                    4306        ; display 8 file names from PTR4 (if 8 exist) (keep count in
IDX2)
 24BD [04] DE57     4307        LDX      PTR4
                    4308  ;     STX      PTR2
 24BF [03] 2003     4309        BRA      STS_SK30
                    4310  STS_LP3:
 24C1 [06] BD31B0   4311        JSR      NEXT_TS
                    4312  STS_SK30:
 24C4 [04] 8C0000   4313        CPX      #$0000
 24C7 [03] 2731     4314        BEQ      STS_SK32         ; No more files!  Skip name display &
count
 24C9 [04] DF53     4315        STX      PTR2
                    4316        ; Legit record!  Find & display name!
 24CB [04] A61A     4317        LDAA     TS_NOFF,X
 24CD [06] BD12EE   4318        JSR      DSP_CHR
 24D0 [04] A61B     4319        LDAA     TS_NOFF+1,X
 24D2 [06] BD12EE   4320        JSR      DSP_CHR
 24D5 [04] A61C     4321        LDAA     TS_NOFF+2,X
```

```
24D7 [06] BD12EE     4322        JSR     DSP_CHR
24DA [04] A61D       4323        LDAA    TS_NOFF+3,X
24DC [06] BD12EE     4324        JSR     DSP_CHR
24DF [02] 8620       4325        LDAA    #$20
24E1 [06] BD12EE     4326        JSR     DSP_CHR
24E4 [06] 7C0081     4327        INC     IDX2            ; incr screen name count
24E7 [03] D681       4328        LDAB    IDX2
24E9 [02] C104       4329        CMPB    #$4
24EB [03] 2609       4330        BNE     STS_SK31
24ED [02] 8602       4331        LDAA    #!2             ; Line 2
24EF [02] C600       4332        LDAB    #!0             ; Column 0
24F1 [06] BD1309     4333        JSR     DSP_CUR         ; Position Cursor
24F4 [03] D681       4334        LDAB    IDX2
                     4335   STS_SK31:
24F6 [02] C108       4336        CMPB    #$8             ; Is screen full?
24F8 [03] 2DC7       4337        BLT     STS_LP3         ; NO!  Continue loop.
                     4338   STS_SK32:
24FA [03] 9681       4339        LDAA    IDX2            ; How many entries did we find?
24FC [03] 2619       4340        BNE     STS_SK34        ; If not NONE, skip ERROR
24FE [06] 13428012   4341        BRCLR   DFLAGS,$80,STS_SK33     ; If in EEPROM then done (no
entries)
2502 [03] CEA000     4342        LDX     #EEPROM         ; Else in ROM so search EEPROM
2505 [06] 154280     4343        BCLR    DFLAGS,$80
2508 [06] BD31B0     4344        JSR     NEXT_TS
                     4345   ; Compare Reg-X (Result of search) If == 0 ==> No USER files!
250B [04] 8C0000     4346        CPX     #$0000          ; Did we find a file?
250E [03] 2704       4347        BEQ     STS_SK33        ; NO!  Display 'NO FILES' message.
2510 [04] DF57       4348        STX     PTR4            ; Save ptr to first file.
2512 [03] 20B0       4349        BRA     STS_SK30        ; and display & count it.
                     4350   STS_SK33:
2514 [03] 7E26B4     4351        JMP     STS_NONE        ; No non-blank entries
                     4352   STS_SK34:
2517 [06] 7D00A0     4353        TST     D1TEMP
251A [03] 2612       4354        BNE     STS_LP31        ; Skip change if not EDIT-SLCT option
                     4355   ; Add code to change last line of display if files in EEPROM or ROM
                     4356   ; Only make change if SLCT-EDIT option is given (D1TEMP = 0)
251C [06] 13428008   4357        BRCLR   DFLAGS,$80,STS_SK35     ; If files in EEPROM, jump to 2nd
choice
                     4358   ; If in ROM then display without EDIT option & disallow EDIT choice
below.
2520 [03] CE680C     4359        LDX     #MSG129
2523 [06] BD12D3     4360        JSR     LINE4
2526 [03] 2006       4361        BRA     STS_LP31
                     4362   STS_SK35:
2528 [03] CE67E2     4363        LDX     #MSG127
252B [06] BD12D3     4364        JSR     LINE4
                     4365   STS_LP31:
                     4366        ; Set cursor on currently selected screen entry
252E [03] D680       4367        LDAB    IDX1
2530 [02] 17         4368        TBA
2531 [02] 58         4369        LSLB                    ; Mult position by 4
2532 [02] 58         4370        LSLB                    ; **
2533 [02] 1B         4371        ABA                     ; Add position (Mult by 5)
2534 [02] 16         4372        TAB
2535 [02] 8601       4373        LDAA    #!1
2537 [02] C114       4374        CMPB    #!20
2539 [03] 2D03       4375        BLT     STS_SK36
253B [02] 4C         4376        INCA
253C [02] C014       4377        SUBB    #!20
                     4378   STS_SK36:
253E [06] BD1309     4379        JSR     DSP_CUR         ; Position Cursor
                     4380   ; #####  Add a time delay or WAIT_NONE call here!
2541 [06] BD1331     4381        JSR     WAIT_NONE
2544 [06] 7D00A0     4382        TST     D1TEMP
2547 [03] 2703       4383        BEQ     STS_SK37
2549 [03] 7E25C4     4384        JMP     STS_SK39
                     4385   STS_SK37:
254C [06] 1342803A   4386        BRCLR   DFLAGS,$80,STS_SK38     ; If files in EEPROM, jump to 2nd
```

```
choice
 2550 macro          4387        CHOOSE2 STS_CNCL,MNU0,STS_CNCL,STS_SLCT,STS_SLCT,STS_BACK,STS_FWD
                     4388  MNU0:
 2550 [06] BD1366    4389   JSR GET_KEY
 2553 [02] 847F      4390   ANDA #$7F
 2555 [03] 27F9      4391   BEQ MNU0
 2557 [02] 8101      4392   CMPA #$01
 2559 [03] 2603      4393   BNE MNU1
 255B [03] 7E26E0    4394   JMP %1
                     4395  MNU1:
 255E [02] 8102      4396   CMPA #$02
 2560 [03] 2603      4397   BNE MNU2
 2562 [03] 7E2550    4398   JMP %2
                     4399  MNU2:
 2565 [02] 8104      4400   CMPA #$04
 2567 [03] 2603      4401   BNE MNU3
 2569 [03] 7E26E0    4402   JMP %3
                     4403  MNU3:
 256C [02] 8108      4404   CMPA #$08
 256E [03] 2603      4405   BNE MNU4
 2570 [03] 7E2675    4406   JMP %4
                     4407  MNU4:
 2573 [02] 8110      4408   CMPA #$10
 2575 [03] 2603      4409   BNE MNU5
 2577 [03] 7E2675    4410   JMP %5
                     4411  MNU5:
 257A [02] 8120      4412   CMPA #$20
 257C [03] 2603      4413   BNE MNU6
 257E [03] 7E25FE    4414   JMP %6
                     4415  MNU6:
 2581 [02] 8140      4416   CMPA #$40
 2583 [03] 2603      4417   BNE MNU7
 2585 [03] 7E2638    4418   JMP %7
                     4419  MNU7:
 2588 [03] 20C6      4420   BRA MNU0
                     4421  STS_SK38:
 258A macro          4422        CHOOSE2
STS_CNCL,STS_SLCT,STS_CNCL,STS_SLCT,STS_SLCT,STS_BACK,STS_FWD
                     4423  MNU0:
 258A [06] BD1366    4424   JSR GET_KEY
 258D [02] 847F      4425   ANDA #$7F
 258F [03] 27F9      4426   BEQ MNU0
 2591 [02] 8101      4427   CMPA #$01
 2593 [03] 2603      4428   BNE MNU1
 2595 [03] 7E26E0    4429   JMP %1
                     4430  MNU1:
 2598 [02] 8102      4431   CMPA #$02
 259A [03] 2603      4432   BNE MNU2
 259C [03] 7E2675    4433   JMP %2
                     4434  MNU2:
 259F [02] 8104      4435   CMPA #$04
 25A1 [03] 2603      4436   BNE MNU3
 25A3 [03] 7E26E0    4437   JMP %3
                     4438  MNU3:
 25A6 [02] 8108      4439   CMPA #$08
 25A8 [03] 2603      4440   BNE MNU4
 25AA [03] 7E2675    4441   JMP %4
                     4442  MNU4:
 25AD [02] 8110      4443   CMPA #$10
 25AF [03] 2603      4444   BNE MNU5
 25B1 [03] 7E2675    4445   JMP %5
                     4446  MNU5:
 25B4 [02] 8120      4447   CMPA #$20
 25B6 [03] 2603      4448   BNE MNU6
 25B8 [03] 7E25FE    4449   JMP %6
                     4450  MNU6:
 25BB [02] 8140      4451   CMPA #$40
 25BD [03] 2603      4452   BNE MNU7
```

```
25BF [03] 7E2638     4453   JMP %7
                     4454  MNU7:
25C2 [03] 20C6       4455   BRA MNU0
                     4456  STS_SK39:
25C4 macro           4457        CHOOSE2 MNU0,MNU0,STS_CNCL,STS_SLCT,STS_SLCT,STS_BACK,STS_FWD
                     4458  MNU0:
25C4 [06] BD1366     4459   JSR GET_KEY
25C7 [02] 847F       4460   ANDA #$7F
25C9 [03] 27F9       4461   BEQ MNU0
25CB [02] 8101       4462   CMPA #$01
25CD [03] 2603       4463   BNE MNU1
25CF [03] 7E25C4     4464   JMP %1
                     4465  MNU1:
25D2 [02] 8102       4466   CMPA #$02
25D4 [03] 2603       4467   BNE MNU2
25D6 [03] 7E25C4     4468   JMP %2
                     4469  MNU2:
25D9 [02] 8104       4470   CMPA #$04
25DB [03] 2603       4471   BNE MNU3
25DD [03] 7E26E0     4472   JMP %3
                     4473  MNU3:
25E0 [02] 8108       4474   CMPA #$08
25E2 [03] 2603       4475   BNE MNU4
25E4 [03] 7E2675     4476   JMP %4
                     4477  MNU4:
25E7 [02] 8110       4478   CMPA #$10
25E9 [03] 2603       4479   BNE MNU5
25EB [03] 7E2675     4480   JMP %5
                     4481  MNU5:
25EE [02] 8120       4482   CMPA #$20
25F0 [03] 2603       4483   BNE MNU6
25F2 [03] 7E25FE     4484   JMP %6
                     4485  MNU6:
25F5 [02] 8140       4486   CMPA #$40
25F7 [03] 2603       4487   BNE MNU7
25F9 [03] 7E2638     4488   JMP %7
                     4489  MNU7:
25FC [03] 20C6       4490   BRA MNU0
                     4491  STS_BACK:
                     4492        ; If screen ptr <= 0 then get previous 8 entries & display
25FE [03] 9680       4493        LDAA    IDX1
2600 [03] 2630       4494        BNE     STS_SK49
                     4495        ; Already on entry #0.  Get previous screen full of entries!
2602 [02] 8608       4496        LDAA    #$8
2604 [04] DE57       4497        LDX     PTR4
                     4498  STS_LP4:
2606 [06] BD31F6     4499        JSR     PREV_TS
2609 [04] 8C0000     4500        CPX     #$0000          ; Beginning of list?
260C [03] 2617       4501        BNE     STS_SK43        ; No.  Continue looking.
                     4502  ; ##### should we display ROM'd TMPRS here if desired??
                     4503  ; *** The following works only if there are 8 or less TMPR/STRCH files
260E [06] 12432008   4504        BRSET   SFLAGS,$20,STS_SK41
2612 [03] CEA000     4505        LDX     #EEPROM         ; Set for start of file list.
2615 [06] 154280     4506        BCLR    DFLAGS,$80      ; Set flag for EEPROM search
2618 [03] 2006       4507        BRA     STS_SK42
                     4508  STS_SK41:
261A [03] CE7000     4509        LDX     #ROM_TS         ; Set for start of file list.
261D [06] 144280     4510        BSET    DFLAGS,$80      ; Set flag for ROM search
                     4511  STS_SK42:
2620 [06] BD31B0     4512        JSR     NEXT_TS
2623 [03] 2003       4513        BRA     STS_SK44
                     4514  STS_SK43:
2625 [02] 4A         4515        DECA
2626 [03] 26DE       4516        BNE     STS_LP4
                     4517  STS_SK44:
2628 [04] DF53       4518        STX     PTR2
262A [04] DF57       4519        STX     PTR4            ; Save Starting Block address
262C [06] 7F0080     4520        CLR     IDX1            ; Start at first entry on screen
```

```
262F [03] 7E24A7    4521        JMP     STS_LP2
                    4522  STS_SK49:
                    4523        ; Decrement screen ptr & BRA to STS_LP3
2632 [02] 4A        4524        DECA
2633 [03] 9780      4525        STAA    IDX1
                    4526        ; If no previous entries then set screen ptr to 0
2635 [03] 7E252E    4527        JMP     STS_LP31
                    4528  STS_FWD:
                    4529        ; If screen ptr >= 7 then get next 8 entries & display
2638 [03] 9680      4530        LDAA    IDX1
263A [02] 8107      4531        CMPA    #$7
263C [03] 2D2D      4532        BLT     STS_SK59
                    4533        ; Already on entry #7.  Get next screen full of entries!
                    4534  ; ##### If TMPR's & on first screen, display ROM'd TMPRs first??
263E [04] DE53      4535        LDX     PTR2
2640 [06] BD31B0    4536        JSR     NEXT_TS
2643 [04] 8C0000    4537        CPX     #$0000          ; End of list?
2646 [03] 2619      4538        BNE     STS_SK51        ; No.  Next file is legit!
                    4539  ; Next file is NULL (end of list or end of ROM area)
2648 [06] 13428011  4540        BRCLR   DFLAGS,$80,STS_SK50     ; End-of-list, do not advance
screen.
                    4541        ; Here we are at end-of-ROM.  Set for EEPROM search & check for
legit.
264C [03] CEA000    4542        LDX     #EEPROM
264F [06] 154280    4543        BCLR    DFLAGS,$80
2652 [06] BD31B0    4544        JSR     NEXT_TS
2655 [04] 8C0000    4545        CPX     #$0000
2658 [03] 2607      4546        BNE     STS_SK51        ; Legit file!  Save pointer & use flags!
265A [06] 144280    4547        BSET    DFLAGS,$80      ; No EEPROM files!  Set flags back to
ROM!
                    4548  STS_SK50:
265D [04] DE57      4549        LDX     PTR4
265F [03] 2003      4550        BRA     STS_SK52
                    4551  STS_SK51:
2661 [06] 7F0080    4552        CLR     IDX1
                    4553  STS_SK52:
2664 [04] DF57      4554        STX     PTR4
2666 [04] DF53      4555        STX     PTR2
2668 [03] 7E24A7    4556        JMP     STS_LP2
                    4557  STS_SK59:
                    4558        ; Increment screen ptr
266B [02] 4C        4559        INCA
266C [03] 9181      4560        CMPA    IDX2
266E [03] 2C02      4561        BGE     STS_SK61        ; already on last entry in list
                    4562        ; If next entry is legit, then set screen ptr to new value
2670 [03] 9780      4563        STAA    IDX1            ; store new entry count
                    4564  STS_SK61:
2672 [03] 7E252E    4565        JMP     STS_LP31
                    4566  STS_SLCT:
                    4567        ; At this point, IDX1 = offset from PTR4 of desired entry
                    4568        ; And Reg-A = keyhit response so save it for later return!
2675 [03] 36        4569        PSHA
                    4570  ; ##### If ROM'd TMPR screen is selected, pick from ROM'd TMPRs first!
2676 [04] DE57      4571        LDX     PTR4
2678 [03] 9680      4572        LDAA    IDX1
                    4573  STS_LP5:
267A [02] 4D        4574        TSTA
267B [03] 270B      4575        BEQ     STS_OUT5
                    4576        ; find next file pointer address & decrement counter
267D [06] BD31B0    4577        JSR     NEXT_TS
2680 [04] 8C0000    4578        CPX     #$0000
2683 [03] 2703      4579        BEQ     STS_OUT5
2685 [02] 4A        4580        DECA
2686 [03] 20F2      4581        BRA     STS_LP5
                    4582  STS_OUT5:
                    4583        ; Reg-X now holds the selected file pointer address
                    4584        ; on exit, set PTR1 and SFLAGS (KEY bits)
                    4585        ; ** DONE.  Reg-X is record header.  Store in PTR1.
```

```
2688 [04] DF51       4586        STX     PTR1
                     4587        ; ** Get name into TS_NAME.
268A [04] 18CE0049   4588        LDY     #TS_NAME
268E [04] A61A       4589        LDAA    TS_NOFF,X
2690 [05] 18A700     4590        STAA    0,Y
2693 [04] A61B       4591        LDAA    TS_NOFF+1,X
2695 [05] 18A701     4592        STAA    1,Y
2698 [04] A61C       4593        LDAA    TS_NOFF+2,X
269A [05] 18A702     4594        STAA    2,Y
269D [04] A61D       4595        LDAA    TS_NOFF+3,X
269F [05] 18A703     4596        STAA    3,Y
26A2 [02] 4F         4597        CLRA
26A3 [05] 18A704     4598        STAA    4,Y
                     4599        ; ** Get KEY data into SFLAGS
26A6 [03] 9643       4600        LDAA    SFLAGS          ; Load current SFLAGS data
26A8 [02] 84FC       4601        ANDA    #$FC            ; Mask off KEY data
26AA [04] E61E       4602        LDAB    TS_FOFF,X       ; Load Flags data from record
26AC [02] C403       4603        ANDB    #$03            ; Mask off non-KEY data
26AE [02] 1B         4604        ABA                     ; Add new KEY data to other SFLAGS
26AF [03] 9743       4605        STAA    SFLAGS          ; Store new SFLAGS
26B1 [04] 32         4606        PULA
26B2 [03] 2034       4607        BRA     STS_DONE
                     4608   STS_NONE:
                     4609        ; No directory block.  No entries.
26B4 [06] BD1329     4610        JSR     CUR_OFF
26B7 [03] CE67A3     4611        LDX     #MSG124
26BA [06] BD12C7     4612        JSR     LINE2
26BD [06] 7D00A0     4613        TST     D1TEMP
26C0 [03] 2705       4614        BEQ     STS_SK91
26C2 [03] CE67B8     4615        LDX     #MSG125
26C5 [03] 2003       4616        BRA     STS_SK92
                     4617   STS_SK91:
26C7 [03] CE6BD2     4618        LDX     #MSG176
                     4619   STS_SK92:
26CA [06] BD12D3     4620        JSR     LINE4
                     4621   STS_LP9:
26CD [06] BD1366     4622        JSR     GET_KEY
26D0 [06] 7D00A0     4623        TST     D1TEMP
26D3 [03] 2702       4624        BEQ     STS_SK95
26D5 [02] 8405       4625        ANDA    #$05
                     4626   STS_SK95:
26D7 [02] 4D         4627        TSTA
26D8 [03] 27F3       4628        BEQ     STS_LP9
26DA [06] 7D00A0     4629        TST     D1TEMP
26DD [03] 2701       4630        BEQ     STS_CNCL
26DF [02] 4F         4631        CLRA
                     4632   STS_CNCL:
26E0 [06] 154206     4633        BCLR    DFLAGS,$06
26E3 [03] CE0000     4634        LDX     #$0000
26E6 [04] DF51       4635        STX     PTR1
                     4636   STS_DONE:
26E8 [06] BD1329     4637        JSR     CUR_OFF
26EB [06] 1838       4638        PULY
26ED [04] 33         4639        PULB
26EE [04] DE51       4640        LDX     PTR1
26F0 [05] 39         4641        RTS
                     4642
                     4643   ; $INCLUDE 'SEQ.ASM'            ;Include SEQUENCE Subroutines
26F1                 4644   $INCLUDE 'TMPR.ASM'             ;Include TEMPERAMENT Subroutines
                     4645   *=====================================================*
                     4646   *   Peterson Tuner Temperament Subroutines            *
                     4647   *   Written by: Robert S. Dobrose                     *
                     4648   *   Saracon, Inc.                                     *
                     4649   *     1135 Garfield Ave.                              *
                     4650   *     Libertyville, IL  60048                         *
                     4651   *=====================================================*
                     4652   *   Release History                                   *
                     4653   *   06/12/95  1.0  - Initial Code                     *
```

```
                    *=====================================================*


                    *=====================================================
                    * Name:  TMPR
                    * Subroutine: Temperament Menu Routine
                    * Written by: Robert S. Dobrose
                    * Purpose: Displays the "Temperament Menu" screen and waits for
                    *            Function key input.  Then jumps to the
                    *            selected sub-menu routine.
                    *   Input: none
                    *  Output: none
                    *   Notes:  This routine is called as a subroutine
                    *             but jumps to other routines.  The other
                    *             menu routines should jump to the start
                    *             of this routine on a "Return To TMPR"
                    *             function and should perform an RTS on a
                    *             "RUN" function to return to the main
                    *             operational loop.
                    *        ** Register X and Accum-A are modified
                    * - - - - - - - - - - - - - - - - - - - - - - - - - - - -

                    TMPR:
26F1                      EQU     *

26F1 macro                MNU     130,021,151,152,TMPR_NEW,TMPR_DEL,TMPR_RUN,TMPR_STOP,MNU0
26F1 [03] CE6821          LDX #MSG%1
26F4 [06] BD12C1          JSR LINE1
26F7 [03] CE6145          LDX #MSG%2
26FA [06] BD12C7          JSR LINE2
26FD [03] CE69DA          LDX #MSG%3
2700 [06] BD12CD          JSR LINE3
2703 [03] CE69EF          LDX #MSG%4
2706 [06] BD12D3          JSR LINE4
2709 [06] BD1331          JSR WAIT_NONE
                    MNU0:
270C [02] 861F            LDAA #$1F
270E [04] 18CE2EE0        LDY #!12000
2712 [06] BD1388          JSR WAIT_KEY
2715 [02] 4D              TSTA
2716 [03] 2601            BNE MNU0A
2718 [05] 39              RTS
                    MNU0A:
2719 [02] 8101            CMPA #$01
271B [03] 2603            BNE MNU1
271D [03] 7E273E          JMP %5
                    MNU1:
2720 [02] 8102            CMPA #$02
2722 [03] 2603            BNE MNU2
2724 [03] 7E28D1          JMP %6
                    MNU2:
2727 [02] 8104            CMPA #$04
2729 [03] 2603            BNE MNU3
272B [03] 7E27FD          JMP %7
                    MNU3:
272E [02] 8108            CMPA #$08
2730 [03] 2603            BNE MNU4
2732 [03] 7E2B28          JMP %8
                    MNU4:
2735 [02] 8110            CMPA #$10
2737 [03] 2603            BNE MNU5
2739 [03] 7E270C          JMP %9
                    MNU5:
273C [03] 20CE            BRA MNU0

                    TMPR_NEW:
                          ; Select source file
273E [06] 144204          BSET    DFLAGS,$04
```

```
2741 [06] 154202     4722        BCLR    DFLAGS,$02
2744 [06] 144320     4723        BSET    SFLAGS,$20
2747 [03] CE68C9     4724        LDX     #MSG138
274A [02] 8600       4725        LDAA    #$0
274C [06] BD242D     4726        JSR     SEL_TS
274F [04] DF51       4727        STX     PTR1
                     4728        ; Check key response
2751 [02] 8101       4729        CMPA    #$01            ; Is it NEW?
2753 [03] 272D       4730        BEQ     TMPR_NAME       ; If so, go pick a new name.
2755 [02] 8102       4731        CMPA    #$02            ; Is it EDIT?
2757 [03] 2603       4732        BNE     TMPR_NW10       ; No.  Continue
2759 [03] 7E2ACF     4733        JMP     TMPR_EDIT       ; Yes!  Go edit file.
                     4734   TMPR_NW10:
275C [02] 8104       4735        CMPA    #$04            ; Is it CNCL?
275E [03] 2705       4736        BEQ     TMPR_NO1        ; If so, clear flags & return
                     4737        ; At this point, key hit was STRT, SLCT or ENTER
2760 [04] 8C0000     4738        CPX     #$0000          ; Check pointer
2763 [03] 2611       4739        BNE     TMPR_STRT       ; Non-zero pointer so file is O.K.(??)
                     4740        ; Else drop through to cancel
                     4741   TMPR_NO1:
2765 [06] 154206     4742        BCLR    DFLAGS,$06
2768 [04] B67C00     4743        LDAA    V_INC1          ; set to Scale #1 (Default)
276B [03] 9746       4744        STAA    V_SCL           ; Store new scale value
276D [06] 154201     4745        BCLR    DFLAGS,$01      ; Clear fractional vernier display flag
2770 [06] BD1331     4746        JSR     WAIT_NONE       ; Wait for no keys pressed
2773 [03] 7E26F1     4747        JMP     TMPR
                     4748
                     4749   TMPR_STRT:
2776 [04] B67C02     4750        LDAA    V_INC3          ; set to Scale #3 (Default)
2779 [03] 9746       4751        STAA    V_SCL           ; Store new scale value
277B [06] 144201     4752        BSET    DFLAGS,$01      ; Set fractional vernier display flag
277E [06] BD1331     4753        JSR     WAIT_NONE       ; Wait for no keys pressed
2781 [05] 39         4754        RTS
                     4755
                     4756   TMPR_NAME:
2782 [06] 154206     4757        BCLR    DFLAGS,$06
                     4758        ; Load pointer of pick name string buffer in Reg-X
2785 [03] CE0049     4759        LDX     #TS_NAME                ; Name string pointer
2788 [04] 18CE6758   4760        LDY     #MSG116
                     4761        ; Call "Pick Name" Routine - result is new name in buffer.
278C [06] BD15B4     4762        JSR     PICK_NAME
278F [04] 8C0000     4763        CPX     #$0000
2792 [03] 2603       4764        BNE     TMPR_NM2
2794 [03] 7E26F1     4765        JMP     TMPR
                     4766   TMPR_NM2:
                     4767        ; Display "Name Chosen" Screen
2797 macro           4768        SCR     097,132,0,099
2797 [03] CE6602     4769    LDX #MSG%1
279A [06] BD12C1     4770    JSR LINE1
279D [03] CE684B     4771    LDX #MSG%2
27A0 [06] BD12C7     4772    JSR LINE2
27A3 [03] CE6015     4773    LDX #MSG%3
27A6 [06] BD12CD     4774    JSR LINE3
27A9 [03] CE662C     4775    LDX #MSG%4
27AC [06] BD12D3     4776    JSR LINE4
                     4777        ; Position Cursor for NAME
                     4778        ;  Cursor Position : (Line = 1,  column = 12)
27AF [02] 8601       4779        LDAA    #!1             ; Line 1
27B1 [02] C60C       4780        LDAB    #!12            ; Column 12
27B3 [06] BD1309     4781        JSR     DSP_CUR         ; Position Cursor
                     4782        ; Display NAME
27B6 [03] CE0049     4783        LDX     #TS_NAME
27B9 [06] BD12BD     4784        JSR     DSP_STR
                     4785   ; Select REDO, OK or RUN
27BC [06] BD1331     4786        JSR     WAIT_NONE       ; Wait for no keys pressed
                     4787   ; On REDO, jump back to start of TMPR_NAME routine
                     4788   ; On OK, go to next section (check for TMPR & EDIT, DEL or START)
                     4789   ; On RUN, cancel TMPR select & return to RUN MODE
```

```
27BF macro          4790        CHOOSE  TMPR_NAME,TMPR_CHK,TMPR_CNCL,MNU0,MNU0
                    4791  MNU0:
27BF [06] BD1366    4792   JSR GET_KEY
27C2 [02] 841F      4793   ANDA #$1F
27C4 [03] 27F9      4794   BEQ MNU0
27C6 [02] 8101      4795   CMPA #$01
27C8 [03] 2603      4796   BNE MNU1
27CA [03] 7E2782    4797   JMP %1
                    4798  MNU1:
27CD [02] 8102      4799   CMPA #$02
27CF [03] 2603      4800   BNE MNU2
27D1 [03] 7E2800    4801   JMP %2
                    4802  MNU2:
27D4 [02] 8104      4803   CMPA #$04
27D6 [03] 2603      4804   BNE MNU3
27D8 [03] 7E27EE    4805   JMP %3
                    4806  MNU3:
27DB [02] 8108      4807   CMPA #$08
27DD [03] 2603      4808   BNE MNU4
27DF [03] 7E27BF    4809   JMP %4
                    4810  MNU4:
27E2 [02] 8110      4811   CMPA #$10
27E4 [03] 2603      4812   BNE MNU5
27E6 [03] 7E27BF    4813   JMP %5
                    4814  MNU5:
27E9 [03] 20D4      4815   BRA MNU0
27EB [03] 7E26F1    4816        JMP     TMPR
                    4817
                    4818  TMPR_CNCL:
27EE [06] 154206    4819        BCLR    DFLAGS,$06
27F1 [04] B67C00    4820        LDAA    V_INC1          ; set to Scale #1 (Default)
27F4 [03] 9746      4821        STAA    V_SCL           ; Store new scale value
27F6 [06] 154201    4822        BCLR    DFLAGS,$01      ; Clear fractional vernier display flag
27F9 [06] BD1331    4823        JSR     WAIT_NONE       ; Wait for no keys pressed
27FC [05] 39        4824        RTS
                    4825
                    4826  TMPR_RUN:
27FD [03] 7E2776    4827        JMP     TMPR_STRT
                    4828
                    4829  TMPR_CHK:
2800 [06] 144204    4830        BSET    DFLAGS,$04
2803 [06] 154202    4831        BCLR    DFLAGS,$02
2806 [06] 144320    4832        BSET    SFLAGS,$20      ; Set to look in ROM
                    4833  ; Look for TMPR in TMPR_DIR
2809 [04] 18CE0049  4834        LDY     #TS_NAME
280D [06] BD323E    4835        JSR     FIND_TS
2810 [04] 8C0000    4836        CPX     #$0000
2813 [03] 2610      4837        BNE     TMPR_CHK2
                    4838  ; If no TMPR exists for name, then create blank TMPR & jump to edit
2815 [06] BD2288    4839        JSR     NEW_TMPR
2818 [04] 8C0000    4840        CPX     #$0000
281B [03] 2705      4841        BEQ     TMPR_CHK1
281D [04] DF51      4842        STX     PTR1
281F [03] 7E2ACF    4843        JMP     TMPR_EDIT
                    4844  TMPR_CHK1:
2822 [03] 7E26F1    4845        JMP     TMPR
                    4846  TMPR_CHK2:
2825 [06] 12428054  4847        BRSET   DFLAGS,$80,TMPR_CHK3    ; File is in ROM.  Go to ROM
menu.
                    4848  ; If TMPR exists, then EDIT, DEL, RUN or NO CHNG
                    4849        ; Display "Already Exists" Screen
2829 macro          4850        SCR     133,101,102,103
2829 [03] CE6860    4851   LDX #MSG%1
282C [06] BD12C1    4852   JSR LINE1
282F [03] CE6656    4853   LDX #MSG%2
2832 [06] BD12C7    4854   JSR LINE2
2835 [03] CE666B    4855   LDX #MSG%3
2838 [06] BD12CD    4856   JSR LINE3
```

```
283B [03] CE6680    4857   LDX #MSG%4
283E [06] BD12D3    4858   JSR LINE4
                    4859       ;  Cursor Position : (Line = 0,  column = 10)
2841 [02] 8600      4860       LDAA    #!0              ; Line 0
2843 [02] C60A      4861       LDAB    #!10             ; Column 10
2845 [06] BD1309    4862       JSR     DSP_CUR          ; Position Cursor
                    4863       ; Display NAME
2848 [03] CE0049    4864       LDX     #TS_NAME
284B [06] BD12BD    4865       JSR     DSP_STR
284E [06] BD1331    4866       JSR     WAIT_NONE        ; Wait for no keys pressed
2851 macro          4867       CHOOSE  TMPR_EDIT,TMPR_DEL2,TMPR_CNCL,TMPR,MNU0
                    4868  MNU0:
2851 [06] BD1366    4869   JSR GET_KEY
2854 [02] 841F      4870   ANDA #$1F
2856 [03] 27F9      4871   BEQ MNU0
2858 [02] 8101      4872   CMPA #$01
285A [03] 2603      4873   BNE MNU1
285C [03] 7E2ACF    4874   JMP %1
                    4875  MNU1:
285F [02] 8102      4876   CMPA #$02
2861 [03] 2603      4877   BNE MNU2
2863 [03] 7E2AC5    4878   JMP %2
                    4879  MNU2:
2866 [02] 8104      4880   CMPA #$04
2868 [03] 2603      4881   BNE MNU3
286A [03] 7E27EE    4882   JMP %3
                    4883  MNU3:
286D [02] 8108      4884   CMPA #$08
286F [03] 2603      4885   BNE MNU4
2871 [03] 7E26F1    4886   JMP %4
                    4887  MNU4:
2874 [02] 8110      4888   CMPA #$10
2876 [03] 2603      4889   BNE MNU5
2878 [03] 7E2851    4890   JMP %5
                    4891  MNU5:
287B [03] 20D4      4892   BRA MNU0
                    4893
                    4894  TMPR_CHK3:
                    4895       ; Display "Factory Default" Screen
287D macro          4896       SCR     133,147,148,149
287D [03] CE6860    4897   LDX #MSG%1
2880 [06] BD12C1    4898   JSR LINE1
2883 [03] CE6986    4899   LDX #MSG%2
2886 [06] BD12C7    4900   JSR LINE2
2889 [03] CE699B    4901   LDX #MSG%3
288C [06] BD12CD    4902   JSR LINE3
288F [03] CE69B0    4903   LDX #MSG%4
2892 [06] BD12D3    4904   JSR LINE4
                    4905       ;  Cursor Position : (Line = 0,  column = 10)
2895 [02] 8600      4906       LDAA    #!0              ; Line 0
2897 [02] C60A      4907       LDAB    #!10             ; Column 10
2899 [06] BD1309    4908       JSR     DSP_CUR          ; Position Cursor
                    4909       ; Display NAME
289C [03] CE0049    4910       LDX     #TS_NAME
289F [06] BD12BD    4911       JSR     DSP_STR
28A2 [06] BD1331    4912       JSR     WAIT_NONE        ; Wait for no keys pressed
28A5 macro          4913       CHOOSE  MNU0,MNU0,TMPR_CNCL,TMPR,MNU0
                    4914  MNU0:
28A5 [06] BD1366    4915   JSR GET_KEY
28A8 [02] 841F      4916   ANDA #$1F
28AA [03] 27F9      4917   BEQ MNU0
28AC [02] 8101      4918   CMPA #$01
28AE [03] 2603      4919   BNE MNU1
28B0 [03] 7E28A5    4920   JMP %1
                    4921  MNU1:
28B3 [02] 8102      4922   CMPA #$02
28B5 [03] 2603      4923   BNE MNU2
28B7 [03] 7E28A5    4924   JMP %2
```

```
                    4925  MNU2:
28BA [02] 8104      4926   CMPA #$04
28BC [03] 2603      4927   BNE MNU3
28BE [03] 7E27EE    4928   JMP %3
                    4929  MNU3:
28C1 [02] 8108      4930   CMPA #$08
28C3 [03] 2603      4931   BNE MNU4
28C5 [03] 7E26F1    4932   JMP %4
                    4933  MNU4:
28C8 [02] 8110      4934   CMPA #$10
28CA [03] 2603      4935   BNE MNU5
28CC [03] 7E28A5    4936   JMP %5
                    4937  MNU5:
28CF [03] 20D4      4938   BRA MNU0
                    4939
                    4940  TMPR_DEL:
                    4941       ; Display COPY/DEL screen
28D1 macro          4942       SCR     161,0,0,162
28D1 [03] CE6AAC    4943   LDX #MSG%1
28D4 [06] BD12C1    4944   JSR LINE1
28D7 [03] CE6015    4945   LDX #MSG%2
28DA [06] BD12C7    4946   JSR LINE2
28DD [03] CE6015    4947   LDX #MSG%3
28E0 [06] BD12CD    4948   JSR LINE3
28E3 [03] CE6AC1    4949   LDX #MSG%4
28E6 [06] BD12D3    4950   JSR LINE4
28E9 [06] BD1331    4951       JSR     WAIT_NONE       ; Wait for no keys pressed
                    4952       ; Select COPY or DEL
28EC macro          4953       CHOOSE  TMPR_COPY,TMPR_DEL1,TMPR_CNCL,TMPR,MNU0
                    4954  MNU0:
28EC [06] BD1366    4955   JSR GET_KEY
28EF [02] 841F      4956   ANDA #$1F
28F1 [03] 27F9      4957   BEQ MNU0
28F3 [02] 8101      4958   CMPA #$01
28F5 [03] 2603      4959   BNE MNU1
28F7 [03] 7E2918    4960   JMP %1
                    4961  MNU1:
28FA [02] 8102      4962   CMPA #$02
28FC [03] 2603      4963   BNE MNU2
28FE [03] 7E2AA2    4964   JMP %2
                    4965  MNU2:
2901 [02] 8104      4966   CMPA #$04
2903 [03] 2603      4967   BNE MNU3
2905 [03] 7E27EE    4968   JMP %3
                    4969  MNU3:
2908 [02] 8108      4970   CMPA #$08
290A [03] 2603      4971   BNE MNU4
290C [03] 7E26F1    4972   JMP %4
                    4973  MNU4:
290F [02] 8110      4974   CMPA #$10
2911 [03] 2603      4975   BNE MNU5
2913 [03] 7E28EC    4976   JMP %5
                    4977  MNU5:
2916 [03] 20D4      4978   BRA MNU0
                    4979  TMPR_COPY:
                    4980       ; If COPY is selected --
                    4981       ; Get new file name
2918 [03] CE0082    4982       LDX     #D_STR
291B [04] 18CE6758  4983       LDY     #MSG116
291F [06] BD15B4    4984       JSR     PICK_NAME
2922 [04] 8C0000    4985       CPX     #$0000
2925 [03] 2603      4986       BNE     TMPR_CPY10
2927 [03] 7E28D1    4987       JMP     TMPR_DEL
                    4988  TMPR_CPY10:

                    4989       ; Check for file exists.  If so, ask for DEL or RENAME.
292A [04] 18CE0082  4990       LDY     #D_STR
292E [06] 144204    4991       BSET    DFLAGS,$04      ; Set to look for TMPR
```

```
2931 [06] 154202     4992        BCLR    DFLAGS,$02       ; (and not STRCH)
2934 [06] 144320     4993        BSET    SFLAGS,$20       ; Set to look in ROM
2937 [06] BD323E     4994        JSR     FIND_TS
293A [04] 8C0000     4995        CPX     #$0000
293D [03] 2766       4996        BEQ     TMPR_CPY20       ; No such file, so name is O.K.
293F [04] DF51       4997        STX     PTR1
                     4998        ; If TMPR already exists for name, then ask for RENAME or DEL
                     4999        ; ** If RENAME then jump to TMPR_COPY label
                     5000        ; Display "Already Exists" Screen
2941 macro           5001        SCR     133,101,168,169
2941 [03] CE6860     5002    LDX #MSG%1
2944 [06] BD12C1     5003    JSR LINE1
2947 [03] CE6656     5004    LDX #MSG%2
294A [06] BD12C7     5005    JSR LINE2
294D [03] CE6B2A     5006    LDX #MSG%3
2950 [06] BD12CD     5007    JSR LINE3
2953 [03] CE6B3F     5008    LDX #MSG%4
2956 [06] BD12D3     5009    JSR LINE4
                     5010        ;  Cursor Position : (Line = 0,  column = 10)
2959 [02] 8600       5011        LDAA    #!0              ; Line 0
295B [02] C60A       5012        LDAB    #!10             ; Column 10
295D [06] BD1309     5013        JSR     DSP_CUR          ; Position Cursor
                     5014        ; Display NAME
2960 [03] CE0082     5015        LDX     #D_STR
2963 [06] BD12BD     5016        JSR     DSP_STR
2966 [06] BD1331     5017        JSR     WAIT_NONE        ; Wait for no keys pressed
                     5018        ; Select RENAME or DEL
2969 macro           5019        CHOOSE  TMPR_COPY,TMPR_DC10,TMPR_CNCL,MNU0,MNU0
                     5020    MNU0:
2969 [06] BD1366     5021     JSR GET_KEY
296C [02] 841F       5022     ANDA #$1F
296E [03] 27F9       5023     BEQ MNU0
2970 [02] 8101       5024     CMPA #$01
2972 [03] 2603       5025     BNE MNU1
2974 [03] 7E2918     5026     JMP %1
                     5027    MNU1:
2977 [02] 8102       5028     CMPA #$02
2979 [03] 2603       5029     BNE MNU2
297B [03] 7E2995     5030     JMP %2
                     5031    MNU2:
297E [02] 8104       5032     CMPA #$04
2980 [03] 2603       5033     BNE MNU3
2982 [03] 7E27EE     5034     JMP %3
                     5035    MNU3:
2985 [02] 8108       5036     CMPA #$08
2987 [03] 2603       5037     BNE MNU4
2989 [03] 7E2969     5038     JMP %4
                     5039    MNU4:
298C [02] 8110       5040     CMPA #$10
298E [03] 2603       5041     BNE MNU5
2990 [03] 7E2969     5042     JMP %5
                     5043    MNU5:
2993 [03] 20D4       5044     BRA MNU0
                     5045    TMPR_DC10:
                     5046        ; ** If DEL then Delete file
2995 [04] DE51       5047        LDX     PTR1
2997 [04] 18CE0082   5048        LDY     #D_STR
299B [06] BD235D     5049        JSR     DEL_TS
299E [02] 8101       5050        CMPA    #$01
29A0 [03] 2703       5051        BEQ     TMPR_CPY20
29A2 [03] 7E2765     5052        JMP     TMPR_NO1
                     5053    TMPR_CPY20:
                     5054        ; Select source file to be copied
29A5 [06] 144204     5055        BSET    DFLAGS,$04
29A8 [06] 154202     5056        BCLR    DFLAGS,$02
29AB [06] 144320     5057        BSET    SFLAGS,$20
29AE [03] CE6B7E     5058        LDX     #MSG172
29B1 [02] 8601       5059        LDAA    #$1
```

```
29B3 [06] BD242D    5060        JSR     SEL_TS
29B6 [02] 8108      5061        CMPA    #$08            ; Was SLCT (F4) key hit?
29B8 [03] 2704      5062        BEQ     TMPR_CPY21      ; If so, skip to file pointer check
29BA [02] 8110      5063        CMPA    #$10            ; Was ENTER key hit?
29BC [03] 2607      5064        BNE     TMPR_CPY25      ; If not, skip next check & cancel
operation.
                    5065  TMPR_CPY21:
29BE [04] 8C0000    5066        CPX     #$0000
29C1 [03] 2702      5067        BEQ     TMPR_CPY25      ; Bad pointer, cancel operation.
29C3 [03] 2003      5068        BRA     TMPR_CPY26
                    5069  TMPR_CPY25:
29C5 [03] 7E2765    5070        JMP     TMPR_NO1
                    5071  TMPR_CPY26:
29C8 [04] DF51      5072        STX     PTR1
                    5073        ; Display "COPY xxxx to xxxx" screen
29CA macro          5074        SCR     171,105,0,106
29CA [03] CE6B69    5075   LDX #MSG%1
29CD [06] BD12C1    5076   JSR LINE1
29D0 [03] CE66AA    5077   LDX #MSG%2
29D3 [06] BD12C7    5078   JSR LINE2
29D6 [03] CE6015    5079   LDX #MSG%3
29D9 [06] BD12CD    5080   JSR LINE3
29DC [03] CE66BF    5081   LDX #MSG%4
29DF [06] BD12D3    5082   JSR LINE4
                    5083        ;  Cursor Position : (Line = 0,  column = 6)
29E2 [02] 8600      5084        LDAA    #!0             ; Line 0
29E4 [02] C606      5085        LDAB    #!6             ; Column 6
29E6 [06] BD1309    5086        JSR     DSP_CUR         ; Position Cursor
                    5087        ; Display NAME
29E9 [03] CE0049    5088        LDX     #TS_NAME
29EC [06] BD12BD    5089        JSR     DSP_STR
                    5090        ;  Cursor Position : (Line = 0,  column = 14)
29EF [02] 8600      5091        LDAA    #!0             ; Line 0
29F1 [02] C60E      5092        LDAB    #!14            ; Column 14
29F3 [06] BD1309    5093        JSR     DSP_CUR         ; Position Cursor
                    5094        ; Display NAME
29F6 [03] CE0082    5095        LDX     #D_STR
29F9 [06] BD12BD    5096        JSR     DSP_STR
29FC [06] BD1331    5097        JSR     WAIT_NONE       ; Wait for no keys pressed
                    5098        ; Get user response & abort or continue
29FF macro          5099        CHOOSE  TMPR_CPY30,TMPR_NO1,MNU0,MNU0,MNU0
                    5100  MNU0:
29FF [06] BD1366    5101   JSR GET_KEY
2A02 [02] 841F      5102   ANDA #$1F
2A04 [03] 27F9      5103   BEQ MNU0
2A06 [02] 8101      5104   CMPA #$01
2A08 [03] 2603      5105   BNE MNU1
2A0A [03] 7E2A2E    5106   JMP %1
                    5107  MNU1:
2A0D [02] 8102      5108   CMPA #$02
2A0F [03] 2603      5109   BNE MNU2
2A11 [03] 7E2765    5110   JMP %2
                    5111  MNU2:
2A14 [02] 8104      5112   CMPA #$04
2A16 [03] 2603      5113   BNE MNU3
2A18 [03] 7E29FF    5114   JMP %3
                    5115  MNU3:
2A1B [02] 8108      5116   CMPA #$08
2A1D [03] 2603      5117   BNE MNU4
2A1F [03] 7E29FF    5118   JMP %4
                    5119  MNU4:
2A22 [02] 8110      5120   CMPA #$10
2A24 [03] 2603      5121   BNE MNU5
2A26 [03] 7E29FF    5122   JMP %5
                    5123  MNU5:
2A29 [03] 20D4      5124   BRA MNU0
                    5125  TMPR_NO3:
                    5126  ;     BCLR    DFLAGS,$06
```

```
2A2B [03] 7E2A2B     5127        JMP      TMPR_NO3
                     5128  TMPR_CPY30:
2A2E [03] CE6860     5129        LDX      #MSG133
2A31 [06] BD12C7     5130        JSR      LINE2
2A34 [03] CE6015     5131        LDX      #MSG0
2A37 [06] BD12CD     5132        JSR      LINE3
2A3A [06] BD12D3     5133        JSR      LINE4
2A3D [06] BD1331     5134        JSR      WAIT_NONE        ; Wait for no keys pressed
                     5135        ; Move name from D_STR to TS_NAME
2A40 [03] CE0082     5136        LDX      #D_STR
2A43 [04] 18CE0049   5137        LDY      #TS_NAME
2A47 [04] A600       5138        LDAA     0,X
2A49 [05] 18A700     5139        STAA     0,Y
2A4C [04] A601       5140        LDAA     1,X
2A4E [05] 18A701     5141        STAA     1,Y
2A51 [04] A602       5142        LDAA     2,X
2A53 [05] 18A702     5143        STAA     2,Y
2A56 [04] A603       5144        LDAA     3,X
2A58 [05] 18A703     5145        STAA     3,Y
2A5B [07] 186F04     5146        CLR      4,Y
                     5147        ;  Cursor Position : (Line = 1,  column = 10)
2A5E [02] 8601       5148        LDAA     #!1              ; Line 1
2A60 [02] C60A       5149        LDAB     #!10             ; Column 10
2A62 [06] BD1309     5150        JSR      DSP_CUR          ; Position Cursor
2A65 [03] CE0049     5151        LDX      #TS_NAME
2A68 [06] BD12BD     5152        JSR      DSP_STR
2A6B [03] CE67CD     5153        LDX      #MSG126          ; Display "WORKING"
2A6E [06] BD12CD     5154        JSR      LINE3
2A71 [03] CE0049     5155        LDX      #TS_NAME
                     5156        ; Create new destination file
2A74 [06] 154320     5157        BCLR     SFLAGS,$20       ; Do not look in ROM
2A77 [06] 154280     5158        BCLR     DFLAGS,$80       ; New file is NOT in ROM
2A7A [06] BD2288     5159        JSR      NEW_TMPR
2A7D [04] 8C0000     5160        CPX      #$0000
2A80 [03] 27A9       5161        BEQ      TMPR_NO3
2A82 [04] DF55       5162        STX      PTR3
2A84 [03] CE67F7     5163        LDX      #MSG128          ; Display "DONE"
2A87 [06] BD12CD     5164        JSR      LINE3
2A8A [03] CE6BBD     5165        LDX      #MSG175          ; Display "COPYING"
2A8D [06] BD12C7     5166        JSR      LINE2
2A90 [03] CE67CD     5167        LDX      #MSG126          ; Display "WORKING"
2A93 [06] BD12CD     5168        JSR      LINE3
2A96 [04] DE55       5169        LDX      PTR3
                     5170        ; Perform copy
2A98 [06] BD22DC     5171        JSR      COPY_TS
                     5172        ; Fix pointers for new file
2A9B [04] DE55       5173        LDX      PTR3
2A9D [04] DF51       5174        STX      PTR1
                     5175        ; And jump to edit new file
2A9F [03] 7E2ACF     5176        JMP      TMPR_EDIT
                     5177  TMPR_DEL1:
                     5178  ; If DEL is selected --
                     5179  ; Display TMPR directory entries & allow select
2AA2 [06] 144204     5180        BSET     DFLAGS,$04
2AA5 [06] 154202     5181        BCLR     DFLAGS,$02
2AA8 [06] 154320     5182        BCLR     SFLAGS,$20
2AAB [03] CE68C9     5183        LDX      #MSG138
2AAE [02] 8601       5184        LDAA     #$1
2AB0 [06] BD242D     5185        JSR      SEL_TS
2AB3 [02] 8108       5186        CMPA     #$08             ; Was SLCT (F4) key hit?
2AB5 [03] 2704       5187        BEQ      TMPR_DEL21       ; If so, skip to pointer check
2AB7 [02] 8110       5188        CMPA     #$10             ; Was ENTER key hit?
2AB9 [03] 2607       5189        BNE      TMPR_DEL25       ; If not, skip next check & cancel
operation.
                     5190  TMPR_DEL21:
2ABB [04] 8C0000     5191        CPX      #$0000
2ABE [03] 2702       5192        BEQ      TMPR_DEL25
2AC0 [03] 2003       5193        BRA      TMPR_DEL2
```

```
                    5194  TMPR_DEL25:
2AC2 [03] 7E2765    5195       JMP      TMPR_NO1
                    5196  TMPR_DEL2:
2AC5 [04] 18CE0049  5197       LDY      #TS_NAME
2AC9 [06] BD235D    5198       JSR      DEL_TS
                    5199  ;    BCLR     DFLAGS,$06
2ACC [03] 7E2765    5200       JMP      TMPR_NO1
                    5201
                    5202  TMPR_EDIT:
2ACF [04] DE51      5203       LDX      PTR1
2AD1 [06] BD1FC3    5204       JSR      EDIT_TS
2AD4 macro          5205       SCR      133,144,145,146
2AD4 [03] CE6860    5206   LDX #MSG%1
2AD7 [06] BD12C1    5207   JSR LINE1
2ADA [03] CE6947    5208   LDX #MSG%2
2ADD [06] BD12C7    5209   JSR LINE2
2AE0 [03] CE695C    5210   LDX #MSG%3
2AE3 [06] BD12CD    5211   JSR LINE3
2AE6 [03] CE6971    5212   LDX #MSG%4
2AE9 [06] BD12D3    5213   JSR LINE4
                    5214       ; Display selected TMPR name here
                    5215       ;  Cursor Position : (Line = 0,  column = 10)
2AEC [02] 8600      5216       LDAA     #!0              ; Line 0
2AEE [02] C60A      5217       LDAB     #!10             ; Column 10
2AF0 [06] BD1309    5218       JSR      DSP_CUR          ; Position Cursor
                    5219       ; Display NAME
2AF3 [03] CE0049    5220       LDX      #TS_NAME
2AF6 [06] BD12BD    5221       JSR      DSP_STR
2AF9 [06] BD1331    5222       JSR      WAIT_NONE        ; Wait for no keys pressed
2AFC macro          5223       CHOOSE   MNU0,MNU0,MNU0,MNU0,TMPR_STRT
                    5224  MNU0:
2AFC [06] BD1366    5225   JSR GET_KEY
2AFF [02] 841F      5226   ANDA #$1F
2B01 [03] 27F9      5227   BEQ MNU0
2B03 [02] 8101      5228   CMPA #$01
2B05 [03] 2603      5229   BNE MNU1
2B07 [03] 7E2AFC    5230   JMP %1
                    5231  MNU1:
2B0A [02] 8102      5232   CMPA #$02
2B0C [03] 2603      5233   BNE MNU2
2B0E [03] 7E2AFC    5234   JMP %2
                    5235  MNU2:
2B11 [02] 8104      5236   CMPA #$04
2B13 [03] 2603      5237   BNE MNU3
2B15 [03] 7E2AFC    5238   JMP %3
                    5239  MNU3:
2B18 [02] 8108      5240   CMPA #$08
2B1A [03] 2603      5241   BNE MNU4
2B1C [03] 7E2AFC    5242   JMP %4
                    5243  MNU4:
2B1F [02] 8110      5244   CMPA #$10
2B21 [03] 2603      5245   BNE MNU5
2B23 [03] 7E2776    5246   JMP %5
                    5247  MNU5:
2B26 [03] 20D4      5248   BRA MNU0
                    5249
                    5250  TMPR_STOP:
                    5251  ; Check if TMPR is already ON.  If so, then stop TMPR.
2B28 [06] 13420651  5252       BRCLR    DFLAGS,$06,TMPR_ST20
2B2C [06] 1342021A  5253       BRCLR    DFLAGS,$02,TMPR_ST10
                    5254  ;##### Display 'STRCH STOPPED' and 'HIT ANY KEY' screen here.
2B30 macro          5255       SCR      155,139,125,126
2B30 [03] CE6A2E    5256   LDX #MSG%1
2B33 [06] BD12C1    5257   JSR LINE1
2B36 [03] CE68DE    5258   LDX #MSG%2
2B39 [06] BD12C7    5259   JSR LINE2
2B3C [03] CE67B8    5260   LDX #MSG%3
2B3F [06] BD12CD    5261   JSR LINE3
```

```
2B42 [03] CE67CD    5262   LDX #MSG%4
2B45 [06] BD12D3    5263   JSR LINE4
2B48 [03] 2018      5264       BRA     TMPR_ST11
                    5265  TMPR_ST10:
                    5266  ;##### Display 'TMPR STOPPED' and 'HIT ANY KEY' screen here.
2B4A macro          5267       SCR     133,139,125,126
2B4A [03] CE6860    5268   LDX #MSG%1
2B4D [06] BD12C1    5269   JSR LINE1
2B50 [03] CE68DE    5270   LDX #MSG%2
2B53 [06] BD12C7    5271   JSR LINE2
2B56 [03] CE67B8    5272   LDX #MSG%3
2B59 [06] BD12CD    5273   JSR LINE3
2B5C [03] CE67CD    5274   LDX #MSG%4
2B5F [06] BD12D3    5275   JSR LINE4
                    5276  TMPR_ST11:
2B62 [06] 154206    5277       BCLR    DFLAGS,$06
                    5278       ;  Cursor Position : (Line = 0,  column = 10)
2B65 [02] 8600      5279       LDAA    #!0             ; Line 0
2B67 [02] C60A      5280       LDAB    #!10            ; Column 10
2B69 [06] BD1309    5281       JSR     DSP_CUR         ; Position Cursor
                    5282       ; Display NAME
2B6C [03] CE0049    5283       LDX     #TS_NAME
2B6F [06] BD12BD    5284       JSR     DSP_STR
2B72 [06] BD1331    5285       JSR     WAIT_NONE       ; Wait for no keys pressed
                    5286  TMPR_ST19:
2B75 [06] BD1366    5287       JSR     GET_KEY
2B78 [03] 27FB      5288       BEQ     TMPR_ST19       ; Wait for any key
2B7A [03] 7E26F1    5289       JMP     TMPR
                    5290  TMPR_ST20:
                    5291  ; Else, Display "NO TMPR OR STRCH" screen.
2B7D macro          5292       SCR     173,174,125,126
2B7D [03] CE6B93    5293   LDX #MSG%1
2B80 [06] BD12C1    5294   JSR LINE1
2B83 [03] CE6BA8    5295   LDX #MSG%2
2B86 [06] BD12C7    5296   JSR LINE2
2B89 [03] CE67B8    5297   LDX #MSG%3
2B8C [06] BD12CD    5298   JSR LINE3
2B8F [03] CE67CD    5299   LDX #MSG%4
2B92 [06] BD12D3    5300   JSR LINE4
2B95 [06] BD1331    5301       JSR     WAIT_NONE
2B98 [03] 7E2B75    5302       JMP     TMPR_ST19
                    5303  ;** ; Else, select TMPR to start.
                    5304  ;** ; Display TMPR directory entries & allow select
                    5305  ;**  BSET    DFLAGS,$04
                    5306  ;**  BCLR    DFLAGS,$02
                    5307  ;**  BSET    SFLAGS,$20
                    5308  ;**  LDX     #MSG138
                    5309  ;**  JSR     SEL_TS
                    5310  ;** ; Load KEY data from TMPR/STRCH into SFLAGS var
                    5311  ;**  JMP     TMPR
                    5312
                    5313  * - - - - - - - - - - - - - - - - - - - - - - - - - - - - - -
                    5314  * End of TMPR Subroutines
                    5315  *=========================================================
                    5316
2B9B                5317  $INCLUDE 'STRCH.ASM'            ;Include STRETCH Subroutines
                    5318  *=========================================================*
                    5319  *   Peterson Tuner Stretch Subroutines                    *
                    5320  *   Written by: Robert S. Dobrose                         *
                    5321  *   Saracon, Inc.                                         *
                    5322  *     1135 Garfield Ave.                                  *
                    5323  *     Libertyville, IL  60048                             *
                    5324  *=========================================================*
                    5325  *   Release History                                       *
                    5326  *   06/12/95  1.0  - Initial Code                         *
                    5327  *=========================================================*
                    5328
                    5329
```

```
                        5330  *=====================================================
                        5331  * Name:  STRCH
                        5332  * Subroutine: Stretch Menu Routine
                        5333  * Written by: Robert S. Dobrose
                        5334  * Purpose: Displays the "Stretch Menu" screen and waits for
                        5335  *            Function key input.  Then jumps to the
                        5336  *            selected sub-menu routine.
                        5337  *   Input: none
                        5338  *  Output: none
                        5339  *   Notes:  This routine is called as a subroutine
                        5340  *             but jumps to other routines.  The other
                        5341  *             menu routines should jump to the start
                        5342  *             of this routine on a "Return To STRCH"
                        5343  *             function and should perform an RTS on a
                        5344  *             "RUN" function to return to the main
                        5345  *             operational loop.
                        5346  *        ** Register X and Accum-A are modified
                        5347  * - - - - - - - - - - - - - - - - - - - - - - - - - - -
                        5348
                        5349  STRCH:
 2B9B                   5350       EQU     *
                        5351
 2B9B macro             5352       MNU
150,021,151,152,STRCH_NEW,STRCH_DEL,STRCH_RUN,STRCH_STOP,MNU0
 2B9B [03] CE69C5       5353   LDX #MSG%1
 2B9E [06] BD12C1       5354   JSR LINE1
 2BA1 [03] CE6145       5355   LDX #MSG%2
 2BA4 [06] BD12C7       5356   JSR LINE2
 2BA7 [03] CE69DA       5357   LDX #MSG%3
 2BAA [06] BD12CD       5358   JSR LINE3
 2BAD [03] CE69EF       5359   LDX #MSG%4
 2BB0 [06] BD12D3       5360   JSR LINE4
 2BB3 [06] BD1331       5361   JSR WAIT_NONE
                        5362  MNU0:
 2BB6 [02] 861F         5363   LDAA #$1F
 2BB8 [04] 18CE2EE0     5364   LDY #!12000
 2BBC [06] BD1388       5365   JSR WAIT_KEY
 2BBF [02] 4D           5366   TSTA
 2BC0 [03] 2601         5367   BNE MNU0A
 2BC2 [05] 39           5368   RTS
                        5369  MNU0A:
 2BC3 [02] 8101         5370   CMPA #$01
 2BC5 [03] 2603         5371   BNE MNU1
 2BC7 [03] 7E2BE8       5372   JMP %5
                        5373  MNU1:
 2BCA [02] 8102         5374   CMPA #$02
 2BCC [03] 2603         5375   BNE MNU2
 2BCE [03] 7E2D78       5376   JMP %6
                        5377  MNU2:
 2BD1 [02] 8104         5378   CMPA #$04
 2BD3 [03] 2603         5379   BNE MNU3
 2BD5 [03] 7E2CA4       5380   JMP %7
                        5381  MNU3:
 2BD8 [02] 8108         5382   CMPA #$08
 2BDA [03] 2603         5383   BNE MNU4
 2BDC [03] 7E2FCC       5384   JMP %8
                        5385  MNU4:
 2BDF [02] 8110         5386   CMPA #$10
 2BE1 [03] 2603         5387   BNE MNU5
 2BE3 [03] 7E2BB6       5388   JMP %9
                        5389  MNU5:
 2BE6 [03] 20CE         5390   BRA MNU0
                        5391
                        5392  STRCH_NEW:
                        5393       ; Select source file
 2BE8 [06] 144202       5394       BSET    DFLAGS,$02
 2BEB [06] 154204       5395       BCLR    DFLAGS,$04
 2BEE [06] 144320       5396       BSET    SFLAGS,$20
```

```
2BF1 [03] CE6AEB    5397        LDX     #MSG165
2BF4 [02] 8600      5398        LDAA    #$0
2BF6 [06] BD242D    5399        JSR     SEL_TS
2BF9 [04] DF51      5400        STX     PTR1
                    5401        ; Check key response
2BFB [02] 8101      5402        CMPA    #$01            ; Is it NEW?
2BFD [03] 272D      5403        BEQ     STRCH_NAME      ; If so, go pick a new name.
2BFF [02] 8102      5404        CMPA    #$02            ; Is it EDIT?
2C01 [03] 2603      5405        BNE     STRCH_NW10      ; No.  Continue
2C03 [03] 7E2F73    5406        JMP     STRCH_EDIT      ; Yes!  Go edit file.
                    5407  STRCH_NW10:
2C06 [02] 8104      5408        CMPA    #$04            ; Is it CNCL?
2C08 [03] 2705      5409        BEQ     STRCH_NO1       ; If so, clear flags & return
                    5410        ; At this point, key hit was STRT, SLCT or ENTER
2C0A [04] 8C0000    5411        CPX     #$0000          ; Check pointer
2C0D [03] 2611      5412        BNE     STRCH_STRT      ; Non-zero pointer so file is O.K.(??)
                    5413        ; Else drop through to cancel
                    5414  STRCH_NO1:
2C0F [06] 154206    5415        BCLR    DFLAGS,$06
2C12 [04] B67C00    5416        LDAA    V_INC1          ; set to Scale #1 (Default)
2C15 [03] 9746      5417        STAA    V_SCL           ; Store new scale value
2C17 [06] 154201    5418        BCLR    DFLAGS,$01      ; Clear fractional vernier display flag
2C1A [06] BD1331    5419        JSR     WAIT_NONE       ; Wait for no keys pressed
2C1D [03] 7E2B9B    5420        JMP     STRCH
                    5421
                    5422  STRCH_STRT:
2C20 [04] B67C02    5423        LDAA    V_INC3          ; set to Scale #3 (0.1 Cent increments)
2C23 [03] 9746      5424        STAA    V_SCL           ; Store new scale value
2C25 [06] 144201    5425        BSET    DFLAGS,$01      ; Set fractional vernier display flag
2C28 [06] BD1331    5426        JSR     WAIT_NONE       ; Wait for no keys pressed
2C2B [05] 39        5427        RTS
                    5428
                    5429  STRCH_NAME:
2C2C [06] 154206    5430        BCLR    DFLAGS,$06
                    5431        ; Load pointer of pick name string buffer in Reg-X
2C2F [03] CE0049    5432        LDX     #TS_NAME                ; Name string pointer
2C32 [04] 18CE675E  5433        LDY     #MSG117
                    5434        ; Call "Pick Name" Routine - result is new name in buffer.
2C36 [06] BD15B4    5435        JSR     PICK_NAME
2C39 [04] 8C0000    5436        CPX     #$0000
2C3C [03] 2603      5437        BNE     STRCH_NM2
2C3E [03] 7E2B9B    5438        JMP     STRCH
                    5439  STRCH_NM2:
                    5440        ; Display "Name Chosen" Screen
2C41 macro          5441        SCR     097,154,0,099
2C41 [03] CE6602    5442   LDX #MSG%1
2C44 [06] BD12C1    5443   JSR LINE1
2C47 [03] CE6A19    5444   LDX #MSG%2
2C4A [06] BD12C7    5445   JSR LINE2
2C4D [03] CE6015    5446   LDX #MSG%3
2C50 [06] BD12CD    5447   JSR LINE3
2C53 [03] CE662C    5448   LDX #MSG%4
2C56 [06] BD12D3    5449   JSR LINE4
                    5450        ; Position Cursor for NAME
                    5451        ;  Cursor Position : (Line = 1,  column = 12)
2C59 [02] 8601      5452        LDAA    #!1             ; Line 1
2C5B [02] C60C      5453        LDAB    #!12            ; Column 12
2C5D [06] BD1309    5454        JSR     DSP_CUR         ; Position Cursor
                    5455        ; Display NAME
2C60 [03] CE0049    5456        LDX     #TS_NAME
2C63 [06] BD12BD    5457        JSR     DSP_STR
                    5458  ; Select REDO, OK or RUN
2C66 [06] BD1331    5459        JSR     WAIT_NONE       ; Wait for no keys pressed
                    5460  ; On REDO, jump back to start of STRCH_NAME routine
                    5461  ; On OK, go to next section (check for STRCH & EDIT, DEL or START)
                    5462  ; On RUN, cancel STRCH select & return to RUN MODE
2C69 macro          5463        CHOOSE  STRCH_NAME,STRCH_CHK,STRCH_CNCL,MNU0,MNU0
                    5464  MNU0:
```

```
2C69 [06] BD1366      5465   JSR GET_KEY
2C6C [02] 841F        5466   ANDA #$1F
2C6E [03] 27F9        5467   BEQ MNU0
2C70 [02] 8101        5468   CMPA #$01
2C72 [03] 2603        5469   BNE MNU1
2C74 [03] 7E2C2C      5470   JMP %1
                      5471  MNU1:
2C77 [02] 8102        5472   CMPA #$02
2C79 [03] 2603        5473   BNE MNU2
2C7B [03] 7E2CA7      5474   JMP %2
                      5475  MNU2:
2C7E [02] 8104        5476   CMPA #$04
2C80 [03] 2603        5477   BNE MNU3
2C82 [03] 7E2C95      5478   JMP %3
                      5479  MNU3:
2C85 [02] 8108        5480   CMPA #$08
2C87 [03] 2603        5481   BNE MNU4
2C89 [03] 7E2C69      5482   JMP %4
                      5483  MNU4:
2C8C [02] 8110        5484   CMPA #$10
2C8E [03] 2603        5485   BNE MNU5
2C90 [03] 7E2C69      5486   JMP %5
                      5487  MNU5:
2C93 [03] 20D4        5488   BRA MNU0
                      5489
                      5490  STRCH_CNCL:
2C95 [06] 154206      5491       BCLR    DFLAGS,$06
2C98 [04] B67C00      5492       LDAA    V_INC1          ; set to Scale #1 (Default)
2C9B [03] 9746        5493       STAA    V_SCL           ; Store new scale value
2C9D [06] 154201      5494       BCLR    DFLAGS,$01      ; Clear fractional vernier display flag
2CA0 [06] BD1331      5495       JSR     WAIT_NONE       ; Wait for no keys pressed
2CA3 [05] 39          5496       RTS
                      5497
                      5498  STRCH_RUN:
2CA4 [03] 7E2C20      5499       JMP     STRCH_STRT
                      5500
                      5501  STRCH_CHK:
2CA7 [06] 144202      5502       BSET    DFLAGS,$02
2CAA [06] 154204      5503       BCLR    DFLAGS,$04
2CAD [06] 144320      5504       BSET    SFLAGS,$20      ; Set to look in ROM
                      5505  ; Look for STRCH in STRCH_DIR
2CB0 [04] 18CE0049    5506       LDY     #TS_NAME
2CB4 [06] BD323E      5507       JSR     FIND_TS
2CB7 [04] 8C0000      5508       CPX     #$0000
2CBA [03] 2610        5509       BNE     STRCH_CHK2
                      5510  ; If no STRCH exists for name, then create blank STRCH & jump to edit
2CBC [06] BD229F      5511       JSR     NEW_STRCH
2CBF [04] 8C0000      5512       CPX     #$0000
2CC2 [03] 2705        5513       BEQ     STRCH_CHK1
2CC4 [04] DF51        5514       STX     PTR1
2CC6 [03] 7E2F73      5515       JMP     STRCH_EDIT
                      5516  STRCH_CHK1:
2CC9 [03] 7E2B9B      5517       JMP     STRCH
                      5518  STRCH_CHK2:
2CCC [06] 12428054    5519       BRSET   DFLAGS,$80,STRCH_CHK3   ; File is in ROM.  Go to ROM
menu.
                      5520  ; If STRCH exists, then EDIT, DEL, RUN or NO CHNG
                      5521       ; Display "Already Exists" Screen
2CD0 macro            5522       SCR     155,101,102,103
2CD0 [03] CE6A2E      5523   LDX #MSG%1
2CD3 [06] BD12C1      5524   JSR LINE1
2CD6 [03] CE6656      5525   LDX #MSG%2
2CD9 [06] BD12C7      5526   JSR LINE2
2CDC [03] CE666B      5527   LDX #MSG%3
2CDF [06] BD12CD      5528   JSR LINE3
2CE2 [03] CE6680      5529   LDX #MSG%4
2CE5 [06] BD12D3      5530   JSR LINE4
                      5531       ;  Cursor Position : (Line = 0,  column = 10)
```

```
2CE8 [02] 8600      5532        LDAA    #!0             ; Line 0
2CEA [02] C60A      5533        LDAB    #!10            ; Column 10
2CEC [06] BD1309    5534        JSR     DSP_CUR         ; Position Cursor
                    5535        ; Display NAME
2CEF [03] CE0049    5536        LDX     #TS_NAME
2CF2 [06] BD12BD    5537        JSR     DSP_STR
2CF5 [06] BD1331    5538        JSR     WAIT_NONE       ; Wait for no keys pressed
2CF8 macro          5539        CHOOSE  STRCH_EDIT,STRCH_DEL2,STRCH_CNCL,STRCH,MNU0
                    5540   MNU0:
2CF8 [06] BD1366    5541    JSR GET_KEY
2CFB [02] 841F      5542    ANDA #$1F
2CFD [03] 27F9      5543    BEQ MNU0
2CFF [02] 8101      5544    CMPA #$01
2D01 [03] 2603      5545    BNE MNU1
2D03 [03] 7E2F73    5546    JMP %1
                    5547   MNU1:
2D06 [02] 8102      5548    CMPA #$02
2D08 [03] 2603      5549    BNE MNU2
2D0A [03] 7E2F69    5550    JMP %2
                    5551   MNU2:
2D0D [02] 8104      5552    CMPA #$04
2D0F [03] 2603      5553    BNE MNU3
2D11 [03] 7E2C95    5554    JMP %3
                    5555   MNU3:
2D14 [02] 8108      5556    CMPA #$08
2D16 [03] 2603      5557    BNE MNU4
2D18 [03] 7E2B9B    5558    JMP %4
                    5559   MNU4:
2D1B [02] 8110      5560    CMPA #$10
2D1D [03] 2603      5561    BNE MNU5
2D1F [03] 7E2CF8    5562    JMP %5
                    5563   MNU5:
2D22 [03] 20D4      5564    BRA MNU0
                    5565
                    5566   STRCH_CHK3:
                    5567        ; Display "Factory Default" Screen
2D24 macro          5568        SCR     155,147,148,149
2D24 [03] CE6A2E    5569    LDX #MSG%1
2D27 [06] BD12C1    5570    JSR LINE1
2D2A [03] CE6986    5571    LDX #MSG%2
2D2D [06] BD12C7    5572    JSR LINE2
2D30 [03] CE699B    5573    LDX #MSG%3
2D33 [06] BD12CD    5574    JSR LINE3
2D36 [03] CE69B0    5575    LDX #MSG%4
2D39 [06] BD12D3    5576    JSR LINE4
                    5577        ;  Cursor Position : (Line = 0,  column = 10)
2D3C [02] 8600      5578        LDAA    #!0             ; Line 0
2D3E [02] C60A      5579        LDAB    #!10            ; Column 10
2D40 [06] BD1309    5580        JSR     DSP_CUR         ; Position Cursor
                    5581        ; Display NAME
2D43 [03] CE0049    5582        LDX     #TS_NAME
2D46 [06] BD12BD    5583        JSR     DSP_STR
2D49 [06] BD1331    5584        JSR     WAIT_NONE       ; Wait for no keys pressed
2D4C macro          5585        CHOOSE  MNU0,MNU0,STRCH_CNCL,STRCH,MNU0
                    5586   MNU0:
2D4C [06] BD1366    5587    JSR GET_KEY
2D4F [02] 841F      5588    ANDA #$1F
2D51 [03] 27F9      5589    BEQ MNU0
2D53 [02] 8101      5590    CMPA #$01
2D55 [03] 2603      5591    BNE MNU1
2D57 [03] 7E2D4C    5592    JMP %1
                    5593   MNU1:
2D5A [02] 8102      5594    CMPA #$02
2D5C [03] 2603      5595    BNE MNU2
2D5E [03] 7E2D4C    5596    JMP %2
                    5597   MNU2:
2D61 [02] 8104      5598    CMPA #$04
2D63 [03] 2603      5599    BNE MNU3
```

```
2D65 [03] 7E2C95     5600   JMP %3
                     5601  MNU3:
2D68 [02] 8108       5602   CMPA #$08
2D6A [03] 2603       5603   BNE MNU4
2D6C [03] 7E2B9B     5604   JMP %4
                     5605  MNU4:
2D6F [02] 8110       5606   CMPA #$10
2D71 [03] 2603       5607   BNE MNU5
2D73 [03] 7E2D4C     5608   JMP %5
                     5609  MNU5:
2D76 [03] 20D4       5610   BRA MNU0
                     5611
                     5612  STRCH_DEL:
                     5613       ; Display COPY/DEL screen
2D78 macro           5614       SCR     161,0,0,162
2D78 [03] CE6AAC     5615   LDX #MSG%1
2D7B [06] BD12C1     5616   JSR LINE1
2D7E [03] CE6015     5617   LDX #MSG%2
2D81 [06] BD12C7     5618   JSR LINE2
2D84 [03] CE6015     5619   LDX #MSG%3
2D87 [06] BD12CD     5620   JSR LINE3
2D8A [03] CE6AC1     5621   LDX #MSG%4
2D8D [06] BD12D3     5622   JSR LINE4
2D90 [06] BD1331     5623       JSR     WAIT_NONE       ; Wait for no keys pressed
                     5624       ; Select COPY or DEL
2D93 macro           5625       CHOOSE  STRCH_COPY,STRCH_DEL1,STRCH_CNCL,STRCH,MNU0
                     5626  MNU0:
2D93 [06] BD1366     5627   JSR GET_KEY
2D96 [02] 841F       5628   ANDA #$1F
2D98 [03] 27F9       5629   BEQ MNU0
2D9A [02] 8101       5630   CMPA #$01
2D9C [03] 2603       5631   BNE MNU1
2D9E [03] 7E2DBF     5632   JMP %1
                     5633  MNU1:
2DA1 [02] 8102       5634   CMPA #$02
2DA3 [03] 2603       5635   BNE MNU2
2DA5 [03] 7E2F46     5636   JMP %2
                     5637  MNU2:
2DA8 [02] 8104       5638   CMPA #$04
2DAA [03] 2603       5639   BNE MNU3
2DAC [03] 7E2C95     5640   JMP %3
                     5641  MNU3:
2DAF [02] 8108       5642   CMPA #$08
2DB1 [03] 2603       5643   BNE MNU4
2DB3 [03] 7E2B9B     5644   JMP %4
                     5645  MNU4:
2DB6 [02] 8110       5646   CMPA #$10
2DB8 [03] 2603       5647   BNE MNU5
2DBA [03] 7E2D93     5648   JMP %5
                     5649  MNU5:
2DBD [03] 20D4       5650   BRA MNU0
                     5651  STRCH_COPY:
                     5652       ; If COPY is selected --
                     5653       ; Get new file name
2DBF [03] CE0082     5654       LDX     #D_STR
2DC2 [04] 18CE675E   5655       LDY     #MSG117
2DC6 [06] BD15B4     5656       JSR     PICK_NAME
2DC9 [04] 8C0000     5657       CPX     #$0000
2DCC [03] 2603       5658       BNE     STRCH_CPY10
2DCE [03] 7E2D78     5659       JMP     STRCH_DEL
                     5660  STRCH_CPY10:
                     5661       ; Check for file exists.  If so, ask for DEL or RENAME.
2DD1 [04] 18CE0082   5662       LDY     #D_STR
2DD5 [06] 144202     5663       BSET    DFLAGS,$02      ; Set to look for STRCH
2DD8 [06] 154204     5664       BCLR    DFLAGS,$04      ; (and not TMPR)
2DDB [06] 144320     5665       BSET    SFLAGS,$20      ; Set to look in ROM
2DDE [06] BD323E     5666       JSR     FIND_TS
2DE1 [04] 8C0000     5667       CPX     #$0000
```

```
2DE4 [03] 2766        5668        BEQ     STRCH_CPY20     ; No such file, so name is O.K.
2DE6 [04] DF51        5669        STX     PTR1
                      5670        ; If STRCH already exists for name, then ask for RENAME or DEL
                      5671        ; ** If RENAME then jump to STRCH_COPY label
                      5672        ; Display "Already Exists" Screen
2DE8 macro            5673        SCR     155,101,168,169
2DE8 [03] CE6A2E      5674    LDX #MSG%1
2DEB [06] BD12C1      5675    JSR LINE1
2DEE [03] CE6656      5676    LDX #MSG%2
2DF1 [06] BD12C7      5677    JSR LINE2
2DF4 [03] CE6B2A      5678    LDX #MSG%3
2DF7 [06] BD12CD      5679    JSR LINE3
2DFA [03] CE6B3F      5680    LDX #MSG%4
2DFD [06] BD12D3      5681    JSR LINE4
                      5682        ;  Cursor Position : (Line = 0,  column = 10)
2E00 [02] 8600        5683        LDAA    #!0             ; Line 0
2E02 [02] C60A        5684        LDAB    #!10            ; Column 10
2E04 [06] BD1309      5685        JSR     DSP_CUR         ; Position Cursor
                      5686        ; Display NAME
2E07 [03] CE0082      5687        LDX     #D_STR
2E0A [06] BD12BD      5688        JSR     DSP_STR
2E0D [06] BD1331      5689        JSR     WAIT_NONE       ; Wait for no keys pressed
                      5690        ; Select RENAME or DEL
2E10 macro            5691        CHOOSE  STRCH_COPY,STRCH_DC10,STRCH_CNCL,MNU0,MNU0
                      5692    MNU0:
2E10 [06] BD1366      5693    JSR GET_KEY
2E13 [02] 841F        5694    ANDA #$1F
2E15 [03] 27F9        5695    BEQ MNU0
2E17 [02] 8101        5696    CMPA #$01
2E19 [03] 2603        5697    BNE MNU1
2E1B [03] 7E2DBF      5698    JMP %1
                      5699    MNU1:
2E1E [02] 8102        5700    CMPA #$02
2E20 [03] 2603        5701    BNE MNU2
2E22 [03] 7E2E3C      5702    JMP %2
                      5703    MNU2:
2E25 [02] 8104        5704    CMPA #$04
2E27 [03] 2603        5705    BNE MNU3
2E29 [03] 7E2C95      5706    JMP %3
                      5707    MNU3:
2E2C [02] 8108        5708    CMPA #$08
2E2E [03] 2603        5709    BNE MNU4
2E30 [03] 7E2E10      5710    JMP %4
                      5711    MNU4:
2E33 [02] 8110        5712    CMPA #$10
2E35 [03] 2603        5713    BNE MNU5
2E37 [03] 7E2E10      5714    JMP %5
                      5715    MNU5:
2E3A [03] 20D4        5716    BRA MNU0
                      5717    STRCH_DC10:
                      5718        ; ** If DEL then Delete file
2E3C [04] DE51        5719        LDX     PTR1
2E3E [04] 18CE0082    5720        LDY     #D_STR
2E42 [06] BD235D      5721        JSR     DEL_TS
                      5722    ;  If YES, continue with copy.  If NO, then return to menu
2E45 [02] 8101        5723        CMPA    #$01
2E47 [03] 2703        5724        BEQ     STRCH_CPY20
2E49 [03] 7E2B9B      5725        JMP     STRCH
                      5726    STRCH_CPY20:
                      5727        ; Select source file to be copied
2E4C [06] 144202      5728        BSET    DFLAGS,$02
2E4F [06] 154204      5729        BCLR    DFLAGS,$04
2E52 [06] 144320      5730        BSET    SFLAGS,$20
2E55 [03] CE6B54      5731        LDX     #MSG170
2E58 [02] 8601        5732        LDAA    #$1
2E5A [06] BD242D      5733        JSR     SEL_TS
2E5D [02] 8108        5734        CMPA    #$08            ; Is it F4 (SLCT)?
2E5F [03] 2704        5735        BEQ     STRCH_CPY21
```

```
2E61 [02] 8110      5736        CMPA    #$10            ; Is it ENTER?
2E63 [03] 2607      5737        BNE     STRCH_CPY25
                    5738   STRCH_CPY21:
2E65 [04] 8C0000    5739        CPX     #$0000
2E68 [03] 2702      5740        BEQ     STRCH_CPY25
2E6A [03] 2003      5741        BRA     STRCH_CPY26
                    5742   STRCH_CPY25:
2E6C [03] 7E2C0F    5743        JMP     STRCH_NO1
                    5744   STRCH_CPY26:
2E6F [04] DF51      5745        STX     PTR1
                    5746        ; Display "COPY xxxx to xxxx" screen
2E71 macro          5747        SCR     171,105,0,106
2E71 [03] CE6B69    5748    LDX #MSG%1
2E74 [06] BD12C1    5749    JSR LINE1
2E77 [03] CE66AA    5750    LDX #MSG%2
2E7A [06] BD12C7    5751    JSR LINE2
2E7D [03] CE6015    5752    LDX #MSG%3
2E80 [06] BD12CD    5753    JSR LINE3
2E83 [03] CE66BF    5754    LDX #MSG%4
2E86 [06] BD12D3    5755    JSR LINE4
                    5756        ;  Cursor Position : (Line = 0,  column = 6)
2E89 [02] 8600      5757        LDAA    #!0             ; Line 0
2E8B [02] C606      5758        LDAB    #!6             ; Column 6
2E8D [06] BD1309    5759        JSR     DSP_CUR         ; Position Cursor
                    5760        ; Display NAME
2E90 [03] CE0049    5761        LDX     #TS_NAME
2E93 [06] BD12BD    5762        JSR     DSP_STR
                    5763        ;  Cursor Position : (Line = 0,  column = 14)
2E96 [02] 8600      5764        LDAA    #!0             ; Line 0
2E98 [02] C60E      5765        LDAB    #!14            ; Column 14
2E9A [06] BD1309    5766        JSR     DSP_CUR         ; Position Cursor
                    5767        ; Display NAME
2E9D [03] CE0082    5768        LDX     #D_STR
2EA0 [06] BD12BD    5769        JSR     DSP_STR
2EA3 [06] BD1331    5770        JSR     WAIT_NONE       ; Wait for no keys pressed
                    5771        ; Get user response & abort or continue
2EA6 macro          5772        CHOOSE  STRCH_CPY30,STRCH_NO1,MNU0,MNU0,MNU0
                    5773   MNU0:
2EA6 [06] BD1366    5774    JSR GET_KEY
2EA9 [02] 841F      5775    ANDA #$1F
2EAB [03] 27F9      5776    BEQ MNU0
2EAD [02] 8101      5777    CMPA #$01
2EAF [03] 2603      5778    BNE MNU1
2EB1 [03] 7E2ED5    5779    JMP %1
                    5780   MNU1:
2EB4 [02] 8102      5781    CMPA #$02
2EB6 [03] 2603      5782    BNE MNU2
2EB8 [03] 7E2C0F    5783    JMP %2
                    5784   MNU2:
2EBB [02] 8104      5785    CMPA #$04
2EBD [03] 2603      5786    BNE MNU3
2EBF [03] 7E2EA6    5787    JMP %3
                    5788   MNU3:
2EC2 [02] 8108      5789    CMPA #$08
2EC4 [03] 2603      5790    BNE MNU4
2EC6 [03] 7E2EA6    5791    JMP %4
                    5792   MNU4:
2EC9 [02] 8110      5793    CMPA #$10
2ECB [03] 2603      5794    BNE MNU5
2ECD [03] 7E2EA6    5795    JMP %5
                    5796   MNU5:
2ED0 [03] 20D4      5797    BRA MNU0
                    5798   STRCH_NO3:
                    5799   ;    BCLR    DFLAGS,$06
2ED2 [03] 7E2C0F    5800        JMP     STRCH_NO1
                    5801   STRCH_CPY30:
2ED5 [03] CE6A2E    5802        LDX     #MSG155         ; Display: STRCH = xxxx
2ED8 [06] BD12C7    5803        JSR     LINE2
```

```
2EDB [03] CE6015     5804        LDX     #MSG0
2EDE [06] BD12CD     5805        JSR     LINE3
2EE1 [06] BD12D3     5806        JSR     LINE4
2EE4 [06] BD1331     5807        JSR     WAIT_NONE        ; Wait for no keys pressed
                     5808        ; Move name from D_STR to TS_NAME
2EE7 [03] CE0082     5809        LDX     #D_STR
2EEA [04] 18CE0049   5810        LDY     #TS_NAME
2EEE [04] A600       5811        LDAA    0,X
2EF0 [05] 18A700     5812        STAA    0,Y
2EF3 [04] A601       5813        LDAA    1,X
2EF5 [05] 18A701     5814        STAA    1,Y
2EF8 [04] A602       5815        LDAA    2,X
2EFA [05] 18A702     5816        STAA    2,Y
2EFD [04] A603       5817        LDAA    3,X
2EFF [05] 18A703     5818        STAA    3,Y
2F02 [07] 186F04     5819        CLR     4,Y
                     5820        ;  Cursor Position : (Line = 1,  column = 10)
2F05 [02] 8601       5821        LDAA    #!1              ; Line 1
2F07 [02] C60A       5822        LDAB    #!10             ; Column 10
2F09 [06] BD1309     5823        JSR     DSP_CUR          ; Position Cursor
2F0C [03] CE0049     5824        LDX     #TS_NAME
2F0F [06] BD12BD     5825        JSR     DSP_STR
2F12 [03] CE67CD     5826        LDX     #MSG126          ; Display "WORKING"
2F15 [06] BD12CD     5827        JSR     LINE3
                     5828  ;     LDX     #TS_NAME
                     5829        ; Create new destination file
2F18 [06] 154320     5830        BCLR    SFLAGS,$20       ; Do not look in ROM
2F1B [06] 154280     5831        BCLR    DFLAGS,$80       ; New file is NOT in ROM
2F1E [06] BD229F     5832        JSR     NEW_STRCH
2F21 [04] 8C0000     5833        CPX     #$0000
2F24 [03] 27AC       5834        BEQ     STRCH_NO3
2F26 [04] DF55       5835        STX     PTR3
2F28 [03] CE67F7     5836        LDX     #MSG128          ; Display "DONE"
2F2B [06] BD12CD     5837        JSR     LINE3
2F2E [03] CE6BBD     5838        LDX     #MSG175          ; Display "COPYING"
2F31 [06] BD12C7     5839        JSR     LINE2
2F34 [03] CE67CD     5840        LDX     #MSG126          ; Display "WORKING"
2F37 [06] BD12CD     5841        JSR     LINE3
2F3A [04] DE55       5842        LDX     PTR3
                     5843        ; Perform copy
2F3C [06] BD22DC     5844        JSR     COPY_TS
                     5845        ; Fix pointers for new file
2F3F [04] DE55       5846        LDX     PTR3
2F41 [04] DF51       5847        STX     PTR1
                     5848        ; And jump to edit new file
2F43 [03] 7E2F73     5849        JMP     STRCH_EDIT
                     5850  STRCH_DEL1:
                     5851  ; If DEL is selected --
                     5852  ; Display STRCH directory entries & allow select
2F46 [06] 144202     5853        BSET    DFLAGS,$02
2F49 [06] 154204     5854        BCLR    DFLAGS,$04
2F4C [06] 154320     5855        BCLR    SFLAGS,$20
2F4F [03] CE6AEB     5856        LDX     #MSG165
2F52 [02] 8601       5857        LDAA    #$1
2F54 [06] BD242D     5858        JSR     SEL_TS
2F57 [02] 8108       5859        CMPA    #$08
2F59 [03] 2704       5860        BEQ     STRCH_DEL21
2F5B [02] 8110       5861        CMPA    #$10
2F5D [03] 2607       5862        BNE     STRCH_DEL25
                     5863  STRCH_DEL21:
2F5F [04] 8C0000     5864        CPX     #$0000
2F62 [03] 2702       5865        BEQ     STRCH_DEL25
2F64 [03] 2003       5866        BRA     STRCH_DEL2
                     5867  STRCH_DEL25:
2F66 [03] 7E2C0F     5868        JMP     STRCH_NO1
                     5869  STRCH_DEL2:
2F69 [04] 18CE0049   5870        LDY     #TS_NAME
2F6D [06] BD235D     5871        JSR     DEL_TS
```

```
                    ;     BCLR    DFLAGS,$06
2F70 [03] 7E2C0F          JMP     STRCH_NO1

                    STRCH_EDIT:
2F73 [04] DE51            LDX     PTR1
2F75 [06] BD1FC3          JSR     EDIT_TS
2F78 macro                SCR     155,144,145,146
2F78 [03] CE6A2E     LDX #MSG%1
2F7B [06] BD12C1     JSR LINE1
2F7E [03] CE6947     LDX #MSG%2
2F81 [06] BD12C7     JSR LINE2
2F84 [03] CE695C     LDX #MSG%3
2F87 [06] BD12CD     JSR LINE3
2F8A [03] CE6971     LDX #MSG%4
2F8D [06] BD12D3     JSR LINE4
                          ; Display selected STRCH name here
                          ;  Cursor Position : (Line = 0,  column = 10)
2F90 [02] 8600            LDAA    #!0             ; Line 0
2F92 [02] C60A            LDAB    #!10            ; Column 10
2F94 [06] BD1309          JSR     DSP_CUR         ; Position Cursor
                          ; Display NAME
2F97 [03] CE0049          LDX     #TS_NAME
2F9A [06] BD12BD          JSR     DSP_STR
2F9D [06] BD1331          JSR     WAIT_NONE       ; Wait for no keys pressed
2FA0 macro                CHOOSE  MNU0,MNU0,MNU0,MNU0,STRCH_STRT
                    MNU0:
2FA0 [06] BD1366     JSR GET_KEY
2FA3 [02] 841F       ANDA #$1F
2FA5 [03] 27F9       BEQ MNU0
2FA7 [02] 8101       CMPA #$01
2FA9 [03] 2603       BNE MNU1
2FAB [03] 7E2FA0     JMP %1
                    MNU1:
2FAE [02] 8102       CMPA #$02
2FB0 [03] 2603       BNE MNU2
2FB2 [03] 7E2FA0     JMP %2
                    MNU2:
2FB5 [02] 8104       CMPA #$04
2FB7 [03] 2603       BNE MNU3
2FB9 [03] 7E2FA0     JMP %3
                    MNU3:
2FBC [02] 8108       CMPA #$08
2FBE [03] 2603       BNE MNU4
2FC0 [03] 7E2FA0     JMP %4
                    MNU4:
2FC3 [02] 8110       CMPA #$10
2FC5 [03] 2603       BNE MNU5
2FC7 [03] 7E2C20     JMP %5
                    MNU5:
2FCA [03] 20D4       BRA MNU0

                    STRCH_STOP:
                    ; Check if STRCH is already ON.  If so, then stop STRCH.
2FCC [06] 13420651        BRCLR   DFLAGS,$06,STRCH_ST20
2FD0 [06] 1342021A        BRCLR   DFLAGS,$02,STRCH_ST10
                    ;##### Display 'STRCH STOPPED' and 'HIT ANY KEY' screen here.
2FD4 macro                SCR     155,139,125,126
2FD4 [03] CE6A2E     LDX #MSG%1
2FD7 [06] BD12C1     JSR LINE1
2FDA [03] CE68DE     LDX #MSG%2
2FDD [06] BD12C7     JSR LINE2
2FE0 [03] CE67B8     LDX #MSG%3
2FE3 [06] BD12CD     JSR LINE3
2FE6 [03] CE67CD     LDX #MSG%4
2FE9 [06] BD12D3     JSR LINE4
2FEC [03] 2018            BRA     STRCH_ST11
                    STRCH_ST10:
                    ;##### Display 'TMPR STOPPED' and 'HIT ANY KEY' screen here.
```

```
2FEE macro          5940        SCR     133,139,125,126
2FEE [03] CE6860    5941   LDX #MSG%1
2FF1 [06] BD12C1    5942   JSR LINE1
2FF4 [03] CE68DE    5943   LDX #MSG%2
2FF7 [06] BD12C7    5944   JSR LINE2
2FFA [03] CE67B8    5945   LDX #MSG%3
2FFD [06] BD12CD    5946   JSR LINE3
3000 [03] CE67CD    5947   LDX #MSG%4
3003 [06] BD12D3    5948   JSR LINE4
                    5949  STRCH_ST11:
3006 [06] 154206    5950        BCLR    DFLAGS,$06
                    5951        ;  Cursor Position : (Line = 0,  column = 10)
3009 [02] 8600      5952        LDAA    #!0             ; Line 0
300B [02] C60A      5953        LDAB    #!10            ; Column 10
300D [06] BD1309    5954        JSR     DSP_CUR         ; Position Cursor
                    5955        ; Display NAME
3010 [03] CE0049    5956        LDX     #TS_NAME
3013 [06] BD12BD    5957        JSR     DSP_STR
3016 [06] BD1331    5958        JSR     WAIT_NONE       ; Wait for no keys pressed
                    5959  STRCH_ST19:
3019 [06] BD1366    5960        JSR     GET_KEY
301C [03] 27FB      5961        BEQ     STRCH_ST19      ; Wait for any key
301E [03] 7E2B9B    5962        JMP     STRCH
                    5963  STRCH_ST20:
                    5964  ; Else, Display "NO TMPR OR STRCH" screen.
3021 macro          5965        SCR     173,174,125,126
3021 [03] CE6B93    5966   LDX #MSG%1
3024 [06] BD12C1    5967   JSR LINE1
3027 [03] CE6BA8    5968   LDX #MSG%2
302A [06] BD12C7    5969   JSR LINE2
302D [03] CE67B8    5970   LDX #MSG%3
3030 [06] BD12CD    5971   JSR LINE3
3033 [03] CE67CD    5972   LDX #MSG%4
3036 [06] BD12D3    5973   JSR LINE4
3039 [06] BD1331    5974        JSR     WAIT_NONE
303C [03] 7E3019    5975        JMP     STRCH_ST19
                    5976  ;** ; Else, select STRCH to start.
                    5977  ;** ; Display STRCH directory entries & allow select
                    5978  ;**  BSET    DFLAGS,$02
                    5979  ;**  BCLR    DFLAGS,$04
                    5980  ;**  BSET    SFLAGS,$20
                    5981  ;**  LDX     #MSG165
                    5982  ;**  JSR     SEL_TS
                    5983  ;** ; Load KEY data from TMPR/STRCH into SFLAGS var
                    5984  ;**  JMP     STRCH
                    5985
                    5986  * - - - - - - - - - - - - - - - - - - - - - - - - - - - - -
                    5987  * End of STRCH Subroutines
                    5988  *=========================================================
                    5989
303F                5990  $INCLUDE 'MEMORY.ASM'          ;Include MEMORY Subroutines
                    5991  *=========================================================*
                    5992  *   Peterson Tuner Memory (EEPROM) Subroutines           *
                    5993  *   Written by: Robert S. Dobrose                        *
                    5994  *   Saracon, Inc.                                        *
                    5995  *     1135 Garfield Ave.                                 *
                    5996  *     Libertyville, IL  60048                            *
                    5997  *=========================================================*
                    5998  *   Release History                                      *
                    5999  *   05/11/95  1.0  - Initial Code                        *
                    6000  *=========================================================*
                    6001
                    6002  *=========================================================
                    6003  * Name:  MEM_TST
                    6004  * Subroutine: EEPROM Memory Test Subroutine
                    6005  * Written by: Robert S. Dobrose
                    6006  * Purpose: Test the EEPROM memory for correct data
                    6007  *            and flag any errors found.
```

```
                    6008  *   Input: none
                    6009  *  Output: none
                    6010  *   Notes:  This routine scans EEPROM memory and
                    6011  *             calculates checksums for memory chunks.
                    6012  *           It then compares the calculated checksum
                    6013  *             with the stored checksum.  Any difference
                    6014  *             indicates an error & should cause an error
                    6015  *             flag to be set.
                    6016  *          INDEX variable is altered
                    6017  *          MEM_ERR variable is altered
                    6018  * - - - - - - - - - - - - - - - - - - - - - - - - - - - - -
                    6019  MEM_TST:
303F                6020        EQU     *
303F [06] 154206    6021        BCLR    DFLAGS,$06        ; Turn off TMPR & STRCH
3042 [06] 7F0040    6022        CLR     MEM_ERR           ; Clear all error flags
3045 [03] CEA000    6023        LDX     #EEPROM
3048 [05] EC00      6024        LDD     EE_PTR,X
304A [05] 1A830001  6025        CPD     #TYP_SH
304E [03] 2706      6026        BEQ     MT_SK10
3050 [06] 144002    6027        BSET    MEM_ERR,$02       ; Flag BLOCK TYPE error
3053 [03] 7E30B5    6028        JMP     MT_BAD
                    6029  MT_SK10:
3056 [02] C61F      6030        LDAB    #!31
3058 [06] BD313E    6031        JSR     CSUM
305B [04] A100      6032        CMPA    0,X
305D [03] 2706      6033        BEQ     MT_SK11
305F [06] 144001    6034        BSET    MEM_ERR,$01       ; Flag CHECKSUM error
                    6035  ;     LDX     #EEPROM
                    6036  ;     JSR     CS_FIX            ; Fix bad checksum
                    6037  ;     TSTA                      ; Test for user response
                    6038  ;     BEQ     MT_SK11           ; User wishes to continue test
3062 [03] 7E30B5    6039        JMP     MT_BAD            ; Stop testing!
                    6040  MT_SK11:
3065 [03] CEA000    6041        LDX     #EEPROM
                    6042  MT_LP1:
3068 [02] C620      6043        LDAB    #!32
306A [03] 3A        6044        ABX                       ; set pointer to next block
306B [04] 8CDFFF    6045        CPX     #EEPEND           ; are we past end of memory?
306E [03] 2D03      6046        BLT     MT_SK21
3070 [03] 7E30B8    6047        JMP     MT_DONE           ; Past end!  break out of loop.
                    6048  MT_SK21:
3073 [04] A601      6049        LDAA    EE_TYPE,X         ; Get block type data
3075 [02] 81FF      6050        CMPA    #$FF              ; Is block EMPTY?
3077 [03] 27EF      6051        BEQ     MT_LP1            ; Empty block.  Do next block.
3079 [02] 841F      6052        ANDA    #$1F              ; Mask off non-type data
307B [02] 8108      6053        CMPA    #TYP_S0           ; Is it a STRCH header block?
307D [03] 2D11      6054        BLT     MT_SK25           ; Not in STRCH block type range
307F [03] 260B      6055        BNE     MT_SK22           ; No.  Skip next stuff.
3081 [06] BD30C0    6056        JSR     TEST_FILE         ; test entire file chain
3084 [06] 7D0040    6057        TST     MEM_ERR           ; Check for errors
3087 [03] 27DF      6058        BEQ     MT_LP1            ; No errors.  Do next block.
3089 [03] 7E30B5    6059        JMP     MT_BAD            ; Error!  flag & exit.
                    6060  MT_SK22:
308C [02] 810F      6061        CMPA    #TYP_S7           ; Is the block in the STRCH type range?
308E [03] 2FD8      6062        BLE     MT_LP1            ; If in STRCH range, skip this block.
                    6063  MT_SK25:
3090 [02] 8107      6064        CMPA    #TYP_T0           ; Is it a TMPR header block?
3092 [03] 260B      6065        BNE     MT_SK26           ; No.  Skip next stuff.
3094 [06] BD30C0    6066        JSR     TEST_FILE         ; test entire file chain
3097 [06] 7D0040    6067        TST     MEM_ERR           ; Check for errors
309A [03] 27CC      6068        BEQ     MT_LP1            ; No errors.  Do next block.
309C [03] 7E30B5    6069        JMP     MT_BAD            ; Error!  flag & exit.
                    6070  MT_SK26:
309F [02] 8106      6071        CMPA    #TYP_Q0           ; Is it a SEQ header block?
30A1 [03] 260B      6072        BNE     MT_SK27           ; No.  Skip next stuff.
30A3 [06] BD30C0    6073        JSR     TEST_FILE         ; test entire file chain
30A6 [06] 7D0040    6074        TST     MEM_ERR           ; Check for errors
30A9 [03] 27BD      6075        BEQ     MT_LP1            ; No errors.  Do next block.
```

```
30AB [03] 7E30B5     6076        JMP     MT_BAD          ; Error!  flag & exit.
                     6077  MT_SK27:
30AE [02] 8101       6078        CMPA    #TYP_SH         ; Is it the system header (small memory!)
30B0 [03] 2706       6079        BEQ     MT_DONE         ; Reached end of small memory.  Exit
loop.
                     6080        ; Test block is not empty & not a normal file type.  Error!
30B2 [06] 144002     6081        BSET    MEM_ERR,$02     ; Flag BLOCK TYPE error
                     6082  MT_BAD:
30B5 [06] BD33DD     6083        JSR     ERR_DFLT
                     6084  MT_DONE:
30B8 [03] CE0000     6085        LDX     #$0000
30BB [04] DF51       6086        STX     PTR1
30BD [04] DF53       6087        STX     PTR2
30BF [05] 39         6088        RTS
                     6089
                     6090  TEST_FILE:
30C0                 6091        EQU     *
30C0 [04] 3C         6092        PSHX
30C1 [03] 9781       6093        STAA    IDX2            ; Save record block type
                     6094  ;     STAB    D1TEMP          ; Save directory block type
30C3 [04] 8CA000     6095        CPX     #EEPROM
30C6 [03] 2E06       6096        BGT     TF_SK11
30C8 [06] 144004     6097        BSET    MEM_ERR,$04     ; Flag POINTER RANGE error
30CB [03] 7E313C     6098        JMP     TF_DONE
                     6099  TF_SK11:
30CE [04] 8CDFFF     6100        CPX     #EEPEND
30D1 [03] 2D06       6101        BLT     TF_SK12
30D3 [06] 144004     6102        BSET    MEM_ERR,$04     ; Flag POINTER RANGE error
30D6 [03] 7E313C     6103        JMP     TF_DONE
                     6104  TF_SK12:
30D9 [04] DF55       6105        STX     PTR3
30DB [04] DF57       6106        STX     PTR4
30DD [03] 9681       6107        LDAA    IDX2
30DF [03] 978E       6108        STAA    MULT1
                     6109  TF_LP3:
                     6110        ; Check record block type (with IDX2 [MULT1])
30E1 [04] DE57       6111        LDX     PTR4
30E3 [04] E601       6112        LDAB    EE_TYPE,X
30E5 [02] C41F       6113        ANDB    #$1F            ; Mask off non-type data
30E7 [03] D18E       6114        CMPB    MULT1
30E9 [03] 2706       6115        BEQ     TF_SK21
30EB [06] 144002     6116        BSET    MEM_ERR,$02     ; Flag BLOCK TYPE error
30EE [03] 7E313C     6117        JMP     TF_DONE
                     6118  TF_SK21:
                     6119        ; Compare record block checksum (reconstruct & warn? if bad)
30F1 [02] C61F       6120        LDAB    #!31
30F3 [06] BD313E     6121        JSR     CSUM
30F6 [04] A100       6122        CMPA    0,X
30F8 [03] 2717       6123        BEQ     TF_SK23
                     6124        ; record block checsum wrong!  Re-write it!
30FA [06] BD1A5D     6125        JSR     ERR_CS          ; Warn user of error
                     6126  TF_SK22:
30FD [04] A700       6127        STAA    0,X
                     6128        ; Wait for EEPROM to store data
30FF [03] CE0002     6129        LDX     #$2
3102 [06] BD1178     6130        JSR     TIMER
3105 [04] DE57       6131        LDX     PTR4
3107 [04] A100       6132        CMPA    0,X
3109 [03] 2706       6133        BEQ     TF_SK23
310B [06] BD1403     6134        JSR     TRY_AGAIN
310E [02] 5D         6135        TSTB
310F [03] 26EC       6136        BNE     TF_SK22
                     6137  TF_SK23:
                     6138        ; Follow Chain (if any) and loop (LP3) until end of chain
3111 [04] DE57       6139        LDX     PTR4
3113 [05] EC00       6140        LDD     EE_PTR,X
3115 [02] C4E0       6141        ANDB    #$E0            ; Mask off non-ptr data
3117 [05] 1A830000   6142        CPD     #$0000
```

```
311B [03] 271F       6143        BEQ     TF_DONE          ; End of chain.  Jump to done.
311D [05] 1A83A000   6144        CPD     #EEPROM
3121 [03] 2E06       6145        BGT     TF_SK24
3123 [06] 144004     6146        BSET    MEM_ERR,$04      ; Flag POINTER RANGE error
3126 [03] 7E313C     6147        JMP     TF_DONE
                     6148  TF_SK24:
3129 [05] 1A83DFFF   6149        CPD     #EEPEND
312D [03] 2D06       6150        BLT     TF_SK25
312F [06] 144004     6151        BSET    MEM_ERR,$04      ; Flag POINTER RANGE error
3132 [03] 7E313C     6152        JMP     TF_DONE
                     6153  TF_SK25:
3135 [04] DD57       6154        STD     PTR4             ; Save new block address
3137 [06] 7C008E     6155        INC     MULT1            ; Increment block type compare value
313A [03] 20A5       6156        BRA     TF_LP3
                     6157  TF_DONE:
313C [05] 38         6158        PULX
313D [05] 39         6159        RTS
                     6160
                     6161  *=====================================================
                     6162  * Name:  CSUM
                     6163  * Subroutine: Calculate Checksum for a range of memory
                     6164  * Written by: Robert S. Dobrose
                     6165  * Purpose: Test the EEPROM memory for correct data
                     6166  *            and flag any errors found.
                     6167  *   Input: Accum-B: number of bytes to check (destroyed)
                     6168  *          Reg-X:   Address of first byte (altered)
                     6169  *  Output: Accum-A: Checksum of bytes
                     6170  *          Reg-X:   Address of next byte after last checked
                     6171  *   Notes:
                     6172  * - - - - - - - - - - - - - - - - - - - - - - - - - - - -
313E                 6173  CSUM:        EQU     *
313E [02] 4F         6174        CLRA
                     6175  CS_LP1:
313F [04] AB00       6176        ADDA    0,X      ;Checksum byte
3141 [03] 08         6177        INX              ;point to next byte
3142 [02] 5A         6178        DECB             ;count byte
3143 [03] 26FA       6179        BNE     CS_LP1   ;Branch until done
3145 [05] 39         6180        RTS
                     6181
                     6182  *=====================================================
                     6183  * Name:  ERASE_BLK
                     6184  * Subroutine: Erase a block (32 bytes) of EEPROM memory
                     6185  * Written by: Robert S. Dobrose
                     6186  * Purpose: Erase a given block of EEPROM memory by filling
                     6187  *            each byte with $FF
                     6188  *   Input: Reg-X : Address of block to be erased
                     6189  *  Output: none
                     6190  *   Notes: This routine assumes the block pointer (Reg-X)
                     6191  *            is legitimate!
                     6192  * - - - - - - - - - - - - - - - - - - - - - - - - - - - -
                     6193  ERASE_BLK:
3146                 6194        EQU     *
3146 [03] 36         6195        PSHA
3147 [03] 37         6196        PSHB
3148 [04] 3C         6197        PSHX
3149 [02] 86FF       6198        LDAA    #$FF
314B [02] C620       6199        LDAB    #$20             ; 32 bytes per block
                     6200  EB_LP1:
314D [04] A700       6201        STAA    0,X
314F [03] 08         6202        INX
3150 [02] 5A         6203        DECB
3151 [03] 26FA       6204        BNE     EB_LP1
                     6205        ; Wait for EEPROM to store data
3153 [03] CE0002     6206        LDX     #$2
3156 [06] BD1178     6207        JSR     TIMER
3159 [05] 38         6208        PULX
315A [04] 33         6209        PULB
315B [04] 32         6210        PULA
```

```
315C [05] 39        6211        RTS
                    6212
                    6213  *=====================================================
                    6214  * Name:  CLEAR_BLK
                    6215  * Subroutine: Clear a block (32 bytes) of EEPROM memory
                    6216  * Written by: Robert S. Dobrose
                    6217  * Purpose: Clears a given block of EEPROM memory by
                    6218  *            filling each byte with $0 and setting the
                    6219  *            block type to the pattern in Reg-B then
                    6220  *            creating & storing a checksum value.
                    6221  *   Input: Reg-X : Address of block to be cleared
                    6222  *          Reg-B : block type pattern.
                    6223  *  Output: none
                    6224  *   Notes: This routine assumes the block pointer (Reg-X)
                    6225  *            is legitimate!
                    6226  *          This routine assumes blank (= 0) values for
                    6227  *            all bytes except the block type pattern.
                    6228  *            This means that the checksum will be the
                    6229  *            same as this block type value.
                    6230  * - - - - - - - - - - - - - - - - - - - - - - - - - - - -
                    6231  CLEAR_BLK:
315D                6232        EQU     *
315D [04] 3C        6233        PSHX
315E [03] 36        6234        PSHA
315F [03] 37        6235        PSHB
3160 [02] 4F        6236        CLRA                    ; Set up Reg-D as TYPE/PTR value
3161 [05] ED00      6237        STD     EE_PTR,X
3163 [03] 08        6238        INX                     ; bump address pointer 2 bytes
3164 [03] 08        6239        INX                     ; **
3165 [02] 861D      6240        LDAA    #!29            ; Set up to do 29 more blank bytes
3167 [02] C600      6241        LDAB    #$0
                    6242  CB_LP1:
3169 [04] E700      6243        STAB    0,X
316B [03] 08        6244        INX
316C [02] 4A        6245        DECA
316D [03] 26FA      6246        BNE     CB_LP1
316F [04] 33        6247        PULB                    ; Get saved block type pattern as
checksum
3170 [03] 37        6248        PSHB                    ; Re-save block type
3171 [04] E700      6249        STAB    0,X             ; and save checksum at end of block
                    6250        ; Wait for EEPROM to store data
3173 [04] 3C        6251        PSHX
3174 [03] CE0002    6252        LDX     #$2
3177 [06] BD1178    6253        JSR     TIMER
317A [05] 38        6254        PULX
317B [04] E100      6255        CMPB    0,X
317D [03] 270B      6256        BEQ     CB_SK21
317F [06] BD1403    6257        JSR     TRY_AGAIN
3182 [02] 5D        6258        TSTB
3183 [03] 2705      6259        BEQ     CB_SK21
                    6260        ; We want to try again so reset everything & go to start of
routine.
3185 [04] 33        6261        PULB
3186 [04] 32        6262        PULA
3187 [05] 38        6263        PULX
3188 [03] 20D3      6264        BRA     CLEAR_BLK
                    6265  CB_SK21:
318A [04] 33        6266        PULB
318B [04] 32        6267        PULA
318C [05] 38        6268        PULX
318D [05] 39        6269        RTS
                    6270
                    6271  *=====================================================
                    6272  * Name:  FIND_FREE
                    6273  * Subroutine: Find next free EEPROM block
                    6274  * Written by: Robert S. Dobrose
                    6275  * Purpose: Search the EEPROM memory for the next free block
                    6276  *   Input: none
```

```
                    6277  *  Output: Reg-X = Address of the next free block.
                    6278  *   Notes: A value of $0000 indicates no free blocks.
                    6279  * - - - - - - - - - - - - - - - - - - - - - - - - - - - - -
                    6280  FIND_FREE:
318E                6281       EQU     *
318E [03] 36        6282       PSHA
318F [03] 37        6283       PSHB
3190 [05] 183C      6284       PSHY
3192 [03] CEA000    6285       LDX     #EEPROM
3195 [02] C620      6286       LDAB    #$20            ;Start looking in second block!
                    6287  FF_LP1:
3197 [03] 3A        6288       ABX
3198 [04] 8CDFFF    6289       CPX     #EEPEND         ; Check against end of EEPROM memory
319B [03] 2D05      6290       BLT     FF_SK1
319D [03] CE0000    6291       LDX     #$0000
31A0 [03] 2009      6292       BRA     FF_DONE
                    6293  FF_SK1:
31A2 [06] 1AEE00    6294       LDY     EE_PTR,X
31A5 [05] 188CFFFF  6295       CPY     #$FFFF
31A9 [03] 26EC      6296       BNE     FF_LP1
                    6297  FF_DONE:
31AB [06] 1838      6298       PULY
31AD [04] 33        6299       PULB
31AE [04] 32        6300       PULA
31AF [05] 39        6301       RTS
                    6302
                    6303  *=========================================================
                    6304  * Name:  NEXT_TS
                    6305  * Subroutine: Search memory to find the next TMPR or
                    6306  *                STRCH record
                    6307  * Written by: Robert S. Dobrose
                    6308  * Purpose: Search through memory looking for the next
                    6309  *            TMPR or STRCH record after the current address.
                    6310  *   Input: Reg-X : starting address pointer
                    6311  *          DFLAGS: R bit indicates start is in ROM
                    6312  *  Output: Reg-X = address of the next TMPR or STRCH header block
                    6313  *          DFLAGS: R bit indicates next is in ROM
                    6314  *   Notes: Reg-X will be set to 0 if no file is found
                    6315  *            before the end of memory.
                    6316  * - - - - - - - - - - - - - - - - - - - - - - - - - - - - -
                    6317  NEXT_TS:
31B0                6318       EQU     *
31B0 [03] 36        6319       PSHA
31B1 [03] 37        6320       PSHB
31B2 [06] 13420204  6321       BRCLR   DFLAGS,$02,NXT_SK11
                    6322       ; Search for STRCH
31B6 [02] 8608      6323       LDAA    #TYP_S0
31B8 [03] 200D      6324       BRA     NXT_LP1
                    6325  NXT_SK11:
31BA [06] 13420404  6326       BRCLR   DFLAGS,$04,NXT_SK12
                    6327       ; Search for TMPR
31BE [02] 8607      6328       LDAA    #TYP_T0
31C0 [03] 2005      6329       BRA     NXT_LP1
                    6330  NXT_SK12:
                    6331       ; No flag set!  Error.
31C2 [03] CE0000    6332       LDX     #$0000          ; Search Failed!
31C5 [03] 202C      6333       BRA     NXT_DONE
                    6334  NXT_LP1:
31C7 [02] C620      6335       LDAB    #!32
31C9 [03] 3A        6336       ABX                     ; set pointer to next block
31CA [06] 13428005  6337       BRCLR   DFLAGS,$80,NXT_SK15
31CE [04] 8C7120    6338       CPX     #ROMTS_END
31D1 [03] 2003      6339       BRA     NXT_SK16
                    6340  NXT_SK15:
31D3 [04] 8CDFFF    6341       CPX     #EEPEND         ; are we past end of memory?
                    6342  NXT_SK16:
31D6 [03] 2D06      6343       BLT     NXT_SK21
31D8 [03] CE0000    6344       LDX     #$0000          ; Search Failed!
```

```
31DB [03] 7E31F3    6345        JMP     NXT_DONE        ; Past end!  break out of loop.
                    6346  NXT_SK21:
31DE [04] E601      6347        LDAB    EE_TYPE,X       ; Get block type data
31E0 [02] C1FF      6348        CMPB    #$FF            ; Is block EMPTY?
31E2 [03] 27E3      6349        BEQ     NXT_LP1         ; Empty block.  Do next block.
31E4 [02] C41F      6350        ANDB    #$1F            ; Mask off non-type data
31E6 [02] C101      6351        CMPB    #TYP_SH         ; System Header block.  End of short
memory.
31E8 [03] 2606      6352        BNE     NXT_SK22
31EA [03] CE0000    6353        LDX     #$0000          ; Search Failed!
31ED [03] 7E31F3    6354        JMP     NXT_DONE        ; Past end of short memory!  break out of
loop.
                    6355  NXT_SK22:
31F0 [02] 11        6356        CBA                     ; Is it desired block type?
31F1 [03] 26D4      6357        BNE     NXT_LP1         ; No.  Do next block.
                    6358        ; Reg-X now points to a desired block type.
                    6359  NXT_DONE:
31F3 [04] 33        6360        PULB
31F4 [04] 32        6361        PULA
31F5 [05] 39        6362        RTS
                    6363
                    6364  *=================================================
                    6365  * Name:  PREV_TS
                    6366  * Subroutine: Search memory to find the previous TMPR or
                    6367  *               STRCH record
                    6368  * Written by: Robert S. Dobrose
                    6369  * Purpose: Search through memory looking for the previous
                    6370  *            TMPR or STRCH record before the current address.
                    6371  *   Input: Reg-X : starting address pointer
                    6372  *          DFLAGS: R bit indicates start is in ROM
                    6373  *  Output: Reg-X = address of the previous TMPR or STRCH header block
                    6374  *          DFLAGS: R bit indicates next is in ROM
                    6375  *   Notes: Reg-X will be set to 0 if no file is found
                    6376  *            before the start of memory.
                    6377  * - - - - - - - - - - - - - - - - - - - - - - - - - - -
                    6378  PREV_TS:
31F6                6379        EQU     *
31F6 [03] 36        6380        PSHA
31F7 [03] 37        6381        PSHB
31F8 [06] 13420204  6382        BRCLR   DFLAGS,$02,PRV_SK11
                    6383        ; Search for STRCH
31FC [02] 8608      6384        LDAA    #TYP_S0
31FE [03] 200D      6385        BRA     PRV_LP1
                    6386  PRV_SK11:
3200 [06] 13420404  6387        BRCLR   DFLAGS,$04,PRV_SK12
                    6388        ; Search for TMPR
3204 [02] 8607      6389        LDAA    #TYP_T0
3206 [03] 2005      6390        BRA     PRV_LP1
                    6391  PRV_SK12:
                    6392        ; No flag set!  Error.
3208 [03] CE0000    6393        LDX     #$0000          ; Search Failed!
320B [03] 202E      6394        BRA     PRV_DONE
                    6395  PRV_LP1:
                    6396        ; Get previous block address in Reg-X
320D [03] 8F        6397        XGDX
320E [04] 830020    6398        SUBD    #!32            ; set pointer to prev block
3211 [03] 8F        6399        XGDX
3212 [06] 13428005  6400        BRCLR   DFLAGS,$80,PRV_SK15
3216 [04] 8C7000    6401        CPX     #ROM_TS
3219 [03] 2003      6402        BRA     PRV_SK16
                    6403  PRV_SK15:
321B [04] 8CA000    6404        CPX     #EEPROM         ; are we past start of memory?
                    6405  PRV_SK16:
321E [03] 2C06      6406        BGE     PRV_SK21
3220 [03] CE0000    6407        LDX     #$0000          ; Search Failed!
3223 [03] 7E323B    6408        JMP     PRV_DONE        ; Past start!  break out of loop.
                    6409  PRV_SK21:
3226 [04] E601      6410        LDAB    EE_TYPE,X       ; Get block type data
```

```
3228 [02] C1FF        6411        CMPB    #$FF            ; Is block EMPTY?
322A [03] 27E1        6412        BEQ     PRV_LP1         ; Empty block.  Do next block.
322C [02] C41F        6413        ANDB    #$1F            ; Mask off non-type data
322E [02] C101        6414        CMPB    #TYP_SH         ; System Header block.  Start of memory.
3230 [03] 2606        6415        BNE     PRV_SK22
3232 [03] CE0000      6416        LDX     #$0000          ; Search Failed!
3235 [03] 7E323B      6417        JMP     PRV_DONE        ; Hit start of memory!  break out of
loop.
                      6418  PRV_SK22:
3238 [02] 11          6419        CBA                     ; Is it desired block type?
3239 [03] 26D2        6420        BNE     PRV_LP1         ; No.  Do next block.
                      6421        ; Reg-X now points to a desired block type.
                      6422  PRV_DONE:
323B [04] 33          6423        PULB
323C [04] 32          6424        PULA
323D [05] 39          6425        RTS
                      6426
                      6427  *=====================================================
                      6428  * Name:  FIND_TS
                      6429  * Subroutine: Find a TMPR or STRCH record
                      6430  * Written by: Robert S. Dobrose
                      6431  * Purpose: Search through TMPR or STRCH directory chain
                      6432  *            in EEPROM looking for a match with the name
                      6433  *            pointed to by Reg-Y.
                      6434  *   Input: Reg-Y : address of string containing TMPR/STRCH record
name.
                      6435  *          SFLAGS: RS bit allows search of ROM first
                      6436  *  Output: Reg-X = address of the TMPR or STRCH header block
                      6437  *          PTR1 = address of the TMPR or STRCH header block
                      6438  *          DFLAGS: R bit indicates TMPR or STRCH is in ROM
                      6439  *   Notes:
                      6440  * - - - - - - - - - - - - - - - - - - - - - - - - - - - -
                      6441  FIND_TS:
323E                  6442        EQU     *
323E [03] 37          6443        PSHB
323F [06] 13432008    6444        BRCLR   SFLAGS,$20,FTS_SK10
3243 [03] CE7000      6445        LDX     #ROM_TS
3246 [06] 144280      6446        BSET    DFLAGS,$80
3249 [03] 2006        6447        BRA     FTS_LP2
                      6448  FTS_SK10:
324B [03] CEA000      6449        LDX     #EEPROM
324E [06] 154280      6450        BCLR    DFLAGS,$80
                      6451  FTS_LP2:
3251 [06] BD31B0      6452        JSR     NEXT_TS
3254 [04] 8C0000      6453        CPX     #$0000
                      6454  ;     BEQ     FTS_DONE        ; Hit end of memory.  Return NULL.
3257 [03] 260C        6455        BNE     FTS_SK30
3259 [06] 13428024    6456        BRCLR   DFLAGS,$80,FTS_DONE     ; File not in ROM, done with
search!
325D [03] CEA000      6457        LDX     #EEPROM         ; Set addr to search EEPROM memory
3260 [06] 154280      6458        BCLR    DFLAGS,$80      ; Set flag for EEPROM memory search
3263 [03] 20EC        6459        BRA     FTS_LP2         ; Go to search of EEPROM
                      6460  FTS_SK30:
3265 [04] E61A        6461        LDAB    TS_NOFF,X
3267 [05] 18E100      6462        CMPB    0,Y
326A [03] 26E5        6463        BNE     FTS_LP2
326C [04] E61B        6464        LDAB    TS_NOFF+1,X
326E [05] 18E101      6465        CMPB    1,Y
3271 [03] 26DE        6466        BNE     FTS_LP2
3273 [04] E61C        6467        LDAB    TS_NOFF+2,X
3275 [05] 18E102      6468        CMPB    2,Y
3278 [03] 26D7        6469        BNE     FTS_LP2
327A [04] E61D        6470        LDAB    TS_NOFF+3,X
327C [05] 18E103      6471        CMPB    3,Y
327F [03] 26D0        6472        BNE     FTS_LP2
                      6473  FTS_DONE:
3281 [04] DF51        6474        STX     PTR1
3283 [04] 33          6475        PULB
```

```
3284 [05] 39          6476        RTS
                      6477
                      6478  *=====================================================
                      6479  * Name:  LOOK_TS
                      6480  * Subroutine: Look up the address & data for an entry
                      6481  * Written by: Robert S. Dobrose
                      6482  * Purpose: Finds the currently selected block & data
                      6483  *            slot for the current TMPR or STRCH record
                      6484  *            and returns the address & data value
                      6485  *   Input: PTR1 : ptr to start of TMPR/STRCH record.
                      6486  *          NOTE_OCT : current NOTE/OCTAVE index.
                      6487  *  Output: Reg-X = address of the desired data slot.
                      6488  *          PTR2 = address of the desired data slot.
                      6489  *          Reg-D = data value from selected slot.
                      6490  *   Notes:
                      6491  * - - - - - - - - - - - - - - - - - - - - - - - - - - - -
                      6492  LOOK_TS:
3285                  6493        EQU     *
3285 [05] 183C        6494        PSHY
3287 [02] 4F          6495        CLRA
3288 [02] 5F          6496        CLRB
3289 [03] CE0000      6497        LDX     #$0000
328C [04] DF53        6498        STX     PTR2
328E [04] DE51        6499        LDX     PTR1
3290 [03] 2733        6500        BEQ     LTS_DONE        ; If bad ptr, skip lookup!
                      6501        ; | Add TMPR or STRCH offset for NOTE and/or Octave (if any)
3292 [06] 13420220    6502        BRCLR   DFLAGS,$02,LTS_SK3
                      6503        ; | Stretch active!  Find data & use it.
3296 [03] D647        6504        LDAB    NOTE_OCT
3298 [02] 54          6505        LSRB                    ; Shift Octave data down to lowest bits
3299 [02] 54          6506        LSRB                    ; **
329A [02] 54          6507        LSRB                    ; **
329B [02] 54          6508        LSRB                    ; **
329C [04] 188F        6509        XGDY
                      6510        ; || Find Header block for Stretch specified
329E [03] 2714        6511        BEQ     LTS_SK2         ; Octave is 0, skip block lookup
                      6512        ; || Find EEPROM block for Octave selected
                      6513  LTS_LP:
32A0 [05] EC00        6514        LDD     EE_PTR,X                ; Get block Type/Ptr value
                      6515        ; || *** Compare to limits?? or check for bad values (0 & FFFF)
32A2 [02] C4E0        6516        ANDB    #$E0            ; Mask off low bits (Block Type)
32A4 [05] 1A830000    6517        CPD     #$0
32A8 [03] 2605        6518        BNE     LTS_SK1
32AA [03] CE0000      6519        LDX     #$0             ; Bad next ptr!  Load fault (NULL)
pointer!
32AD [03] 2016        6520        BRA     LTS_DONE
                      6521  LTS_SK1:
32AF [03] 8F          6522        XGDX                    ; Move new pointer to Reg-X
32B0 [04] 1809        6523        DEY                     ; Decrement Block Counter
32B2 [03] 26EC        6524        BNE     LTS_LP          ; Continue until block found
                      6525  LTS_SK2:
32B4 [03] 2004        6526        BRA     LTS_SK4
                      6527  LTS_SK3:
32B6 [06] 1342040B    6528        BRCLR   DFLAGS,$04,LTS_DONE
                      6529        ; | Temerament active!  Find data & use it.
                      6530        ; || Find Header block for Temperament specified
                      6531        ; *** (Already in Reg-X)
                      6532  LTS_SK4:
                      6533        ; || Find data related to IDX1 (current Note)
32BA [03] D647        6534        LDAB    NOTE_OCT        ; Get Note & Octave data
32BC [02] C40F        6535        ANDB    #$0F            ; Mask off non-Note data
                      6536  ; #####  Add in TMPR Key offset here!
32BE [02] 5C          6537        INCB                    ; Skip Type/Ptr data
32BF [02] 58          6538        LSLB                    ; Adjust offset for 2-byte records
32C0 [03] 3A          6539        ABX                     ; Add offset to X-Reg
32C1 [04] DF53        6540        STX     PTR2
                      6541        ; || (Get data in Reg-D)
32C3 [05] EC00        6542        LDD     0,X
```

```
                    LTS_DONE:
32C5 [06] 1838          PULY
32C7 [04] DE53          LDX     PTR2
32C9 [05] 39            RTS

                    *=====================================================
                    * Name:  ERASE_USER
                    * Subroutine: Erase User Memory area of EEPROM
                    * Written by: Robert S. Dobrose
                    * Purpose: Clears all blocks of the EEPROM except the
                    *            header block.
                    *   Input: none
                    *  Output: none
                    *   Notes:
                    * - - - - - - - - - - - - - - - - - - - - - - - - - - -
                    ERASE_USER:
32CA                    EQU     *
32CA [03] CEA000        LDX     #EEPROM         ; Get starting record
                    EU_SK11:
32CD [03] CC0000        LDD     #$0000
32D0 [05] ED08          STD     H_TDIR,X        ; Clear TMPR DIR pointer
32D2 [05] ED0A          STD     H_SDIR,X        ; Clear STRCH DIR pointer
32D4 [05] ED0C          STD     H_QDIR,X        ; Clear SEQ DIR pointer
                        ; Wait for EEPROM to store data
32D6 [04] 3C            PSHX
32D7 [03] CE0002        LDX     #$2
32DA [06] BD1178        JSR     TIMER
32DD [05] 38            PULX
32DE [07] 1AA30C        CPD     H_QDIR,X
32E1 [03] 2706          BEQ     EU_SK12
32E3 [06] BD1403        JSR     TRY_AGAIN
32E6 [02] 5D            TSTB
32E7 [03] 26E4          BNE     EU_SK11
                    EU_SK12:
32E9 [03] CEA000        LDX     #EEPROM
32EC [02] C61F          LDAB    #!31
32EE [06] BD313E        JSR     CSUM
                    EU_SK21:
32F1 [04] A700          STAA    0,X
                        ; Wait for EEPROM to store data
32F3 [04] 3C            PSHX
32F4 [03] CE0002        LDX     #$2
32F7 [06] BD1178        JSR     TIMER
32FA [05] 38            PULX
32FB [04] A100          CMPA    0,X
32FD [03] 2706          BEQ     EU_SK22
32FF [06] BD1403        JSR     TRY_AGAIN
3302 [02] 5D            TSTB
3303 [03] 26EC          BNE     EU_SK21
                    EU_SK22:
3305 [03] CEA000        LDX     #EEPROM         ; Get starting record
3308 [02] C620          LDAB    #!32            ; Get record size
330A [03] 3A            ABX
                    EU_LP1:
330B [06] BD3146        JSR     ERASE_BLK
330E [03] 3A            ABX
330F [04] 8CBFFF        CPX     #EEPSML
3312 [03] 2DF7          BLT     EU_LP1
3314 [04] 18CEA000      LDY     #EEPROM
3318 [06] 18EC00        LDD     EE_PTR,Y
331B [05] 1A830001      CPD     #TYP_SH
331F [03] 2611          BNE     EU_OUT
3321 [05] EC00          LDD     EE_PTR,X
3323 [05] 1A830001      CPD     #TYP_SH
3327 [03] 2709          BEQ     EU_OUT          ; 8K boundary record = header record
                    EU_LP2:
3329 [06] BD3146        JSR     ERASE_BLK
332C [03] 3A            ABX
```

```
332D [04] 8CDFFF    6611        CPX     #EEPEND
3330 [03] 2DF7      6612        BLT     EU_LP2
                    6613  EU_OUT:
3332 [05] 39        6614        RTS
                    6615
                    6616  *=========================================================
                    6617  * Name:  NEW_HEAD
                    6618  * Subroutine: Create new System Header record in EEPROM
                    6619  * Written by: Robert S. Dobrose
                    6620  * Purpose: Loads the System Header block in EEPROM
                    6621  *          with the Factory Default values.
                    6622  *   Input: none
                    6623  *  Output: none
                    6624  *   Notes:
                    6625  * - - - - - - - - - - - - - - - - - - - - - - - - - - - -
                    6626  NEW_HEAD:
3333                6627        EQU     *
3333 [03] CEA000    6628        LDX     #EEPROM         ; Load addr of header
3336 [04] 18CE7000  6629        LDY     #DFLT_HDR       ; Load addr of data
333A [02] C61F      6630        LDAB    #!31            ; Load size of header
333C [06] BD34C5    6631        JSR     ESTORE          ; Store data & checksum
                    6632        ; Wait for EEPROM to store data
333F [03] CE0002    6633        LDX     #$2
3342 [06] BD1178    6634        JSR     TIMER
3345 [05] 39        6635        RTS
                    6636
                    6637  *=========================================================
                    6638  * Name:  SAVE_HEAD
                    6639  * Subroutine: Save current System Header data in EEPROM
                    6640  * Written by: Robert S. Dobrose
                    6641  * Purpose: Saves the current System Header data in EEPROM.
                    6642  *   Input: none
                    6643  *  Output: none
                    6644  *   Notes:
                    6645  * - - - - - - - - - - - - - - - - - - - - - - - - - - - -
                    6646  SAVE_HEAD:
3346                6647        EQU     *
3346 [03] CEA000    6648        LDX     #EEPROM         ; Load addr of header
3349 [03] 9642      6649        LDAA    DFLAGS
334B [02] 84F0      6650        ANDA    #$F0
334D [04] A702      6651        STAA    H_DFLG,X        ; Save DFLAGS
334F [03] 9643      6652        LDAA    SFLAGS
3351 [02] 841F      6653        ANDA    #$1F
3353 [04] A703      6654        STAA    H_SFLG,X        ; Save SFLAGS
3355 [03] 9648      6655        LDAA    CONTRAST
3357 [04] A70C      6656        STAA    H_CONT,X        ; Save CONTRAST value
3359 [03] 9659      6657        LDAA    N_SCAN
335B [04] A704      6658        STAA    H_SCAN,X        ; Save SCAN rate
335D [04] DC5A      6659        LDD     CAL_A
335F [05] ED06      6660        STD     H_CALA,X        ; Save CAL_A rate
                    6661        ; Wait for EEPROM to store data
3361 [04] 3C        6662        PSHX
3362 [03] CE0002    6663        LDX     #$2
3365 [06] BD1178    6664        JSR     TIMER
3368 [05] 38        6665        PULX
3369 [07] 1AA306    6666        CPD     H_CALA,X
336C [03] 2706      6667        BEQ     SVH_SK12
336E [06] BD1403    6668        JSR     TRY_AGAIN
3371 [02] 5D        6669        TSTB
3372 [03] 26D2      6670        BNE     SAVE_HEAD
                    6671  SVH_SK12:
3374 [03] CEA000    6672        LDX     #EEPROM
3377 [02] C61F      6673        LDAB    #!31
3379 [06] BD313E    6674        JSR     CSUM
                    6675  SVH_SK21:
337C [04] A700      6676        STAA    0,X
                    6677        ; Wait for EEPROM to store data
337E [04] 3C        6678        PSHX
```

```
337F [03] CE0002     6679        LDX     #$2
3382 [06] BD1178     6680        JSR     TIMER
3385 [05] 38         6681        PULX
3386 [04] A100       6682        CMPA    0,X
3388 [03] 2706       6683        BEQ     SVH_SK22
338A [06] BD1403     6684        JSR     TRY_AGAIN
338D [02] 5D         6685        TSTB
338E [03] 26EC       6686        BNE     SVH_SK21
                     6687  SVH_SK22:
3390 [05] 39         6688        RTS
                     6689
                     6690  *=====================================================
                     6691  * Name:  GET_HEAD
                     6692  * Subroutine: Get saved data from system header record
                     6693  * Written by: Robert S. Dobrose
                     6694  * Purpose: Check the header record for correct data &
                     6695  *            load the data into the system & flag variables.
                     6696  *   Input: none
                     6697  *  Output: none
                     6698  *   Notes:
                     6699  * - - - - - - - - - - - - - - - - - - - - - - - - - - - -
                     6700  GET_HEAD:
3391                 6701        EQU     *
3391 [03] CEA000     6702        LDX     #EEPROM
3394 [05] EC00       6703        LDD     EE_PTR,X
3396 [05] 1A830001   6704        CPD     #TYP_SH
339A [03] 2620       6705        BNE     GTH_OUT          ; Header type bad.  Skip this!
339C [02] C61F       6706        LDAB    #!31
339E [06] BD313E     6707        JSR     CSUM
33A1 [04] A100       6708        CMPA    0,X
33A3 [03] 2617       6709        BNE     GTH_OUT          ; Checksum bad.  Skip this!
33A5 [03] CEA000     6710        LDX     #EEPROM
33A8 [04] A602       6711        LDAA    H_DFLG,X         ; Get DFLAGS
33AA [03] 9742       6712        STAA    DFLAGS
33AC [04] A603       6713        LDAA    H_SFLG,X         ; Get SFLAGS
33AE [03] 9743       6714        STAA    SFLAGS
33B0 [04] A60C       6715        LDAA    H_CONT,X         ; Get CONTRAST value
33B2 [03] 9748       6716        STAA    CONTRAST
33B4 [04] A604       6717        LDAA    H_SCAN,X         ; Get SCAN rate
33B6 [03] 9759       6718        STAA    N_SCAN
33B8 [05] EC06       6719        LDD     H_CALA,X         ; Get CAL_A rate
33BA [04] DD5A       6720        STD     CAL_A
                     6721  GTH_OUT:
33BC [05] 39         6722        RTS
                     6723
                     6724  *=====================================================
                     6725  * Name:  GET_SER
                     6726  * Subroutine: Get Serial Number from system header record
                     6727  * Written by: Robert S. Dobrose
                     6728  * Purpose: Check the header record for correct data &
                     6729  *            Get a pointer to the Serial Number string.
                     6730  *   Input: none
                     6731  *  Output: Reg-X contains the address of the Serial
                     6732  *            Number string (or NULL if bad)
                     6733  *   Notes:
                     6734  * - - - - - - - - - - - - - - - - - - - - - - - - - - - -
                     6735  GET_SER:
33BD                 6736        EQU     *
33BD [03] CEA000     6737        LDX     #EEPROM
33C0 [05] EC00       6738        LDD     EE_PTR,X
33C2 [05] 1A830001   6739        CPD     #TYP_SH
33C6 [03] 2611       6740        BNE     GTS_BAD          ; Header type bad.  Skip this!
33C8 [02] C61F       6741        LDAB    #!31
33CA [06] BD313E     6742        JSR     CSUM
33CD [04] A100       6743        CMPA    0,X
33CF [03] 2608       6744        BNE     GTS_BAD          ; Checksum bad.  Skip this!
33D1 [03] CEA000     6745        LDX     #EEPROM
33D4 [02] C612       6746        LDAB    #H_SNUM          ; Get SERIAL NUMBER offset
```

```
33D6 [03] 3A        6747        ABX
33D7 [03] 2003      6748        BRA     GTS_OUT
                    6749  GTS_BAD:
33D9 [03] CE0000    6750        LDX     #$0000
                    6751  GTS_OUT:
33DC [05] 39        6752        RTS
                    6753
                    6754  *=========================================================
                    6755  * Name:  ERR_DFLT
                    6756  *        SET_DFLT
                    6757  * Subroutine: Set Factory Defaults Subroutine
                    6758  * Written by: Robert S. Dobrose
                    6759  * Purpose: Set the EEPROM memory to factory default values.
                    6760  *   Input: none
                    6761  *  Output: none
                    6762  *   Notes:  This routine loads EEPROM memory with the
                    6763  *             factory default values and calculates
                    6764  *             checksums for each data block.
                    6765  *           Entry point ERR_DFLT displays the current
                    6766  *             MEM_ERR value for error code before asking
                    6767  *             if defaults should be set.
                    6768  *           Entry point SET_DFLT only asks if defaults
                    6769  *             should be set without displaying the error
                    6770  *             status code.
                    6771  * - - - - - - - - - - - - - - - - - - - - - - - - - - - -
                    6772  ERR_DFLT:
33DD                6773        EQU     *
                    6774        ; display ERROR CODE screen
33DD [03] CE61C3    6775        LDX     #MSG027
33E0 [06] BD12C1    6776        JSR     LINE1
                    6777        ; set cursor position to line 0, column 18
                    6778  ;  Cursor Position : (Line = 0,  column = 18)
33E3 [02] 8600      6779        LDAA    #$0             ; Line 0
33E5 [02] C612      6780        LDAB    #!18            ; Column 18
33E7 [06] BD1309    6781        JSR     DSP_CUR         ; Position Cursor
33EA [02] 4F        6782        CLRA
33EB [03] D640      6783        LDAB    MEM_ERR         ; Load error flags
33ED [06] BD125C    6784        JSR     HEX_DSP         ; Convert to hex
33F0 [03] CE0084    6785        LDX     #D_STR+2        ; Get string pointer to last 2 digits
33F3 [06] BD12BD    6786        JSR     DSP_STR         ; and display code
33F6 [06] BD1331    6787        JSR     WAIT_NONE       ; Wait for no keys pressed
33F9 [03] 2009      6788        BRA     SD_IN1
                    6789
                    6790  SET_DFLT:
33FB                6791        EQU     *
33FB [06] BD1331    6792        JSR     WAIT_NONE       ; Wait for no keys pressed
                    6793        ; display SET DEFAULTS? screen
33FE [03] CE616F    6794        LDX     #MSG023
3401 [06] BD12C1    6795        JSR     LINE1
                    6796  SD_IN1:
3404 [03] CE6184    6797        LDX     #MSG024
3407 [06] BD12C7    6798        JSR     LINE2
340A [03] CE6015    6799        LDX     #MSG0
340D [06] BD12CD    6800        JSR     LINE3
3410 [03] CE607E    6801        LDX     #MSG004
3413 [06] BD12D3    6802        JSR     LINE4
                    6803  SD_LP0:
3416 [06] BD1366    6804        JSR     GET_KEY         ; Get PANEL Inputs
3419 [02] 840F      6805        ANDA    #$0F            ; Mask off all but FUNCTION keys
341B [03] 27F9      6806        BEQ     SD_LP0          ; Branch while no keys hit
                    6807
341D [02] 8501      6808        BITA    #$01            ; Test for F1 key (YES)
341F [03] 2607      6809        BNE     SD_OUT0         ; If F1, branch to continue
                    6810
3421 [02] 8508      6811        BITA    #$08            ; Test for F4 key (NO)
3423 [03] 2701      6812        BEQ     SD_SK01         ; If not F4, continue loop
3425 [05] 39        6813        RTS                     ;   else, Return
                    6814  SD_SK01:
```

```
3426 [03] 20EE       6815        BRA     SD_LP0          ; Loop until Function key is hit
                     6816  SD_OUT0:
3428 [06] BD1331     6817        JSR     WAIT_NONE       ; Wait for no keys pressed
342B macro           6818        SCR     007,0,105,006
342B [03] CE60BD     6819   LDX #MSG%1
342E [06] BD12C1     6820   JSR LINE1
3431 [03] CE6015     6821   LDX #MSG%2
3434 [06] BD12C7     6822   JSR LINE2
3437 [03] CE66AA     6823   LDX #MSG%3
343A [06] BD12CD     6824   JSR LINE3
343D [03] CE60A8     6825   LDX #MSG%4
3440 [06] BD12D3     6826   JSR LINE4
                     6827  SD_LP1:
3443 [06] BD1366     6828        JSR     GET_KEY         ; Get PANEL Inputs
3446 [02] 840F       6829        ANDA    #$0F            ; Mask off all but FUNCTION keys
3448 [03] 27F9       6830        BEQ     SD_LP1          ; Branch while no keys hit
                     6831
344A [02] 8502       6832        BITA    #$02            ; Test for F2 key (YES)
344C [03] 2607       6833        BNE     SD_OUT1         ; If F2, branch to continue
                     6834
344E [02] 8504       6835        BITA    #$04            ; Test for F3 key (NO)
3450 [03] 2701       6836        BEQ     SD_SK11         ; If not F3, continue loop
3452 [05] 39         6837        RTS                     ;   else, Return
                     6838  SD_SK11:
3453 [03] 20EE       6839        BRA     SD_LP1          ; Loop until Function key is hit
                     6840  SD_OUT1:
3455 [03] CE6015     6841        LDX     #MSG0
3458 [06] BD12CD     6842        JSR     LINE3
345B [03] CE61AE     6843        LDX     #MSG026         ; Display "WORKING" message
345E [06] BD12D3     6844        JSR     LINE4
3461 [06] BD32CA     6845        JSR     ERASE_USER
                     6846        ; Check header block for correct type & if not, set DEFAULTS
3464 [03] CEA000     6847        LDX     #EEPROM         ; Load addr of header
3467 [05] EC00       6848        LDD     0,X
3469 [05] 1A830001   6849        CPD     #TYP_SH         ; Is SYS_HDR type O.K.?
346D [03] 2705       6850        BEQ     SD_SK31
346F [06] BD3333     6851        JSR     NEW_HEAD
3472 [03] 2047       6852        BRA     SD_SK42
                     6853  SD_SK31:
                     6854        ; Header Block type is O.K. Do not erase Serial Number!
                     6855        ; Clear directory block pointers in header!
3474 [03] CC0000     6856        LDD     #$0000
3477 [04] A702       6857        STAA    H_DFLG,X        ; Clear DFLAGS
3479 [04] A703       6858        STAA    H_SFLG,X        ; Clear SFLAGS
347B [04] A704       6859        STAA    H_SCAN,X        ; Clear SCAN rate
347D [05] ED08       6860        STD     H_TDIR,X        ; Clear TMPR DIR pointer
347F [05] ED0A       6861        STD     H_SDIR,X        ; Clear STRCH DIR pointer
3481 [05] ED0C       6862        STD     H_QDIR,X        ; Clear SEQ DIR pointer
3483 [02] 8608       6863        LDAA    #$8
3485 [04] A70C       6864        STAA    H_CONT,X
3487 [03] CC01B8     6865        LDD     #!440
348A [05] ED06       6866        STD     H_CALA,X        ; Set CAL_A rate to default
                     6867        ; Wait for EEPROM to store data
348C [04] 3C         6868        PSHX
348D [03] CE0002     6869        LDX     #$2
3490 [06] BD1178     6870        JSR     TIMER
3493 [05] 38         6871        PULX
3494 [07] 1AA306     6872        CPD     H_CALA,X
3497 [03] 2706       6873        BEQ     SD_SK32
3499 [06] BD1403     6874        JSR     TRY_AGAIN
349C [02] 5D         6875        TSTB
349D [03] 26D5       6876        BNE     SD_SK31
                     6877  SD_SK32:
349F [03] CEA000     6878        LDX     #EEPROM
34A2 [02] C61F       6879        LDAB    #!31
34A4 [06] BD313E     6880        JSR     CSUM
                     6881  SD_SK41:
34A7 [04] A700       6882        STAA    0,X
```

```
                    6883        ; Wait for EEPROM to store data
34A9 [04] 3C        6884        PSHX
34AA [03] CE0002    6885        LDX     #$2
34AD [06] BD1178    6886        JSR     TIMER
34B0 [05] 38        6887        PULX
34B1 [04] A100      6888        CMPA    0,X
34B3 [03] 2706      6889        BEQ     SD_SK42
34B5 [06] BD1403    6890        JSR     TRY_AGAIN
34B8 [02] 5D        6891        TSTB
34B9 [03] 26EC      6892        BNE     SD_SK41
                    6893   SD_SK42:
34BB [06] 7F0040    6894        CLR     MEM_ERR         ; Clear all error flags
34BE [03] CE61D8    6895        LDX     #MSG028
34C1 [06] BD12D3    6896        JSR     LINE4
34C4 [05] 39        6897        RTS
                    6898
                    6899
                    6900
                    6901   *=====================================================
                    6902   * Name:  ESTORE
                    6903   * Subroutine: Save a block of bytes to EEPROM with checksum
                    6904   * Written by: Robert S. Dobrose
                    6905   * Purpose: Save a block of data to EEPROM memory, calculate
                    6906   *            checksum while storing and save at end of
                    6907   *            data block.
                    6908   *   Input: Accum-B = Number of bytes to save
                    6909   *          Reg-X   = Address of EEPROM storage
                    6910   *          REG-Y   = Address of data to be stored
                    6911   *  Output: Accum-B : Checksum returned
                    6912   *          Reg-X : Address of next byte after last stored
                    6913   *          REG-Y : Address of next data byte after last read
                    6914   *   Notes: IDX1 is used to count bytes
                    6915   * - - - - - - - - - - - - - - - - - - - - - - - - - - - -
34C5                6916   ESTORE:      EQU     *
34C5 [03] 36        6917        PSHA
34C6 [03] D780      6918        STAB    IDX1            ; Save byte count
34C8 [02] 5F        6919        CLRB                    ; Clear checksum
                    6920   ES_LP1:
34C9 [05] 18EB00    6921        ADDB    0,Y             ; Add new byte to checksum
34CC [05] 18A600    6922        LDAA    0,Y             ; Get new byte data from source
34CF [04] A700      6923        STAA    0,X             ; Store byte at target
34D1 [03] 08        6924        INX                     ; Set new target
34D2 [04] 1808      6925        INY                     ; Set new source
34D4 [06] 7A0080    6926        DEC     IDX1            ; Count byte
34D7 [03] 26F0      6927        BNE     ES_LP1          ; Loop until done
34D9 [04] E700      6928        STAB    0,X             ; Store Checksum in next target byte
34DB [03] 08        6929        INX
34DC [04] 1808      6930        INY
34DE [04] 32        6931        PULA
34DF [05] 39        6932        RTS
                    6933
                    6934   * - - - - - - - - - - - - - - - - - - - - - - - - - - - -
                    6935   * End of MEMORY Subroutines
                    6936   *=====================================================
                    6937
34E0                6938   $INCLUDE 'DEBUG.ASM'            ;Include DEBUG Subroutines
                    6939   *=====================================================*
                    6940   *   Peterson Tuner Debug Subroutines                  *
                    6941   *   Written by: Robert S. Dobrose                     *
                    6942   *   Saracon, Inc.                                     *
                    6943   *     1135 Garfield Ave.                              *
                    6944   *     Libertyville, IL  60048                         *
                    6945   *=====================================================*
                    6946   *   Release History                                   *
                    6947   *   01/20/95  1.0  - Initial Code                     *
                    6948   *=====================================================*
                    6949
                    6950
```

```
                    6951  *=====================================================
                    6952  * Name:  NO_IMP
                    6953  * Subroutine: "FEATURE NOT IMPLEMENTED" screen
                    6954  * Written by: Robert S. Dobrose
                    6955  * Purpose: Displays the "FEATURE NOT IMPLEMENTED" screen
                    6956  *            and waits for MODE key input.
                    6957  *          The routine then returns to the calling routine.
                    6958  *   Input: none
                    6959  *  Output: none
                    6960  *   Notes:  This routine is used to indicate a menu or
                    6961  *             feature that is currently not implemented.
                    6962  * - - - - - - - - - - - - - - - - - - - - - - - - - - - -
                    6963  NO_IMP:
34E0                6964       EQU     *
34E0 [03] CE7C70    6965       LDX     #X_MSG1          ;Load NOT NOW message
34E3 [06] BD12C1    6966       JSR     LINE1
34E6 [03] CE7C85    6967       LDX     #X_MSG2
34E9 [06] BD12C7    6968       JSR     LINE2
34EC [03] CE7C9A    6969       LDX     #X_MSG3
34EF [06] BD12CD    6970       JSR     LINE3
34F2 [03] CE7CAF    6971       LDX     #X_MSG4
34F5 [06] BD12D3    6972       JSR     LINE4
34F8 [06] BD1331    6973       JSR     WAIT_NONE        ; Wait for no keys pressed
                    6974
                    6975  NOI_LP1:
34FB [06] BD1366    6976       JSR     GET_KEY          ; Get PANEL Inputs
34FE [02] 841F      6977       ANDA    #$1F             ; Mask off JOG keys
3500 [03] 27F9      6978       BEQ     NOI_LP1          ; Branch while no keys hit
                    6979
3502 [05] 39        6980       RTS
                    6981
                    6982  * - - - - - - - - - - - - - - - - - - - - - - - - - - - -
                    6983
                    6984  *=====================================================
                    6985  * Name:  TEST_SHOW
                    6986  * Subroutine: Data (EEPROM) memory dump routine
                    6987  * Written by: Robert S. Dobrose
                    6988  * Purpose: Displays the Address and Value of (EEPROM) memory.
                    6989  *            MODE key exits routine.
                    6990  *            Function Keys change address being displayed.
                    6991  *   Input: none
                    6992  *  Output: none
                    6993  *   Notes:  This routine is used to display the value of
                    6994  *             a single location of (EEPROM) memory.
                    6995  *             The Address is shown on the first line.
                    6996  *             The Value of that address location is
                    6997  *             shown on the second line.
                    6998  *           F1   : Decrements address by 16 ($10 hex)
                    6999  *           F2   : Decrements address by 1
                    7000  *           F3   : Increments address by 1
                    7001  *           F4   : Increments address by 16 ($10 hex)
                    7002  *           MODE : Exits routine (returns)
                    7003  * - - - - - - - - - - - - - - - - - - - - - - - - - - - -
                    7004  TEST_SHOW:
3503                7005       EQU     *
3503 [03] CE7C07    7006       LDX     #CLR_MSG
3506 [06] BD12C1    7007       JSR     LINE1
3509 [03] CE7C07    7008       LDX     #CLR_MSG
350C [06] BD12C7    7009       JSR     LINE2
350F [03] CE7C07    7010       LDX     #CLR_MSG
3512 [06] BD12CD    7011       JSR     LINE3
3515 [03] CE7CAF    7012       LDX     #X_MSG4
3518 [06] BD12D3    7013       JSR     LINE4
351B [06] BD1331    7014       JSR     WAIT_NONE        ; Wait for no keys pressed
                    7015
351E [03] CEA000    7016       LDX     #EEPROM          ; Load test addr #####
                    7017  TTT_LP1:
3521 [06] BD1331    7018       JSR     WAIT_NONE        ; Wait for no keys pressed
```

```
3524 [04] 3C        7019        PSHX
3525 [03] 8F        7020        XGDX
3526 [06] BD125C    7021        JSR     HEX_DSP
3529 [03] CE0082    7022        LDX     #D_STR
352C [06] BD12C1    7023        JSR     LINE1
352F [05] 38        7024        PULX
3530 [04] 3C        7025        PSHX
3531 [02] 4F        7026        CLRA
3532 [04] E600      7027        LDAB    0,X
3534 [06] BD125C    7028        JSR     HEX_DSP
3537 [03] CE0082    7029        LDX     #D_STR
353A [06] BD12C7    7030        JSR     LINE2
353D [05] 38        7031        PULX
                    7032  TTT_LP2:
353E [06] BD1366    7033        JSR     GET_KEY         ; Get PANEL Inputs
3541 [02] 841F      7034        ANDA    #$1F            ; Mask off JOG keys
3543 [03] 27F9      7035        BEQ     TTT_LP2         ; Branch while no keys hit
                    7036
3545 [02] 8110      7037        CMPA    #$10            ; MODE key hit
3547 [03] 2726      7038        BEQ     TTT_OUT
                    7039
3549 [02] 8101      7040        CMPA    #$1             ; F1 key hit
354B [03] 2607      7041        BNE     TTT_SK1
354D [03] 8F        7042        XGDX
354E [04] 830010    7043        SUBD    #$10            ; Decrement addr by 16
3551 [03] 8F        7044        XGDX
3552 [03] 20CD      7045        BRA     TTT_LP1
                    7046  TTT_SK1:
3554 [02] 8102      7047        CMPA    #$2             ; F2 key hit
3556 [03] 2603      7048        BNE     TTT_SK2
3558 [03] 09        7049        DEX
3559 [03] 20C6      7050        BRA     TTT_LP1
                    7051  TTT_SK2:
355B [02] 8104      7052        CMPA    #$4             ; F3 key hit
355D [03] 2603      7053        BNE     TTT_SK3
355F [03] 08        7054        INX
3560 [03] 20BF      7055        BRA     TTT_LP1
                    7056  TTT_SK3:
3562 [02] 8108      7057        CMPA    #$8             ; F4 key hit
3564 [03] 2607      7058        BNE     TTT_SK4
3566 [03] 8F        7059        XGDX
3567 [04] C30010    7060        ADDD    #$10            ; Increment addr by 16
356A [03] 8F        7061        XGDX
356B [03] 20B4      7062        BRA     TTT_LP1
                    7063  TTT_SK4:
356D [03] 20B2      7064        BRA     TTT_LP1
                    7065
                    7066  TTT_OUT:
356F [05] 39        7067        RTS
                    7068
                    7069  * - - - - - - - - - - - - - - - - - - - - - - - - - - - - - -
                    7070  * End of MAINT Subroutines
                    7071  *=====================================================
                    7072
3570                7073  $INCLUDE 'SPISUBR.ASM'          ;Include SPI Subroutines
3570                7074  $base 10T
3570                7075  $pagewidth 132
                    7076  *=====================================================*
                    7077  *   Peterson Tuner: SPI Subroutines                   *
                    7078  *   Rev. 1.0 - 03/04/95                               *
                    7079  *   Written by  Robert S. Dobrose                     *
                    7080  *   Saracon, Inc.                                     *
                    7081  *     1135 Garfield Ave.                              *
                    7082  *     Libertyville, IL  60048                         *
                    7083  *=====================================================*
                    7084  *   Release History                                   *
                    7085  *   03/04/95  0.1 - Initial code revision             *
                    7086  *=====================================================*
```

```
                    7087
                    7088
                    7089  *=====================================================
                    7090  * Name:  SPI_SEND
                    7091  * Subroutine: SPI Transmission Subroutine
                    7092  * Written by: Robert S. Dobrose
                    7093  * Purpose: This subroutine transmits a new velocity value
                    7094  *            to the MCS sub-system.
                    7095  *   Input: Reg-A contains the number of the MCS unit to
                    7096  *            communicate with.
                    7097  *          Reg-X contains a pointer to the velocity value
                    7098  *            to be transmitted.
                    7099  *  Output: NONE
                    7100  *   Notes: Value in X-Reg is destroyed
                    7101  * - - - - - - - - - - - - - - - - - - - - - - - - - - -
                    7102
                    7103  SPI_SEND:
3570                7104       EQU     *
3570 [03] 36        7105       PSHA
3571 [03] 37        7106       PSHB
3572 [05] 183C      7107       PSHY
3574 [02] C60E      7108       LDAB    #$0E            ; New veloc xmit start
3576 [06] BD35B8    7109       JSR     SPI_DLY
3579 [04] E600      7110       LDAB    0,X             ; Load MSB of veloc
357B [02] 58        7111       LSLB
357C [02] 58        7112       LSLB
357D [02] 58        7113       LSLB
357E [02] 58        7114       LSLB
357F [06] BD35B8    7115       JSR     SPI_DLY
3582 [04] E600      7116       LDAB    0,X             ; Load MSB of veloc
3584 [02] C4F0      7117       ANDB    #$F0            ; Mask off low nibble
3586 [02] CA01      7118       ORAB    #$01            ; Set command to MSB, High Nibble
3588 [06] BD35B8    7119       JSR     SPI_DLY
358B [04] E601      7120       LDAB    1,X             ; Load 2nd byte of veloc
358D [02] 58        7121       LSLB
358E [02] 58        7122       LSLB
358F [02] 58        7123       LSLB
3590 [02] 58        7124       LSLB
3591 [02] CA02      7125       ORAB    #$02            ; Set command to 2nd byte, Low nibble
3593 [06] BD35B8    7126       JSR     SPI_DLY
3596 [04] E601      7127       LDAB    1,X             ; Load 2nd byte of veloc
3598 [02] C4F0      7128       ANDB    #$F0            ; Mask off low nibble
359A [02] CA03      7129       ORAB    #$03            ; Set command to 2nd byte, High Nibble
359C [06] BD35B8    7130       JSR     SPI_DLY
359F [04] E602      7131       LDAB    2,X             ; Load LSB of veloc
35A1 [02] 58        7132       LSLB
35A2 [02] 58        7133       LSLB
35A3 [02] 58        7134       LSLB
35A4 [02] 58        7135       LSLB
35A5 [02] CA04      7136       ORAB    #$04            ; Set command to LSB, Low nibble
35A7 [06] BD35B8    7137       JSR     SPI_DLY
35AA [04] E602      7138       LDAB    2,X             ; Load LSB of veloc
35AC [02] C4F0      7139       ANDB    #$F0            ; Mask off low nibble
35AE [02] CA05      7140       ORAB    #$05            ; Set command to LSB, High Nibble
35B0 [06] BD35B8    7141       JSR     SPI_DLY
                    7142
35B3 [06] 1838      7143       PULY
35B5 [04] 33        7144       PULB
35B6 [04] 32        7145       PULA
35B7 [05] 39        7146       RTS
                    7147
                    7148  *=====================================================
                    7149  * Subroutine: SPI_DLY
                    7150  * Purpose: SPI Delay routine
                    7151  *   Input: Reg-A = Slave select number
                    7152  *          Reg-B = Data byte to be sent
                    7153  *  Output: Reg-B = Feedback return from Slave
                    7154  *   Notes: short delay for SPI transmit (~150 usec)
```

```
                    7155  * - - - - - - - - - - - - - - - - - - - - - - - - - - - - - -
                    7156
                    7157  SPI_DLY:
35B8                7158       EQU     *
35B8 [05] 183C      7159       PSHY
35BA [04] B7E005    7160       STAA    MCS_SEL          ; Select MCS device
35BD [03] D72A      7161       STAB    SPDR             ; put in SPI data reg
                    7162  SDL_LP1:
35BF [06] 132980FC  7163       BRCLR   SPSR,$80,SDL_LP1         ; Wait until SPIF is set
35C3 [03] D62A      7164       LDAB    SPDR                     ; Get feedback data
                    7165       ; (At present, this data is not used.)
35C5 [06] 7FE005    7166       CLR     MCS_SEL          ; De-Select MCS device
35C8 [04] 18CE002B  7167       LDY     #$002B                   ; Then wait a time delay
                    7168  SDL_LP2:
35CC [04] 1809      7169       DEY
35CE [03] 26FC      7170       BNE     SDL_LP2
35D0 [06] 1838      7171       PULY
35D2 [05] 39        7172       RTS
                    7173
                    7174  * - - - - - - - - - - - - - - - - - - - - - - - - - - - - - -
                    7175  * End of SPI Subroutines
                    7176  *=====================================================
                    7177
                    7178
                    7179  * - - - - - - - - - - - - - - - - - - - - - - - - - - - - - -
                    7180  * End of Subroutine INCLUDES
                    7181  *=====================================================
                    7182
35D3                7183  $INCLUDE 'SCREEN.ASM'           ;Include Message Screen Data
6000                7184       ORG     MESSAGES
                    7185
6000      52455620  7186  MSGREV        FCB    'REV 1.01 on 07/03/96'
          312E3031
          206F6E20
          30372F30
          332F3936
6014      00        7187                FCB    $00
6015      20202020  7188  MSG0          FCB    '                    '
          20202020
          20202020
          20202020
          20202020
6029      00        7189                FCB    $00
602A      20202A2A  7190  MSG1          FCB    '  *** WAITING ***   '
          2A205741
          4954494E
          47202A2A
          2A202020
603E      00        7191                FCB    $00
603F      20202020  7192  MSG001        FCB    '      PETERSON      '
          20205045
          54455253
          4F4E2020
          20202020
6053      00        7193                FCB    $00
6054      204D4F44  7194  MSG002        FCB    ' MODEL SC5000 TUNER '
          454C2053
          43353030
          30205455
          4E455220
6068      00        7195                FCB    $00
6069      53455249  7196  MSG003        FCB    'SERIAL # x          '
          414C2023
          20782020
          20202020
          20202020
607D      00        7197                FCB    $00
607E      59455320  7198  MSG004        FCB    'YES              NO '
```

```
        20202020
        20202020
        20202020
        204E4F20
6092    00          7199                FCB    $00
6093    20205553    7200  MSG005        FCB    '  USER MEMORY FULL  '
        4552204D
        454D4F52
        59204655
        4C4C2020
60A7    00          7201                FCB    $00
60A8    20202020    7202  MSG006        FCB    '     YES   NO       '
        20594553
        2020204E
        4F202020
        20202020
60BC    00          7203                FCB    $00
60BD    45524153    7204  MSG007        FCB    'ERASE SYSTEM MEMORY '
        45205359
        5354454D
        204D454D
        4F525920
60D1    00          7205                FCB    $00
60D2    4B45593D    7206  MSG011        FCB    'KEY= xx             '
        20787820
        20202020
        20202020
        20202020
60E6    00          7207                FCB    $00
60E7    20202020    7208  MSG012        FCB    '              +xx.x'
        20202020
        20202020
        20202B78
        782E78
60FA    EC          7209          FCB    $EC                  ; This is a "cent" symbol
60FB    00          7210                FCB    $00
60FC    20202020    7211  MSG013        FCB    '     A=440          '
        20413D34
        34302020
        20202020
        20202020
6110    00          7212                FCB    $00
6111    53455455    7213  MSG014        FCB    'SETUP IMAG          '
        5020494D
        41472020
        20202020
        20202020
6125    00          7214                FCB    $00
6126    4F43542D    7215  MSG015        FCB    'OCT- OCT+'
        204F4354
        2B
612F    00          7216                FCB    $00
6130    20202020    7217  MSG020        FCB    '     SETUP MENU     '
        20534554
        5550204D
        454E5520
        20202020
6144    00          7218                FCB    $00
6145    20504C45    7219  MSG021        FCB    ' PLEASE SELECT MODE '
        41534520
        53454C45
        4354204D
        4F444520
6159    00          7220                FCB    $00
615A    4F50544E    7221  MSG022        FCB    'OPTN FILE  RUN  DIAG'
        2046494C
        45202052
        554E2020
```

```
         44494147
616E     00        7222                FCB    $00
616F     20202044  7223  MSG023        FCB    '   DO YOU WISH TO   '
         4F20594F
         55205749
         53482054
         4F202020
6183     00        7224                FCB    $00
6184     20455241  7225  MSG024        FCB    ' ERASE USER MEMORY? '
         53452055
         53455220
         4D454D4F
         52593F20
6198     00        7226                FCB    $00
6199     20202053  7227  MSG025        FCB    '   SYSTEM VALUES?   '
         59535445
         4D205641
         4C554553
         3F202020
61AD     00        7228                FCB    $00
61AE     20202A2A  7229  MSG026        FCB    '  *** WORKING ***   '
         2A20574F
         524B494E
         47202A2A
         2A202020
61C2     00        7230                FCB    $00
61C3     4D454D4F  7231  MSG027        FCB    'MEMORY ERROR CODE xx'
         52592045
         52524F52
         20434F44
         45207878
61D7     00        7232                FCB    $00
61D8     2020203D  7233  MSG028        FCB    '   ==== DONE ====   '
         3D3D3D20
         444F4E45
         203D3D3D
         3D202020
61EC     00        7234                FCB    $00
61ED     45524153  7235  MSG029        FCB    'ERASING USER MEMORY '
         494E4720
         55534552
         204D454D
         4F525920
6201     00        7236                FCB    $00
6202     20545552  7237  MSG030        FCB    ' TURN AUTO SEQUENCE '
         4E204155
         544F2053
         45515545
         4E434520
6216     00        7238                FCB    $00
6217     4F46462F  7239  MSG031        FCB    'OFF/ON? (NOW - xxx) '
         4F4E3F20
         284E4F57
         202D2078
         78782920
622B     00        7240                FCB    $00
622C     4E455854  7241  MSG032        FCB    'NEXT  RUN  OFF    ON'
         20205255
         4E20204F
         46462020
         20204F4E
6240     00        7242                FCB    $00
6241     4E455854  7243  MSG033        FCB    'NEXT       OFF    ON'
         20202020
         2020204F
         46462020
         20204F4E
6255     00        7244                FCB    $00
```

```
6256    4F4E20     7245  MSG034    FCB   'ON '
6259    00         7246            FCB   $00
625A    4F4646     7247  MSG035    FCB   'OFF'
625D    00         7248            FCB   $00
625E    20202054   7249  MSG037    FCB   '   TURN AUTO-NOTE   '
        55524E20
        4155544F
        2D4E4F54
        45202020
6272    00         7250            FCB   $00
6273    5455524E   7251  MSG038    FCB   'TURN BATTERY OPTION '
        20424154
        54455259
        204F5054
        494F4E20
6287    00         7252            FCB   $00
6288    20204348   7253  MSG040    FCB   '  CHANGE NOTE SCAN  '
        414E4745
        204E4F54
        45205343
        414E2020
629C    00         7254            FCB   $00
629D    53504545   7255  MSG041    FCB   'SPEED?  NOW = xx SEC'
        443F2020
        4E4F5720
        3D207878
        20534543
62B1    00         7256            FCB   $00
62B2    4E455854   7257  MSG042    FCB   'NEXT  RUN   SLO  FST'
        20205255
        4E202020
        534C4F20
        20465354
62C6    00         7258            FCB   $00
62C7    53455420   7259  MSG045    FCB   'SET IMAGE CLARIFIER '
        494D4147
        4520434C
        41524946
        49455220
62DB    00         7260            FCB   $00
62DC    4C4F572F   7261  MSG046    FCB   'LOW/HI? (NOW - xxx) '
        48493F20
        284E4F57
        202D2078
        78782920
62F0    00         7262            FCB   $00
62F1    4E455854   7263  MSG047    FCB   'NEXT  RUN  LOW   HI '
        20205255
        4E20204C
        4F572020
        20484920
6305    00         7264            FCB   $00
6306    4C4F57     7265  MSG048    FCB   'LOW'
6309    00         7266            FCB   $00
630A    484920     7267  MSG049    FCB   'HI '
630D    00         7268            FCB   $00
630E    20524543   7269  MSG050    FCB   ' RECALIBRATE TUNER? '
        414C4942
        52415445
        2054554E
        45523F20
6322    00         7270            FCB   $00
6323    20202020   7271  MSG051    FCB   '    NOW  A= xxx     '
        4E4F5720
        20413D20
        78787820
        20202020
6337    00         7272            FCB   $00
```

```
6338    4E455854  7273  MSG052    FCB   'NEXT  RUN  DOWN  UP '
        20205255
        4E202044
        4F574E20
        20555020
634C    00        7274            FCB   $00
634D    2020434F  7275  MSG053    FCB   '  CONTRAST ADJUST   '
        4E545241
        53542041
        444A5553
        54202020
6361    00        7276            FCB   $00
6362    20202043  7277  MSG054    FCB   '   CONTRAST = xx    '
        4F4E5452
        41535420
        3D207878
        20202020
6376    00        7278            FCB   $00
6377    20205354  7279  MSG055    FCB   '  STORE VALUES IN   '
        4F524520
        56414C55
        45532049
        4E202020
638B    00        7280            FCB   $00
638C    20202020  7281  MSG056    FCB   '      MEMORY?       '
        20204D45
        4D4F5259
        3F202020
        20202020
63A0    00        7282            FCB   $00
63A1    204E4F20  7283  MSG057    FCB   ' NO   YES  RUN      '
        20205945
        53202052
        554E2020
        20202020
63B5    00        7284            FCB   $00
63B6    4E455854  7285  MSG058    FCB   'NEXT  RUN  DOWN  UP '
        20205255
        4E202044
        4F574E20
        20555020
63CA    00        7286            FCB   $00
63CB    20204449  7287  MSG060    FCB   '  DIAGNOSTIC MENU   '
        41474E4F
        53544943
        204D454E
        55202020
63DF    00        7288            FCB   $00
63E0    53454C46  7289  MSG061    FCB   'SELF  OSC           '
        20204F53
        43202020
        20202020
        20202020
63F4    00        7290            FCB   $00
63F5    54455354  7291  MSG062    FCB   'TEST  TEST RUN SETUP'
        20205445
        53542052
        554E2053
        45545550
6409    00        7292            FCB   $00
640A    20202020  7293  MSG063    FCB   '    SYSTEM IS OK    '
        53595354
        454D2049
        53204F4B
        20202020
641E    00        7294            FCB   $00
641F    20202050  7295  MSG064    FCB   '   PRESS ENTER TO   '
        52455353
```

```
         20454E54
         45522054
         4F202020
6433     00          7296                FCB    $00
6434     20202020    7297  MSG065        FCB    '      CONTINUE      '
         2020434F
         4E54494E
         55452020
         20202020
6448     00          7298                FCB    $00
6449     20204552    7299  MSG066        FCB    '  ERROR CODE - XXX  '
         524F5220
         434F4445
         202D2058
         58582020
645D     00          7300                FCB    $00
645E     50524553    7301  MSG067        FCB    'PRESS ENTER TO TEST '
         5320454E
         54455220
         544F2054
         45535420
6472     00          7302                FCB    $00
6473     41474149    7303  MSG068        FCB    'AGAIN - PLEASE CHECK'
         4E202D20
         504C4541
         53452043
         4845434B
6487     00          7304                FCB    $00
6488     20494E53    7305  MSG069        FCB    ' INSTRUCTION MANUAL '
         54525543
         54494F4E
         204D414E
         55414C20
649C     00          7306                FCB    $00
649D     20504C45    7307  MSG070        FCB    ' PLEASE REMOVE ALL  '
         41534520
         52454D4F
         56452041
         4C4C2020
64B1     00          7308                FCB    $00
64B2     20415544    7309  MSG071        FCB    ' AUDIO INPUTS THEN  '
         494F2049
         4E505554
         53205448
         454E2020
64C6     00          7310                FCB    $00
64C7     20202050    7311  MSG072        FCB    '   PRESS ENTER TO   '
         52455353
         20454E54
         45522054
         4F202020
64DB     00          7312                FCB    $00
64DC     20205045    7313  MSG073        FCB    '  PERFORM THE TEST  '
         52464F52
         4D205448
         45205445
         53542020
64F0     00          7314                FCB    $00
64F1     20202020    7315  MSG074        FCB    '     OSCILLATOR     '
         204F5343
         494C4C41
         544F5220
         20202020
6505     00          7316                FCB    $00
6506     20205445    7317  MSG075        FCB    '  TEST IN PROGRESS  '
         53542049
         4E205052
         4F475245
```

```
        53532020
651A    00          7318                FCB    $00
651B    20202020    7319  MSG076        FCB    '        STOP        '
        20202020
        53544F50
        20202020
        20202020
652F    00          7320                FCB    $00
6530    544D5052    7321  MSG080        FCB    'TMPR STRCH     SETUP'
        20535452
        43482020
        20202053
        45545550
6544    00          7322                FCB    $00
6545    544D5052    7323  MSG081        FCB    'TMPR STRCH SEQ SETUP'
        20535452
        43482053
        45512053
        45545550
6559    00          7324                FCB    $00
655A    20202020    7325  MSG082        FCB    '     FILE MENU      '
        2046494C
        45204D45
        4E552020
        20202020
656E    00          7326                FCB    $00
656F    20202053    7327  MSG090        FCB    '   SEQUENCE MENU    '
        45515545
        4E434520
        4D454E55
        20202020
6583    00          7328                FCB    $00
6584    53544152    7329  MSG091        FCB    'START COPY          '
        5420434F
        50592020
        20202020
        20202020
6598    00          7330                FCB    $00
6599    2D454449    7331  MSG092        FCB    '-EDIT -DEL  RUN STOP'
        54202D44
        454C2020
        52554E20
        53544F50
65AD    00          7332                FCB    $00
65AE    5049434B    7333  MSG093        FCB    'PICK NAME - ABCDEFGH'
        204E414D
        45202D20
        41424344
        45464748
65C2    00          7334                FCB    $00
65C3    494A4B4C    7335  MSG094        FCB    'IJKLMNOPQRSTUVWXYZ01'
        4D4E4F50
        51525354
        55565758
        595A3031
65D7    00          7336                FCB    $00
65D8    32333435    7337  MSG095        FCB    '23456789    SEQ=____'
        36373839
        20202020
        5345513D
        5F5F5F5F
65EC    00          7338                FCB    $00
65ED    203C2D2D    7339  MSG096        FCB    ' <--  -->  BKSP CNCL'
        20202D2D
        3E202042
        4B535020
        434E434C
6601    00          7340                FCB    $00
```

```
6602    54484520  7341  MSG097    FCB   'THE NAME CHOSEN FOR '
        4E414D45
        2043484F
        53454E20
        464F5220
6616    00        7342            FCB   $00
6617    20202020  7343  MSG098    FCB   '    SEQ IS: ____    '
        53455120
        49533A20
        5F5F5F5F
        20202020
662B    00        7344            FCB   $00
662C    5245444F  7345  MSG099    FCB   'REDO  OK   CNCL     '
        20204F4B
        20202043
        4E434C20
        20202020
6640    00        7346            FCB   $00
6641    20202020  7347  MSG100    FCB   '     SEQ= xxxx      '
        20534551
        3D207878
        78782020
        20202020
6655    00        7348            FCB   $00
6656    20202041  7349  MSG101    FCB   '   ALREADY EXISTS   '
        4C524541
        44592045
        58495354
        53202020
666A    00        7350            FCB   $00
666B    20202020  7351  MSG102    FCB   '                 NO '
        20202020
        20202020
        20202020
        204E4F20
667F    00        7352            FCB   $00
6680    45444954  7353  MSG103    FCB   'EDIT  DEL  RUN  CHNG'
        20204445
        4C202052
        554E2020
        43484E47
6694    00        7354            FCB   $00
6695    20204445  7355  MSG104    FCB   '  DELETE SEQ= xxxx  '
        4C455445
        20534551
        3D207878
        78782020
66A9    00        7356            FCB   $00
66AA    20202041  7357  MSG105    FCB   '   ARE YOU SURE?    '
        52452059
        4F552053
        5552453F
        20202020
66BE    00        7358            FCB   $00
66BF    59455320  7359  MSG106    FCB   'YES   NO            '
        20204E4F
        20202020
        20202020
        20202020
66D3    00        7360            FCB   $00
66D4    5345513D  7361  MSG107    FCB   'SEQ= xxxx   NOTE= xx'
        20787878
        78202020
        4E4F5445
        3D207878
66E8    00        7362            FCB   $00
66E9    20205345  7363  MSG108    FCB   '  SELECT NOTE - __  '
        4C454354
```

```
        204E4F54
        45202D20
        5F5F2020
66FD    00          7364                FCB    $00
66FE    4E455854    7365  MSG109        FCB    'NEXT            DONE'
        20202020
        20202020
        20202020
        444F4E45
6712    00          7366                FCB    $00
6713    5345513D    7367  MSG110        FCB    'SEQ= xx xx xx xx xx '
        20787820
        78782078
        78207878
        20787820
6727    00          7368                FCB    $00
6728    20202020    7369  MSG111        FCB    '     xx xx xx xx xx '
        20787820
        78782078
        78207878
        20787820
673C    00          7370                FCB    $00
673D    204F4B20    7371  MSG112        FCB    ' OK  CHNG           '
        2043484E
        47202020
        20202020
        20202020
6751    00          7372                FCB    $00
6752    20205345    7373  MSG115        FCB    '  SEQ'
        51
6757    00          7374                FCB    $00
6758    20544D50    7375  MSG116        FCB    ' TMPR'
        52
675D    00          7376                FCB    $00
675E    53545243    7377  MSG117        FCB    'STRCH'
        48
6763    00          7378                FCB    $00
6764    20202020    7379  MSG120        FCB    '    DELETE SEQ=     '
        44454C45
        54452053
        45513D20
        20202020
6778    00          7380                FCB    $00
6779    78787878    7381  MSG121        FCB    'xxxx xxxx xxxx xxxx '
        20787878
        78207878
        78782078
        78787820
678D    00          7382                FCB    $00
678E    20202020    7383  MSG123        FCB    '    SELECT SEQ=     '
        53454C45
        43542053
        45513D20
        20202020
67A2    00          7384                FCB    $00
67A3    20202020    7385  MSG124        FCB    '     NO ENTRIES     '
        204E4F20
        454E5452
        49455320
        20202020
67B7    00          7386                FCB    $00
67B8    20202050    7387  MSG125        FCB    '   PRESS ANY KEY    '
        52455353
        20414E59
        204B4559
        20202020
67CC    00          7388                FCB    $00
67CD    20202020    7389  MSG126        FCB    '    TO CONTINUE     '
```

```
        544F2043
        4F4E5449
        4E554520
        20202020
67E1    00          7390                FCB    $00
67E2    4E455720    7391  MSG127        FCB    'NEW  EDIT CNCL START'
        20454449
        5420434E
        434C2053
        54415254
67F6    00          7392                FCB    $00
67F7    20202020    7393  MSG128        FCB    '          CNCL  SLCT'
        20202020
        2020434E
        434C2020
        534C4354
680B    00          7394                FCB    $00
680C    4E455720    7395  MSG129        FCB    'NEW       CNCL START'
        20202020
        2020434E
        434C2053
        54415254
6820    00          7396                FCB    $00
6821    20205445    7397  MSG130        FCB    '  TEMPERAMENT MENU  '
        4D504552
        414D454E
        54204D45
        4E552020
6835    00          7398                FCB    $00
6836    32333435    7399  MSG131        FCB    '23456789   TMPR=____'
        36373839
        20202054
        4D50523D
        5F5F5F5F
684A    00          7400                FCB    $00
684B    20202054    7401  MSG132        FCB    '   TMPR IS: ____    '
        4D505220
        49533A20
        5F5F5F5F
        20202020
685F    00          7402                FCB    $00
6860    20202020    7403  MSG133        FCB    '    TMPR= xxxx      '
        544D5052
        3D207878
        78782020
        20202020
6874    00          7404                FCB    $00
6875    20204445    7405  MSG134        FCB    '  DELETE TMPR= xxxx '
        4C455445
        20544D50
        523D2078
        78787820
6889    00          7406                FCB    $00
688A    5049434B    7407  MSG135        FCB    'PICK KEY  TMPR= xxxx'
        204B4559
        2020544D
        50523D20
        78787878
689E    00          7408                FCB    $00
689F    2020204B    7409  MSG136        FCB    '   KEY= C  Bb F  Eb '
        45593D20
        43202042
        62204620
        20456220
68B3    00          7410                FCB    $00
68B4    20202020    7411  MSG137        FCB    '    DELETE TMPR=    '
        44454C45
        54452054
```

```
        4D50523D
        20202020
68C8    00          7412                FCB    $00
68C9    20202020    7413  MSG138        FCB    '    SELECT TMPR=    '
        53454C45
        43542054
        4D50523D
        20202020
68DD    00          7414                FCB    $00
68DE    20202020    7415  MSG139        FCB    '     IS STOPPED     '
        20495320
        53544F50
        50454420
        20202020
68F2    00          7416                FCB    $00
68F3    20544D50    7417  MSG140        FCB    ' TMPR= xxxx  KEY= xx'
        523D2078
        78787820
        204B4559
        3D207878
6907    00          7418                FCB    $00
6908    2020204E    7419  MSG141        FCB    '   NOTE= nn +xx.x   '
        4F54453D
        206E6E20
        2B78782E
        78202020
691C    00          7420                FCB    $00
691D    20555345    7421  MSG142        FCB    ' USE +/- TO ADJUST  '
        202B2F2D
        20544F20
        41444A55
        53542020
6931    00          7422                FCB    $00
6932    55534520    7423  MSG143        FCB    'USE ENTER TO SELECT '
        454E5445
        5220544F
        2053454C
        45435420
6946    00          7424                FCB    $00
6947    20202020    7425  MSG144        FCB    '      SETTINGS      '
        20205345
        5454494E
        47532020
        20202020
695B    00          7426                FCB    $00
695C    2020434F    7427  MSG145        FCB    '  COMPLETE - PRESS  '
        4D504C45
        5445202D
        20505245
        53532020
6970    00          7428                FCB    $00
6971    2020454E    7429  MSG146        FCB    '  ENTER TO CONTINUE '
        54455220
        544F2043
        4F4E5449
        4E554520
6985    00          7430                FCB    $00
6986    20495320    7431  MSG147        FCB    ' IS FACTORY DEFAULT '
        46414354
        4F525920
        44454641
        554C5420
699A    00          7432                FCB    $00
699B    20202020    7433  MSG148        FCB    '                 NO '
        20202020
        20202020
        20202020
        204E4F20
```

```
69AF    00          7434                FCB    $00
69B0    20202020    7435  MSG149        FCB    '            RUN  CHNG'
        20202020
        20202052
        554E2020
        43484E47
69C4    00          7436                FCB    $00
69C5    20202020    7437  MSG150        FCB    '    STRETCH MENU    '
        53545245
        54434820
        4D454E55
        20202020
69D9    00          7438                FCB    $00
69DA    53544152    7439  MSG151        FCB    'START COPY          '
        5420434F
        50592020
        20202020
        20202020
69EE    00          7440                FCB    $00
69EF    2D454449    7441  MSG152        FCB    '-EDIT -DEL  RUN STOP'
        54202D44
        454C2020
        52554E20
        53544F50
6A03    00          7442                FCB    $00
6A04    32333435    7443  MSG153        FCB    '23456789  STRCH=____'
        36373839
        20205354
        5243483D
        5F5F5F5F
6A18    00          7444                FCB    $00
6A19    20205354    7445  MSG154        FCB    '  STRCH IS: ____    '
        52434820
        49533A20
        5F5F5F5F
        20202020
6A2D    00          7446                FCB    $00
6A2E    20202053    7447  MSG155        FCB    '   STRCH= xxxx      '
        54524348
        3D207878
        78782020
        20202020
6A42    00          7448                FCB    $00
6A43    2044454C    7449  MSG156        FCB    ' DELETE STRCH= xxxx '
38
        45544520
        53545243
        483D2078
        78787820
6A57    00          7450                FCB    $00
6A58    5049434B    7451  MSG157        FCB    'PICK KEY STRCH= xxxx'
        204B4559
        20535452
        43483D20
        78787878
6A6C    00          7452                FCB    $00
6A6D    53545243    7453  MSG158        FCB    'STRCH= xxxx  KEY= xx'
        483D2078
        78787820
        204B4559
        3D207878
6A81    00          7454                FCB    $00
6A82    20202020    7455  MSG159        FCB    '      OCTV= x       '
        20204F43
        54563D20
        78202020
        20202020
6A96    00          7456                FCB    $00
```

```
6A97    20202020  7457  MSG160    FCB   '          DONE  NEXT'
        20202020
        2020444F
        4E452020
        4E455854
6AAB    00        7458            FCB   $00
6AAC    20202043  7459  MSG161    FCB   '   COPY/DEL MENU    '
        4F50592F
        44454C20
       4D454E55
        20202020
6AC0    00        7460            FCB   $00
6AC1    434F5059  7461  MSG162    FCB   'COPY  DEL  RUN  BACK'
        20204445
        4C202052
        554E2020
        4241434B
6AD5    00        7462            FCB   $00
6AD6    20202044  7463  MSG164    FCB   '   DELETE STRCH=    '
        454C4554
        45205354
        5243483D
        20202020
6AEA    00        7464            FCB   $00
6AEB    20202053  7465  MSG165    FCB   '   SELECT STRCH=    '
        454C4543
        54205354
        5243483D
        20202020
6AFF    00        7466            FCB   $00
6B00    204E4557  7467  MSG166    FCB   ' NEW NAME - ABCDEFGH'
        204E414D
        45202D20
        41424344
        45464748
6B14    00        7468            FCB   $00
6B15    204E4557  7469  MSG167    FCB   ' NEW STRCH IS: ____ '
        20535452
        43482049
        533A205F
        5F5F5F20
6B29    00        7470            FCB   $00
6B2A    52452D20  7471  MSG168    FCB   'RE-                 '
        20202020
        20202020
        20202020
        20202020
6B3E    00        7472            FCB   $00
6B3F    4E414D45  7473  MSG169    FCB   'NAME  DEL  RUN      '
        20204445
        4C202052
        554E2020
        20202020
6B53    00        7474            FCB   $00
6B54    2020434F  7475  MSG170    FCB   '  COPY THIS STRCH=  '
        50592054
        48495320
        53545243
        483D2020
6B68    00        7476            FCB   $00
6B69    20434F50  7477  MSG171    FCB   ' COPY xxxx TO xxxx  '
        59207878
        78782054
        4F207878
        78782020
6B7D    00        7478            FCB   $00
6B7E    2020434F  7479  MSG172    FCB   '  COPY THIS TMPR=   '
        50592054
```

```
        48495320
        544D5052
        3D202020
6B92    00          7480                FCB    $00
6B93    4E4F2054    7481  MSG173        FCB    'NO TMPR OR STRCH IS '
        4D505220
        4F522053
        54524348
        20495320
6BA7    00          7482                FCB    $00
6BA8    20435552    7483  MSG174        FCB    ' CURRENTLY RUNNING  '
        52454E54
        4C592052
        554E4E49
        4E472020
6BBC    00          7484                FCB    $00
6BBD    20434F50    7485  MSG175        FCB    ' COPYING FILE DATA  '
        59494E47
        2046494C
        45204441
        54412020
6BD1    00          7486                FCB    $00
6BD2    4E455720    7487  MSG176        FCB    'NEW        CNCL     '
        20202020
        20202043
        4E434C20
        20202020
6BE6    00          7488                FCB    $00
6BE7    53455420    7489  MSG200        FCB    'SET IMAGE & PRS ENTR'
        494D4147
        45202620
        50525320
        454E5452
6BFB    00          7490                FCB    $00
6BFC    434C4152    7491  MSG201        FCB    'CLARIFIER / CONTRAST'
        49464945
        52202F20
        434F4E54
        52415354
6C10    00          7492                FCB    $00
6C11    204E4F57    7493  MSG202        FCB    ' NOW=         =     '
        3D202020
        20202020
        20203D20
        20202020
6C25    00          7494                FCB    $00
6C26    4C4F5720    7495  MSG203        FCB    'LOW   HI    DOWN  UP'
        20204849
        20202020
        444F574E
        20205550
6C3A    00          7496                FCB    $00
                    7497
6C3B    2020204D    7498  MSG800   FCB    '   MEMORY ERROR!!   '
        454D4F52
        59204552
        524F5221
        21202020
6C4F    00          7499          FCB    $00
6C50    204D5553    7500  MSG801   FCB    ' MUST FORMAT MEMORY '
        5420464F
        524D4154
        204D454D
        4F525920
6C64    00          7501          FCB    $00
6C65    20202042    7502  MSG802   FCB    '   BEFORE EDITING.  '
        45464F52
        45204544
```

```
        4954494E
        472E2020
6C79    00        7503          FCB    $00
6C7A    20202050  7504  MSG803  FCB    '   PRESS ANY KEY.   '
        52455353
        20414E59
        204B4559
        2E202020
6C8E    00        7505          FCB    $00
6C8F    20434845  7506  MSG810  FCB    ' CHECKSUM ERROR IN  '
        434B5355
        4D204552
        524F5220
        494E2020
6CA3    00        7507          FCB    $00
6CA4    20787878  7508  MSG811  FCB    ' xxxxx    NAME=xxxx '
        78782020
        20204E41
        4D453D78
        78787820
6CB8    00        7509          FCB    $00
6CB9    20504C45  7510  MSG812  FCB    ' PLEASE CHECK DATA. '
        41534520
        43484543
        4B204441
        54412E20
6CCD    00        7511          FCB    $00
6CCE    41424344  7512  MSG820       FCB    'ABCDEFGHIJKLMNOPQRST'
        45464748
        494A4B4C
        4D4E4F50
        51525354
6CE2    00        7513               FCB    $00
6CE3    55565758  7514  MSG821       FCB    'UVWXYZ0123456789    '
        595A3031
        32333435
        36373839
        20202020
6CF7    00        7515               FCB    $00
6CF8    53455220  7516  MSG822       FCB    'SER NUM =__________'
        4E554D20
        3D5F5F5F
        5F5F5F5F
        5F5F5F5F
6D0C    00        7517               FCB    $00
6D0D    20202020  7518  MSG830  FCB    '    CANNOT EDIT     '
        43414E4E
        4F542045
        44495420
        20202020
6D21    00        7519          FCB    $00
6D22    5354414E  7520  MSG831  FCB    'STANDARD TMPR/STRCH '
        44415244
        20544D50
        522F5354
        52434820
6D36    00        7521          FCB    $00
6D37    20202020  7522  MSG832  FCB    '      RECORDS.      '
        20205245
        434F5244
        532E2020
        20202020
6D4B    00        7523          FCB    $00
6D4C    20202043  7524  MSG833  FCB    '   CANNOT DELETE    '
        414E4E4F
        54204445
        4C455445
        20202020
```

```
6D60    00          7525            FCB    $00
                    7526
6D61    2020204D    7527  MSG900         FCB    '   MCS SPEED TEST   '
        43532053
        50454544
        20544553
        54202020
6D75    00          7528                 FCB    $00
6D76    20202052    7529  MSG901         FCB    '   RPM = xxxx.xxx   '
        504D203D
        20787878
        782E7878
        78202020
6D8A    00          7530                 FCB    $00
6D8B    20555345    7531  MSG902         FCB    ' USE +/- TO ADJUST  '
        202B2F2D
        20544F20
        41444A55
        53542020
6D9F    00          7532                 FCB    $00
6DA0    55534520    7533  MSG903         FCB    'USE ENTER TO SELECT '
        454E5445
        5220544F
        2053454C
        45435420
6DB4    00          7534                 FCB    $00
6DB5    50524553    7535  MSG904         FCB    'PRESS ENTER TO QUIT '
        5320454E
        54455220
        544F2051
        55495420
6DC9    00          7536                 FCB    $00
                    7537
6DCA    5345513D    7538  S_SEQ          FCB    'SEQ= '
        20
6DCF    00          7539                 FCB    $00
6DD0    20544D50    7540  S_TMPR         FCB    ' TMPR= '
        523D20
6DD7    00          7541                 FCB    $00
6DD8    53545243    7542  S_STRCH        FCB    'STRCH= '
        483D20
6DDF    00          7543                 FCB    $00
6DE0    4F43543D    7544  S_OCT          FCB    'OCT= '
        20
6DE5    00          7545                 FCB    $00
6DE6    2B32        7546  S_OOF2         FCB    '+2'
6DE8    00          7547                 FCB    $00
6DE9    2D31        7548  S_OOF1         FCB    '-1'
6DEB    00          7549                 FCB    $00
6DEC    4D          7550  S_MUTEON FCB          'M'
6DED    00          7551                 FCB    $00
6DEE    20          7552  S_MUTEOF FCB          ' '
6DEF    00          7553                 FCB    $00
6DF0    414E        7554  S_AN           FCB    'AN'
6DF2    00          7555                 FCB    $00
6DF3    4320        7556  S_KEY0         FCB    'C '
6DF5    0000        7557                 FCB    $00,$00
6DF7    4262        7558  S_KEY1         FCB    'Bb'
6DF9    0000        7559                 FCB    $00,$00
6DFB    4620        7560  S_KEY2         FCB    'F '
6DFD    0000        7561                 FCB    $00,$00
6DFF    4562        7562  S_KEY3         FCB    'Eb'
6E01    0000        7563                 FCB    $00,$00
6E03    4320        7564  NOTE01         FCB    'C '
6E05    0000        7565                 FCB    $00,$00
6E07    4323        7566  NOTE02         FCB    'C#'
6E09    0000        7567                 FCB    $00,$00
6E0B    4420        7568  NOTE03         FCB    'D '
```

```
6E0D    0000    7569                FCB     $00,$00
6E0F    4423    7570  NOTE04        FCB     'D#'
6E11    0000    7571                FCB     $00,$00
6E13    4520    7572  NOTE05        FCB     'E '
6E15    0000    7573                FCB     $00,$00
6E17    4620    7574  NOTE06        FCB     'F '
6E19    0000    7575                FCB     $00,$00
6E1B    4623    7576  NOTE07        FCB     'F#'
6E1D    0000    7577                FCB     $00,$00
6E1F    4720    7578  NOTE08        FCB     'G '
6E21    0000    7579                FCB     $00,$00
6E23    4723    7580  NOTE09        FCB     'G#'
6E25    0000    7581                FCB     $00,$00
6E27    4120    7582  NOTE10        FCB     'A '
6E29    0000    7583                FCB     $00,$00
6E2B    4123    7584  NOTE11        FCB     'A#'
6E2D    0000    7585                FCB     $00,$00
6E2F    4220    7586  NOTE12        FCB     'B '
6E31    0000    7587                FCB     $00,$00
                7588
6E33            7589  $INCLUDE 'DEFAULT.ASM'          ;Include DEFAULT Data
                7590  *=====================================================*
                7591  *   Peterson Tuner Default Data                       *
                7592  *   Written by: Robert S. Dobrose                     *
                7593  *   Saracon, Inc.                                     *
                7594  *     1135 Garfield Ave.                              *
                7595  *     Libertyville, IL  60048                         *
                7596  *=====================================================*
                7597  *   Release History                                   *
                7598  *   04/11/95  1.0  - Initial Code                     *
                7599  *=====================================================*
                7600
                7601
                7602  *=====================================================
                7603  *  DEFAULT DATA
                7604  * - - - - - - - - - - - - - - - - - - - - - - - - - - -
                7605  *  This code creates factory default values in ROM
                7606  *    memory.  These values cannot be altered in any way.
                7607  * - - - - - - - - - - - - - - - - - - - - - - - - - - -
                7608  ; Default data
7000            7609      ORG     DEFAULT
                7610  ;   SYSTEM HEADER
7000            7611  DFLT_HDR:     EQU     *
                7612
                7613  ROM_TS:               ; Start of ROM'd TMPR & STRCH records
                7614  DH_PAD:
7000    0001    7615                FDB     TYP_SH  ; SYSTEM HEADER block type
7002    00      7616                FCB     0       ; Default DFLAGS value
7003    08      7617                FCB     $08     ; Default SFLAGS value
7004    00      7618                FCB     0       ; Default SCAN SPEED value
7005    00      7619                FCB     0       ; PAD 1
7006    01B8    7620                FDB     !440    ; Default CAL A value
7008    0000    7621                FDB     0       ; Default TMPR DIR pointer
700A    0000    7622                FDB     0       ; Default STRCH DIR pointer
700C    0000    7623                FDB     0       ; Default SEQ DIR pointer
700E    0008    7624                FDB     8       ; Default CONTRAST value
7010    0000    7625                FDB     0       ; PAD 2
7012    78787878 7626               FCB     'xxxxxxxxxxx'   ; Default SERIAL NUMBER (11
chars)
        78787878
        787878
701D    00      7627                FCB     0       ; Terminate SERIAL NUMBER with NULL
701E    0000    7628                FDB     0       ; PAD 2
                7629
                7630
                7631  TMPR_DEF:     ; Start of TMPR Default tables (factory default configs)
                7632  T_TMPR01:
7020    0007    7633  TT01_TPTR:    FDB     TYP_T0  ; Type/Ptr data
```

```
7022    0000      7634                FDB     !0
7024    0000      7635                FDB     !0
7026    0000      7636                FDB     !0
7028    0000      7637                FDB     !0
702A    0000      7638                FDB     !0
702C    0000      7639                FDB     !0
702E    0000      7640                FDB     !0
7030    0000      7641                FDB     !0
7032    0000      7642                FDB     !0
7034    0000      7643                FDB     !0
7036    0000      7644                FDB     !0
7038    0000      7645                FDB     !0
703A    45515541  7646  TT01_NAME:    FCB     'EQUA'
703E    0000      7647                FDB     $0000
                  7648
                  7649
                  7650  T_TMPR02:
7040    0007      7651  TT02_TPTR:    FDB     TYP_T0  ; Type/Ptr data
7042    FFC5      7652                FDB     !-59
7044    004E      7653                FDB     !78
7046    FFEC      7654                FDB     !-20
7048    FF8A      7655                FDB     !-118
704A    0014      7656                FDB     !20
704C    FFB2      7657                FDB     !-78
704E    003B      7658                FDB     !59
7050    FFD9      7659                FDB     !-39
7052    0062      7660                FDB     !98
7054    0000      7661                FDB     !0
7056    FF9E      7662                FDB     !-98
7058    0027      7663                FDB     !39
705A    50595448  7664  TT02_NAME:    FCB     'PYTH'
705E    0000      7665                FDB     $0000
                  7666
                  7667
                  7668  T_TMPR03:
7060    0007      7669  TT03_TPTR:    FDB     TYP_T0  ; Type/Ptr data
7062    009C      7670                FDB     !156
7064    FF77      7671                FDB     !-137
7066    00C4      7672                FDB     !196
7068    0139      7673                FDB     !313
706A    0013      7674                FDB     !19
706C    0089      7675                FDB     !137
706E    FF64      7676                FDB     !-156
7070    00B0      7677                FDB     !176
7072    FF8A      7678                FDB     !-118
7074    0000      7679                FDB     !0
7076    014D      7680                FDB     !333
7078    0027      7681                FDB     !39
707A    4A554D41  7682  TT03_NAME:    FCB     'JUMA'
707E    0000      7683                FDB     $0000
                  7684
                  7685
                  7686  T_TMPR04:
7080    0007      7687  TT04_TPTR:    FDB     TYP_T0  ; Type/Ptr data
7082    009C      7688                FDB     !156
7084    01E8      7689                FDB     !488
7086    00C4      7690                FDB     !196
7088    0139      7691                FDB     !313
708A    0013      7692                FDB     !19
708C    0089      7693                FDB     !137
708E    01D5      7694                FDB     !469
7090    00B0      7695                FDB     !176
7092    0125      7696                FDB     !293
7094    0000      7697                FDB     !0
7096    014D      7698                FDB     !333
7098    0027      7699                FDB     !39
709A    4A554D49  7700  TT04_NAME:    FCB     'JUMI'
709E    0000      7701                FDB     $0000
```

```
                  7702
                  7703
                  7704  T_TMPR05:
70A0    0007      7705  TT05_TPTR:  FDB    TYP_T0  ; Type/Ptr data
70A2    0068      7706              FDB    !104
70A4    FF7B      7707              FDB    !-133
70A6    0024      7708              FDB    !36
70A8    00CF      7709              FDB    !207
70AA    FFDF      7710              FDB    !-33
70AC    0088      7711              FDB    !136
70AE    FF9F      7712              FDB    !-97
70B0    0046      7713              FDB    !70
70B2    FF56      7714              FDB    !-170
70B4    0000      7715              FDB    !0
70B6    00B0      7716              FDB    !176
70B8    FFC0      7717              FDB    !-64
70BA    4D45414E  7718  TT05_NAME:  FCB    'MEAN'
70BE    0000      7719              FDB    $0000
                  7720
                  7721
                  7722  T_TMPR06:
70C0    0007      7723  TT06_TPTR:  FDB    TYP_T0  ; Type/Ptr data
70C2    0067      7724              FDB    !103
70C4    0005      7725              FDB    !5
70C6    0022      7726              FDB    !34
70C8    002C      7727              FDB    !44
70CA    0014      7728              FDB    !20
70CC    0053      7729              FDB    !83
70CE    FFF1      7730              FDB    !-15
70D0    0044      7731              FDB    !68
70D2    0018      7732              FDB    !24
70D4    0000      7733              FDB    !0
70D6    003F      7734              FDB    !63
70D8    0027      7735              FDB    !39
70DA    57524B33  7736  TT06_NAME:  FCB    'WRK3'
70DE    0000      7737              FDB    $0000
                  7738
                  7739
                  7740  T_TMPR07:
70E0    0007      7741  TT07_TPTR:  FDB    TYP_T0  ; Type/Ptr data
70E2    0075      7742              FDB    !117
70E4    0013      7743              FDB    !19
70E6    0027      7744              FDB    !39
70E8    003A      7745              FDB    !58
70EA    FFEC      7746              FDB    !-20
70EC    0062      7747              FDB    !98
70EE    0014      7748              FDB    !20
70F0    004E      7749              FDB    !78
70F2    0027      7750              FDB    !39
70F4    0000      7751              FDB    !0
70F6    004E      7752              FDB    !78
70F8    0000      7753              FDB    !0
70FA    4B524E33  7754  TT07_NAME:  FCB    'KRN3'
70FE    0000      7755              FDB    $0000
                  7756
                  7757
                  7758  T_TMPR08:
7100    0007      7759  TT08_TPTR:  FDB    TYP_T0  ; Type/Ptr data
7102    003A      7760              FDB    !58
7104    FFD8      7761              FDB    !-40
7106    0014      7762              FDB    !20
7108    FFFF      7763              FDB    !-1
710A    FFEE      7764              FDB    !-18
710C    0027      7765              FDB    !39
710E    FFC3      7766              FDB    !-61
7110    0027      7767              FDB    !39
7112    FFEC      7768              FDB    !-20
7114    0000      7769              FDB    !0
```

```
7116    0013      7770                FDB     !19
7118    FFDB      7771                FDB     !-37
711A    594F4E47  7772  TT08_NAME:    FCB     'YONG'
711E    0000      7773                FDB     $0000
                  7774
                  7775  TD_END:
                  7776  ROMTS_END:
7120              7777                EQU     *
                  7778
                  7779  * - - - - - - - - - - - - - - - - - - - - - - - - - - - - -
                  7780  * End of DEFAULT data
                  7781  *=========================================================
                  7782
                  7783
                  7784  *=========================================================
                  7785  *  CONST DATA
                  7786  * - - - - - - - - - - - - - - - - - - - - - - - - - - - - -
                  7787  *  This code creates constant variable values in ROM
                  7788  *    memory.  These values cannot be altered in any way.
                  7789  * - - - - - - - - - - - - - - - - - - - - - - - - - - - - -
7C00              7790      ORG  CONST
                  7791
                  7792  * - - - - - - - - - - - - - - - - - - - - - - - - - - - - -
                  7793  * Configuration Data
                  7794  * - - - - - - - - - - - - - - - - - - - - - - - - - - - - -
                  7795
                  7796  ; ===== New scaling values (* 32) adjusted for 20 FullSt/Rev motor
=====
7C00    0A        7797  V_INC1          FCB     !10     ; 1.0 Cent
7C01    05        7798  V_INC2          FCB     !5      ; 0.5 Cent
7C02    01        7799  V_INC3          FCB     !1      ; 0.1 Cent
                  7800
7C03    02        7801  KEY_OFF         FCB     !2      ; C = 2 note offset (0 note shift)
7C04    00        7802                  FCB     !0      ; Bb = 0 note offset (-2 note shift)
7C05    07        7803                  FCB     !7      ; F = 7 note offset (+5 note shift)
7C06    05        7804                  FCB     !5      ; Eb = 5 note offset (+3 note shift)
                  7805
                  7806  * - - - - - - - - - - - - - - - - - - - - - - - - - - - - -
                  7807  *  BOOT & ERROR Messages
                  7808  * - - - - - - - - - - - - - - - - - - - - - - - - - - - - -
7C07    20202020  7809  CLR_MSG  FCB    '                    '
        20202020
        20202020
        20202020
        20202020
7C1B    00        7810           FCB    $00
7C1C    20204D43  7811  B_MSG1   FCB    '  MCS Test System   '
        53205465
        73742053
        79737465
        6D202020
7C30    00        7812           FCB    $00
7C31    20204D6F  7813  B_MSG2   FCB    '  Model 12W Tuner   '
        64656C20
        31325720
        54756E65
        72202020
7C45    00        7814           FCB    $00
7C46    52657620  7815  B_MSG3   FCB    'Rev D.9 on 03/04/96 '
        442E3920
        6F6E2030
        332F3034
        2F393620
7C5A    00        7816           FCB    $00
7C5B    20206279  7817  B_MSG4   FCB    '  by Saracon, Inc.  '
        20536172
        61636F6E
        2C20496E
```

```
        632E2020
7C6F    00          7818            FCB     $00
7C70    20205448    7819  X_MSG1    FCB     '  THIS FUNCTION IS  '
        49532046
        554E4354
        494F4E20
        49532020
7C84    00          7820            FCB     $00
7C85    204E4F54    7821  X_MSG2    FCB     ' NOT IMPLEMENTED AT '
        20494D50
        4C454D45
        4E544544
        20415420
7C99    00          7822            FCB     $00
7C9A    20202020    7823  X_MSG3    FCB     '     THIS TIME      '
        20544849
        53205449
        4D452020
        20202020
7CAE    00          7824            FCB     $00
7CAF    506C6561    7825  X_MSG4    FCB     'Please Hit ENTER Key'
        73652048
        69742045
        4E544552
        204B6579
7CC3    00          7826            FCB     $00
7CC4    20202020    7827  E_MSG1    FCB     '    ERROR WHILE     '
        4552524F
        52205748
        494C4520
        20202020
7CD8    00          7828            FCB     $00
7CD9    20202020    7829  E_MSG2    FCB     '    STORING DATA    '
        53544F52
        494E4720
        44415441
        20202020
7CED    00          7830            FCB     $00
7CEE    20202020    7831  E_MSG3    FCB     '     TRY AGAIN?     '
        20545259
        20414741
        494E3F20
        20202020
7D02    00          7832            FCB     $00
7D03    2020204D    7833  E_MSG4    FCB     '   MEMORY ERROR!!   '
        454D4F52
        59204552
        524F5221
        21202020
7D17    00          7834            FCB     $00
7D18    204D5553    7835  E_MSG5    FCB     ' MUST FORMAT MEMORY '
        5420464F
        524D4154
        204D454D
        4F525920
7D2C    00          7836            FCB     $00
7D2D    20202042    7837  E_MSG6    FCB     '   BEFORE EDITING.  '
        45464F52
        45204544
        4954494E
        472E2020
7D41    00          7838            FCB     $00
                    7839
                    7840  * - - - - - - - - - - - - - - - - - - - - - - - - - - - -
                    7841  * END CONST DATA
                    7842  ***********************************************************
                    7843
                    7844  * - - - - - - - - - - - - - - - - - - - - - - - - - - - -
```

```
                    * End of ROM data
                    *=====================================================


                    *=====================================================
                    * INTERRUPT VECTOR ASSIGNMENTS
                    * - - - - - - - - - - - - - - - - - - - - - - - - - - - -
7E50                        ORG    XINT_TO1      ;Assign OC1 interrupt
7E50 [12] 3B                       RTI

7E40                        ORG    XINT_TO2      ;Assign OC2 interrupt to
7E40 [12] 3B                       RTI

7DC0                        ORG    XINT_SCI
7DC0 [12] 3B                       RTI

7DD0                        ORG    XINT_SPI
7DD0 [12] 3B                       RTI

7DE0                        ORG    XINT_EDGE
7DE0 [12] 3B                       RTI

7DF0                        ORG    XINT_ACO
7DF0 [12] 3B                       RTI

7E00                        ORG    XINT_TOF
7E00 [12] 3B                       RTI

7E10                        ORG    XINT_TO5
7E10 [12] 3B                       RTI

7E20                        ORG    XINT_TO4
7E20 [12] 3B                       RTI

7E30                        ORG    XINT_TO3
7E30 [12] 3B                       RTI

7E60                        ORG    XINT_TI3
7E60 [12] 3B                       RTI

7E70                        ORG    XINT_TI2
7E70 [12] 3B                       RTI

7E80                        ORG    XINT_TI1
7E80 [12] 3B                       RTI

7E90                        ORG    XINT_RT
7E90 [12] 3B                       RTI

7EA0                        ORG    XINT_IRQ
7EA0 [12] 3B                       RTI

7EB0                        ORG    XINT_XIRQ
7EB0 [12] 3B                       RTI

7EC0                        ORG    XINT_SW
7EC0 [12] 3B                       RTI

7ED0                        ORG    XINT_OP
7ED0 [12] 3B                       RTI

7EE0                        ORG    XINT_COP
7EE0 [12] 3B                       RTI

7EF0                        ORG    XINT_CLK
7EF0 [12] 3B                       RTI

                    * - - - - - - - - - - - - - - - - - - - - - - - - - - - -
```

```
7913  * End of vector assignments
7914  *=====================================================
7915
7916
7917
7918
```

Symbol Table

| | |
|---|---|
| AUX_IRQ | E003 |
| BAUD | 002B |
| B_MSG1 | 7C1C |
| B_MSG2 | 7C31 |
| B_MSG3 | 7C46 |
| B_MSG4 | 7C5B |
| CALC_MULT | 1776 |
| CAL_A | 005A |
| CB_LP1 | 3169 |
| CB_SK21 | 318A |
| CENTS | 8000 |
| CFORC | 000B |
| CHS_SK13 | 1876 |
| CHS_SK14 | 1883 |
| CHS_SK15 | 189A |
| CHS_SK16 | 18A1 |
| CHS_SK17 | 18B2 |
| CHS_SK18 | 18B4 |
| CHS_SK1X | 1889 |
| CH_KEY | 1EBB |
| CH_SCL | 1867 |
| CLEAR_BLK | 315D |
| CLEAR_TS | 2240 |
| CLR_MSG | 7C07 |
| CM_LP1 | 1790 |
| CM_SK1 | 17B6 |
| CM_SK2 | 17D8 |
| CONST | 7C00 |
| CONTRAST | 0048 |
| COPY_TS | 22DC |
| CPTS_DONE | 2357 |
| CPTS_LP1 | 22E6 |
| CPTS_LP2 | 22EF |
| CPTS_LP3 | 2322 |
| CSUM | 313E |
| CS_LP1 | 313F |
| CTS_LP1 | 2250 |
| CUR_OFF | 1329 |
| CUR_ON | 1321 |
| D1TEMP | 00A0 |
| DBUF0 | 0099 |
| DBUF1 | 0098 |
| DBUF2 | 0097 |
| DBUF3 | 0096 |
| DBUFFER | 0096 |
| DC_X1 | 1301 |
| DDRB | 0006 |
| DDRC | 0007 |
| DDRD | 0009 |
| DD_DONE | 1254 |
| DD_LP1 | 1230 |
| DD_LP2 | 1249 |
| DD_X1 | 12F4 |
| DEBUG | 7F00 |
| DEC_DSP | 1221 |
| DEFAULT | 7000 |
| DEL_TS | 235D |
| DFLAGS | 0042 |
| DFLT_HDR | 7000 |

| | |
|---|---|
| DG1_SK1 | 1D37 |
| DG4_LP1 | 1D96 |
| DG4_OUT | 1DA6 |
| DG4_SK11 | 1D8B |
| DG4_SK21 | 1DBB |
| DG4_SK31 | 1DC3 |
| DG4_SK32 | 1DD7 |
| DG6_LP1 | 1E16 |
| DG6_OUT1 | 1E28 |
| DG6_SK11 | 1E26 |
| DG_1 | 1D27 |
| DG_2 | 1D58 |
| DG_3 | 1D79 |
| DG_4 | 1D7A |
| DG_5 | 1DDA |
| DG_6 | 1DE3 |
| DG_7 | 1E55 |
| DH_PAD | 7000 |
| DIAG | 1CC2 |
| DIAG2 | 1E5B |
| DSP_2SB | 1287 |
| DSP_3SB | 129C |
| DSP_4SB | 12AD |
| DSP_A1 | 1274 |
| DSP_A2 | 1285 |
| DSP_A3 | 129A |
| DSP_A4 | 12AB |
| DSP_CHR | 12EE |
| DSP_CLR | 12F9 |
| DSP_CMD | 12E9 |
| DSP_CONT | 12DA |
| DSP_CUR | 1309 |
| DSP_DLY | 12F1 |
| DSP_DONE | 12E7 |
| DSP_INIT | 11A4 |
| DSP_MSB | 1276 |
| DSP_STR | 12BD |
| DTS_DONE | 2428 |
| DTS_EXIT | 2419 |
| DTS_LP0 | 238A |
| DTS_LP1 | 2407 |
| DTS_SK03 | 2372 |
| DTS_SK05 | 2392 |
| DTS_SK11 | 23B0 |
| DTS_SK12 | 23C8 |
| DTS_SK21 | 2405 |
| D_PAD | 00A1 |
| D_STR | 0082 |
| EB_LP1 | 314D |
| EDIT_TS | 1FC3 |
| ED_REC | 1E64 |
| EEPEND | DFFF |
| EEPROM | A000 |
| EEPSML | BFFF |
| EE_COFF | 001F |
| EE_PTR | 0000 |
| EE_TYPE | 0001 |
| ENC_H | E000 |
| ENC_L | E001 |
| ERASE_BLK | 3146 |
| ERASE_USER | 32CA |
| ERB_LP1 | 1A54 |
| ERC_LP1 | 1AB6 |
| ERC_SK10 | 1A8A |
| ERC_SK11 | 1A93 |
| ERC_SK14 | 1A96 |
| ERR_BLOCK | 1A3A |
| ERR_CS | 1A5D |

| | |
|---|---|
| ERR_DFLT | 33DD |
| ER_SK1 | 1E6E |
| ESTORE | 34C5 |
| ES_LP1 | 34C9 |
| ETS_DONE | 223C |
| ETS_LP0 | 1FF7 |
| ETS_LP4 | 207E |
| ETS_LP41 | 20C2 |
| ETS_LP42 | 20D7 |
| ETS_OUT2 | 2006 |
| ETS_OUT4 | 211B |
| ETS_RUN | 21ED |
| ETS_SK11 | 1FCB |
| ETS_SK13 | 1FDC |
| ETS_SK15 | 1FFF |
| ETS_SK31 | 203B |
| ETS_SK32 | 205A |
| ETS_SK33 | 2042 |
| ETS_SK34 | 20AA |
| ETS_SK37 | 20B0 |
| ETS_SK38 | 20B3 |
| ETS_SK41 | 20EF |
| ETS_SK42 | 20F3 |
| ETS_SK43 | 2106 |
| ETS_SK44 | 210A |
| ETS_SK45 | 210A |
| ETS_SK46 | 2111 |
| ETS_SK47 | 2134 |
| ETS_SK51 | 2149 |
| ETS_SK52 | 215D |
| ETS_SK53 | 2162 |
| ETS_SK54 | 2176 |
| ETS_SK55 | 217D |
| ETS_SK59 | 218E |
| ETS_SK62 | 2197 |
| ETS_SK63 | 21A6 |
| ETS_SK64 | 21BA |
| ETS_SK65 | 21BF |
| ETS_SK66 | 21D3 |
| ETS_SK67 | 21E4 |
| ETS_SK71 | 2206 |
| ETS_SK72 | 220F |
| ETS_SK73 | 2223 |
| ETS_SK74 | 2228 |
| ETS_SK75 | 223C |
| EU_LP1 | 330B |
| EU_LP2 | 3329 |
| EU_OUT | 3332 |
| EU_SK11 | 32CD |
| EU_SK12 | 32E9 |
| EU_SK21 | 32F1 |
| EU_SK22 | 3305 |
| E_MSG1 | 7CC4 |
| E_MSG2 | 7CD9 |
| E_MSG3 | 7CEE |
| E_MSG4 | 7D03 |
| E_MSG5 | 7D18 |
| E_MSG6 | 7D2D |
| E_VECT | 7DC0 |
| FE | 0002 |
| FF_DONE | 31AB |
| FF_LP1 | 3197 |
| FF_SK1 | 31A2 |
| FIND_FREE | 318E |
| FIND_TS | 323E |
| FTS_DONE | 3281 |
| FTS_LP2 | 3251 |
| FTS_SK10 | 324B |

| | |
|---|---|
| FTS_SK30 | 3265 |
| GETA_X1 | 13CB |
| GETK_X1 | 136B |
| GET_AUX | 13C6 |
| GET_HEAD | 3391 |
| GET_KEY | 1366 |
| GET_SER | 33BD |
| GTH_OUT | 33BC |
| GTS_BAD | 33D9 |
| GTS_OUT | 33DC |
| HEX_DSP | 125C |
| HPRIO | 003C |
| H_CALA | 0006 |
| H_CONT | 000C |
| H_DFLG | 0002 |
| H_QDIR | 000C |
| H_SCAN | 0004 |
| H_SDIR | 000A |
| H_SFLG | 0003 |
| H_SNUM | 0012 |
| H_TDIR | 0008 |
| ICC_CUPD | 1FB0 |
| ICC_DISP | 1F21 |
| ICC_DN | 1F9A |
| ICC_DN2 | 1FA3 |
| ICC_DONE | 1FC2 |
| ICC_HI | 1F8F |
| ICC_LOW | 1F85 |
| ICC_SK11 | 1F31 |
| ICC_SK12 | 1F34 |
| ICC_UP | 1FA5 |
| ICC_UP2 | 1FAE |
| IC_CONT | 1F06 |
| IDLE | 0010 |
| IDX1 | 0080 |
| IDX2 | 0081 |
| ILIE | 0010 |
| INI_SK1 | 1028 |
| INI_SK2 | 102A |
| KEY_OFF | 7C03 |
| LCD_C | E006 |
| LCD_D | E007 |
| LINE1 | 12C1 |
| LINE2 | 12C7 |
| LINE3 | 12CD |
| LINE4 | 12D3 |
| LOOK_TS | 3285 |
| LTS_DONE | 32C5 |
| LTS_LP | 32A0 |
| LTS_SK1 | 32AF |
| LTS_SK2 | 32B4 |
| LTS_SK3 | 32B6 |
| LTS_SK4 | 32BA |
| MAIN | 1096 |
| MAIN2_SK1 | 1136 |
| MAIN_2 | 1120 |
| MAIN_3 | 1140 |
| MAIN_31 | 1161 |
| MAIN_32 | 1175 |
| MAIN_BAD1 | 10A2 |
| MAIN_KDONE | 1115 |
| MAIN_OK1 | 10A5 |
| MAIN_SK1 | 10AE |
| MAIN_SK2 | 10BB |
| MAIN_SK3 | 10C5 |
| MAIN_SK4 | 10CF |
| MAIN_SK6 | 10E4 |
| MAIN_SK61 | 10E2 |

| | |
|---|---|
| MAIN_SK7 | 1102 |
| MAIN_SK71 | 10F7 |
| MAIN_SK8 | 1113 |
| MAIN_SK81 | 110A |
| MAIN_X1 | 111D |
| MCS_SEL | E005 |
| MEM_ERR | 0040 |
| MEM_FULL | 1A17 |
| MEM_OK | 108A |
| MEM_TST | 303F |
| MENU | 1B7F |
| MENU_RUN | 1BCC |
| MESSAGES | 6000 |
| MFLAGS | 0041 |
| MF_LP1 | 1A31 |
| MM_SK1 | 1B21 |
| MM_SK2 | 1B2F |
| MM_SK3 | 1B3D |
| MM_SK4 | 1B4B |
| MM_SK5 | 1B59 |
| MM_SK6 | 1B67 |
| MM_SK7 | 1B75 |
| MNU0:0008 | 1B9A |
| MNU0:000D | 1C8F |
| MNU0:000F | 1CDD |
| MNU0:0015 | 1E89 |
| MNU0:0017 | 1F53 |
| MNU0:001E | 23D9 |
| MNU0:0021 | 2550 |
| MNU0:0022 | 258A |
| MNU0:0023 | 25C4 |
| MNU0:0024 | 270C |
| MNU0:0026 | 27BF |
| MNU0:0028 | 2851 |
| MNU0:002A | 28A5 |
| MNU0:002C | 28EC |
| MNU0:002E | 2969 |
| MNU0:0030 | 29FF |
| MNU0:0032 | 2AFC |
| MNU0:0036 | 2BB6 |
| MNU0:0038 | 2C69 |
| MNU0:003A | 2CF8 |
| MNU0:003C | 2D4C |
| MNU0:003E | 2D93 |
| MNU0:0040 | 2E10 |
| MNU0:0042 | 2EA6 |
| MNU0:0044 | 2FA0 |
| MNU0A:0008 | 1BA7 |
| MNU0A:0015 | 1E96 |
| MNU0A:0017 | 1F60 |
| MNU0A:0024 | 2719 |
| MNU0A:0036 | 2BC3 |
| MNU1:0008 | 1BAE |
| MNU1:000D | 1C9D |
| MNU1:0015 | 1E9D |
| MNU1:0017 | 1F67 |
| MNU1:001E | 23E7 |
| MNU1:0021 | 255E |
| MNU1:0022 | 2598 |
| MNU1:0023 | 25D2 |
| MNU1:0024 | 2720 |
| MNU1:0026 | 27CD |
| MNU1:0028 | 285F |
| MNU1:002A | 28B3 |
| MNU1:002C | 28FA |
| MNU1:002E | 2977 |
| MNU1:0030 | 2A0D |
| MNU1:0032 | 2B0A |

| | |
|---|---|
| MNU1:0036 | 2BCA |
| MNU1:0038 | 2C77 |
| MNU1:003A | 2D06 |
| MNU1:003C | 2D5A |
| MNU1:003E | 2DA1 |
| MNU1:0040 | 2E1E |
| MNU1:0042 | 2EB4 |
| MNU1:0044 | 2FAE |
| MNU2:0008 | 1BB5 |
| MNU2:000D | 1CA4 |
| MNU2:0015 | 1EA4 |
| MNU2:0017 | 1F6E |
| MNU2:001E | 23EE |
| MNU2:0021 | 2565 |
| MNU2:0022 | 259F |
| MNU2:0023 | 25D9 |
| MNU2:0024 | 2727 |
| MNU2:0026 | 27D4 |
| MNU2:0028 | 2866 |
| MNU2:002A | 28BA |
| MNU2:002C | 2901 |
| MNU2:002E | 297E |
| MNU2:0030 | 2A14 |
| MNU2:0032 | 2B11 |
| MNU2:0036 | 2BD1 |
| MNU2:0038 | 2C7E |
| MNU2:003A | 2D0D |
| MNU2:003C | 2D61 |
| MNU2:003E | 2DA8 |
| MNU2:0040 | 2E25 |
| MNU2:0042 | 2EBB |
| MNU2:0044 | 2FB5 |
| MNU3:0008 | 1BBC |
| MNU3:000D | 1CAB |
| MNU3:0015 | 1EAB |
| MNU3:0017 | 1F75 |
| MNU3:001E | 23F5 |
| MNU3:0021 | 256C |
| MNU3:0022 | 25A6 |
| MNU3:0023 | 25E0 |
| MNU3:0024 | 272E |
| MNU3:0026 | 27DB |
| MNU3:0028 | 286D |
| MNU3:002A | 28C1 |
| MNU3:002C | 2908 |
| MNU3:002E | 2985 |
| MNU3:0030 | 2A1B |
| MNU3:0032 | 2B18 |
| MNU3:0036 | 2BD8 |
| MNU3:0038 | 2C85 |
| MNU3:003A | 2D14 |
| MNU3:003C | 2D68 |
| MNU3:003E | 2DAF |
| MNU3:0040 | 2E2C |
| MNU3:0042 | 2EC2 |
| MNU3:0044 | 2FBC |
| MNU4:0008 | 1BC3 |
| MNU4:000D | 1CB2 |
| MNU4:0015 | 1EB2 |
| MNU4:0017 | 1F7C |
| MNU4:001E | 23FC |
| MNU4:0021 | 2573 |
| MNU4:0022 | 25AD |
| MNU4:0023 | 25E7 |
| MNU4:0024 | 2735 |
| MNU4:0026 | 27E2 |
| MNU4:0028 | 2874 |
| MNU4:002A | 28C8 |

| | |
|---|---|
| MNU4:002C | 290F |
| MNU4:002E | 298C |
| MNU4:0030 | 2A22 |
| MNU4:0032 | 2B1F |
| MNU4:0036 | 2BDF |
| MNU4:0038 | 2C8C |
| MNU4:003A | 2D1B |
| MNU4:003C | 2D6F |
| MNU4:003E | 2DB6 |
| MNU4:0040 | 2E33 |
| MNU4:0042 | 2EC9 |
| MNU4:0044 | 2FC3 |
| MNU5:0008 | 1BCA |
| MNU5:000D | 1CB9 |
| MNU5:0015 | 1EB9 |
| MNU5:0017 | 1F83 |
| MNU5:001E | 2403 |
| MNU5:0021 | 257A |
| MNU5:0022 | 25B4 |
| MNU5:0023 | 25EE |
| MNU5:0024 | 273C |
| MNU5:0026 | 27E9 |
| MNU5:0028 | 287B |
| MNU5:002A | 28CF |
| MNU5:002C | 2916 |
| MNU5:002E | 2993 |
| MNU5:0030 | 2A29 |
| MNU5:0032 | 2B26 |
| MNU5:0036 | 2BE6 |
| MNU5:0038 | 2C93 |
| MNU5:003A | 2D22 |
| MNU5:003C | 2D76 |
| MNU5:003E | 2DBD |
| MNU5:0040 | 2E3A |
| MNU5:0042 | 2ED0 |
| MNU5:0044 | 2FCA |
| MNU6:0021 | 2581 |
| MNU6:0022 | 25BB |
| MNU6:0023 | 25F5 |
| MNU7:0021 | 2588 |
| MNU7:0022 | 25C2 |
| MNU7:0023 | 25FC |
| MNUX0A:000F | 1CEA |
| MNUX11:000F | 1D0D |
| MNUX12:000F | 1D14 |
| MNUX13:000F | 1D1B |
| MNUX14:000F | 1D22 |
| MNUX1:000F | 1CF1 |
| MNUX2:000F | 1CF8 |
| MNUX3:000F | 1CFF |
| MNUX4:000F | 1D06 |
| MSG0 | 6015 |
| MSG001 | 603F |
| MSG002 | 6054 |
| MSG003 | 6069 |
| MSG004 | 607E |
| MSG005 | 6093 |
| MSG006 | 60A8 |
| MSG007 | 60BD |
| MSG011 | 60D2 |
| MSG012 | 60E7 |
| MSG013 | 60FC |
| MSG014 | 6111 |
| MSG015 | 6126 |
| MSG020 | 6130 |
| MSG021 | 6145 |
| MSG022 | 615A |
| MSG023 | 616F |

| | |
|---|---|
| MSG024 | 6184 |
| MSG025 | 6199 |
| MSG026 | 61AE |
| MSG027 | 61C3 |
| MSG028 | 61D8 |
| MSG029 | 61ED |
| MSG030 | 6202 |
| MSG031 | 6217 |
| MSG032 | 622C |
| MSG033 | 6241 |
| MSG034 | 6256 |
| MSG035 | 625A |
| MSG037 | 625E |
| MSG038 | 6273 |
| MSG040 | 6288 |
| MSG041 | 629D |
| MSG042 | 62B2 |
| MSG045 | 62C7 |
| MSG046 | 62DC |
| MSG047 | 62F1 |
| MSG048 | 6306 |
| MSG049 | 630A |
| MSG050 | 630E |
| MSG051 | 6323 |
| MSG052 | 6338 |
| MSG053 | 634D |
| MSG054 | 6362 |
| MSG055 | 6377 |
| MSG056 | 638C |
| MSG057 | 63A1 |
| MSG058 | 63B6 |
| MSG060 | 63CB |
| MSG061 | 63E0 |
| MSG062 | 63F5 |
| MSG063 | 640A |
| MSG064 | 641F |
| MSG065 | 6434 |
| MSG066 | 6449 |
| MSG067 | 645E |
| MSG068 | 6473 |
| MSG069 | 6488 |
| MSG070 | 649D |
| MSG071 | 64B2 |
| MSG072 | 64C7 |
| MSG073 | 64DC |
| MSG074 | 64F1 |
| MSG075 | 6506 |
| MSG076 | 651B |
| MSG080 | 6530 |
| MSG081 | 6545 |
| MSG082 | 655A |
| MSG090 | 656F |
| MSG091 | 6584 |
| MSG092 | 6599 |
| MSG093 | 65AE |
| MSG094 | 65C3 |
| MSG095 | 65D8 |
| MSG096 | 65ED |
| MSG097 | 6602 |
| MSG098 | 6617 |
| MSG099 | 662C |
| MSG1 | 602A |
| MSG100 | 6641 |
| MSG101 | 6656 |
| MSG102 | 666B |
| MSG103 | 6680 |
| MSG104 | 6695 |
| MSG105 | 66AA |

| | |
|---|---|
| MSG106 | 66BF |
| MSG107 | 66D4 |
| MSG108 | 66E9 |
| MSG109 | 66FE |
| MSG110 | 6713 |
| MSG111 | 6728 |
| MSG112 | 673D |
| MSG115 | 6752 |
| MSG116 | 6758 |
| MSG117 | 675E |
| MSG120 | 6764 |
| MSG121 | 6779 |
| MSG123 | 678E |
| MSG124 | 67A3 |
| MSG125 | 67B8 |
| MSG126 | 67CD |
| MSG127 | 67E2 |
| MSG128 | 67F7 |
| MSG129 | 680C |
| MSG130 | 6821 |
| MSG131 | 6836 |
| MSG132 | 684B |
| MSG133 | 6860 |
| MSG134 | 6875 |
| MSG135 | 688A |
| MSG136 | 689F |
| MSG137 | 68B4 |
| MSG138 | 68C9 |
| MSG139 | 68DE |
| MSG140 | 68F3 |
| MSG141 | 6908 |
| MSG142 | 691D |
| MSG143 | 6932 |
| MSG144 | 6947 |
| MSG145 | 695C |
| MSG146 | 6971 |
| MSG147 | 6986 |
| MSG148 | 699B |
| MSG149 | 69B0 |
| MSG150 | 69C5 |
| MSG151 | 69DA |
| MSG152 | 69EF |
| MSG153 | 6A04 |
| MSG154 | 6A19 |
| MSG155 | 6A2E |
| MSG156 | 6A43 |
| MSG157 | 6A58 |
| MSG158 | 6A6D |
| MSG159 | 6A82 |
| MSG160 | 6A97 |
| MSG161 | 6AAC |
| MSG162 | 6AC1 |
| MSG164 | 6AD6 |
| MSG165 | 6AEB |
| MSG166 | 6B00 |
| MSG167 | 6B15 |
| MSG168 | 6B2A |
| MSG169 | 6B3F |
| MSG170 | 6B54 |
| MSG171 | 6B69 |
| MSG172 | 6B7E |
| MSG173 | 6B93 |
| MSG174 | 6BA8 |
| MSG175 | 6BBD |
| MSG176 | 6BD2 |
| MSG200 | 6BE7 |
| MSG201 | 6BFC |
| MSG202 | 6C11 |

| | |
|---|---|
| MSG203 | 6C26 |
| MSG800 | 6C3B |
| MSG801 | 6C50 |
| MSG802 | 6C65 |
| MSG803 | 6C7A |
| MSG810 | 6C8F |
| MSG811 | 6CA4 |
| MSG812 | 6CB9 |
| MSG820 | 6CCE |
| MSG821 | 6CE3 |
| MSG822 | 6CF8 |
| MSG830 | 6D0D |
| MSG831 | 6D22 |
| MSG832 | 6D37 |
| MSG833 | 6D4C |
| MSG900 | 6D61 |
| MSG901 | 6D76 |
| MSG902 | 6D8B |
| MSG903 | 6DA0 |
| MSG904 | 6DB5 |
| MSGREV | 6000 |
| MT_BAD | 30B5 |
| MT_DONE | 30B8 |
| MT_LP1 | 3068 |
| MT_SK10 | 3056 |
| MT_SK11 | 3065 |
| MT_SK21 | 3073 |
| MT_SK22 | 308C |
| MT_SK25 | 3090 |
| MT_SK26 | 309F |
| MT_SK27 | 30AE |
| MULT1 | 008E |
| MULT2 | 0092 |
| MULTI | 1AC0 |
| MULTMCS | 1B03 |
| MULTSCL | 1AED |
| NEW_HEAD | 3333 |
| NEW_STRCH | 229F |
| NEW_TMPR | 2288 |
| NEXT_TS | 31B0 |
| NF | 0004 |
| NOI_LP1 | 34FB |
| NOTE | 9F60 |
| NOTE01 | 6E03 |
| NOTE02 | 6E07 |
| NOTE03 | 6E0B |
| NOTE04 | 6E0F |
| NOTE05 | 6E13 |
| NOTE06 | 6E17 |
| NOTE07 | 6E1B |
| NOTE08 | 6E1F |
| NOTE09 | 6E23 |
| NOTE10 | 6E27 |
| NOTE11 | 6E2B |
| NOTE12 | 6E2F |
| NOTE_CAL | 005C |
| NOTE_OCT | 0047 |
| NO_IMP | 34E0 |
| NWS_LP3 | 22A8 |
| NWS_LP4 | 22B4 |
| NWS_OUT | 22DB |
| NWS_SK31 | 22C9 |
| NWS_SK41 | 22C1 |
| NWT_OUT | 229E |
| NWT_SK31 | 2298 |
| NXT_DONE | 31F3 |
| NXT_LP1 | 31C7 |
| NXT_SK11 | 31BA |

| | |
|---|---|
| NXT_SK12 | 31C2 |
| NXT_SK15 | 31D3 |
| NXT_SK16 | 31D6 |
| NXT_SK21 | 31DE |
| NXT_SK22 | 31F0 |
| N_SCAN | 0059 |
| OA_SK1 | 1EF6 |
| OA_SK2 | 1EFF |
| OA_SK4 | 1F02 |
| OC1D | 000D |
| OC1F | 0080 |
| OC1M | 000C |
| OCT_ADJ | 1EEA |
| OCT_DN | 1EDA |
| OCT_UP | 1ECA |
| OD_SK1 | 1EE6 |
| OP_SCR | 13E8 |
| ORUN | 0008 |
| OUTPUTS | E004 |
| OU_SK1 | 1ED6 |
| PA0 | 0001 |
| PA1 | 0002 |
| PA2 | 0004 |
| PA3 | 0008 |
| PA4 | 0010 |
| PA5 | 0020 |
| PA6 | 0040 |
| PA7 | 0080 |
| PACNT | 0027 |
| PACTL | 0026 |
| PANEL | E002 |
| PAOUT | 00A0 |
| PB0 | 0001 |
| PB1 | 0002 |
| PB2 | 0004 |
| PB3 | 0008 |
| PB4 | 0010 |
| PB5 | 0020 |
| PB6 | 0040 |
| PB7 | 0080 |
| PC0 | 0001 |
| PC1 | 0002 |
| PC2 | 0004 |
| PC3 | 0008 |
| PC4 | 0010 |
| PC5 | 0020 |
| PC6 | 0040 |
| PC7 | 0080 |
| PD0 | 0001 |
| PD1 | 0002 |
| PD2 | 0004 |
| PD3 | 0008 |
| PD4 | 0010 |
| PD5 | 0020 |
| PD6 | 0040 |
| PD7 | 0080 |
| PDOUT | 000D |
| PICK_NAME | 15B4 |
| PIOC | 0002 |
| PN_KSK1 | 1620 |
| PN_KSK11 | 161C |
| PN_KSK2 | 1631 |
| PN_KSK21 | 162D |
| PN_KSK3 | 1653 |
| PN_KSK4 | 165F |
| PN_KSK5 | 1694 |
| PN_KSK50 | 167A |
| PN_KSK51 | 167E |

| | |
|---|---|
| PN_KSK52 | 1680 |
| PN_LP1 | 15EC |
| PN_LP2 | 160A |
| PN_OUT1 | 1697 |
| PN_SK1 | 15FF |
| PORTA | 0000 |
| PORTB | 0004 |
| PORTC | 0003 |
| PORTD | 0008 |
| PREV_TS | 31F6 |
| PRV_DONE | 323B |
| PRV_LP1 | 320D |
| PRV_SK11 | 3200 |
| PRV_SK12 | 3208 |
| PRV_SK15 | 321B |
| PRV_SK16 | 321E |
| PRV_SK21 | 3226 |
| PRV_SK22 | 3238 |
| PTR1 | 0051 |
| PTR2 | 0053 |
| PTR3 | 0055 |
| PTR4 | 0057 |
| RAMBASE | 0040 |
| RDRF | 0020 |
| RE | 0004 |
| RESTART | 1085 |
| RIE | 0020 |
| ROMBASE | 1000 |
| ROMHI | 8000 |
| ROMTS_END | 7120 |
| ROM_TS | 7000 |
| SAVE_HEAD | 3346 |
| SBK | 0001 |
| SCCR1 | 002C |
| SCCR2 | 002D |
| SCDR | 002F |
| SCN_LP0 | 1554 |
| SCN_LP1 | 158E |
| SCN_LSK1 | 155C |
| SCN_LSK2 | 1564 |
| SCN_OUT | 15AF |
| SCN_SK1 | 159B |
| SCN_SK2 | 15A1 |
| SCN_SK3 | 15A8 |
| SCN_SK4 | 15AD |
| SCSR | 002E |
| SC_X1 | 1314 |
| SC_X2 | 131A |
| SDL_LP1 | 35BF |
| SDL_LP2 | 35CC |
| SD_IN1 | 3404 |
| SD_LP0 | 3416 |
| SD_LP1 | 3443 |
| SD_OUT0 | 3428 |
| SD_OUT1 | 3455 |
| SD_SK01 | 3426 |
| SD_SK11 | 3453 |
| SD_SK31 | 3474 |
| SD_SK32 | 349F |
| SD_SK41 | 34A7 |
| SD_SK42 | 34BB |
| SEL_TS | 242D |
| SER_NUM | 169E |
| SER_SK1 | 1062 |
| SETUP | 1BD0 |
| SET_DFLT | 33FB |
| SET_LN | 12D6 |
| SFLAGS | 0043 |

| | |
|---|---|
| SFS_LP0 | 14BB |
| SFS_LP1 | 14E2 |
| SFS_LSK1 | 14C0 |
| SFS_LSK2 | 14C6 |
| SFS_OUT | 1501 |
| SFS_SK1 | 14EF |
| SFS_SK2 | 14F5 |
| SFS_SK3 | 14FA |
| SFS_SK4 | 14FF |
| SHL_DSK1 | 1489 |
| SHL_DSK2 | 148C |
| SHL_LP0 | 1478 |
| SHL_LP1 | 1492 |
| SHL_OUT | 14B8 |
| SHL_SK1 | 149F |
| SHL_SK2 | 14A5 |
| SHL_SK3 | 14AD |
| SHL_SK4 | 14B6 |
| SLCT_CONTRAST | 1553 |
| SLCT_FST_SLO | 14BA |
| SLCT_HI_LOW | 1477 |
| SLCT_ON_OFF | 143A |
| SLCT_UP_DOWN | 1503 |
| SN_KSK1 | 16F6 |
| SN_KSK11 | 16F2 |
| SN_KSK2 | 1707 |
| SN_KSK21 | 1703 |
| SN_KSK3 | 1729 |
| SN_KSK4 | 1735 |
| SN_KSK5 | 176A |
| SN_KSK50 | 1750 |
| SN_KSK51 | 1754 |
| SN_KSK52 | 1756 |
| SN_LP1 | 16CB |
| SN_LP2 | 16E0 |
| SN_OUT1 | 176D |
| SN_SK1 | 16D5 |
| SOF_DSK1 | 144C |
| SOF_DSK2 | 144F |
| SOF_LP0 | 143B |
| SOF_LP1 | 1455 |
| SOF_OUT | 1475 |
| SOF_SK1 | 1462 |
| SOF_SK2 | 1468 |
| SOF_SK3 | 146D |
| SOF_SK4 | 1473 |
| SPCR | 0028 |
| SPDR | 002A |
| SPI_DLY | 35B8 |
| SPI_SEND | 3570 |
| SPSR | 0029 |
| STACK | 00FF |
| START | 1000 |
| STRCH | 2B9B |
| STRCH_CHK | 2CA7 |
| STRCH_CHK1 | 2CC9 |
| STRCH_CHK2 | 2CCC |
| STRCH_CHK3 | 2D24 |
| STRCH_CNCL | 2C95 |
| STRCH_COPY | 2DBF |
| STRCH_CPY10 | 2DD1 |
| STRCH_CPY20 | 2E4C |
| STRCH_CPY21 | 2E65 |
| STRCH_CPY25 | 2E6C |
| STRCH_CPY26 | 2E6F |
| STRCH_CPY30 | 2ED5 |
| STRCH_DC10 | 2E3C |
| STRCH_DEL | 2D78 |

| | |
|---|---|
| STRCH_DEL1 | 2F46 |
| STRCH_DEL2 | 2F69 |
| STRCH_DEL21 | 2F5F |
| STRCH_DEL25 | 2F66 |
| STRCH_EDIT | 2F73 |
| STRCH_NAME | 2C2C |
| STRCH_NEW | 2BE8 |
| STRCH_NM2 | 2C41 |
| STRCH_NO1 | 2C0F |
| STRCH_NO3 | 2ED2 |
| STRCH_NW10 | 2C06 |
| STRCH_RUN | 2CA4 |
| STRCH_ST10 | 2FEE |
| STRCH_ST11 | 3006 |
| STRCH_ST19 | 3019 |
| STRCH_ST20 | 3021 |
| STRCH_STOP | 2FCC |
| STRCH_STRT | 2C20 |
| STS_BACK | 25FE |
| STS_CNCL | 26E0 |
| STS_DONE | 26E8 |
| STS_FWD | 2638 |
| STS_LP2 | 24A7 |
| STS_LP3 | 24C1 |
| STS_LP31 | 252E |
| STS_LP4 | 2606 |
| STS_LP5 | 267A |
| STS_LP9 | 26CD |
| STS_NONE | 26B4 |
| STS_OUT5 | 2688 |
| STS_SK01 | 244F |
| STS_SK02 | 2467 |
| STS_SK11 | 247D |
| STS_SK12 | 2483 |
| STS_SK13 | 24A2 |
| STS_SK15 | 24A5 |
| STS_SK30 | 24C4 |
| STS_SK31 | 24F6 |
| STS_SK32 | 24FA |
| STS_SK33 | 2514 |
| STS_SK34 | 2517 |
| STS_SK35 | 2528 |
| STS_SK36 | 253E |
| STS_SK37 | 254C |
| STS_SK38 | 258A |
| STS_SK39 | 25C4 |
| STS_SK41 | 261A |
| STS_SK42 | 2620 |
| STS_SK43 | 2625 |
| STS_SK44 | 2628 |
| STS_SK49 | 2632 |
| STS_SK50 | 265D |
| STS_SK51 | 2661 |
| STS_SK52 | 2664 |
| STS_SK59 | 266B |
| STS_SK61 | 2672 |
| STS_SK91 | 26C7 |
| STS_SK92 | 26CA |
| STS_SK95 | 26D7 |
| STS_SLCT | 2675 |
| STUP_SK03 | 1BFF |
| STUP_SK13 | 1C2F |
| STUP_SK41 | 1C5A |
| STUP_SK42 | 1C5F |
| STUP_SK43 | 1C6A |
| STUP_SK71 | 1C74 |
| STUP_SK74 | 1CBB |
| STUP_SK75 | 1CBE |

| | |
|---|---|
| STUP_SK76 | 1CC1 |
| SUD_LP0 | 1504 |
| SUD_LP1 | 152D |
| SUD_LSK1 | 150C |
| SUD_LSK2 | 1514 |
| SUD_OUT | 154E |
| SUD_SK1 | 153A |
| SUD_SK2 | 1540 |
| SUD_SK3 | 1547 |
| SUD_SK4 | 154C |
| SVH_SK12 | 3374 |
| SVH_SK21 | 337C |
| SVH_SK22 | 3390 |
| S_AN | 6DF0 |
| S_KEY0 | 6DF3 |
| S_KEY1 | 6DF7 |
| S_KEY2 | 6DFB |
| S_KEY3 | 6DFF |
| S_MUTEOF | 6DEE |
| S_MUTEON | 6DEC |
| S_OCT | 6DE0 |
| S_OOF1 | 6DE9 |
| S_OOF2 | 6DE6 |
| S_SEQ | 6DCA |
| S_STRCH | 6DD8 |
| S_TMPR | 6DD0 |
| T1D-LP | 1190 |
| T1_DLY | 118A |
| T2D-LP | 119D |
| T2_DLY | 1197 |
| TA_LP0 | 1420 |
| TA_OUT | 1438 |
| TA_SK1 | 142F |
| TA_SK2 | 1436 |
| TC | 0040 |
| TCIE | 0040 |
| TCNT | 000E |
| TCTL1 | 0020 |
| TCTL2 | 0021 |
| TDRE | 0080 |
| TD_END | 7120 |
| TE | 0008 |
| TEST_FILE | 30C0 |
| TEST_LP | 107A |
| TEST_SHOW | 3503 |
| TFLG1 | 0023 |
| TFLG2 | 0025 |
| TF_DONE | 313C |
| TF_LP3 | 30E1 |
| TF_SK11 | 30CE |
| TF_SK12 | 30D9 |
| TF_SK21 | 30F1 |
| TF_SK22 | 30FD |
| TF_SK23 | 3111 |
| TF_SK24 | 3129 |
| TF_SK25 | 3135 |
| TIE | 0080 |
| TIMER | 1178 |
| TIME_X1 | 117A |
| TIME_X2 | 117E |
| TK_OFF | 0050 |
| TMPR | 26F1 |
| TMPR_CHK | 2800 |
| TMPR_CHK1 | 2822 |
| TMPR_CHK2 | 2825 |
| TMPR_CHK3 | 287D |
| TMPR_CNCL | 27EE |
| TMPR_COPY | 2918 |

| | |
|---|---|
| TMPR_CPY10 | 292A |
| TMPR_CPY20 | 29A5 |
| TMPR_CPY21 | 29BE |
| TMPR_CPY25 | 29C5 |
| TMPR_CPY26 | 29C8 |
| TMPR_CPY30 | 2A2E |
| TMPR_DC10 | 2995 |
| TMPR_DEF | 7020 |
| TMPR_DEL | 28D1 |
| TMPR_DEL1 | 2AA2 |
| TMPR_DEL2 | 2AC5 |
| TMPR_DEL21 | 2ABB |
| TMPR_DEL25 | 2AC2 |
| TMPR_EDIT | 2ACF |
| TMPR_NAME | 2782 |
| TMPR_NEW | 273E |
| TMPR_NM2 | 2797 |
| TMPR_NO1 | 2765 |
| TMPR_NO3 | 2A2B |
| TMPR_NW10 | 275C |
| TMPR_RUN | 27FD |
| TMPR_ST10 | 2B4A |
| TMPR_ST11 | 2B62 |
| TMPR_ST19 | 2B75 |
| TMPR_ST20 | 2B7D |
| TMPR_STOP | 2B28 |
| TMPR_STRT | 2776 |
| TMSK1 | 0022 |
| TMSK2 | 0024 |
| TOC1 | 0016 |
| TOC2 | 0018 |
| TOC3 | 001A |
| TOF | 0080 |
| TRY_AGAIN | 1403 |
| TS_DOFF | 0002 |
| TS_FOFF | 001E |
| TS_NAME | 0049 |
| TS_NOFF | 001A |
| TT01_NAME | 703A |
| TT01_TPTR | 7020 |
| TT02_NAME | 705A |
| TT02_TPTR | 7040 |
| TT03_NAME | 707A |
| TT03_TPTR | 7060 |
| TT04_NAME | 709A |
| TT04_TPTR | 7080 |
| TT05_NAME | 70BA |
| TT05_TPTR | 70A0 |
| TT06_NAME | 70DA |
| TT06_TPTR | 70C0 |
| TT07_NAME | 70FA |
| TT07_TPTR | 70E0 |
| TT08_NAME | 711A |
| TT08_TPTR | 7100 |
| TTT_LP1 | 3521 |
| TTT_LP2 | 353E |
| TTT_OUT | 356F |
| TTT_SK1 | 3554 |
| TTT_SK2 | 355B |
| TTT_SK3 | 3562 |
| TTT_SK4 | 356D |
| TWU | 0002 |
| TYP_EM | 0000 |
| TYP_Q0 | 0006 |
| TYP_QD | 0003 |
| TYP_S0 | 0008 |
| TYP_S7 | 000F |
| TYP_SD | 0005 |

| | |
|---|---|
| TYP_SH | 0001 |
| TYP_SI | 0002 |
| TYP_T0 | 0007 |
| TYP_TD | 0004 |
| T_KEY | 004F |
| T_TMPR01 | 7020 |
| T_TMPR02 | 7040 |
| T_TMPR03 | 7060 |
| T_TMPR04 | 7080 |
| T_TMPR05 | 70A0 |
| T_TMPR06 | 70C0 |
| T_TMPR07 | 70E0 |
| T_TMPR08 | 7100 |
| UD_SK1 | 1998 |
| UD_SK11 | 199F |
| UD_SK2 | 19AF |
| UD_SK3 | 19AF |
| UD_SK4 | 19C0 |
| UD_SK5 | 19C9 |
| UD_SK51 | 19D0 |
| UD_SK6 | 19DA |
| UD_SK7 | 19EB |
| UPDATE | 1935 |
| VC_SK1 | 1903 |
| VC_SK2 | 191C |
| VC_SK3 | 1929 |
| VERNIER | 17D9 |
| VERN_STR | 11B4 |
| VRN_LP1 | 1810 |
| VRN_LP2 | 181F |
| VRN_OUT | 1862 |
| VRN_SK1 | 17E3 |
| VRN_SK2 | 17EB |
| VRN_SK3 | 183B |
| VRN_SK31 | 1837 |
| VRN_SK4 | 1852 |
| VRN_SK41 | 184E |
| VRN_SK6 | 1860 |
| VS_NEG | 11CE |
| VS_SK1 | 11D6 |
| VS_SK2 | 11F1 |
| VS_SK3 | 11FE |
| VS_ZERO | 11CA |
| VU_LP1 | 19FB |
| VU_SK5 | 1A05 |
| V_CALC | 18C8 |
| V_DISP | 18B7 |
| V_INC1 | 7C00 |
| V_INC2 | 7C01 |
| V_INC3 | 7C02 |
| V_MAX | 01F4 |
| V_MIN | FE0C |
| V_SCL | 0046 |
| V_TEMP | 009E |
| V_UPDATE | 19EF |
| V_VAL | 0044 |
| WAIT_KEY | 1388 |
| WAIT_NONE | 1331 |
| WAIT_X1 | 1333 |
| WK_DONE | 13C1 |
| WK_OUT | 13C0 |
| WK_X0 | 138E |
| WK_X1 | 1394 |
| XINT_ACO | 7DF0 |
| XINT_CLK | 7EF0 |
| XINT_COP | 7EE0 |
| XINT_EDGE | 7DE0 |
| XINT_IRQ | 7EA0 |

```
XINT_OP          7ED0
XINT_RT          7E90
XINT_SCI         7DC0
XINT_SPI         7DD0
XINT_SW          7EC0
XINT_TI1         7E80
XINT_TI2         7E70
XINT_TI3         7E60
XINT_TO1         7E50
XINT_TO2         7E40
XINT_TO3         7E30
XINT_TO4         7E20
XINT_TO5         7E10
XINT_TOF         7E00
XINT_XIRQ        7EB0
X_MSG1           7C70
X_MSG2           7C85
X_MSG3           7C9A
X_MSG4           7CAF
-----------------------------------------------------
```

CENT OFFSET TABLE

```
S0030000FC
S1138000128EACCA128EF30A128F394C128F7F8EE5
S1138010128FC5D112900C161290525B129098A236
S11380201290DEE91291253212916B7B1291B1C646
S11380301291F81112923E5E129284AC1292CAFB13
S11380401293114B1293579B12939DED1293E4409C
S113805012942A94129470E91294B73F1294FD96E4
S1138060129543EF12958A481295D0A2129616FDE6
S113807012965D5A1296A3B71296EA1512973075A6
S1138080129776D51297BD3712980399129849FD25
S11380901298906112 98D6C712991D2E1299639660
S11380A01299A9FE1299F068129A36D3129A7D3F5A
S11380B0129AC3AC129B0A1A129B5089129B96F90E
S11380C0129BDD6A129C23DC129C6A50129CB0C481
S11380D0129CF739129D3DB0129D8427129DCA9FB0
S11380E0129E1119129E5793129E9E0F129EE48B9C
S11380F0129F2B09129F7188129FB807129FFE8846
S113810012A0450A12A08B8D12A0D21112A11896AA
S113811012A15F1C12A1A5A312A1EC2B12A232B4CE
S113812012A2793E12A2BFC912A3065512A34CE3B0
S113813012A3937112A3DA0012A4209112A467224D
S113814012A4ADB512A4F44812A53ADD12A58172A9
S113815012A5C80912A60EA112A6553A12A69BD3BF
S113816012A6E26E12A7290A12A76FA712A7B64594
S113817012A7FCE412A8438412A88A2512A8D0C727
S113818012A9176A12A95E0F12A9A4B412A9EB5A74
S113819012AA320212AA78AA12AABF5412AB05FE7E
S11381A012AB4CAA12AB935612ABDA0412AC20B346
S11381B012AC676212ACAE1312ACF4C512AD3B78CC
S11381C012AD822C12ADC8E112AE0F9712AE564E0C
S11381D012AE9D0612AEE3BF12AF2A7912AF71340C
S11381E012AFB7F112AFFEAE12B0456C12B08C2CC8
S11381F012B0D2EC12B119AE12B1607012B1A73440
S113820012B1EDF912B234BE12B27B8512B2C24D74
S113821012B3091612B34FDF12B396AA12B3DD7666
S113822012B4244312B46B1212B4B1E112B4F8B113
S113823012B53F8212B5865412B5CD2812B613FC7E
S113824012B65AD112B6A1A812B6E87F12B72F58A7
S113825012B7763112B7BD0C12B803E812B84AC48B
S113826012B891A212B8D88112B91F6112B966422C
S113827012B9AD2412B9F40712BA3AEB12BA81D08A
S113828012BAC8B612BB0F9D12BB568612BB9D6FA5
S113829012BBE45912BC2B4512BC723112BCB91F7B
S11382A012BD000D12BD46FD12BD8DEE12BDD4DF10
S11382B012BE1BD212BE62C612BEA9BB12BEF0B160
S11382C012BF37A812BF7EA012BFC59912C00C936B
S11382D012C0538E12C09A8A12C0E18712C1288636
S11382E012C16F8512C1B68512C1FD8712C24489BD
S11382F012C28B8D12C2D29112C3199712C3609EFF
S113830012C3A7A612C3EEAE12C435B812C47CC3FE
S113831012C4C3CF12C50ADC12C551EA12C598F9BA
S113832012C5E00912C6271B12C66E2D12C6B5402F
S113833012C6FC5412C7436A12C78A8012C7D19866
S113834012C818B012C85FCA12C8A6E512C8EE0057
S113835012C9351D12C97C3B12C9C35A12CA0A7A02
S113836012CA519B12CA98BD12CADFE012CB27046D
S113837012CB6E2912CBB54F12CBFC7712CC439F94
S113838012CC8AC812CCD1F312CD191E12CD604B77
S113839012CDA77812CDEEA712CE35D712CE7D0816
S11383A012CEC43912CF0B6C12CF52A012CF99D572
S11383B012CFE10B12D0284212D06F7A12D0B6B489
```

S11383C012D0FDEE12D1452912D18C6512D1D3A35E
S11383D012D21AE112D2622112D2A96112D2F0A3EE
S11383E012D337E612D37F2912D3C66E12D40DB43A
S11383F012D454FB12D49C4312D4E38C12D52AD643
S113840012D5722112D5B96D12D600BA12D6480807
S113841012D68F5812D6D6A812D71DF912D7654C8A
S113842012D7ACA012D7F3F412D83B4A12D882A0C8
S113843012D8C9F812D9115112D958AB12D9A006C1
S113844012D9E76212DA2EBF12DA761D12DABD7C77
S113845012DB04DC12DB4C3D12DB93A012DBDB03EA
S113846012DC226712DC69CD12DCB13312DCF89B1A
S113847012DD400412DD876D12DDCED812DE164403
S113848012DE5DB112DEA51F12DEEC8E12DF33FEAA
S113849012DF7B6F12DFC2E112E00A5412E051C80E
S11384A012E0993E12E0E0B412E1282B12E16FA42D
S11384B012E1B71D12E1FE9812E2461412E28D9009
S11384C012E2D50E12E31C8D12E3640D12E3AB8E9F
S11384D012E3F31012E43A9312E4821712E4C99CF3
S11384E012E5112212E558AA12E5A03212E5E7BB03
S11384F012E62F4612E676D112E6BE5E12E705ECCE
S113850012E74D7A12E7950A12E7DC9B12E8242D54
S113851012E86BC012E8B35412E8FAE912E9427F98
S113852012E98A1612E9D1AE12EA194712EA60E298
S113853012EAA87D12EAF01A12EB37B712EB7F5653
S113854012EBC6F512EC0E9612EC563812EC9DDBCB
S113855012ECE57E12ED2D2312ED74C912EDBC7000
S113856012EE041812EE4BC212EE936C12EEDB17ED
S113857012EF22C312EF6A7112EFB21F12EFF9CF9A
S113858012F0417F12F0893112F0D0E412F1189701
S113859012F1604C12F1A80212F1EFB912F2377124
S11385A012F27F2A12F2C6E412F30EA012F3565C02
S11385B012F39E1912F3E5D712F42D9712F475579E
S11385C012F4BD1912F504DC12F54C9F12F59464F3
S11385D012F5DC2A12F623F112F66BB812F6B38107
S11385E012F6FB4B12F7431712F78AE312F7D2B0D5
S11385F012F81A7E12F8624E12F8AA1E12F8F1F05E
S113860012F939C212F9819612F9C96A12FA1140A3
S113861012FA591712FAA0EF12FAE8C812FB30A2A4
S113862012FB787D12FBC05912FC083612FC501460
S113863012FC97F312FCDFD412FD27B512FD6F98DC
S113864012FDB77B12FDFF6012FE474512FE8F2C10
S113865012FED71412FF1EFD12FF66E712FFAED200
S113866012FFF6BE13003EAB130086991300CE88AA
S1138670130116781301 5E6A1301A65C1301EE5010
S1138680130236441302 7E3A1302C63113030E2832
S1138690130356211303 9E1B1303E61613042E1211
S11386A01304760F1304BE0D1305060C13054E0DAB
S11386B01305960E1305DE1013062614130 66E1802
S11386C01306B61E1306FE241307462C13078E3515
S11386D01307D63F13081E4A130866561308AE63E1
S11386E01308F67113093E80130986901309CEA26C
S11386F0130A16B4130A5EC7130AA6DC130AEEF1B2
S1138700130B3708130B7F20130BC739130C0F52AD
S1138710130C576D130C9F89130CE7A6130D2FC46C
S1138720130D77E3130DC004130E0825130E5047E1
S1138730130E986B130EE08F130F28B5130F70DB15
S1138740130FB9031310012C131049561310918100
S11387501310D9AD131121DA13116A081311B237AA
S11387601311FA671312429813128ACB1312D2FE12
S113877013131B33131363681313AB9F1313F3D730
S113878013143C0F131484491314CC84131514C00C
S113879013155CFD1315A53B1315ED7B131635BBA3
S11387A013167DFC1316C63E13170E82131756C6F6
S11387B013179F0C1317E75313182F9A131877E303
S11387C01318C02D13190878131950C413199911CB

S11387D01319E15F131A29AE131A71FF131ABA5051
S11387E0131B02A3131B4AF6131B934B131BDBA08F
S11387F0131C23F7131C6C4F131CB4A8131CFD018A
S1138800131D455C131D8DB8131DD616131E1E743F
S1138810131E66D3131EAF33131EF795131F3FF7B2
S1138820131F885B131FD0BF132019251320618CDD
S11388301320A9F41320F25D13213AC713218332C4
S11388401321CB9E1322140B13225C791322A4E868
S11388501322ED59132335CA13237E3D1323C6B0C7
S113886013240F251324579B1324A0121324E88ADE
S1138870132531031325797D1325C1F813260A74B2
S1138880132652F113269B6F1326E3EF13272C6F45
S1138890132774F11327BD73132805F713284E7C8F
S11388A0132897021328DF8913292811329709A92
S11388B01329B924132A01AF132A4A3B132A92C954
S11388C0132ADB57132B23E6132B6C77132BB509D1
S11388D0132BFD9B132C462F132C8EC4132CD75A09
S11388E0132D1FF1132D6889132DB122132DF9BCFB
S11388F0132E4258132E8AF4132ED391132F1C30A7
S1138900132F64CF132FAD70132FF61213303EB50F
S113891013308758133 0CFFD133118A31331614B33
S11389201331A9F31331F29C13323B46133283F211
S11389301332CC9E1333154C13335DFA1333A6AAAA
S11389401333EF5B1334380D133480C01334C974FC
S113895013351229133 55ADF1335A3961335EC4E0C
S113896013363508133 67DC21336C67E13370F3AD5
S1138970133757F81337A0B71337E977133832375B
S1138980133 87AF91338C3BC13390C81133955469B
S1138990133 99E0C1339E6D3133A2F9C133A786596
S11389A0133AC130133B09FC133B52C8133B9B964B
S11389B0133BE465133C2D35133C7606133CBED8BB
S11389C0133D07AB133D5080133D9955133DE22CE5
S11389D0133E2B03133E73DC133EBCB5133F0590CB
S11389E0133F4E6C133F9749133FE027134029066A
S11389F0134071E61340BAC7134103A913414C8DC8
S1138A00134195711341DE571342273D13427025DC
S1138A101342B90E134301F813434AE2134393CEAE
S1138A201343DCBB134425AA13446E991344B7893A
S1138A301345007B1345496D134592611345DB557E
S1138A401346244B13466D421346B6391346FF3280
S1138A501347482C134791271347DA24134823213B
S1138A6013486C1F1348B51F1348FE1F13494721B1
S1138A70134990231349D927134A222C134A6B32E2
S1138A80134AB439134AFD41134B464A134B8F54CE
S1138A90134BD85F134C216C134C6A79134CB38875
S1138AA0134CFC97134D45A8134D8EBA134DD7CDD7
S1138AB0134E20E0134E69F5134EB30C134EFC23F2
S1138AC0134F453B134F8E54134FD76F1350208AC7
S1138AD0135069A71350B2C41350FBE31351450359
S1138AE013518E241351D7461352206913526 98DA2
S1138AF01352B2B21352FBD91353450013538E28A9
S1138B001353D7521354207D135469A81354B2D568
S1138B101354FC031355453213558E621355D793E2
S1138B20135620C5135669F91356B32D1356FC6218
S1138B301357459913578ED11357D8091358214306
S1138B4013586A7E1358B3BA1358FCF713594635B1
S1138B5013598F741359D8B5135A21F6135A6B3815
S1138B60135AB47C135AFDC1135B4706135B904D33
S1138B70135BD995135C22DE135C6C28135CB5730C
S1138B80135CFEBF135D480C135D915B135DDAAAA1
S1138B90135E23FB135E6D4C135EB69F135EFFF3EF
S1138BA0135F4948135F929E135FDBF51360254DF5
S1138BB013606EA61360B8001361015C13614AB8B8
S1138BC01361941613 61DD75136226D41362703534
S1138BD01362B997136302FA13634C5E136395C36C

S1138BE01363DF2913642891136471F91364BB635D
S1138BF0136504CD13654E39136597A61365E11308
S1138C0013662A82136673F21366BD63136706D66E
S1138C1013675049136799BD1367E33313682CA98D
S1138C2013687621136 8BF99136909131369528E67
S1138C3013699C0A1369E587136A2F05136A7884FC
S1138C40136AC205136B0B86136B5509136B9E8C49
S1138C50136BE811136C3196136C7B1D136CC4A554
S1138C60136D0E2E136D57B8136DA143136DEAD017
S1138C70136E345D136E7DEC136EC77B136F110C92
S1138C80136F5A9D136FA430136FEDC413703759CB
S1138C90137080EF1370CA861371141E13715DB8BC
S1138CA01371A7521371F0EE13723A8A1372842867
S1138CB01372CDC713731766137361071373AAA9CD
S1138CC01373F44D13743DF1137487961374D13CEC
S1138CD013751AE41375648C1375AE361375F7E1C6
S1138CE01376418D13768B3A1376D4E813771E9757
S1138CF0137768471377B1F81377FBAA1378455EA7
S1138D0013788F121378D8C81379227F13796C37AC
S1138D101379B5EF1379FFA9137A4965137A93216F
S1138D20137ADCDE137B269C137B705C137BBA1CEA
S1138D30137C03DE137C4DA1137C9764137CE1291F
S1138D40137D2AEF137D74B6137DBE7F137E08480E
S1138D50137E5212137E9BDE137EE5AA137F2F78B7
S1138D60137F7947137FC31613800CE7138056B91A
S1138D701380A08C1380EA601381343613817E0C37
S1138D801381C7E4138211BC13825B961382A5700E
S1138D901382EF4C1383392913838307138 3CCE69F
S1138DA0138416C6138460A81384AA8A1384F46EE9
S1138DB013853E5213858838138 5D21F13861C06EB
S1138DC0138665EF1386AFD91386F9C4138743B1AD
S1138DD013878D9E1387D78C1388217C13886B6C23
S1138DE01388B55E1388FF5113894945138 9933A53
S1138DF01389DD30138A2727138A711F138ABB183E
S1138E00138B0513138B4F0E138B990B138BE309E1
S1138E10138C2D08138C7707138CC108138D0B0A40
S1138E20138D550E138D9F12138DE917138E331E58
S1138E30138E7D25138EC72E138F1138138F5B432A
S1138E40138FA54E138FEF5B1390396A13908379B8
S1138E501390CD891391179B139161AD1391ABC1FD
S1138E601391F5D513923FEB13928A021392D41AFD
S1138E7013931E331393684D1393B2691393FC85B4
S1138E80139446A2139490C11394DAE11395250127
S1138E9013956F231395B9461396036A13964D8F52
S1138EA0139697B61396E1DD13972C051397762F37
S1138EB01397C05913980A85139854B213989EE0D7
S1138EC01398E90F1399333F13997D701399C7A22F
S1138ED0139A11D6139A5C0A139AA640139AF07740
S1138EE0139B3AAE139B84E7139BCF21139C195C0D
S1138EF0139C6399139CADD6139CF814139D425490
S1138F00139D8C94139DD6D6139E2119139E6B5CCE
S1138F10139EB5A1139EFFE7139F4A2F139F9477C7
S1138F20139FDEC013A0290B13A0735613A0BDA377
S1138F3013A107F113A1523F13A19C8F13A1E6E0E3
S1138F4013A2313313A27B8613A2C5DA13A3103004
S1138F5013A35A8613A3A4DE13A3EF3713A43990E3
S1138F6013A483EB13A4CE4713A518A413A563037A
S1138F7013A5AD6213A5F7C213A6422413A68C87CA
S1138F8013A6D6EA13A7214F13A76BB513A7B61CD4
S1138F9013A8008413A84AED13A8955813A8DFC397
S1138FA013A92A3013A9749D13A9BF0C13AA097C11
S1138FB013AA53ED13AA9E5F13AAE8D213AB334648
S1138FC013AB7DBC13ABC83213AC12AA13AC5D2235
S1138FD013ACA79C13ACF21713AD3C9313AD8710DD
S1138FE013ADD18E13AE1C0D13AE668E13AEB10F3E

S1138FF013AEFB9213AF461513AF909A13AFDB2059
S113900013B025A713B0702F13B0BAB813B105422B
S113901013B14FCE13B19A5A13B1E4E813B22F77B8
S113902013B27A0613B2C49713B30F2913B359BCFE
S113903013B3A45013B3EEE613B4397C13B48414FD
S113904013B4CEAC13B5194613B563E113B5AE7DB5
S113905013B5F91A13B643B813B68E5713B6D8F727
S113906013B7239913B76E3B13B7B8DF13B8038450
S113907013B84E2A13B898D113B8E37913B92E2232
S113908013B978CC13B9C37713BA0E2413BA58D1D1
S113909013BAA38013BAEE3013BB38E113BB839326
S11390A013BBCE4613BC18FA13BC63AF13BCAE6635
S11390B013BCF91D13BD43D613BD8E9013BDD94BFC
S11390C013BE240613BE6EC413BEB98213BF04417B
S11390D013BF4F0113BF99C313BFE48513C02F49B6
S11390E013C07A0E13C0C4D413C10F9B13C15A63A7
S11390F013C1A52C13C1EFF613C23AC213C2858E55
S113910013C2D05C13C31B2B13C365FA13C3B0CBB8
S113911013C3FB9D13C4467113C4914513C4DC1AD5
S113912013C526F113C571C813C5BCA113C6077BAB
S113913013C6525613C69D3213C6E80F13C732ED39
S113914013C77DCC13C7C8AD13C8138E13C85E7183
S113915013C8A95513C8F43A13C93F2013C98A0781
S113916013C9D4EF13CA1FD813CA6AC313CAB5AE3E
S113917013CB009B13CB4B8813CB967713CBE167B0
S113918013CC2C5813CC774A13CCC23E13CD0D32DA
S113919013CD582813CDA31E13CDEE1613CE390FBD
S11391A013CE840913CECF0413CF1A0013CF64FD5A
S11391B013CFAFFB13CFFAFB13D045FB13D090FDB5
S11391C013D0DC0013D1270413D1720913D1BD0FBE
S11391D013D2081613D2531F13D29E2813D2E93385
S11391E013D3343E13D37F4B13D3CA5913D4156806
S11391F013D4607813D4AB8913D4F69C13D541AF40
S113920013D58CC313D5D7D913D622F013D66E0831
S113921013D6B92113D7043B13D74F5613D79A72D9
S113922013D7E59013D830AE13D87BCE13D8C6EF3E
S113923013D9121113D95D3413D9A85813D9F37D56
S113924013DA3EA313DA89CB13DAD4F313DB201D2C
S113925013DB6B4813DBB67413DC01A113DC4CCFB6
S113926013DC97FE13DCE32E13DD2E6013DD7992FD
S113927013DDC4C613DE0FFB13DE5B3113DEA668F9
S113928013DEF1A013DF3CD913DF881313DFD34FB0
S113929013E01E8B13E069C913E0B50813E100481D
S11392A013E14B8913E196CB13E1E20E13E22D5245
S11392B013E2789813E2C3DE13E30F2613E35A6F25
S11392C013E3A5B913E3F10413E43C5013E4879DBD
S11392D013E4D2EC13E51E3B13E5698C13E5B4DD0E
S11392E013E6003013E64B8413E696D913E6E22F17
S11392F013E72D8713E778DF13E7C43813E80F93D8
S113930013E85AEF13E8A64C13E8F1AA13E93D0950
S113931013E9886913E9D3CA13EA1F2D13EA6A9083
S113932013EAB5F513EB015B13EB4CC113EB98296E
S113933013EBE39313EC2EFD13EC7A6813ECC5D511
S113934013ED114213ED5CB113EDA82113EDF3926B
S113935013EE3F0413EE8A7713EED5EB13EF21607F
S113936013EF6CD713EFB84F13F003C713F04F414B
S113937013F09ABC13F0E63813F131B513F17D34D0
S113938013F1C8B313F2143413F25FB513F2AB380C
S113939013F2F6BC13F3424113F38DC713F3D94E02
S11393A013F424D713F4706013F4BBEB13F50776AE
S11393B013F5530313F59E9113F5EA2013F635B014
S11393C013F6814213F6CCD413F7186813F763FC31
S11393D013F7AF9213F7FB2913F846C113F8925A07
S11393E013F8DDF413F9299013F9752C13F9C0CA95
S11393F013FA0C6913FA580813FAA3A913FAEF4BDA

S113940013FB3AEF13FB869313FBD23813FC1DDFD7
S113941013FC698613FCB52F13FD00D913FD4C848E
S113942013FD983013FDE3DE13FE2F8C13FE7B3BFC
S113943013FEC6EC13FF129E13FF5E5113FFAA0521
S113944013FFF5BA140041701400 8D271400D8E0FE
S1139450140124991401705414 01BC10140207CD92
S1139460140253 8B14029F4A1402EB0A140336CCE1
S1139470140382 8E1403CE5214041A16140465DCE9
S1139480140 4B1A31404FD6C14054935140594FFA8
S1139490140 5E0CB14062C97140678651406C4341E
S11394A0140 7100414075BD51407A7A71407F37A4D
S11394B014083F4F14088B241408D6FB140922D334
S11394C014096EAC1409BA86140A0661140A523ED1
S11394D0140A9E1B140AE9FA140B35D9140B81BA29
S11394E0140BCD9C140C197F140C6563140CB14837
S11394F0140CFD2F140D4916140D94FF140DE0E9FE
S1139500140E2CD4140E78C0140EC4AD140F109B7A
S1139510140F5C8A140FA87B140FF46D1410405FB1
S113952014108C531410D8481411243E141170369E
S11395301411BC2E141208281412542 21412A01E42
S11395401412EC1B141338191413841 81413D018A0
S113955014141C191414681C1414B42014150024B5
S113956014154C2A141598311415E4391416304284
S113957014167C4D1416C858141714651417607308
S11395801417AC821417F892141844A3141890B545
S11395901418DCC8141928DD141974F21419C1093B
S11395A0141A0D21141A593A141AA554141AF16FE5
S11395B0141B3D8C141B89A9141BD5C8141C21E74A
S11395C0141C6E08141CBA2A141D064D141D527264
S11395D0141D9E97141DEABD141E36E5141E830E39
S11395E0141ECF38141F1B63141F678F141FB3BCC2
S11395F0141FFFEA14204C1A1420984A1420E47C07
S1139600142130AF14217CE31421C9181422154EFF
S1139610142261861422ADBE1422F9F814234633B1
S1139620142392 6F1423DEAC14242AEA1424772919
S1139630142 4C36A14250FAB14255BEE1425A83239
S1139640142 5F476142640BC14268D041426D94C13
S1139650142 72595142771E01427BE2C14280A78A2
S1139660142856C61428A3151428EF6614293BB7EA
S1139670142988091429D45D142A20B2142A6D08E7
S1139680142AB95E142B05B7142B5210142B9E6A9E
S1139690142BEAC6142C3722142C8380142CCFDF0D
S11396A0142D1C3F142D68A0142DB502142E016630
S11396B0142E4DCA142E9A30142EE697142F32FF0E
S11396C0142F7F68142FCBD21430183D143064A9A2
S11396D01430B1171430FD86143149F614319666EE
S11396E01431E2D914322F4C14327BC01432C836F0
S11396F0143314AC143361241433AD9D1433FA17AA
S1139700143446921434930E1434DF8C14352C0A1A
S1139710143578 8A1435C50A1436118C14365E0F44
S1139720143 6AA941436F7191437439F1437902724
S1139730143 7DCB01438293914387 5C41438C250BD
S1139740143 90EDE14395B6C1439A7FC1439F48C0B
S1139750143A411E143A8DB1143ADA45143B26DA10
S1139760143B7370143BC008143C0CA0143C593ACD
S1139770143CA5D5143CF271143D3F0E143D8BAC42
S1139780143DD84B143E24EC143E718D143EBE306F
S1139790143F0AD4143F5779143FA41F143FF0C751
S11397A014403D6F14408A181440D6C31441236FEB
S11397B01441701C1441BCCA14420979144256 2A3B
S11397C01442A2DB1442EF8E14433C41144388F646
S11397D01443D5AC1444226414446F1C1444BBD504
S11397E0144508901445554B1445A2081445EEC67B
S11397F014463B8514468846 1446D507144721C9A8
S113980014476E8D1447BB5214480818144854DF8B

S11398101448A1A71448EE7014493B3B1449880628
S11398201449D4D3144A21A1144A6E70144ABB407B
S1139830144B0811144B54E4144BA1B7144BEE8C85
S1139840144C3B62144C8839144CD511144D21EA44
S1139850144D6EC4144DBBA0144E087C144E555ABE
S1139860144EA239144EEF19144F3BFA144F88DDED
S1139870144FD5C0145022A514506F8A1450BC71D3
S11398801451095914515642145 1A32D1451F0186E
S11398901452 3D05145289F21452D6E1145323D1C3
S11398A0145370C21453BDB414540AA81454579CCE
S11398B01454A4921454F18914553E8114558B7A8E
S11398C01455D8741456256F1456726C1456BF6907
S11398D014570C68145759681457A6691457F36B36
S11398E01458406E14588D731458DA791459277F1C
S11398F0145974871459C190145A0E9A145A5BA6B9
S1139900145AA8B2145AF5C0145B42CE145B8FDE0D
S1139910145BDCEF145C2A01145C7714145CC42916
S1139920145D113E145D5E55145DAB6D145DF886D7
S1139930145E45A0145E92BB145EDFD7145F2CF551
S1139940145F7A14145FC7331460145414606176 7E
S11399501460AE9A1460FBBE146148E41461960A64
S11399601461E3321462305B14627D851462CAB000
S1139970146317DD1463650A1463B2391463FF6852
S11399801464 4C99146499CB1464E6FF146534335D
S11399901465 81681465CE9F14661BD7146669101C
S11399A01466B64A14670385146750C114679DFF93
S11399B01467EB3D1468387D146885BE1468D300C1
S11399C01469204314696D881469BACD146A0814A3
S11399D0146A555B146AA2A4146AEFEE146B3D3A40
S11399E0146B8A86146BD7D3146C2522146C727290
S11399F0146CBFC3146D0D15146D5A68146DA7BC97
S1139A00146DF512146E4268146E8FC0146EDD1955
S1139A10146F2A73146F77CE146FC52A14701288CA
S1139A2014705FE71470AD461470FAA714714809F6
S1139A301471956C1471E2D11472303614727D9DD8
S1139A401472CB051473186E147365D81473B3436E
S1139A50147400AF14744E1D14749B8B1474E8FBBF
S1139A601475366C147583DE1475D15114761EC6C4
S1139A7014766C3B1476B9B21477072A147754A37E
S1139A801477A21D1477EF9814783D1514788A92F0
S1139A901478D811147925911479731214 79C09417
S1139AA0147A0E17147A5B9B147AA921147AF6A8F7
S1139AB0147B442F147B91B8147BDF43147C2CCE8D
S1139AC0147C7A5A147CC7E8147D1577147D6307D7
S1139AD0147DB098147DFE2A147E4BBD147E9952D9
S1139AE0147EE6E7147F347E147F8216147FCFAF92
S1139AF014801D4914806AE41480B8811481061FFF
S1139B00148153BD1481A15D1481EEFE14823CA125
S1139B1014828A441482D7E91483258E14837335FE
S1139B201483C0DD14840E8614845C301484A9DC90
S1139B301484F7881485453614859 2E51485E095D8
S1139B4014862E4614867BF91486C9AC14871761D3
S1139B50148765161487B2CD1488008514884E3F87
S1139B6014889BF91488E9B4148937711489852FF2
S1139B701489D2EE148A20AE148A6E6F148ABC3211
S1139B80148B09F5148B57BA148BA580148BF347E7
S1139B90148C410F148C8ED8148CDCA3148D2A6E73
S1139BA0148D783B148DC609148E13D8148E61A8B5
S1139BB0148EAF7A148EFD4C148F4B20148F98F5AD
S1139BC0148FE6CB149034A21490827A1490D0535C
S1139BD014911E2E14916C0A1491B9E7149207C5BE
S1139BE0149255A41492A3841492F16614933F48DA
S1139BF014938D2C1493DB11149428F7149476DEAB
S1139C001494C4C7149512B01495609B1495AE8730
S1139C101495FC7414964A62149698511496E6426C

```
S1139C20149734331497822614 97D01A14981E0F5D
S1139C3014986C051498B9FD149907F5149955EF07
S1139C401499A3EA1499F1E6149A3FE3149A8DE166
S1139C50149ADBE0149B29E1149B77E3149BC5E67B
S1139C60149C13EA149C61EF149CAFF5149CFDFD45
S1139C70149D4C05149D9A0F149DE81A149E3626C3
S1139C80149E8434149ED242149F2052149F6E62F8
S1139C90149FBC7414A00A8714A0589C14A0A6B1E5
S1139CA014A0F4C814A142DF14A190F814A1DF1287
S1139CB014A22D2D14A27B4914A2C96714A31786DC
S1139CC014A365A514A3B3C614A401E814A4500CEA
S1139CD014A49E3014A4EC5514A53A7C14A588A4AD
S1139CE014A5D6CD14A624F714A6732314A6C14F25
S1139CF014A70F7D14A75DAB14A7ABDB14A7FA0C54
S1139D0014A8483F14A8967214A8E4A714A932DC36
S1139D1014A9811314A9CF4B14AA1D8514AA6BBFCF
S1139D2014AAB9FA14AB083714AB567514ABA4B41F
S1139D3014ABF2F414AC413514AC8F7814ACDDBB25
S1139D4014AD2C0014AD7A4614ADC88D14AE16D5DE
S1139D5014AE651F14AEB36914AF01B514AF50024D
S1139D6014AF9E5014AFEC9F14B03AEF14B0894175
S1139D7014B0D79414B125E714B1743C14B1C29251
S1139D8014B210EA14B25F4214B2AD9C14B2FBF7E1
S1139D9014B34A5314B398B014B3E70E14B4356D26
S1139DA014B483CE14B4D23014B5209214B56EF624
S1139DB014B5BD5C14B60BC214B65A2A14B6A892D4
S1139DC014B6F6FC14B7456714B793D314B7E2403E
S1139DD014B830AF14B87F1F14B8CD8F14B91C0158
S1139DE014B96A7414B9B8E914BA075E14BA55D52B
S1139DF014BAA44D14BAF2C514BB414014BB8FBBB2
S1139E0014BBDE3714BC2CB514BC7B3314BCC9B3EF
S1139E1014BD183414BD66B714BDB53A14BE03BEE0
S1139E2014BE524414BEA0CB14BEEF5314BF3DDC89
S1139E3014BF8C6614BFDAF214C0297F14C0780CE6
S1139E4014C0C69B14C1152B14C163BD14C1B24FF9
S1139E5014C200E314C24F7814C29E0E14C2ECA5BF
S1139E6014C33B3D14C389D614C3D87114C4270D3D
S1139E7014C475AA14C4C44814C512E714C5618770
S1139E8014C5B02914C5FECC14C64D7014C69C1557
S1139E9014C6EABB14C7396214C7880B14C7D6B5F5
S1139EA014C8255F14C8740B14C8C2B914C9116747
S1139EB014C9601614C9AEC714C9FD7914CA4C2C50
S1139EC014CA9AE014CAE99614CB384C14CB87040C
S1139ED014CBD5BD14CC247714CC733214CCC1EE7E
S1139EE014CD10AC14CD5F6A14CDAE2A14CDFCEBA6
S1139EF014CE4BAD14CE9A7114CEE93514CF37FB82
S1139F0014CF86C114CFD58914D0245314D0731D13
S1139F1014D0C1E814D110B514D15F8314D1AE525A
S1139F2014D1FD2214D24BF314D29AC614D2E99957
S1139F3014D3386E14D3874414D3D61B14D424F307
S1079F4014D473CDF1
S9030000FC
```

NOTE OFFSET TABLE

```
S0030000FC
S1139F6010F38F9211F59AC31306FE0A1428A2F96E
S1139F70155B810816A09E6617F910D71965FEA512
S1139F801AE89F991C823E071E3437E72000000020
S1139F9021E71F2523EB3587260DFC14285145F3B3
S10F9FA02AB702112D413CCC2FF221AE57
S9030000FC
```

```
1  *=================================================
                                                   =====
2  *=  Xilinx chip configuration routine #2
                                                       =
3  *=    For tuner control (Modified SSO)
                                                       =
4  *=================================================
                                                   =====
5  *-  Written by  Robert S. Dobrose  03/03/95
                                                       -
6  *-  Copyright  Saracon, Inc.  1995
                                                       -
7  *-------------------------------------------------
                                                   -----
8  *-  This routine configures the Xilinx device from
                                                   the  -
9  *-  configuration data in ROM memory.  It is
                                              written    -
10 *-  as in-line code so no stack is required.  This
                                                       -
11 *-  routine will try several times if the configurat
                                                   ion -
12 *-  fails.
                                                       -
13 *-------------------------------------------------
                                                   -----
14 *-  This routine should be included after Power-On
                                                       -
15 *-  Boot code (anything that must be done immediatel
                                                   y   -
16 *-  on power-up or before the lengthy config code
                                                   time) -
17 *-  and before other initialization code.
                                                       -
18 *-  This code must be done before external memory
                                                   or  -
19 *-  devices are accessed since the Xilinx generates
                                                       -
20 *-  the chip selects and glue logic for these
                                              devices.  -
21 *-  This means that this code should probably be
                                                   done -
22 *-  before setting the EXTRNAL EXTENDED mode for
                                                   the  -
23 *-  HC11 microcontroller.  If serial diagnostics
                                                   are  -
24 *-  desired on a config failure, the serial port
                                                   (SCI) -
25 *-  should be Initialized & configured before this
                                                   code.-
26 *-------------------------------------------------
                                                   -----
27 *- The code reqires 1 temporary internal RAM memory
                                                       -
28 *- location (XTRY) to store the Try count.
                                                       -
29 *- There are 3 EQU's that must be set or may be
                                              changed -
30 *-      XTRIES : Number of configuration tries
                                              before  -
31 *-               lock-up failure. (default = 5)
                                                       -
32 *-      XSTART : Address of start of Xilinx config
                                                       -
33 *-               data storage.  Data must be in
                                                       -
34 *-               HC11 internal ROM memory!!
```

```
35  *-      XEND   : Address of end of Xilinx config
                                                  data.  -
36  *-               We may need to pad this data with
                                                         -
37  *-               several $FF bytes to flush Xilinx
                                                         -
38  *-               internal processes at end of
                                              config.    -
39  *-----------------------------------------------------
                                                    -----
40  *- For the 8 Shoe contact version, the size of the
                                                         -
41  *- data file is 1853 bytes ($73D bytes in hex).
                                                         -
42  *- This leaves 2179 bytes ($883 hex) of memory
                                                  after  -
43  *- subtracting reserved interrupt vector memory.
                                                         -
44  *- For the 16 Shoe contact version, the size of the
                                                         -
45  *- data file is 2777 bytes ($AD9 bytes in hex).
                                                         -
46  *- This leaves 1255 bytes ($4E7 hex) of memory
                                                  after  -
47  *- subtracting reserved interrupt vector memory.
                                                         -
48  *-----------------------------------------------------
                                                    -----
49  *- If we assume the Xilinx code begins at $F000 and
                                                     we  -
50  *- will reserve enough space for the 16 shoe
                                              contact    -
51  *- version (wasting space on the 8 shoe version),
                                                  we     -
52  *- can assume that our RESET VECTOR is $FB00 and
                                                  Boot   -
53  *- code will begin there!  This config code will be
                                                         -
54  *- located after that code and initialization code
                                                   will -
55  *- follow this code.  Initialization code must end
                                                         -
56  *- before $FFC0 as this is the start of the vector
                                                         -
57  *- table!!!  XSTART will then always be $F000.
                                                         -
58  *- XEND will be either $F73D or $FAD9 depending on
                                                    the  -
59  *- shoe contact version.  The space from XEND to
                                                  $FAFF  -
60  *- should be padded to $FF.
                                                         -
61  *-----------------------------------------------------
                                                    -----
62
63  $INCLUDE 'EQUATE11.ASM'        ;Include equates
64  ***************************************************
                                                    *****
65  *  EQUATES for Motorola MC68HC11
66  * - - - - - - - - - - - - - - - - - - - - - - - - -
                                                    - - -
67  *  I/O Registers
68  * - - - - - - - - - - - - - - - - - - - - - - - - -
                                                    - - -
69  PORTA        EQU     $0000   ;Port A
70  PAOUT        EQU     $A0     ;Port A
71  PA7  EQU     $80     ;Port A:7
```

```
0000   PA6  EQU   $40     ;Port A:6
0000   PA5  EQU   $20     ;Port A:5
0000   PA4  EQU   $10     ;Port A:4
0000   PA3  EQU   $08     ;Port A:3
0000   PA2  EQU   $04     ;Port A:2
0000   PA1  EQU   $02     ;Port A:1
0000   PA0  EQU   $01     ;Port A:0

0000   DDRB EQU   $0006   ;Port B Data Direction Reg
0000   PORTB      EQU    $0004   ;Port B
0000   PB7  EQU   $80     ;Port B:7
0000   PB6  EQU   $40     ;Port B:6
0000   PB5  EQU   $20     ;Port B:5
0000   PB4  EQU   $10     ;Port B:4
0000   PB3  EQU   $08     ;Port B:3
0000   PB2  EQU   $04     ;Port B:2
0000   PB1  EQU   $02     ;Port B:1
0000   PB0  EQU   $01     ;Port B:0

0000   PIOC EQU   $0002   ;Port C Control Register
0000   DDRC EQU   $0007   ;Port C Data Direction Reg
0000   PORTC      EQU    $0003   ;Port C
0000   PC7  EQU   $80     ;Port C:7
0000   PC6  EQU   $40     ;Port C:6
0000   PC5  EQU   $20     ;Port C:5
0000   PC4  EQU   $10     ;Port C:4
0000   PC3  EQU   $08     ;Port C:3
0000   PC2  EQU   $04     ;Port C:2
0000   PC1  EQU   $02     ;Port C:1
0000   PC0  EQU   $01     ;Port C:0

0000   DDRD EQU   $0009   ;Port D Data Direction Reg
0000   PORTD      EQU    $0008   ;Port D
0000   PDOUT      EQU    $0D     ;Port D outputs
0000   PD7  EQU   $80     ;Port D:7
0000   PD6  EQU   $40     ;Port D:6
0000   PD5  EQU   $20     ;Port D:5
0000   PD4  EQU   $10     ;Port D:4
0000   PD3  EQU   $08     ;Port D:3
0000   PD2  EQU   $04     ;Port D:2
0000   PD1  EQU   $02     ;Port D:1
0000   PD0  EQU   $01     ;Port D:0

       * - - - - - - - - - - - - - - - - - - - - - - - - - - - - - - - - - - - - - - -
       *  Timer registers
       * - - - - - - - - - - - - - - - - - - - - - - - - - - - - - - - - - - - - - - -
0000   TCTL2      EQU    $0021   ;Timer Control
                                                        Register 2
0000   CFORC      EQU    $000B   ;Timer Compare Force
                                                          Register
0000   OC1M EQU   $000C   ;Output Compare 1 Mask Register
0000   OC1D EQU   $000D   ;Output Compare Data Register
0000   TCNT EQU   $000E   ;Timer Count Register (16 bits)
0000   TCTL1      EQU    $0020   ;Timer Control
                                                        Register 1
0000   TMSK1      EQU    $0022   ;Timer Interrupt Mask
                                                        Register 1
0000   TFLG1      EQU    $0023   ;Timer Flag Register 1
0000   TMSK2      EQU    $0024   ;Timer Interrupt Mask
                                                        Register 2
0000   TFLG2      EQU    $0025   ;Timer Flag Register 2
0000   PACTL      EQU    $0026   ;Pulse Accumulator
                                                  Control Register
0000   PACNT      EQU    $0027   ;Pulse Accumulator
                                                    Count Register
0000   TOF  EQU   $80     ;Timer overflow bit [TFLG2]
```

```
0000    OC1F EQU    $80     ;Output compare 1 flag bit [TFLG1]

0000    TOC1 EQU    $0016   ;Output compare 1 value (16 bits)
0000    TOC2 EQU    $0018   ;Output compare 2 value (16 bits)
0000    TOC3 EQU    $001A   ;Output compare 3 value (16 bits)
        * - - - - - - - - - - - - - - - - - - - - - - - - - - - - - - - -
        *  Serial Peripheral Port
        * - - - - - - - - - - - - - - - - - - - - - - - - - - - - - - - -
0000    SPCR EQU    $0028
0000    SPSR EQU    $0029
0000    SPDR EQU    $002A
        * - - - - - - - - - - - - - - - - - - - - - - - - - - - - - - - -
        *  Serial Com Port
        * - - - - - - - - - - - - - - - - - - - - - - - - - - - - - - - -
0000    SCDR EQU    $002F   ;Serial Com Data Register
0000    SCCR1       EQU     $002C   ;Serial Com Control Reg 1

0000    SCCR2       EQU     $002D   ;Serial Com Control Reg 2
0000    TIE  EQU    $80     ;SCCR2 xmit interrupt enable
0000    TCIE EQU    $40     ;SCCR2 xmit complete intr en
0000    RIE  EQU    $20     ;SCCR2 rcv interrupt enable
0000    ILIE EQU    $10     ;SCCR2 idle line int enable
0000    TE   EQU    $08     ;SCCR2 xmit enable
0000    RE   EQU    $04     ;SCCR2 receive enable
0000    TWU  EQU    $02     ;SCCR2 receiver wakeup
0000    SBK  EQU    $01     ;SCCR2 send break

0000    SCSR EQU    $002E   ;Serial Com Status Register
0000    TDRE EQU    $80     ;SCSR xmit data reg empty
0000    TC   EQU    $40     ;SCSR xmit complete
0000    RDRF EQU    $20     ;SCSR receive data reg full
0000    IDLE EQU    $10     ;SCSR idle line detect
0000    ORUN EQU    $08     ;SCSR overrun error
0000    NF   EQU    $04     ;SCSR noise flag
0000    FE   EQU    $02     ;SCSR framing error

0000    BAUD EQU    $002B   ;Baud Rate Register

        * - - - - - - - - - - - - - - - - - - - - - - - - - - - - - - - -
        * Misc registers
        * - - - - - - - - - - - - - - - - - - - - - - - - - - - - - - - -
0000    HPRIO       EQU     $003C   ;Misc and interrupt priority

        * - - - - - - - - - - - - - - - - - - - - - - - - - - - - - - - -
        * Memory Assignments
        * - - - - - - - - - - - - - - - - - - - - - - - - - - - - - - - -
                                    ;Software map - - - -
0000    STACK       EQU     $00FF   ;Stack location
0000    ROMBASE     EQU     $1000   ;Start of ROM
0000    DEBUG       EQU     $7F00   ;$FF bytes reserved for debugger
```

```
0000          182  E_VECT       EQU     $7DC0   ;EPROM interrupt
                                                        vector table
              183
              184
              185  ;-----------------------------------------------
                                                  ----------------------
              186  ; EPROM (remapped) Interrupt Vector Table
              187  ;-----------------------------------------------
                                                  ----------------------
0000          188  XINT_SCI     EQU     $7DC0   ; serial communication
                                                                  intfc
0000          189  XINT_SPI     EQU     $7DD0   ; serial peripheral
                                                              interface
0000          190  XINT_EDGE    EQU     $7DE0   ; pulse accumulator
                                                            input edge
0000          191  XINT_ACO     EQU     $7DF0   ; pulse accumulator
                                                              overflow
0000          192  XINT_TOF     EQU     $7E00   ; timer overflow
0000          193  XINT_TO5     EQU     $7E10   ; timer output compare
                                                                     5
0000          194  XINT_TO4     EQU     $7E20   ; timer output compare
                                                                     4
0000          195  XINT_TO3     EQU     $7E30   ; timer output compare
                                                                     3
0000          196  XINT_TO2     EQU     $7E40   ; timer output compare
                                                                     2
0000          197  XINT_TO1     EQU     $7E50   ; timer output compare
0000          198  XINT_TI3     EQU     $7E60   ; timer input capture 3
0000          199  XINT_TI2     EQU     $7E70   ; timer input capture 2
0000          200  XINT_TI1     EQU     $7E80   ; timer input capture 1
0000          201  XINT_RT              EQU     $7E90   ; real time
                                                              interrupt
0000          202  XINT_IRQ     EQU     $7EA0   ; IRQ
0000          203  XINT_XIRQ    EQU     $7EB0   ; XIRQ
0000          204  XINT_SW              EQU     $7EC0   ; software
                                                        interrupt (SWI)
0000          205  XINT_OP              EQU     $7ED0   ; illegal
                                                                opcode
0000          206  XINT_COP     EQU     $7EE0   ; COP
0000          207  XINT_CLK     EQU     $7EF0   ; clock monitor
              208
              209
              210
0000          211  MCONFIG EQU     $003F
0000          212  MINIT   EQU     $003D
0000          213  MOPTION EQU     $0039
0000          214  CFGRAM  EQU     $0040
0000          215  CFGCODE EQU     $FB00
0000          216  VECTORS EQU     $FFC0
              217
0000          218  XTRIES  EQU     5       ;Number of config tries
                                                       before failure
0000          219  XSTART  EQU     $F000   ;Start address of Xilinx
                                                         Config code
              220
0000          221  XEND    EQU     $FAD9   ;End address of Xilinx
                                                         Config code
              222
              223
              224  ;**************************************************
              225  ; Define a 1 byte RAM memory location for try count
              226  ;**************************************************
0040          227          ORG     CFGRAM
0040     00   228  XTRY    FCB     $00     ;Config try count register
              229
              230
              231
              232  ;**************************************************
```

```
                    233  ; Time delay macro
                    234  ;   Uses Y Index Register (Alters Index Y)
                    235  ;   Timing loop uses 6 bus cycles per loop.
                    236  ;   Bus clock (E clock) is 2MHz (SYSCLK/4 = 8MHz/4
                                                                    = 2MHz)
                    237  ;   Bus Cycle time = 500 nsec.
                    238  ;   Loop Cycle time = Cycle time * 7 = 3.5 usec
                    239  ; Usage:        WAIT <loop count>
                    240  ; Example:      WAIT #$10        ;delay 16 cycles
                                                                  (-56 usec)
                    241  ;*************************************************
0041                242  $MACRO  WAIT count
                    243          LDY     %1               ;Load A register
                                                       with timing loop count
                    244  TLOOP:  DEY                      ;Decrement loop
                                                                     count
                    245          BNE     TLOOP            ;Loop until time is
                                                                   expired
0041                246  $MACROEND
                    247
                    248
                    249
                    250  ;*************************************************
                    251  ;       MAIN CONFIGURATION CODE STARTS HERE
                    252  ;*************************************************
                    253  ; Initialize XILINX Chip
                    254  ; Load XTRY (RAM Memory) with number of tries
                    255  ;*************************************************
FB00                256          ORG     CFGCODE
                    257  ;*************************************************
                    258  ; Put BOOT initialization stuff here.
                    259  ;*************************************************
                    260  START:
FB00                261          EQU     *
FB00 [06] 143F06    262          BSET    MCONFIG,$06      ; Disable COP & ROM
                                                                   Present
FB03 [06] 1408EC    263          BSET    PORTD,$EC        ;Set PD2-PD4 &
                                                              PD6-PD7 to high
FB06 [06] 150820    264          BCLR    PORTD,$20        ; Set PD5 low
FB09 [06] 1409FC    265          BSET    DDRD,$FC         ;Set bits 2-7 as
                                                            outputs (All high)
FB0C [06] 1408EC    266          BSET    PORTD,$EC        ;Re-Store Port D
                                                                      data
FB0F [06] 150820    267          BCLR    PORTD,$20        ; Set PD5 low
                    268
                    269  XCONFIG:
FB12 [02] 8605      270          LDAA    #XTRIES          ;Try up to 5 times!?
FB14 [03] 9740      271          STAA    XTRY             ;Store data in XTRY
                                                                  location
                    272
                    273  XRESET:
                    274
                    275  ;*************************************************
                    276  ; Set port A control for PA1 & PA2 as inputs
                    277  ;       (No action.  This is hardwired.)
                    278  ; SPI mode will be enabled later!
                    279  ;       (bit 6 [SPE] of SPCR register must be 0)
                    280  ; Set port A control for PA2 & PA4-PA7 as Xilinx
                                                                 config I/O
                    281  ;       PA7 is Bi-directional starting as output,
                    282  ;       PA3-PA5 are outputs
                    283  ;*************************************************
FB16 [06] 1400F8    284          BSET    PORTA,$F8        ; Set all Xilinx
                                                              config pins high
FB19 [06] 142688    285          BSET    PACTL,$88        ; Set PA7 & PA3 to
                                                                    outputs
FB1C [06] 1400F8    286          BSET    PORTA,$F8        ; Set all Xilinx
                                                              config pins high
```

```
                    287
                    288  ;*************************************************
                    289  ; Wait a while so we are sure XRESET stays high for
                                                                    >6 usec
                    290  ;       (Xilinx reset specification for slow power
                                                        ramp conditions!)
                    291  ;*************************************************
FB1F macro          292          WAIT    #$10            ;Delay about 56 usec
FB1F [05] 18DE10    293   LDY %1
FB22 [04] 1809      294  TLOOP: DEY
FB24 [03] 26FC      295   BNE TLOOP
                    296
                    297  ;*************************************************
                    298  ; Pull XRESET and XDP (DONE/PROGRAM) low (PA6 & PA7)
                    299  ;*************************************************
FB26 [06] 1500C0    300          BCLR    PORTA,$C0       ;Reset bit 7 & bit
                                                            6 (Set both low)
                    301
                    302  ;*************************************************
                    303  ; Wait for Xilinx chip to recognize XRESET (at
                                                          least 6 usec)
                    304  ;   Timing loop uses 6 bus cycles per loop.
                    305  ;   Bus clock (E clock) is 2MHz (SYSCLK/4 = 8MHz/4
                                                                  = 2MHz)
                    306  ;   Cycle time = 500 nsec.  Loop time = Cycle time
                                                              * 5 = 2.5 usec
                    307  ;   4 loops = ~10 usec > 6 usec (times 4 to be
                                                        safe!?) Do 16 Loops!
                    308  ;*************************************************
FB29 macro          309          WAIT    #$10            ;Delay about 56 usec
FB29 [05] 18DE10    310   LDY %1
FB2C [04] 1809      311  TLOOP: DEY
FB2E [03] 26FC      312   BNE TLOOP
                    313
                    314  ;*************************************************
                    315  ; Release XRESET & D/Ps
                    316  ;  Do NOT output HIGH on XDP on Port A!  Just change
                    317  ;  to input & allow to float high or low as
                                                              required!!!
                    318  ;*************************************************
FB30 [06] 152680    319          BCLR    PACTL,$80       ; Set PA7 to input
                    320  ;*************************************************
                    321  ; Set XRESET to HIGH
                    322  ;*************************************************
FB33 [06] 140040    323          BSET    PORTA,$40       ;Set Bit 6 to high
                    324
                    325  ;*************************************************
                    326  ;  wait for INIT to go high.  (PA2 = 1)
                    327  ;*************************************************
                    328
                    329  INIT0:
FB36 [02] 01        330          NOP
FB37 [02] 01        331          NOP
FB38 [02] 01        332          NOP
FB39 [03] 9600      333          LDAA    PORTA           ;read port A data
FB3B [02] 8404      334          ANDA    #$04            ;test for INIT
FB3D [03] 27F7      335          BEQ     INIT0           ;and wait until
                                                                      ready
                    336
                    337  ;*************************************************
                    338  ; Wait a short time for INIT to stabilize and
                                                        triple check XINIT
                    339  ;*************************************************
FB3F macro          340          WAIT    #$10            ;Delay about 56 usec
FB3F [05] 18DE10    341   LDY %1
FB42 [04] 1809      342  TLOOP: DEY
FB44 [03] 26FC      343   BNE TLOOP
```

```
                    344
FB46 [03] 9600      345         LDAA    PORTA           ;read port A data
FB48 [02] 8404      346         ANDA    #$04            ;test for INIT
FB4A [03] 27EA      347         BEQ     INIT0           ;and wait until
                                                                    ready
                    348
FB4C [03] 9600      349         LDAA    PORTA           ;read port A data
FB4E [02] 8404      350         ANDA    #$04            ;test for INIT
FB50 [03] 27E4      351         BEQ     INIT0           ;and wait until
                                                                    ready
                    352
                    353
                    354 XLOAD:
                    355 ;*************************************************
                    356 ; Set up start addresses, index and lengths for
                                                            Xilinx data
                    357 ;   Xilinx configuration register requirements:
                    358 ;       Configuration Byte Addr (16)    (Index X)
                    359 ;       Configuration Byte Data (8)     (Accum B)
                    360 ;       Data Bit Count (8)              (Accum A)
                    361 ;   Xilinx configuration data required (Absolute
                                                             Addresses):
                    362 ;       Start Address of data           XSTART
                    363 ;       End Address of data             XEND
                    364 ;*************************************************
FB52 [03] CEF000    365         LDX     #XSTART         ;Load index
                                                  register with start addr
                    366
                    367 ;*************************************************
                    368 ; loop until end of all data --
                    369 ;*************************************************
                    370 XLOOP1:
                    371 ;*************************************************
                    372 ; set count to 8 (bits per byte)
                    373 ;*************************************************
FB55 [02] 8608      374         LDAA    #$8             ;Set Accum A to
                                                  count down from 8 to 1
                    375
                    376 ;*************************************************
                    377 ; Load Data from where index register points to
                    378 ;*************************************************
FB57 [04] E600      379         LDAB    0,X             ;Get next data byte
                    380
                    381 XLOOP2:
                    382 ;*************************************************
                    383 ; ##### Do this different!
                    384 ; LSR data & BCC to clear bit, else set bit!
                    385 ;*************************************************
FB59 [02] 54        386         LSRB
FB5A [03] 2405      387         BCC     DATA0
                    388 ;*************************************************
                    389 ; Data bit is set (1) so set XCD0 bit in Port A
                                                                Register
                    390 ;*************************************************
FB5C [06] 140020    391         BSET    PORTA,$20       ;Set PA5 (XCD0) to
                                                                High (1)
FB5F [03] 2003      392         BRA     DODATA
                    393 DATA0:
                    394 ;*************************************************
                    395 ; Data bit is clear (0) so clear XCD0 bit in Port A
                                                                Register
                    396 ;*************************************************
FB61 [06] 150020    397         BCLR    PORTA,$20       ;Clear PA5 to Low
                                                                      (0)
                    398 DODATA:
                    399 ;*************************************************
                    400 ; Set XCCLK (PA4) Low (Start of XCCLK, Falling edge)
                    401 ;   XCCLK must be low for 0.05-5.0 usec.
```

```
                    402  ;   Data is clocked on the rising edge (end of
                                                                  cycle)
                    403  ;   Delay should be 1 NOP (~1 usec)
                    404  ;*************************************************
                    405          ; Move NOP to before BCLR of XCCLK since
                                                          timing of XCCLK
                    406          ; is already ~4usec+!  NOP before BCLR will
                                                              allow more
                    407          ; time for data to stabilize before
                                                               clocking!
FB64 [02] 01        408          NOP                     ;Delay ~1 usec
FB65 [06] 150010    409          BCLR    PORTA,$10       ;Clear PA4 to Low
                                                                    (0)
                    410
                    411  ;*************************************************
                    412  ; Set XCCLK (PA4) High (End of XCCLK, Rising edge)
                    413  ;*************************************************
FB68 [06] 140010    414          BSET    PORTA,$10       ;Set PA4 to High (1)
                    415  ;*************************************************
                    416  ; Decrement bit count & Loop
                    417  ;*************************************************
FB6B [02] 4A        418          DECA                    ;Decrement bit count
FB6C [03] 26EB      419          BNE     XLOOP2          ;Branch to do next
                                                                 data bit
                    420
                    421  ;*************************************************
                    422  ; Increment index (point to next data byte) & Loop
                    423  ; Check for end of data
                    424  ; (Compare Index X with XEND)
                    425  ; Branch to start of outer loop if not end of data
                    426  ;*************************************************
FB6E [03] 08        427          INX                     ;Increment Index
FB6F [04] 8CFAD9    428          CPX     #XEND           ;Compare to end of
                                                              data address
FB72 [03] 2FE1      429          BLE     XLOOP1          ;Continue if not
                                                                     done
                    430
                    431  ;*************************************************
                    432  ; At this point, all data should be transmitted!
                    433  ;   Wait a bit
                    434  ;   Check for XDP to go High
                    435  ;   If so, then Xilinx is configured!
                    436  ;   Else, Try again up to specified number of tries
                                                                       (5)
                    437  ;*************************************************
                    438  ;       WAIT    $10             ;Wait about 56 usec
                                                          for XDP to go high
FB74 macro          439          WAIT    $20             ;Wait about 112
                                                     usec for XDP to go high
FB74 [05] 18DE20    440   LDY %1
FB77 [04] 1809      441  TLOOP: DEY
FB79 [03] 26FC      442   BNE TLOOP
FB7B [03] 9600      443          LDAA    PORTA           ;Get Port A Data Reg
                    444
FB7D [02] 8480      445          ANDA    #$80            ;Mask unused bits
                                                             (Leave only XDP0)
FB7F [03] 260E      446          BNE     XDONE           ;XDP0 is high
                                                  (Config is done) (Continue)
                    447
                    448  ;*************************************************
                    449  ; Otherwise, Configuration was unsuccessful.
                    450  ; Reset & try again up to 5 times.
                    451  ;   Delay for a while
                    452  ;*************************************************
FB81 macro          453          WAIT    #$7F            ;Wait about 0.5
                                                  msec (relatively long time)
FB81 [05] 18DE7F    454   LDY %1
FB84 [04] 1809      455  TLOOP: DEY
```

```
FB86 [03] 26FC        456   BNE TLOOP
                      457
FB88 [06] 7A0040      458          DEC     XTRY            ;Decrement tries
                                                                    register
FB8B [03] 2E89        459          BGT     XRESET          ;if < 5, try again
                      460
                      461  ;*************************************************
                      462  ; Tried 5 times to configure & could not!
                      463  ; Lock up system here!
                      464  ; Pull Xilinx Chip back to RESET!!!
                      465  ; Pull XRESET and DONE/PROGRAM low
                      466  ;*************************************************
                      467  ;       BSET    PACTL,$80       ; Set PA7 (XDP0) as
                                                                      output
                      468  ;       BCLR    PORTA,$C0       ;Clear PA7 & PA6 to
                                                                     Low (0)
                      469
                      470  ;*************************************************
                      471  ; Lock up system here!!!
                      472  ; *** Do we need any diagnostics here??? ***
                      473  ;*************************************************
FB8D [03] 20FE        474  XSTOP:  BRA     XSTOP           ;If Not DONE after
                                                                 5 tries, Lock
                      475
                      476  XDONE:
                      477  ;*************************************************
                      478  ; Xilinx is set up.  Continue with Boot Code
                      479  ;*************************************************
                      480          ;
                      481
FB8F macro            482          WAIT    $20             ;Wait about 100
                                                             usec for 4MHz clock
FB8F [05] 18DE20      483   LDY %1
FB92 [04] 1809        484  TLOOP: DEY
FB94 [03] 26FC        485   BNE TLOOP
FB96 [06] 140820      486          BSET    PORTD,$20       ; Set PD5 high
                                                   (Bring 'HC05 out of RESET)
                      487          ; Set External Mode
FB99 [06] 143C20      488          BSET    HPRIO,$20       ; Set External Mode
                      489          ; Disable all interrupts??
                      490
                      491  ;XGOOD: JMP     XGOOD           ;If Good, Lock up
                                                                 here for now.
FB9C [03] 7E1000      492  XGOOD:  JMP     ROMBASE         ;If Good, Jump to
                                                              start of ROM code
                      493
                      494  MERROR:
                      495          ; Flag System Error!!!
                      496
FB9F [03] 20FE        497  ELOOP:  BRA     ELOOP           ;If ERROR, Lock up
                                                                 here for now.
                      498
                      499
                      500  ;*************************************************
                      501  ; Start of Interrupt Vector Table
                      502  ;   $FFC0 - $FFD5 are reserved
                      503  ;   $FFD6,D7 are SCI
                      504  ;   $FFD8,D9 are SPI
                      505  ;   $FFDA - $FFDD are Pulse Accumulator
                      506  ;   $FFDE - $FFEF are Timer Interrupts
                      507  ;   $FFF0,F1 are Real Time Interrupt
                      508  ;   $FFF2,F3 are IRQ pin Interrupt
                      509  ;   $FFF4,F5 are XIRQ Interrupt
                      510  ;   $FFF6,F7 are Software Interrupt
                      511  ;   $FFF8,F9 are Illegal Opcode Trap
                      512  ;   $FFFA,FB are COP Failure
                      513  ;   $FFFC,FD are Clock Monitor Failure
                      514  ;   $FFFE,FF are RESET Vector
```

```
                    515  ;*************************************************
FFC0                516          ORG     VECTORS
FFC0                517          EQU     *
FFC0      FB9F      518          FDB     MERROR          ;RESERVED ($C0,$C1)
FFC2      FB9F      519          FDB     MERROR          ;RESERVED ($C2,$C3)
FFC4      FB9F      520          FDB     MERROR          ;RESERVED ($C4,$C5)
FFC6      FB9F      521          FDB     MERROR          ;RESERVED ($C6,$C7)
FFC8      FB9F      522          FDB     MERROR          ;RESERVED ($C8,$C9)
FFCA      FB9F      523          FDB     MERROR          ;RESERVED ($CA,$CB)
FFCC      FB9F      524          FDB     MERROR          ;RESERVED ($CC,$CD)
FFCE      FB9F      525          FDB     MERROR          ;RESERVED ($CE,$CF)
FFD0      FB9F      526          FDB     MERROR          ;RESERVED ($D0,$D1)
FFD2      FB9F      527          FDB     MERROR          ;RESERVED ($D2,$D3)
FFD4      FB9F      528          FDB     MERROR          ;RESERVED ($D4,$D5)
FFD6      7DC0      529          FDB     XINT_SCI        ;SCI ($D6,$D7)
FFD8      7DD0      530          FDB     XINT_SPI        ;SPI ($D8,$D9)
FFDA      7DE0      531          FDB     XINT_EDGE       ;PAIE ($DA,$DB)
FFDC      7DF0      532          FDB     XINT_ACO        ;PAO ($DC,$DD)
FFDE      7E00      533          FDB     XINT_TOF        ;TMR OVF ($DE,$DF)
FFE0      7E10      534          FDB     XINT_TO5        ;TMR IC4 OC5
                                                                 ($E0,$E1)
FFE2      7E20      535          FDB     XINT_TO4        ;TMR OC4 ($E2,$E3)
FFE4      7E30      536          FDB     XINT_TO3        ;TMR OC3 ($E4,$E5)
FFE6      7E40      537          FDB     XINT_TO2        ;TMR OC2 ($E6,$E7)
FFE8      7E50      538          FDB     XINT_TO1        ;TMR OC1 ($E8,$E9)
FFEA      7E60      539          FDB     XINT_TI3        ;TMR IC3 ($EA,$EB)
FFEC      7E70      540          FDB     XINT_TI2        ;TMR IC2 ($EC,$ED)
FFEE      7E80      541          FDB     XINT_TI1        ;TMR IC1 ($EE,$EF)
FFF0      7E90      542          FDB     XINT_RT         ;RTI ($F0,$F1)
FFF2      7EA0      543          FDB     XINT_IRQ        ;IRQ ($F2,$F3)
FFF4      7EB0      544          FDB     XINT_XIRQ       ;XIRQ ($F4,$F5)
FFF6      7EC0      545          FDB     XINT_SW         ;SFT INT ($F6,$F7)
FFF8      7ED0      546          FDB     XINT_OP         ;ILGL OPCD ($F8,$F9)
FFFA      7EE0      547          FDB     XINT_COP        ;COP FAIL ($FA,$FB)
FFFC      7EF0      548          FDB     XINT_CLK        ;CLK MON FAIL
                                                                 ($FC,$FD)
                    549
FFFE      FB00      550          FDB     START           ;RESET ($FE,$FF)
                    551
                    552
                    553
```

Symbol Table

| | |
|---|---|
| BAUD | 002B |
| CFGCODE | FB00 |
| CFGRAM | 0040 |
| CFORC | 000B |
| DATA0 | FB61 |
| DDRB | 0006 |
| DDRC | 0007 |
| DDRD | 0009 |
| DEBUG | 7F00 |
| DODATA | FB64 |
| ELOOP | FB9F |
| E_VECT | 7DC0 |
| FE | 0002 |
| HPRIO | 003C |
| IDLE | 0010 |
| ILIE | 0010 |
| INIT0 | FB36 |
| MCONFIG | 003F |
| MERROR | FB9F |
| MINIT | 003D |
| MOPTION | 0039 |
| NF | 0004 |
| OC1D | 000D |
| OC1F | 0080 |

| | |
|---|---|
| OC1M | 000C |
| ORUN | 0008 |
| PA0 | 0001 |
| PA1 | 0002 |
| PA2 | 0004 |
| PA3 | 0008 |
| PA4 | 0010 |
| PA5 | 0020 |
| PA6 | 0040 |
| PA7 | 0080 |
| PACNT | 0027 |
| PACTL | 0026 |
| PAOUT | 00A0 |
| PB0 | 0001 |
| PB1 | 0002 |
| PB2 | 0004 |
| PB3 | 0008 |
| PB4 | 0010 |
| PB5 | 0020 |
| PB6 | 0040 |
| PB7 | 0080 |
| PC0 | 0001 |
| PC1 | 0002 |
| PC2 | 0004 |
| PC3 | 0008 |
| PC4 | 0010 |
| PC5 | 0020 |
| PC6 | 0040 |
| PC7 | 0080 |
| PD0 | 0001 |
| PD1 | 0002 |
| PD2 | 0004 |
| PD3 | 0008 |
| PD4 | 0010 |
| PD5 | 0020 |
| PD6 | 0040 |
| PD7 | 0080 |
| PDOUT | 000D |
| PIOC | 0002 |
| PORTA | 0000 |
| PORTB | 0004 |
| PORTC | 0003 |
| PORTD | 0008 |
| RDRF | 0020 |
| RE | 0004 |
| RIE | 0020 |
| ROMBASE | 1000 |
| SBK | 0001 |
| SCCR1 | 002C |
| SCCR2 | 002D |
| SCDR | 002F |
| SCSR | 002E |
| SPCR | 0028 |
| SPDR | 002A |
| SPSR | 0029 |
| STACK | 00FF |
| START | FB00 |
| TC | 0040 |
| TCIE | 0040 |
| TCNT | 000E |
| TCTL1 | 0020 |
| TCTL2 | 0021 |
| TDRE | 0080 |
| TE | 0008 |
| TFLG1 | 0023 |
| TFLG2 | 0025 |
| TIE | 0080 |
| TLOOP:0001 | FB22 |

| | |
|---|---|
| TLOOP:0002 | FB2C |
| TLOOP:0003 | FB42 |
| TLOOP:0004 | FB77 |
| TLOOP:0005 | FB84 |
| TLOOP:0006 | FB92 |
| TMSK1 | 0022 |
| TMSK2 | 0024 |
| TOC1 | 0016 |
| TOC2 | 0018 |
| TOC3 | 001A |
| TOF | 0080 |
| TWU | 0002 |
| VECTORS | FFC0 |
| XCONFIG | FB12 |
| XDONE | FB8F |
| XEND | FAD9 |
| XGOOD | FB9C |
| XINT_ACO | 7DF0 |
| XINT_CLK | 7EF0 |
| XINT_COP | 7EE0 |
| XINT_EDGE | 7DE0 |
| XINT_IRQ | 7EA0 |
| XINT_OP | 7ED0 |
| XINT_RT | 7E90 |
| XINT_SCI | 7DC0 |
| XINT_SPI | 7DD0 |
| XINT_SW | 7EC0 |
| XINT_TI1 | 7E80 |
| XINT_TI2 | 7E70 |
| XINT_TI3 | 7E60 |
| XINT_TO1 | 7E50 |
| XINT_TO2 | 7E40 |
| XINT_TO3 | 7E30 |
| XINT_TO4 | 7E20 |
| XINT_TO5 | 7E10 |
| XINT_TOF | 7E00 |
| XINT_XIRQ | 7EB0 |
| XLOAD | FB52 |
| XLOOP1 | FB55 |
| XLOOP2 | FB59 |
| XRESET | FB16 |
| XSTART | F000 |
| XSTOP | FB8D |
| XTRIES | 0005 |
| XTRY | 0040 |

```
S113F000FF04A036F37CFF5EFF7AB7FEFDCEDEFE82
S113F010EFEC676FE777DFCECFEECEFCDEDEF6D621
S113F020EFF6EDFFEDB5D7CFFDFFFCFFEFFFFCF9E9
S113F030DFEFFDBC37BFB7EFF67F5B4F3FDFAF7F3E
S113F0406CBFF9FF7DFBFEFFFDFD9ABEA6DEF6FE5A
S113F050FD7D7D9DEDCFEFEBEEEDEFDDDFD3DFDD6D
S113F060FEFE7D7D7D5E5DFDBD7AFACC8FFFFEFDEB
S113F070FFFFFFF3FBDFF7FD1E3E3F3F3E7E1C7CA0
S113F0807C7EFECFF77FD7FFF5EFFBEBEF7EEFFE45
S113F0907FE77FFFFBFFFEFFEDDFEFFDFDFFFFFDF
S113F0A0FDFFFFFFBAFFE0EEF7FFFA9FFDD7BDD9E2
S113F0B05FCE5FEFEF5FEFBFDCBFF9FFEBF6FDFC68
S113F0C0EDF5F4FBE9EBDBFBEFFEEDFFEF7FDFDAC1
S113F0D0FFDFFFFBFEEEF6F6FFFEDFFDFFEDFFEFC9
S113F0E0DE5F5F5DDDBFBABFBFBDE9DCFCECFFFFE7
S113F0F0ECEFFBEFBBFDAEBFBEADFFBD7FFF7F7F7F
S113F1007BF7EADFFFFDFFFFFFFBBFF77F8FFFFF0A
S113F110BFFE7D7EFFFFFFFFFEBEBDB999BD793BFB
S113F1207B637BF3AEBFFFFFFDFF7FF9FF7EF9F743
S113F130FAFBFFFFFBEFD7FFF7FF67CFBFFFFFBC73
S113F140FF7DBF7FFF7FEFECD8FBFAFFFBF5FFF7F6
S113F150B1F7EF7FBFBFFEBFDDFE7F7F5FEFCEDD88
S113F160DDFCFDFDF9BBFBFBFB6EFF8FEFCFCD9FFD
S113F1709FDFFBFEF5FEDFFFCFFFDBFFFFF7FFFFA7
S113F180AECFDFDFDFDC9EBF3999BFF5EAEEFEFDCF
S113F190DFFEFFFFFBBED3D4F7FFEFFEDFEBF9DBFDA
S113F1A0FFDDEDFECEFFFCFF9BFFF5DFBFDF6EDF73
S113F1B0ED7CBC7FDEBDDEDEDFFBFEEDF4FCFCFCA3
S113F1C0EBF1FBABF9EFEFEFFFFF7FDEDFFFD8FFE3
S113F1D0EFFAFED7F6FEF6EDDDEDFDFDEFDFDFDF46
S113F1E0DDDFBFBF9EBF9FEFF6FFFEFFFCFCBFFD50
S113F1F0FFF9FD8EAFBFADBFFDDD5F7FFF7FF7FA87
S113F200FFDFFFFBFDBFD3DFBF7FEFBDFDFCFDFED6
S113F210FFFDFFFF7FFBBCA9B99DB96D7B5B5B3B29
S113F220FBAEFFFF9DFFFFFF7D7FFF3FF7FAFBEB88
S113F230FBEBFBDFF7F7FF77CF9FFFFFFFFCFFFF41
S113F240FFFFFFFEFECFACBF8FFFBBDB1B1F1D5EF57
S113F250AFDFDCFFDFDFFF7E7FBFEFFEFCE9D9F924
S113F260F9F9B3B3FBF16EEFEFAFCFCFDDFFFFFFE3
S113F2705FE3FEFFFEFFEFDFDFBFBFFFFFEEDFCF89
S113F280DFDFCF3F9F9D9F9DF7FEFDDEFDEFFEFB81
S113F290DDDDFD59EFFFFEFDCF7DFBDADFFCDDEBAD
S113F2A0E2FFFCFBDCF8FDD9F5FD1FAEFEFEFFFE20
S113F2B0FFBEFBBB3F5EEFF6D4EDF4F4F4FBF9EBD9
S113F2C0DBFBEFEEFFFFFEFFDFDFFFDFF9FBFEF707
S113F2D0FEDFFEC6FFFDEFFDFFEFDDCD5F5FDFBEAE
S113F2E0BFBEBFBEEFFCDEFFEEFDEFFFDFFF9FFF03
S113F2F0AEBFBFFFBEEEFF5FFB5F7BF7FADFFFED44
S113F300FFFFFF9FFFFF7F8FFFBFFEFFFFFFFFF9A0
S113F310FDFFFEBEBDBDBDB97D7B335B7BF3AEBFE0
S113F320BE7FFEFDFFFFFF7FFDF7DAFBFFFFFFEF70
S113F330F7D7F7E73F4FBFDFFFFFFF7C7F7B7FFB04
S113F340EFFCFCF8FBCAFBFF77FED1D7EFFF7FDFB2
S113F350DFDCFD5BE5FF7EEFFEDDDDEDFCFDFB7B31
S113F360DAFBFBEEFFFEEFEDEF9FDFC79F9DE7FEAD
S113F370DBFFFEFEDEFF37FEFFFFAFCECFCFCCCEEE
S113F380BEBBA79BBBF7FAEBFFDEFFFFBF7B9A9FD9
S113F3907D4FFEFFFEEEFFDBFDE3FFFFEFFCDEFF34
S113F3A0CFE8AFF7F99DF5996E5F7DFDFDFFFDF99F
S113F3B0BBBBFFFDFEFCFCEDFDFCC9E9FBFBFBEF69
S113F3C0EFEFFFFEFFFFDDFDFDDDDFEFFAFFFEDFEE44
S113F3D0FEEFFDBFFFFDEF1FDF5FDFDEBFBFBFBE80
S113F3E0BFEEFEFFEFE6DCDCFDFFAFFDFB8EBEAF44
S113F3F0BEBFFF7FD97D7F7DF5FAFFEFEFFDEF9B69
S113F400FFDFF77FEFFDFEBFFFFFFFFFFFFFFFFE04
```

```
S113F410BCB999B9BD7D7B7B737BF3AEFF7F7C3F29
S113F420FF7DFDFF7BF9F7FAFBFBFBFBFBB7D7F78F
S113F430D777CFBFFFFFFFDFFFFF7B7BFFE9FCFE3A
S113F440DAFAF2FBF5FFF1F1D7EFEFBFBC7F7E7F75
S113F450FF7BFF7EEFFEECF8E8F8F9F1F3FBFBF33A
S113F4606EEFEDEFFFFEDF9FFFFF9FE7EEFFFFFF75
S113F470EFFBFFBF9FFFDF8EDFDCCEDDDE9EBD9B9B
S113F4809FBFF7FADDFDCDEEFAFBFFFFFFDFCEFFF6
S113F490FE6F7FFFFBDDFBFADDFBF8FFF8FCEEAE51
S113F4A0EDD7F9FDFDCEFFFFFFDF9EBDFDFBB9BB30
S113F4B0FBFCF4F4F5FDFDF9F9C9EBF96FEFEFEF9F
S113F4C0EFFDFDDFFFFFFBEFFEEEFEFEF6FEEFFDC0
S113F4D0EFEDFD2F4E5FDFDFDDBFBFBD99BDEFFE5A
S113F4E0CFFCFCD6FEEDFFFDFFFF8EFFBFBFAFAF2D
S113F4F0FF5DFB7F5FF7EAFBCFEFDFFFBFF3BFBF2B
S113F50077EF7FFFFF7FFFFFFFFFFFFFFEBCADBD77
S113F510BD9D695B735B33FBAE7FBFBFBFFCFFFF69
S113F520FFFD7BF7BAFBFFFBFBFBD7F7F7F777CFC2
S113F530ABFFBFBFBD7F797F7F7BED5CEBFEFCFF44
S113F540F8F5F5F7F5DFEFDFFFFEEFBFBF7F9BBBFD
S113F550FDEFFAFDFCEDFDFDD9F9FBB97B8EEDEF76
S113F560FEFFEFDDDFDFDFDFF3F6FDEFFFFFFFD7A9
S113F570FFFDDFFFCEDECFCECFDD1FBF9FBFBFF7C6
S113F580BEFCECCECEFCFBDBDDF35BEF6F7F7FEFED
S113F5906FDFFDFBFFFBEBF0F7FFD7F7F0EDFDE9C5
S113F5A0EDBDEEFF2DEFFFFFBFBFFEBFBFFBFEFFB4
S113F5B0E8F9F8FCF9D9F9F9F9AFFFEFEDBD9FBF10
S113F5C0FFFFFFFFFEFEEEEEAF7F6F6CDEDEDEFFF0E
S113F5D0EFFFCF5FDEDFBFBEBFBDBEEBCCFDFFF7ED
S113F5E0F7F7EFEFEFEFFF8EBBBFFFEEEE5F5FDDF0
S113F5F07F7DF7BAFEFFFFFFFFFFFFFDFBB5F6FFBFF
S113F6007DDDFFFFBEBF7FFFFFFBB4A9BDBDBD6DA8
S113F6103B7B7B7BFBAE7FBE7E7EFE7E7FFF7F7B64
S113F620F7BAFBFFFFFBEBF7F7F7F737CFEB7FDF1B
S113F630BDBF7F7B7D7F7BEFFCFEFCEBEBF3F1F149
S113F640F5F1F1EFFFFD6FDFDFBFBFBDBFBFEF2EF1
S113F650FAFDFDFDFDFBFBB9FBFBAEE3FFFFEF6E27
S113F660DFDBDFDFDFF73EDBFFFFFEFEFDF5D9FD6D
S113F6707DEFBACCDF8FCF9F9B9F9F1BF77EFDDF73
S113F680CFCFFFDFF7FF9DFFEFE7EFFFFFFFFEFFA9
S113F6907DFFFFF7EA3E2F3F3E7F7454FCE7312E97
S113F6A01FE1E15361A7A787DEFFEFEE2D3C353D57
S113F6B0F56878E8FB3BEFFFE2F3F3D105D4EF5FA5
S113F6C0FFFFFE3F9E5606566C0CECFDFDEFDD532E
S113F6D0D3D3DBA7A7A7BBBFEBFC3F3D3D3D7D7A62
S113F6E07AFAFFE98EBFBBB2B3B16667675F7FF793
S113F6F0FAFFEEFEEEFEFDF9FD977FEFDFFAFBF970
S113F700FBF7F5B7FFFDFFBEBD99BDBD6D733B3380
S113F7103BF3AEBF7FBEBDBFFF79FF7BFFF7FAFBB4
S113F720BFBFAB7F4777F7FF47EFBFFFEFAFED5F9B
S113F7305B9FFFFFEFDCFA7A3E2E5A7878F4FDDF08
S113F740CF6FBDF3FB73E7E763FFFBEFEEFC3C3CDD
S113F7503C5C7A7A90F9F3EEFFEFE1E3E3C7C7C7C5
S113F760DD9DF7FEFF3E3E1E4E7C3CF4DFFFEFCEF8
S113F770CCC0C3C18787879FBDF7FEEF1E3E7E7A4C
S113F7805C7CBDDBFDEEDFEFE0E3E156CB46DFFE64
S113F790FF78FCF4ECF77EFFDF1CEE7FEEB7FDFE96
S113F7A0FD9FCFDE97E3DFEF3AF4FCFCE4FCFDE9D8
S113F7B05DF1F9AFF3EDFFFFFFFF397CEEFFFF3E94
S113F7C0FEF7FEDFEFCE7F7DFCFDEFC35FDFDFDF03
S113F7D0F7BBCFA6BFEF6EFFD6FCE67FDE7D7EBE15
S113F7E0D98FB7BFBFBDBF677B67477FF57ADFFFA0
S113F7F0EFEF7FFD577FFB7F6F3BFFFFFFFFFFFFB7
S113F800F1893DFFBC9DBD99BD7D7F3F777BF32E84
S113F810BF3FFFBDBE7D7FFF7FFBF672FBEBFFEFBB
```

```
S113F8207B77F7F6F77FEEABBFDFFFBFE7E7D7D312
S113F830FCF7ACF8F8DBF878D67E7EF0D54EBBDD6D
S113F840BFDCBF47D3C3A79FEFBEFDDDFDFDFD7643
S113F8505677F7F9AEFBFE6FEFFFD7C7EC4EDFF537
S113F860FEDFFFFBDEFFFFFDFFFEF5EFDFCFDFCEA8
S113F870CFFFFFDFF79BF3FEEEEFFCEE6F53FF3E8F
S113F880FAFD4EFF7EFFFFEDCECCD567FFEFF2EF22
S113F890FCCFFCD6EDF89C6D15EEFF7EEFFEDDBFD0
S113F8A0F1AB3197FFFEFCFDFDF5FDFB7BFA73FD2B
S113F8B02FEFED7EEFFFFDDFC7DFF6F3FEFEFEFE6A
S113F8C0EEF7BD7DBC75FDEF5FDD4FDC5FBEBFA70E
S113F8D0BBD7EDCCFCDDDFEDF6BFDDF87DBD8EBF23
S113F8E0FFBDFFBF5FDF6F5F75E7FADFFFDFFFFF7D
S113F8F03FFDFDFD7D6FFEFFFEFFFDFEB7B7F7B7D1
S113F900E39E9DBDB9AD6D7B7B337FF3AFBFFCFD43
S113F9107DBE7FFFFD7DFFF6FAFBEBFFDFFB777714
S113F92067F75F6E9FBF7FFFBF7F5F57DBFDF7FC0D
S113F930F8CBFAF8FFFD71F1FFD7CEBFAF7CBFEE75
S113F940FDBB6BDF5DEFFEFDEDFCFDFDF97BFAD742
S113F950FBAEFEEEEFEFFFDFDDC5DDFFF5FEFFFFE3
S113F960FFCFFFFF7DFCFDFFAF8EDECFDECFBD9D61
S113F97085DBBFF7FEFEDDFCFDCE5BFF3EFFF50E33
S113F980FFFE7DFFFDFF5657F7FFFDF0FEFCFFF77E
S113F990FFFFF7FDF97DCF5F7F7FEF7FDFCF9F7E96
S113F9A0BDEFDEFCFCFCF4FDABBD7DFFF9EEFFCE4C
S113F9B0FFFEFFFE7DEFDB7FFDFEFED6FFFEFEFDBC
S113F9C0EFFDE5FDEF1DDFDF9F8C1D7F7EF7BFEFB1
S113F9D0FCFFF7FFFCFFBFFFBFA9F98FAFEFFDBF2F
S113F9E0BD7F7F5FFF7FF7FAFDDBFFFFFF77BDBDC4
S113F9F0F57FEFFFFFBFFFBFFFF777F7FEFFBE996D
S113FA00BDBD9D7D7B3B7B7BFFAEFFFDFFBFBD7D11
S113FA107B7BFF7FF6FAFBFFFBFFFF7F77F7F77631
S113FA20EFBFFDBDDDFFFFD7DFFBD7EEFCFAF3FA36
S113FA30FBFFFFF7F7F7D1CFAF7FDF6FEFFD8B9FB2
S113FA40BB7FFFFEFCFDFCFDFDFBF7F773EEAEEEA6
S113FA50CFEF6FCF9F9FFFFFE7F7FEFFFFFEFCFD99
S113FA60FBFFFF7FFEEFDFDFCFCFDFBFDFF79FC7F7
S113FA70FFFEFDFFFFFEFFFFFDFFBFDDEFDF6FFFBA
S113FA80FFEFDDFFDFFBFEFF9EBD9F9FBF3F7B6F50
S113FA907FBFFFAF9BFFD9DBDBB7B7B7FFB3FBFE7D
S113FAA0BCBDDDFCFCF9F9796B9BAFE7D3B3E7E7A9
S113FAB0CFCF4EA72FF97E7E797E7EFEFCECFCE252
S113FAC0DFAF9DE7C79F9F3F3F3FCF87F9DEFFFF33
S10DFAD0DFFFFFFFFFFFFFFFFFFF52
S9030000FC
-------------------------
```

```
*=========================================================
*=  Peterson Tuner Motion Control Sub-system             =
*=========================================================
*-  Written by  Robert S. Dobrose  02/23/95              -
*-  Copyright  Saracon, Inc.  1995                       -
*---------------------------------------------------------
*-  This routine performs a velocity based motion        -
*-  control system for all the Peterson Tuners.          -
*---------------------------------------------------------
*-  This code uses a Motorola 68HC705-C9 along with      -
*-  a dual DAC and stepper motor driver chip to create   -
*-  a velocity-controlled motion subsystem.  This        -
*-  subsystem communicates with the master device via    -
*-  a serial peripheral interface.  The motor velocity   -
*-  must be controlled to a very tight resolution to     -
*-  support the tuner requirements.  This must be done   -
*-  using a combination of a high microstep resolution   -
*-  and a velocity averaging method.  An update time     -
*-  interval is used to calculate a new position value   -
*-  based on a high resolution velocity rate.  The new   -
*-  position is calculated by adding a fractional        -
*-  distance-per-update value to the current fractional  -
*-  step position value.  These fractional values are    -
*-  represented by 24 bit numbers where the high 8 bits  -
*-  are the whole step difference and the remaining 16   -
*-  bits are the fractional averaging portion.  Each     -
*-  update time interval, the speed rate is added to     -
*-  the current position value and the high 8 bits are   -
*-  used to find the new step cycle position.            -
*---------------------------------------------------------

0000  $INCLUDE 'EQU05C4.ASM'          ;Include equates

      ; Equate Constants
0000  PHA_WR    EQU     $E8           ; Begin Phase-A write cycle
0000  PHB_WR    EQU     $E0           ; Begin Phase-B write cycle
0000  DAC_INI   EQU     $E6           ; Initialize DAC device (end RESET)
0000  UTICK     EQU     !50           ; 100 usec timer interval
0000  ATICK     EQU     !100          ; 10 msec accel rate ???
0000  VMAX      EQU     !20           ; Gross max velocity
                                ; (must be less than 64 using present waveform)

0050    ORG     RAMBASE
0050  DUMMY     RMB     !1            ; Dummy for Emulator fake
0051  POS       RMB     !3            ; 24-bit position var
0054  VELOC     RMB     !3            ; 24-bit velocity var
0057  TVEL      RMB     !3            ; 24-bit target velocity var
005A  TMPVEL    RMB     !3            ; 24-bit temp velocity var
005D  SPIVEL    RMB     !3            ; 24-bit temp SPI velocity var
0060  SPITMP    RMB     !1            ; SPI temp var
0061  SPITMP2   RMB     !1            ; SPI temp var #2
0062  ACCEL     RMB     !3            ; 24-bit accel var
0065  ACLT      RMB     !1            ; 8-bit accel time var
0066  MFLAGS    RMB     !1            ; Motion flags register
                                ; bit 0:  New Velocity Ready flag
                                ; bit 1:  1=Accelerating,
```

```
                                                                0=constant Vel
                                                ; bit 2:  1=Accel, 0=Decel
                                                ; bit 3:  1=Target Veloc
                                                                exceeded flag
                ; TPOS     RMB     !2                ; 16-bit target
                                                          distance counter
0067            UNIT      RMB     !1
0068            DUM2      RMB     !8
0070            TPTR      RMB     !1
0071            TBUF      RMB     !16

                ;*****************************************************
                ; ROM Constants area
                ;*****************************************************
0EC0              ORG     CONST
0EC0 000400     ACL_DFLT  FCB     $00,$04,$00      ; Default Acceleration
                                                                    value


                ;*****************************************************
                ; MAIN SYSTEM CODE STARTS HERE
                ;*****************************************************

0100              ORG     ROMBASE
                ;*****************************************************
                ; Put BOOT initialization stuff here.
                ;*****************************************************
                START:
0100              EQU     *
                  ; Initialize Port Data Output bits
0100 A6FF         LDA     #$FF
0102 B700         STA     PORTA
0104 B701         STA     PORTB
0106 B702         STA     PORTC
                  ; Set Port Data Direction Registers (Everything is
                                                                  Output)
0108 B704         STA     DDRA
010A B705         STA     DDRB
010C B706         STA     DDRC
                  ; Initialize DAC Registers (by clearing DAC RESET)
010E A6E6         LDA     #DAC_INI
0110 B701         STA     PORTB
                  ; Initialize System Variables
0112 4F           CLRA
0113 B766         STA     MFLAGS
0115 B751         STA     POS
0117 B752         STA     POS+1
0119 B753         STA     POS+2
011B B754         STA     VELOC
011D B755         STA     VELOC+1
011F B756         STA     VELOC+2
0121 B757         STA     TVEL
0123 B758         STA     TVEL+1
0125 B759         STA     TVEL+2
0127 B75A         STA     TMPVEL
0129 B75B         STA     TMPVEL+1
012B B75C         STA     TMPVEL+2
012D B75D         STA     SPIVEL
012F B75E         STA     SPIVEL+1
0131 B75F         STA     SPIVEL+2
0133 B760         STA     SPITMP
0135 B761         STA     SPITMP2
0137 B770         STA     TPTR
0139 B771         STA     TBUF
013B B772         STA     TBUF+1
013D B773         STA     TBUF+2
013F B774         STA     TBUF+3
0141 B775         STA     TBUF+4
```

```
0143 B776        120    STA      TBUF+5
0145 B777        121    STA      TBUF+6
0147 B778        122    STA      TBUF+7
0149 B765        123    STA      ACLT
014B C60EC0      124    LDA      ACL_DFLT
014E B762        125    STA      ACCEL
0150 C60EC1      126    LDA      ACL_DFLT+1
0153 B763        127    STA      ACCEL+1
0155 C60EC2      128    LDA      ACL_DFLT+2
0158 B764        129    STA      ACCEL+2
                 130    ; Initialize SPI port
015A A6C4        131    LDA      #$C4            ; Enable SPI with CPOL=0,
                                                      CPHA=1 clk=/2
015C B70A        132    STA      SPICR
015E B60B        133    LDA      SPISR
0160 A6A2        134    LDA      #$A2            ; Set up data for initial ACK
0162 B70C        135    STA      SPIDR           ; and store it in SPI data
                                                                  register
                 136    ; Initialize Timer Registers
0164 A640        137    LDA      #$40            ; OC enabled, others disabled
0166 B712        138    STA      TCR             ; init control register
0168 B613        139    LDA      TSR             ; Read timer status (to init)
016A BE18        140    LDX      TCNT            ; Read timer counter MSB
016C B619        141    LDA      TCNT+1          ; Read LSB
016E AB32        142    ADD      #UTICK          ; Get initial timer time
0170 2401        143    BCC      ST_X1           ; Skip next stuff if no 8-bit
                                                                   rollover
0172 5C          144    INCX                     ; else, increment MSB
                 145  ST_X1:
0173 BF16        146    STX      TOC             ; Write MBS of TOC
0175 B717        147    STA      TOC+1           ; Write LSB of TOC
                 148    ; Enable Interrupts
0177 9A          149    CLI
                 150
                 151    ; *** Main Polling Loop ***
                 152  MAIN:
                 153    ; Poll for new SPI (or SCI) input
                 154    ;   (or handle this via interrupts!)
0178 01663C      155    BRCLR   0,MFLAGS,MAIN2
                 156        ; If new data is available, convert to motion
                                                                 scale values
                 157        ; and load variables with data for new motion.
                 158        ; (Implementation of the new motion will be handled
                 159        ;  by the Timer Interrupt Handler routine.)
017B 1566        160    BCLR     2,MFLAGS        ; Clear ACL/DCL bit (Default
                                                                  to DECEL)
017D B65D        161    LDA      SPIVEL          ; Get MSB of new veloc
017F 2B32        162    BMI      MN_S3           ; Blow off new veloc if
                                                          negative (Bad)
0181 A114        163    CMP      #VMAX           ; Check for new veloc > limit
0183 222E        164    BHI      MN_S3           ; Blow off new veloc if > limit
0185 B757        165    STA      TVEL            ; Store in target veloc var
0187 B154        166    CMP      VELOC           ; Compare to MSB of current
                                                                       veloc
0189 2706        167    BEQ      MN_S1           ; Target = current so skip
                                                                   decision
018B 2502        168    BLO      MN_S11          ; Target < current so skip
                                                                 ACCEL stuff
018D 1466        169    BSET     2,MFLAGS        ; Set to ACCEL
                 170  MN_S11:
018F 1266        171    BSET     1,MFLAGS        ; Set bit to perform new veloc
                                                                       change
                 172  MN_S1:
0191 B65E        173    LDA      SPIVEL+1        ; Get 2nd byte of new veloc
0193 B758        174    STA      TVEL+1          ; Store in 2nd byte of target
                                                                  veloc var
0195 02660A      175    BRSET    1,MFLAGS,MN_S2  ; ACL/DCL already set
0198 B155        176    CMP      VELOC+1         ; Compare to 2nd byte of
```

```
                                                                  current veloc
019A 2706        177    BEQ      MN_S2            ; Target = current so skip
                                                                       decision
019C 2502        178    BLO      MN_S21           ; Target < current so skip
                                                                     ACCEL stuff
019E 1466        179    BSET     2,MFLAGS         ; Set to ACCEL
                 180  MN_S21:
01A0 1266        181    BSET     1,MFLAGS         ; Set bit to perform new veloc
                                                                         change
                 182  MN_S2:
01A2 B65F        183    LDA      SPIVEL+2         ; Get LSB of new veloc
01A4 B759        184    STA      TVEL+2           ; Store in LSB of target veloc
                                                                           var
01A6 02660A      185    BRSET    1,MFLAGS,MN_S3   ; ACL/DCL already set
01A9 B156        186    CMP      VELOC+2          ; Compare to LSB of current
                                                                        veloc
01AB 2706        187    BEQ      MN_S3            ; Target = current so skip
                                                                       decision
01AD 2502        188    BLO      MN_S31           ; Target < current so skip
                                                                     ACCEL stuff
01AF 1466        189    BSET     2,MFLAGS         ; Set to ACCEL
                 190  MN_S31:
01B1 1266        191    BSET     1,MFLAGS         ; Set bit to perform new veloc
                                                                         change
                 192  MN_S3:
01B3 3F65        193    CLR      ACLT             ; Clear accel timer count
01B5 1166        194    BCLR     0,MFLAGS         ; Clear new veloc flag
                 195
                 196  MAIN2:
                 197    ; Check for ACCEL flag on (new ACCEL to be done)
01B7 026603      198    BRSET    1,MFLAGS,MN2_S01
01BA CC026A      199    JMP      MAIN3
                 200  MN2_S01:
                 201    ; Poll for Accel time expired
01BD B665        202    LDA      ACLT
01BF A164        203    CMP      #ATICK
01C1 2403        204    BHS      MN2_S02
01C3 CC026A      205    JMP      MAIN3            ; Skip if ACCEL time has not
                                                                         expired
                 206  MN2_S02:
                 207        ; If so, then increase or decrease current velocity
                 208        ; variable by the accel variable rate and compare
                 209        ; against the target velocity.
01C6 1766        210    BCLR     3,MFLAGS         ; start with target veloc not
                                                                       reached
01C8 056642      211    BRCLR    2,MFLAGS,MN2_S1  ; Skip ACCEL & go to DECEL code
                 212    ; ACCEL code
01CB B656        213    LDA      VELOC+2          ; Get LSB of current veloc
01CD BB64        214    ADD      ACCEL+2          ; Add LSB of accel rate
01CF B75C        215    STA      TMPVEL+2         ; Store it in temp var
01D1 B655        216    LDA      VELOC+1          ; Get 2nd byte of current veloc
01D3 B963        217    ADC      ACCEL+1          ; Add 2nd byte of accel rate
01D5 B75B        218    STA      TMPVEL+1         ; Store it in temp var
01D7 B654        219    LDA      VELOC            ; Get MSB of current veloc
01D9 B962        220    ADC      ACCEL            ; Add MSB of accel rate
01DB B75A        221    STA      TMPVEL           ; Store it in temp var
01DD 2A04        222    BPL      MN2_S10          ; Check for register overflow
01DF 1666        223    BSET     3,MFLAGS         ; Overflow occurred, accel
                                                                         done!
01E1 2062        224    BRA      MN2_S2           ; skip rest of check
                 225  MN2_S10:
01E3 A114        226    CMP      #VMAX            ; Check for max veloc exceeded
01E5 2504        227    BLO      MN2_S11          ; if max not exceeded, go to
                                                                         check
01E7 1666        228    BSET     3,MFLAGS         ; Max veloc exceeded, accel
                                                                         done!
01E9 205A        229    BRA      MN2_S2           ; skip rest of check
                 230  MN2_S11:
```

```
01EB B65A        231    LDA      TMPVEL          ; Restore MSB of temp var
01ED B157        232    CMP      TVEL            ; Compare against MSB of
                                                                  target veloc
01EF 2706        233    BEQ      MN2_S12         ; No decision, check next byte.
01F1 2552        234    BLO      MN2_S2          ; Target not reached, skip bit
                                                                        set
01F3 1666        235    BSET     3,MFLAGS        ; Target reached or exceeded
01F5 204E        236    BRA      MN2_S2          ; skip to done
                 237  MN2_S12:
01F7 B65B        238    LDA      TMPVEL+1        ; Restore 2nd byte of temp var
01F9 B158        239    CMP      TVEL+1          ; Compare against 2nd byte of
                                                                  target veloc
01FB 2706        240    BEQ      MN2_S13         ; No decision, check next byte.
01FD 2546        241    BLO      MN2_S2          ; Target not reached, skip bit
                                                                        set
01FF 1666        242    BSET     3,MFLAGS        ; Target reached or exceeded
0201 2042        243    BRA      MN2_S2          ; skip to done
                 244  MN2_S13:
0203 B65C        245    LDA      TMPVEL+2        ; Restore LSB of temp var
0205 B159        246    CMP      TVEL+2          ; Compare against target veloc
0207 253C        247    BLO      MN2_S2
0209 1666        248    BSET     3,MFLAGS        ; Target reached or exceeded
                 249  MN2_S14:
020B 2038        250    BRA      MN2_S2
                 251  MN2_S1:
                 252    ; DECEL code
020D B656        253    LDA      VELOC+2         ; Get LSB of current veloc
020F B064        254    SUB      ACCEL+2         ; Subtract LSB of accel rate
0211 B75C        255    STA      TMPVEL+2        ; Store it in temp var
0213 B655        256    LDA      VELOC+1         ; Get 2nd byte of current veloc
0215 B263        257    SBC      ACCEL+1         ; Subtract 2nd byte of accel
                                                                          rate
0217 B75B        258    STA      TMPVEL+1        ; Store it in temp var
0219 B654        259    LDA      VELOC           ; Get MSB of current veloc
021B B262        260    SBC      ACCEL           ; Subtract MSB of accel rate
021D B75A        261    STA      TMPVEL          ; Store it in temp var
021F 2A04        262    BPL      MN2_S20         ; Check for register overflow
0221 1666        263    BSET     3,MFLAGS        ; Overflow occurred, decel
                                                                        done!
0223 2020        264    BRA      MN2_S2          ; skip rest of check
                 265  MN2_S20:
0225 B65A        266    LDA      TMPVEL          ; Restore MSB of temp var
0227 B157        267    CMP      TVEL            ; Compare against MSB of
                                                                  target veloc
0229 2706        268    BEQ      MN2_S22         ; No decision, check next byte.
022B 2218        269    BHI      MN2_S2          ; Target not reached, skip bit
                                                                        set
022D 1666        270    BSET     3,MFLAGS        ; Target reached or exceeded
022F 2014        271    BRA      MN2_S2          ; skip to done
                 272  MN2_S22:
0231 B65B        273    LDA      TMPVEL+1        ; Restore 2nd byte of temp var
0233 B158        274    CMP      TVEL+1          ; Compare against 2nd byte of
                                                                  target veloc
0235 2706        275    BEQ      MN2_S23         ; No decision, check next byte.
0237 220C        276    BHI      MN2_S2          ; Target not reached, skip bit
                                                                        set
0239 1666        277    BSET     3,MFLAGS        ; Target reached or exceeded
023B 2008        278    BRA      MN2_S2          ; skip to done
                 279  MN2_S23:
023D B65C        280    LDA      TMPVEL+2        ; Restore LSB of temp var
023F B159        281    CMP      TVEL+2          ; Compare against target veloc
0241 2202        282    BHI      MN2_S2
0243 1666        283    BSET     3,MFLAGS        ; Target reached or exceeded
                 284  MN2_S24:
                 285  MN2_S2:
0245 076610      286    BRCLR    3,MFLAGS,MN2_S3
                 287        ; If target is exceeded, then set current to target
                 288        ; and stop accel
```

```
0248 B659    289    LDA     TVEL+2
024A B756    290    STA     VELOC+2
024C B658    291    LDA     TVEL+1
024E B755    292    STA     VELOC+1
0250 B657    293    LDA     TVEL
0252 B754    294    STA     VELOC
0254 1366    295    BCLR    1,MFLAGS        ; Stop change of veloc
0256 2012    296    BRA     MAIN3
             297  MN2_S3:
             298        ; else, store new velocity in current velocity
                                                                variable.
0258 B65C    299    LDA     TMPVEL+2
025A B756    300    STA     VELOC+2
025C B65B    301    LDA     TMPVEL+1
025E B755    302    STA     VELOC+1
0260 B65A    303    LDA     TMPVEL
0262 B754    304    STA     VELOC
             305        ; Then either decrement accel time register or
                                                                update
             306        ; a compare register.
0264 B665    307    LDA     ACLT
0266 A064    308    SUB     #ATICK
0268 B765    309    STA     ACLT
             310  MAIN3:
             311    ; At end of code, jump back to top of polling loop
026A CC0178  312    JMP     MAIN
             313    ; *** End Of MAIN POLLING LOOP ***
             314
             315
             316  ;*****************************************************
             317  ; Interrupt Handler Routines
             318  ;*****************************************************
             319  ; Serial Peripheral Interrupt (SPI) Handler
             320  ;*****************************************************
             321  ; This routine handles the main communications
             322  ; to the master microcontroller.
             323  ;*****************************************************
             324  INT_SPI:
026D B60B    325    LDA     SPISR           ; Read status (set to clear
                                                          interrupt bit)
026F B60C    326    LDA     SPIDR           ; Read data (clears int bit)
0271 B760    327    STA     SPITMP          ; Save data
             328
0273 BE70    329    LDX     TPTR
0275 E771    330    STA     TBUF,X
0277 9F      331    TXA
0278 4C      332    INCA
0279 A40F    333    AND     #$0F
027B B770    334    STA     TPTR
027D B660    335    LDA     SPITMP
             336
027F 9A      337    CLI                     ; Allow other interrupts
                                                          higher priority
0280 A40F    338    AND     #$0F
0282 A105    339    CMP     #$05
0284 2334    340    BLS     IS_DATA
0286 A10F    341    CMP     #$0F            ; Check for 'STATUS' command
0288 2606    342    BNE     IS_S1           ; If not, then check other
                                                                stuff
             343    ; 'STATUS' Command
028A B661    344    LDA     SPITMP2         ; Load last ACK flag
028C B70C    345    STA     SPIDR           ; Re-Transmit last ACK
028E 2049    346    BRA     IS_DONE
             347  IS_S1:
0290 A10E    348    CMP     #$0E
0292 260A    349    BNE     IS_S2
             350    ; 'NEW VELOC' Command
0294 A600    351    LDA     #$0             ; New veloc data comming
```

```
0296 B75D    352    STA     SPIVEL          ; Clear SPI velocity variable
0298 B75E    353    STA     SPIVEL+1
029A B75F    354    STA     SPIVEL+2
029C 203B    355    BRA     IS_DONE
             356  IS_S2:
029E A10D    357    CMP     #$0D
02A0 2608    358    BNE     IS_S3
             359    ; 'SET UNIT NUMBER' Command
02A2 B660    360    LDA     SPITMP
02A4 A4F0    361    AND     #$F0
02A6 B767    362    STA     UNIT
02A8 202F    363    BRA     IS_DONE
             364  IS_S3:
02AA A10C    365    CMP     #$0C
02AC 260A    366    BNE     IS_S4
             367    ; 'GET UNIT NUMBER' Command
02AE B667    368    LDA     UNIT
02B0 A4F0    369    AND     #$F0
02B2 AA0B    370    ORA     #$0B            ; include 'UNIT NUMBER
                                                        RESONSE' code
02B4 B70C    371    STA     SPIDR           ; Transmit response
02B6 2021    372    BRA     IS_DONE
             373  IS_S4:
             374    ; No other commands implemented at this time
02B8 201F    375    BRA     IS_DONE
             376  IS_DATA:
02BA 00661C  377    BRSET   0,MFLAGS,IS_DONE        ; Disallow new data if
                                                          old data pending
             378    ; Velocity Data comming in
02BD 97      379    TAX
02BE AA80    380    ORA     #$80
02C0 B761    381    STA     SPITMP2         ; Save ACK flag data
02C2 B70C    382    STA     SPIDR           ; Transmit ACK on next data
                                                                    xfer
02C4 B660    383    LDA     SPITMP          ; Re-Load data
02C6 A4F0    384    AND     #$F0            ; Mask off non-data bits
02C8 A305    385    CPX     #$5             ; Last data of velocity xmit
02CA 2602    386    BNE     IS_D1
02CC 1066    387    BSET    0,MFLAGS        ; Flag for new velocity
             388  IS_D1:
02CE 54      389    LSRX                    ; Shift high-nibble bit into C
02CF 2504    390    BCS     IS_D2           ; If high-nibble bit is set
                                                        then skip shift
02D1 44      391    LSRA                    ; Shift data down to low 4 bits
02D2 44      392    LSRA                    ;   if data is for low nibble
02D3 44      393    LSRA                    ;   (high-nibble bit is clear)
02D4 44      394    LSRA
             395  IS_D2:
02D5 EA5D    396    ORA     SPIVEL,X
02D7 E75D    397    STA     SPIVEL,X
             398  IS_DONE:
02D9 80      399    RTI
             400
             401  ;*****************************************************
             402  ; Serial Communications Interrupt (SCI) Handler
             403  ;*****************************************************
             404  ; This interrupt is normally unused.  The handler
             405  ; should simply clear the interrupt (or optionally
             406  ; turn off SCI functions) if the interrupt is hit.
             407  ; ** This may be implemented for test
             408  ;    and/or debug functionality.  **
             409  ;*****************************************************
             410  INT_SCI:
02DA 80      411    RTI
             412
             413  ;*****************************************************
             414  ; Timer Interrupt (TMR) Handler
             415  ;*****************************************************
```

```
                 416  ; This interrupt is the main operational unit of
                 417  ; the Motion Control Sub-system.  This should occur
                 418  ; at fixed time intervals and will update the
                 419  ; stepper motor phase angle current values by
                 420  ; calculating the new positional value from the
                 421  ; current position and velocity values and using
                 422  ; the result as an offset into the "SINE" table.
                 423  ; This gives us reference to the A and B phase
                 424  ; values for that cycle position.  These values
                 425  ; are then loaded into the DAC data registers.
                 426  ; This interrupt may also handle acceleration or
                 427  ; flag when new acceleration is to be performed
                 428  ; by the main polling loop.  (The method of
                 429  ; acceleration must be determined by the amount
                 430  ; of microcontroller bandwidth remaining after
                 431  ; velocity handling is done and the amount of
                 432  ; time required by acceleration handling.)
                 433  ;*************************************************
                 434  INT_TMR:
                 435    ; Clear interrupt flag bit
02DB B613        436    LDA     TSR             ; Read timer status register
                 437    ; Update timer output compare (TOC) register
02DD A632        438    LDA     #UTICK          ; Set for 100 usec tick
02DF BB17        439    ADD     TOC+1           ; Add LSB of output compare Reg
02E1 2402        440    BCC     IT_X1           ; Skip MSB update if no
                                                                        rollover
02E3 3C16        441    INC     TOC             ; Increment MSB of TOC if LSB
                                                                        rollover
                 442  IT_X1:
02E5 B717        443    STA     TOC+1           ; Update LSB of TOC
                 444    ; Calc new position (add velocity to current position)
02E7 B653        445    LDA     POS+2           ; Load lowest byte of current
                                                                        position
02E9 BB56        446    ADD     VELOC+2         ; Add lowest byte of velocity
02EB B753        447    STA     POS+2           ; Store updated value
02ED B652        448    LDA     POS+1           ; Load 2nd byte of position
02EF B955        449    ADC     VELOC+1         ; Add (with carry) 2nd byte of
                                                                        velocity
02F1 B752        450    STA     POS+1           ; Store updated value
02F3 B651        451    LDA     POS             ; Load high byte of position
02F5 B954        452    ADC     VELOC           ; Add high byte of velocity
02F7 B751        453    STA     POS             ; Store updated value
                 454    ; Use upper bits as lookup offset to SINE table
                 455    ; Reg-A now contains new table offset ??
02F9 97          456    TAX                     ; Move offset to index register
                 457    ; Get sine data & write to DAC registers
02FA D60FC0      458    LDA     SINA,X          ; Lookup new Phase-A value
02FD B700        459    STA     PORTA           ; Store new Phase-A value
02FF A6E8        460    LDA     #PHA_WR         ; Get Phase-A write command
                                                                        pattern
0301 B701        461    STA     PORTB           ; Start Phase-A write cycle
0303 1401        462    BSET    2,PORTB         ; End write cycle
0305 D61000      463    LDA     SINB,X          ; Lookup new Phase-B value
0308 B700        464    STA     PORTA           ; Store new Phase-B value
030A A6E0        465    LDA     #PHB_WR         ; Get Phase-B write command
                                                                        pattern
030C B701        466    STA     PORTB           ; Start Phase-A write cycle
030E 1401        467    BSET    2,PORTB         ; End write cycle
0310 3C65        468    INC     ACLT
0312 80          469    RTI
                 470
                 471  ;*************************************************
                 472  ; External IRQ Line Interrupt (IRQ) Handler
                 473  ;*************************************************
                 474  ; No external IRQ Line interrupt are expected to
                 475  ; be implemented at this time.  This handler should
                 476  ; simply clear (and possibly disable) the pending
                 477  ; interrupt and return.
```

```
                 478  ; This could be used in the future as a "trigger"
                 479  ; for pre-loaded motion data.
                 480  ;*************************************************
                 481  INT_IRQ:
0313 80          482    RTI
                 483
                 484  ;*************************************************
                 485  ; Software Interrupt (SWI) Handler
                 486  ;*************************************************
                 487  ; We do not expect to use software interrupts at
                 488  ; this time although this may be used to perform
                 489  ; the acceleration part of the motion.
                 490  ;*************************************************
                 491  INT_SWI:
0314 80          492    RTI
                 493
                 494
                 495  ;*************************************************
                 496  ; Start of Interrupt Vector Table
                 497  ; #####  IS THIS TABLE CORRECT FOR -C9 DEVICE???
                 498  ;   $1FF4,F5 are SPI Interrupt
                 499  ;   $1FF6,F7 are SCI Interrupt
                 500  ;   $1FF8,F9 are TIMER Interrupt
                 501  ;   $1FFA,FB are IRQ Interrupt
                 502  ;   $1FFC,FD are Software (SWI) Interrupt
                 503  ;   $1FFE,FF are RESET Vector
                 504  ;*************************************************
1FF4             505    ORG     VECT
1FF4             506    EQU     *
1FF4 026D        507    FDB     INT_SPI          ;SPI ($F4,$F5)
1FF6 02DA        508    FDB     INT_SCI          ;SCI ($F6,$F7)
1FF8 02DB        509    FDB     INT_TMR          ;TMR ($F8,$F9)
1FFA 0313        510    FDB     INT_IRQ          ;IRQ ($FA,$FB)
1FFC 0314        511    FDB     INT_SWI          ;SWI ($FC,$FD)
                 512
1FFE 0100        513    FDB     START            ;RESET ($FE,$FF)
                 514
                 515
```

Symbol Table

```
ACCEL            0062
ACLT             0065
ACL_DFLT         0EC0
ACNT             001A
ATICK            0064
BAUD             000D
BOOTROM          1F00
BOOTVEC          1FE0
CONST            0EC0
DAC_INI          00E6
DDRA             0004
DDRB             0005
DDRC             0006
DUM2             0068
DUMMY            0050
FE               0002
IDLE             0010
ILIE             0010
INT_IRQ          0313
INT_SCI          02DA
INT_SPI          026D
INT_SWI          0314
INT_TMR          02DB
IRQ_VEC          1FFA
IS_D1            02CE
IS_D2            02D5
IS_DATA          02BA
```

| | |
|---|---|
| IS_DONE | 02D9 |
| IS_S1 | 0290 |
| IS_S2 | 029E |
| IS_S3 | 02AA |
| IS_S4 | 02B8 |
| IT_X1 | 02E5 |
| MAIN | 0178 |
| MAIN2 | 01B7 |
| MAIN3 | 026A |
| MFLAGS | 0066 |
| MN2_S01 | 01BD |
| MN2_S02 | 01C6 |
| MN2_S1 | 020D |
| MN2_S10 | 01E3 |
| MN2_S11 | 01EB |
| MN2_S12 | 01F7 |
| MN2_S13 | 0203 |
| MN2_S14 | 020B |
| MN2_S2 | 0245 |
| MN2_S20 | 0225 |
| MN2_S22 | 0231 |
| MN2_S23 | 023D |
| MN2_S24 | 0245 |
| MN2_S3 | 0258 |
| MN_S1 | 0191 |
| MN_S11 | 018F |
| MN_S2 | 01A2 |
| MN_S21 | 01A0 |
| MN_S3 | 01B3 |
| MN_S31 | 01B1 |
| NF | 0004 |
| ORUN | 0008 |
| PA0 | 0001 |
| PA1 | 0002 |
| PA2 | 0004 |
| PA3 | 0008 |
| PA4 | 0010 |
| PA5 | 0020 |
| PA6 | 0040 |
| PA7 | 0080 |
| PAOUT | 00A0 |
| PB0 | 0001 |
| PB1 | 0002 |
| PB2 | 0004 |
| PB3 | 0008 |
| PB4 | 0010 |
| PB5 | 0020 |
| PB6 | 0040 |
| PB7 | 0080 |
| PC0 | 0001 |
| PC1 | 0002 |
| PC2 | 0004 |
| PC3 | 0008 |
| PC4 | 0010 |
| PC5 | 0020 |
| PC6 | 0040 |
| PC7 | 0080 |
| PD0 | 0001 |
| PD1 | 0002 |
| PD2 | 0004 |
| PD3 | 0008 |
| PD4 | 0010 |
| PD5 | 0020 |
| PD6 | 0040 |
| PD7 | 0080 |
| PHA_WR | 00E8 |
| PHB_WR | 00E0 |
| PORTA | 0000 |

| | |
|---|---|
| PORTB | 0001 |
| PORTC | 0002 |
| PORTD | 0003 |
| POS | 0051 |
| RAMBASE | 0050 |
| RDRF | 0020 |
| RE | 0004 |
| RIE | 0020 |
| ROMBASE | 0100 |
| ROMEND | 10FF |
| RST_VEC | 1FFE |
| SBK | 0001 |
| SCCR1 | 000E |
| SCCR2 | 000F |
| SCDR | 0011 |
| SCI_VEC | 1FF6 |
| SCSR | 0010 |
| SINA | 0FC0 |
| SINB | 1000 |
| SPICR | 000A |
| SPIDR | 000C |
| SPISR | 000B |
| SPITMP | 0060 |
| SPITMP2 | 0061 |
| SPIVEL | 005D |
| SPI_VEC | 1FF4 |
| STACK | 00FF |
| START | 0100 |
| ST_X1 | 0173 |
| SWI_VEC | 1FFC |
| TBUF | 0071 |
| TC | 0040 |
| TCIE | 0040 |
| TCNT | 0018 |
| TCR | 0012 |
| TDRE | 0080 |
| TE | 0008 |
| TIC | 0014 |
| TIE | 0080 |
| TIM_VEC | 1FF8 |
| TMPVEL | 005A |
| TOC | 0016 |
| TPTR | 0070 |
| TSR | 0013 |
| TVEL | 0057 |
| TWU | 0002 |
| UNIT | 0067 |
| UTICK | 0032 |
| VECT | 1FF4 |
| VELOC | 0054 |
| VMAX | 0014 |

```
S0030000FC
S1130FC000C0609030F048A818D8788424E454B461
S1130FD00CCC6C9CDC7C82226292D2720ACAAAEA91
S1130FE09A3A7A064626661696D6B6760E8ECE2E91
S1130FF0AE6EEE1E9E5EDE3E3EBEBE7E7E7EFEFE7D
S1131000FEFEFE7E7E7EBEBE3E3EDE5E9E1EEE6E1C
S1131010AE2ECE8E0E76B6D69616662646067A3A4C
S11310209AEAAACA0A72D2926222827CDC9C6CCCB2
S11310300CB454E4248478D818A848F0309060C0E4
S113104000C1619131F149A919D9798525E555B5D1
S11310500DCD6D9DDD7D83236393D3730BCBABEB00
S11310609B3B7B074727671797D7B7770F8FCF2F00
S1131070AF6FEF1F9F5FDF3F3FBFBF7F7F7FFFFFEC
S1131080FFFFFF7F7F7FBFBF3F3FDF5F9F1FEF6F8C
S1131090AF2FCF8F0F77B7D79717672747077B3BBC
S11310A09BEBABCB0B73D3936323837DDD9D6DCD22
S11310B00DB555E5258579D919A949F1319161C154
S11310C000C0609030F048A818D8788424E454B460
S11310D00CCC6C9CDC7C82226292D2720ACAAAEA90
S11310E09A3A7A064626661696D6B6760E8ECE2E90
S11310F0AE6EEE1E9E5EDE3E3EBEBE7E7E7EFEFE7C
S9030000FC
```

```
                 1  *=====================================================
                 2  *=  Peterson Tuner PreAmp Controller                =
                 3  *=====================================================
                 4  *-  Written by  Robert S. Dobrose  11/14/95          -
                 5  *-  Copyright  Saracon, Inc.  1995                   -
                 6  *-  Rev 0.03 - Add MUTE MODE status feedback         -
                 7  *-----------------------------------------------------
                 8  *-  This routine performs the functions required     -
                 9  *-  for control of the preamp circuitry for          -
                10  *-  the Peterson Tuners.                             -
                11  *-----------------------------------------------------
                12  *-  This code uses a Motorola 68HC05-C4 to control   -
                13  *-  circuitry to perform the preamp functions of the -
                14  *-  various Peterson tuner devices.  This subsystem  -
                15  *-  communicates with the master device via a serial -
                16  *-  peripheral interface.                            -
                17  *-----------------------------------------------------
                18
0000            19  $INCLUDE 'EQU05C4.ASM'            ;Include equates
                20
                21  ; Equate Constants
0000            22  UTICK     EQU     !250            ; 0.5 msec timer
                                                                  interval
0000            23  MUTE_DB   EQU     !60             ; MUTE button debounce
                                                            value (30 msec)
                24
0050            25    ORG     RAMBASE
0050            26  DUMMY     RMB     !1              ; Dummy for Emulator
                                                                     fake
0051            27  SPITMP    RMB     !1              ; SPI temp var
0052            28  SPITMP2   RMB     !1              ; SPI temp var #2
0053            29  UNIT      RMB     !1              ; Unit number
0054            30  MFLAGS    RMB     !1              ; Motion flags register
                31                              ; bit 0:  New CONTRAST Ready
                                                                     flag
0055            32  MUTE      RMB     !1              ; MUTE status
0056            33  CONT      RMB     !1              ; Contrast value
0057            34  DBNC      RMB     !2              ; Debounce counter
0059            35  IN_LAST   RMB     !1              ; Last input state
                                                                  value
005A            36  DUM2      RMB     !5
005F            37  TPTR      RMB     !1
0060            38  TBUF      RMB     !16
                39
                40  ;*****************************************************
                41  ; ROM Constants area
                42  ;*****************************************************
0EC0            43    ORG     CONST
                44
                45
                46  ;*****************************************************
                47  ; MAIN SYSTEM CODE STARTS HERE
                48  ;*****************************************************
                49
0100            50    ORG     ROMBASE
                51  ;*****************************************************
                52  ; Put BOOT initialization stuff here.
                53  ;*****************************************************
                54  START:
0100            55    EQU     *
                56    ; Initialize Port Data Output bits
0100 A6FF       57    LDA     #$FF
0102 B700       58    STA     PORTA
0104 B701       59    STA     PORTB
0106 B702       60    STA     PORTC
                61    ; Set Port Data Direction Registers (Everything is
                                                                  Output)
0108 B704       62    STA     DDRA
```

```
010A B705        63    STA     DDRB
010C A6FE        64    LDA     #$FE     ; PC0 is input
010E B706        65    STA     DDRC
                 66    ; Initialize System Variables
0110 4F          67    CLRA
0111 B754        68    STA     MFLAGS
0113 B751        69    STA     SPITMP
0115 B752        70    STA     SPITMP2
0117 B75F        71    STA     TPTR
0119 B760        72    STA     TBUF
011B B761        73    STA     TBUF+1
011D B762        74    STA     TBUF+2
011F B763        75    STA     TBUF+3
0121 B764        76    STA     TBUF+4
0123 B765        77    STA     TBUF+5
0125 B766        78    STA     TBUF+6
0127 B767        79    STA     TBUF+7
0129 A601        80    LDA     #$1
012B B755        81    STA     MUTE     ; Initial MUTE status is 1 (MUTE = OFF)
012D A608        82    LDA     #$8
012F B756        83    STA     CONT     ; Save initial contrast value
0131 A80F        84    EOR     #$0F     ; Invert CONTRAST bits
0133 48          85    LSLA             ; Shift data into CONTRAST output bits
0134 BA55        86    ORA     MUTE
0136 AAE0        87    ORA     #$E0     ; PB5-PB7 always high
0138 B701        88    STA     PORTB
013A A63C        89    LDA     #MUTE_DB
013C B757        90    STA     DBNC     ; Initialize debounce counter
013E B602        91    LDA     PORTC    ; Get initial PORT-C value
0140 A401        92    AND     #$01     ; Mask off all except PC0
0142 B759        93    STA     IN_LAST ; Save as last input value
                 94    ; Initialize SPI port
0144 A6C4        95    LDA     #$C4             ; Enable SPI with CPOL=0,
                                                        CPHA=1 clk=/2
0146 B70A        96    STA     SPICR
0148 B60B        97    LDA     SPISR
014A A6A2        98    LDA     #$A2             ; Set up data for initial ACK
014C B70C        99    STA     SPIDR            ; and store it in SPI data
                                                          register
                100    ; Initialize Timer Registers
014E A640       101    LDA     #$40             ; OC enabled, others disabled
0150 B712       102    STA     TCR              ; init control register
0152 B613       103    LDA     TSR              ; Read timer status (to init)
0154 BE18       104    LDX     TCNT             ; Read timer counter MSB
0156 B619       105    LDA     TCNT+1           ; Read LSB
0158 ABFA       106    ADD     #UTICK           ; Get initial timer time
015A 2401       107    BCC     ST_X1            ; Skip next stuff if no 8-bit
                                                          rollover
015C 5C         108    INCX                     ; else, increment MSB
                109  ST_X1:
015D BF16       110    STX     TOC              ; Write MBS of TOC
015F B717       111    STA     TOC+1            ; Write LSB of TOC
                112    ; Enable Interrupts
0161 9A         113    CLI
                114
                115    ; *** Main Polling Loop ***
                116  MAIN:
                117    ; Poll for new data available
0162 01540F     118    BRCLR   0,MFLAGS,MAIN2
                119        ; If new data is available, Output new value
0165 B656       120    LDA     CONT
0167 A40F       121    AND     #$0F
0169 A80F       122    EOR     #$0F             ; Invert CONTRAST bits
016B 48         123    LSLA                     ; Shift data into CONTRAST
                                                          output bits
016C BA55       124    ORA     MUTE             ; Add in current MUTE status
016E AAE0       125    ORA     #$E0             ; PB5-PB7 always high
0170 B701       126    STA     PORTB            ; Set PORT-B for new output
```

```
                                                                    values
0172 1154      127    BCLR    0,MFLAGS        ; Clear new data flag
               128
               129  MAIN2:
               130    ; At end of code, jump back to top of polling loop
0174 CC0162    131    JMP     MAIN
               132    ; *** End Of MAIN POLLING LOOP ***
               133
               134
               135  ;*************************************************
               136  ; Interrupt Handler Routines
               137  ;*************************************************
               138  ; Serial Peripheral Interrupt (SPI) Handler
               139  ;*************************************************
               140  ; This routine handles the main communications
               141  ; to the master microcontroller.
               142  ;*************************************************
               143  INT_SPI:
0177 B60B      144    LDA     SPISR           ; Read status (set to clear
                                                          interrupt bit)
0179 B60C      145    LDA     SPIDR           ; Read data (clears int bit)
017B B751      146    STA     SPITMP          ; Save data
               147
017D BE5F      148    LDX     TPTR
017F E760      149    STA     TBUF,X
0181 9F        150    TXA
0182 4C        151    INCA
0183 A40F      152    AND     #$0F
0185 B75F      153    STA     TPTR
0187 B651      154    LDA     SPITMP
               155
0189 9A        156    CLI                     ; Allow other interrupts
                                                          higher priority
018A A40F      157    AND     #$0F
               158  ;**       CMP     #$05
               159  ;**       BLS     IS_DATA
018C A10F      160    CMP     #$0F            ; Check for 'STATUS' command
018E 2606      161    BNE     IS_S1           ; If not, then check other
                                                                    stuff
               162    ; 'STATUS' Command
0190 B652      163    LDA     SPITMP2         ; Load last ACK flag
0192 B70C      164    STA     SPIDR           ; Re-Transmit last ACK
0194 2046      165    BRA     IS_DONE
               166  IS_S1:
0196 A10E      167    CMP     #$0E
0198 2602      168    BNE     IS_S2
               169    ; 'NEW VELOC' Command
               170  ;** Ignore this for PreAmp module
019A 2040      171    BRA     IS_DONE
               172  IS_S2:
019C A10D      173    CMP     #$0D
019E 2608      174    BNE     IS_S3
               175    ; 'SET UNIT NUMBER' Command
01A0 B651      176    LDA     SPITMP
01A2 A4F0      177    AND     #$F0
01A4 B753      178    STA     UNIT
01A6 2034      179    BRA     IS_DONE
               180  IS_S3:
01A8 A10C      181    CMP     #$0C
01AA 260A      182    BNE     IS_S4
               183    ; 'GET UNIT NUMBER' Command
01AC B653      184    LDA     UNIT
01AE A4F0      185    AND     #$F0
01B0 AA0B      186    ORA     #$0B            ; include 'UNIT NUMBER
                                                          RESPONSE' code
01B2 B70C      187    STA     SPIDR           ; Transmit response
01B4 2026      188    BRA     IS_DONE
               189  IS_S4:
```

```
01B6 A10B   190   CMP     #$0B
01B8 260E   191   BNE     IS_S5
            192   ; 'NEW CONTRAST VALUE' Command
01BA B651   193   LDA     SPITMP
01BC A4F0   194   AND     #$F0
01BE 44     195   LSRA
01BF 44     196   LSRA
01C0 44     197   LSRA
01C1 44     198   LSRA
01C2 B756   199   STA     CONT
01C4 1054   200   BSET    0,MFLAGS        ; Set new data flag
01C6 2014   201   BRA     IS_DONE
            202 IS_S5:
01C8 A10A   203   CMP     #$0A
01CA 260E   204   BNE     IS_S6
            205   ; 'GET MUTE MODE STATUS' Command
01CC B655   206   LDA     MUTE            ; Get Mute Status
01CE 48     207   LSLA                    ; Shift into DATA bits of
                                                        response byte
01CF 48     208   LSLA                    ; **
01D0 48     209   LSLA                    ; **
01D1 48     210   LSLA                    ; **
01D2 A4F0   211   AND     #$F0            ; Mask off extra bits
01D4 AA09   212   ORA     #$09            ; include 'MUTE STATUS
                                                      RESPONSE' code
01D6 B70C   213   STA     SPIDR           ; Transmit response
01D8 2002   214   BRA     IS_DONE
            215 IS_S6:
            216   ; No other commands implemented at this time
01DA 2000   217   BRA     IS_DONE
            218 IS_DONE:
01DC 80     219   RTI
            220
            221 ;*****************************************************
            222 ; Serial Communications Interrupt (SCI) Handler
            223 ;*****************************************************
            224 ; This interrupt is normally unused.  The handler
            225 ; should simply clear the interrupt (or optionally
            226 ; turn off SCI functions) if the interrupt is hit.
            227 ; ** This may be implemented for test
            228 ;    and/or debug functionality.  **
            229 ;*****************************************************
            230 INT_SCI:
01DD 80     231   RTI
            232
            233 ;*****************************************************
            234 ; Timer Interrupt (TMR) Handler
            235 ;*****************************************************
            236 ; This interrupt handles the MUTE input switch
            237 ; sense (with debounce) and sets the MUTE output
            238 ; status in the MUTE variable.  Then sets the flag
            239 ; to indicate new data values to be output.
            240 ;*****************************************************
            241 INT_TMR:
            242   ; Clear interrupt flag bit
01DE B613   243   LDA     TSR             ; Read timer status register
            244   ; Update timer output compare (TOC) register
01E0 A6FA   245   LDA     #UTICK          ; Set for 0.5 msec tick
01E2 BB17   246   ADD     TOC+1           ; Add LSB of output compare Reg
01E4 2402   247   BCC     IT_X1           ; Skip MSB update if no
                                                              rollover
01E6 3C16   248   INC     TOC             ; Increment MSB of TOC if LSB
                                                              rollover
            249 IT_X1:
01E8 B717   250   STA     TOC+1           ; Update LSB of TOC
            251   ; Get new input data status & compare to old status
01EA B602   252   LDA     PORTC           ; Get current input data
01EC A401   253   AND     #$01            ; Mask off all but PC0
```

```
01EE B159   254   CMP     IN_LAST          ; Compare to last status
            255   ; If values are the same, reset DBNC counter and exit
                                                                (RESET).
01F0 2712   256   BEQ     IT_RESET
            257   ; ELSE, if values are different, decrement DBNC &
                                                          check for = 0.
01F2 3A57   258   DEC     DBNC             ; Decrement DBNC counter
            259   ; -- If not 0 ==> exit (continue debounce).
01F4 2612   260   BNE     IT_DONE
            261   ; -- If = 0 ==> debounce expired so:
01F6 B759   262   STA     IN_LAST
            263   ;                  (toggle only on button push, not on
                                                              release!)
01F8 260A   264   BNE     IT_RESET
01FA B655   265   LDA     MUTE             ; Get old MUTE data
01FC A801   266   EOR     #$01             ; Toggle lowest bit
01FE A401   267   AND     #$01             ; Mask off all except lowest
                                                                     bit
0200 B755   268   STA     MUTE             ; Save new MUTE data
0202 1054   269   BSET    0,MFLAGS         ; Set new data flag
            270 IT_RESET:
            271   ; Reset DBNC counter and exit.
0204 A63C   272   LDA     #MUTE_DB
0206 B757   273   STA     DBNC             ; Reset debounce counter
            274 IT_DONE:  ; Exit Routine
0208 80     275   RTI
            276
            277 ;**************************************************
            278 ; External IRQ Line Interrupt (IRQ) Handler
            279 ;**************************************************
            280 ; No external IRQ Line interrupt are expected to
            281 ; be implemented at this time.  This handler should
            282 ; simply clear (and possibly disable) the pending
            283 ; interrupt and return.
            284 ; This could be used in the future as a "trigger"
            285 ; for pre-loaded motion data.
            286 ;**************************************************
            287 INT_IRQ:
0209 80     288   RTI
            289
            290 ;**************************************************
            291 ; Software Interrupt (SWI) Handler
            292 ;**************************************************
            293 ; We do not expect to use software interrupts at
            294 ; this time although this may be used to perform
            295 ; the acceleration part of the motion.
            296 ;**************************************************
            297 INT_SWI:
020A 80     298   RTI
            299
            300
            301 ;**************************************************
            302 ; Start of Interrupt Vector Table
            303 ; #####  IS THIS TABLE CORRECT FOR -C9 DEVICE???
            304 ;   $1FF4,F5 are SPI Interrupt
            305 ;   $1FF6,F7 are SCI Interrupt
            306 ;   $1FF8,F9 are TIMER Interrupt
            307 ;   $1FFA,FB are IRQ Interrupt
            308 ;   $1FFC,FD are Software (SWI) Interrupt
            309 ;   $1FFE,FF are RESET Vector
            310 ;**************************************************
1FF4        311   ORG     VECT
1FF4        312   EQU     *
1FF4 0177   313   FDB     INT_SPI          ;SPI ($F4,$F5)
1FF6 01DD   314   FDB     INT_SCI          ;SCI ($F6,$F7)
1FF8 01DE   315   FDB     INT_TMR          ;TMR ($F8,$F9)
1FFA 0209   316   FDB     INT_IRQ          ;IRQ ($FA,$FB)
1FFC 020A   317   FDB     INT_SWI          ;SWI ($FC,$FD)
```

```
                318
1FFE 0100       319     FDB     START           ;RESET ($FE,$FF)
                320
                321
```

Symbol Table

| | |
|---|---|
| ACNT | 001A |
| BAUD | 000D |
| BOOTROM | 1F00 |
| BOOTVEC | 1FE0 |
| CONST | 0EC0 |
| CONT | 0056 |
| DBNC | 0057 |
| DDRA | 0004 |
| DDRB | 0005 |
| DDRC | 0006 |
| DUM2 | 005A |
| DUMMY | 0050 |
| FE | 0002 |
| IDLE | 0010 |
| ILIE | 0010 |
| INT_IRQ | 0209 |
| INT_SCI | 01DD |
| INT_SPI | 0177 |
| INT_SWI | 020A |
| INT_TMR | 01DE |
| IN_LAST | 0059 |
| IRQ_VEC | 1FFA |
| IS_DONE | 01DC |
| IS_S1 | 0196 |
| IS_S2 | 019C |
| IS_S3 | 01A8 |
| IS_S4 | 01B6 |
| IS_S5 | 01C8 |
| IS_S6 | 01DA |
| IT_DONE | 0208 |
| IT_RESET | 0204 |
| IT_X1 | 01E8 |
| MAIN | 0162 |
| MAIN2 | 0174 |
| MFLAGS | 0054 |
| MUTE | 0055 |
| MUTE_DB | 003C |
| NF | 0004 |
| ORUN | 0008 |
| PA0 | 0001 |
| PA1 | 0002 |
| PA2 | 0004 |
| PA3 | 0008 |
| PA4 | 0010 |
| PA5 | 0020 |
| PA6 | 0040 |
| PA7 | 0080 |
| PAOUT | 00A0 |
| PB0 | 0001 |
| PB1 | 0002 |
| PB2 | 0004 |
| PB3 | 0008 |
| PB4 | 0010 |
| PB5 | 0020 |
| PB6 | 0040 |
| PB7 | 0080 |
| PC0 | 0001 |
| PC1 | 0002 |
| PC2 | 0004 |
| PC3 | 0008 |
| PC4 | 0010 |

| | |
|---|---|
| PC5 | 0020 |
| PC6 | 0040 |
| PC7 | 0080 |
| PD0 | 0001 |
| PD1 | 0002 |
| PD2 | 0004 |
| PD3 | 0008 |
| PD4 | 0010 |
| PD5 | 0020 |
| PD6 | 0040 |
| PD7 | 0080 |
| PORTA | 0000 |
| PORTB | 0001 |
| PORTC | 0002 |
| PORTD | 0003 |
| RAMBASE | 0050 |
| RDRF | 0020 |
| RE | 0004 |
| RIE | 0020 |
| ROMBASE | 0100 |
| ROMEND | 10FF |
| RST_VEC | 1FFE |
| SBK | 0001 |
| SCCR1 | 000E |
| SCCR2 | 000F |
| SCDR | 0011 |
| SCI_VEC | 1FF6 |
| SCSR | 0010 |
| SINA | 0FC0 |
| SINB | 1000 |
| SPICR | 000A |
| SPIDR | 000C |
| SPISR | 000B |
| SPITMP | 0051 |
| SPITMP2 | 0052 |
| SPI_VEC | 1FF4 |
| STACK | 00FF |
| START | 0100 |
| ST_X1 | 015D |
| SWI_VEC | 1FFC |
| TBUF | 0060 |
| TC | 0040 |
| TCIE | 0040 |
| TCNT | 0018 |
| TCR | 0012 |
| TDRE | 0080 |
| TE | 0008 |
| TIC | 0014 |
| TIE | 0080 |
| TIM_VEC | 1FF8 |
| TOC | 0016 |
| TPTR | 005F |
| TSR | 0013 |
| TWU | 0002 |
| UNIT | 0053 |
| UTICK | 00FA |
| VECT | 1FF4 |

What is claimed is:

1. A strobe tuner for use in tuning a musical instrument comprising:

a) a strobe disc having a strobe pattern disposed thereon;

b) a motor connected to said disc for rotating said disc;

c) microprocessor means for controlling the speed of said motor;

d) memory means interfaced to said microprocessor means for storing tuning data for each of a plurality of musical notes, said data to be used by said microprocessor means for controlling the speed of said motor;

e) a light source for illuminating said strobe pattern as said strobe disc rotates;

f) means for detecting a sound played by a musical instrument and flashing said light source at a frequency proportional to an audio frequency of said sound; and g) input means interfaced to said microprocessor means for entering tuning data for a plurality of notes to which an instrument is to be tuned into said microprocessor means.

2. The strobe tuner of claim 1, wherein said motor is a digital stepper motor, and said microprocessor means includes means for supplying digital position data to said stepper motor in response to said tuning data for causing said strobe disc to be rotated at a speed at which said strobe pattern appears to be stopped by the flashing of said light source when a sound is detected having the same pitch as a note corresponding to said tuning data.

3. The strobe tuner of claim 2, further including means for determining the identity of a detected musical note corresponding to a detected sound, and means in said microprocessor responsive to said determined identity for causing said motor to rotate at a speed assigned to said detected note.

4. The strobe tuner of claim 1, wherein said input means includes note selection means and vernier pitch offset selection means for entering tuning data for a selected note.

5. The strobe tuner of claim 4, wherein said input means further includes key selection means for selecting a musical key to which said strobe tuner is tuned.

6. The strobe tuner of claim 5, wherein said input means further includes means for adjusting a frequency assigned to the middle A note of a selected key.

7. The strobe tuner of claim 1, further including:

h) a second strobe disc having a strobe pattern disposed thereon;

i) a second motor connected to said second strobe disc for rotating said disc; and j) means in said microprocessor means for rotating said first motor at a speed assigned to a first musical note stored in said memory means, and means for rotating said second motor at a speed assigned to a second musical note stored in said memory means.

8. The strobe tuner of claim 7, wherein said microprocessor means includes:

1) a first micro controller for controlling said first motor;

2) a second micro controller for controlling said second motor; and 3) a main microprocessor for sending motor position control signals to said first and second micro controllers.

9. The strobe tuner of claim 8, further including an oscillator means for generating clock pulses for controlling operation of said first and second microcontrollers, and said main microprocessor.

10. The strobe tuner of claim 1, wherein said means for detecting a sound further includes a low pass filter for selectively removing higher order harmonics from a detected sound.

11. The strobe tuner of claim 1, wherein said means for detecting a sound and flashing said light source further includes means for adjusting the intensity of said light source.

12. The strobe tuner of claim 1, further including means for cycling said microprocessor means through a sequence of pitch data for a plurality of notes, and causing said motor to rotate said strobe disc at a speed assigned to each of said plurality of notes.

13. A strobe tuner for use in tuning a musical instrument comprising:

a) a plurality of strobe discs, each having a strobe pattern disposed thereon;

b) a plurality of digital stepper motors, each connected to a corresponding one of said strobe discs for rotating the same;

c) a plurality of microcontrollers, each for supplying position control signals to a corresponding one of said stepper motors;

d) a main microprocessor means for supplying motor position data to each of said microcontrollers;

e) memory means interfaced to said microprocessor means for storing tuning data for each of a plurality of musical notes to be used by said microprocessor means for supplying motor position data to each of said microcontrollers;

f) a light source for illuminating said strobe patterns as said strobe discs rotate;

g) means for detecting a sound played by a musical instrument and flashing said light source at a frequency proportional to an audio frequency of said sound; and h) input means interfaced to said microprocessor means for entering tuning data for a plurality of notes into said microprocessor means.

14. The strobe tuner of claim 13, further comprising an oscillator means for generating clock pulses for controlling operation of said main microprocessor means and each of said microcontrollers.

15. The strobe tuner of claim 13, wherein 12 of each of said strobe discs, stepper motors and microcontrollers are provided, each of which is assigned to one of 12 musical notes in an octave.

16. A method for determining the tuning of a musical instrument comprising the steps of:

a) providing at least one strobe disc having a strobe pattern disposed thereon and a motor connected to said disc for rotating the same;

b) providing a microprocessor means for controlling the speed of said motor;

c) storing tuning data for each of a plurality of musical notes in a memory means interfaced to said microprocessor means;

d) employing said tuning data to supply speed control signals to said motor for rotating said strobe disc at a speed assigned to a selected musical note;

e) providing a light source for illuminating said strobe pattern as said strobe disc rotates;

f) detecting a sound played by a musical instrument; and g) flashing said light source at a frequency proportional to an audio frequency of said sound;

whereby, said strobe pattern is appeared to be stopped by the flashing of said light source if said detected sound is in tune with said selected musical note.

17. The method of claim 16, wherein the steps of providing a strobe disc and providing a microprocessor means further comprise:

1) providing a plurality of strobe discs, each having a strobe pattern disposed thereon and each having a digital stepper motor connected to said disc for rotating the same;

2) providing a plurality of microcontrollers, each for supplying position control data to a corresponding one of said digital stepper motors for controlling the speed of the same; and 3) providing a main microprocessor for supplying motor position data to each of said microcontrollers.

18. The method of claim 17, further comprising the step of providing an oscillator means for supplying clock pulses to each of said microcontrollers and to said main microprocessor.

19. The method of claim 16, further comprising the steps of detecting the identity of a musical note played by a musical instrument, and, in response to said identity detecting, causing said strobe disc to be rotated at a speed assigned to said detected musical note.

20. The method of claim 19, wherein said step of providing a strobe disc and a motor connected to said disc further comprises providing a digital stepper motor connected to said disc for rotating the same.

* * * * *